US008693931B2

(12) United States Patent
Oda et al.

(10) Patent No.: US 8,693,931 B2
(45) Date of Patent: Apr. 8, 2014

(54) IMAGE FORMING APPARATUS AND FIXING DEVICE

(75) Inventors: Tomoyuki Oda, Osaka (JP); Hidenori Takenaka, Osaka (JP); Jumpei Hobo, Osaka (JP)

(73) Assignee: Kyocera Mita Corporation (JP)

( * ) Notice: Subject to any disclaimer, the term of this patent is extended or adjusted under 35 U.S.C. 154(b) by 160 days.

(21) Appl. No.: 13/197,360

(22) Filed: Aug. 3, 2011

(65) Prior Publication Data

US 2012/0034003 A1 Feb. 9, 2012

(30) Foreign Application Priority Data

| | | |
|---|---|---|
| Aug. 6, 2010 | (JP) | 2010-177638 |
| Oct. 22, 2010 | (JP) | 2010-237186 |
| Oct. 22, 2010 | (JP) | 2010-237187 |
| Oct. 22, 2010 | (JP) | 2010-237188 |
| Oct. 22, 2010 | (JP) | 2010-237189 |
| Oct. 22, 2010 | (JP) | 2010-237190 |
| Oct. 22, 2010 | (JP) | 2010-237191 |
| Oct. 22, 2010 | (JP) | 2010-237192 |

(51) Int. Cl.
*G03G 15/20* (2006.01)

(52) U.S. Cl.
USPC ..... 399/320; 399/329; 399/339; 399/340

(58) Field of Classification Search
USPC ..... 399/320, 339, 340
See application file for complete search history.

(56) References Cited

U.S. PATENT DOCUMENTS

| | | | | |
|---|---|---|---|---|
| 6,459,878 | B1 * | 10/2002 | Tomoyuki et al. | 399/331 |
| 7,437,111 | B2 * | 10/2008 | Yamada et al. | 399/327 |
| 2006/0127142 | A1 | 6/2006 | Nakamoto et al. | |
| 2008/0118856 | A1 | 5/2008 | Ivanova | |
| 2008/0213013 | A1 | 9/2008 | Nakamoto et al. | |
| 2009/0123203 | A1 | 5/2009 | Tanaka et al. | |
| 2009/0208264 | A1 | 8/2009 | Fujiwara et al. | |
| 2009/0208265 | A1 | 8/2009 | Nakamoto et al. | |
| 2013/0251429 | A1 | 9/2013 | Tanaka et al. | |

FOREIGN PATENT DOCUMENTS

| | | |
|---|---|---|
| JP | 7-84457 | 3/1995 |
| JP | 8-115004 | 5/1996 |
| JP | 2001-290382 | 10/2001 |
| JP | 2001-290383 | 10/2001 |
| JP | 2002268428 | 9/2002 |
| JP | 2004-240172 | 8/2004 |
| JP | 2005-49462 | 2/2005 |
| JP | 2006-106151 | 4/2006 |
| JP | 200725500 | 2/2007 |
| JP | 2008-90116 | 4/2008 |
| JP | 2009-75180 | 4/2009 |
| JP | 2009-98474 | 5/2009 |
| JP | 2009-116262 | 5/2009 |
| JP | 2009-222818 | 10/2009 |
| JP | 2010-139984 | 6/2010 |

* cited by examiner

*Primary Examiner* — David Gray
*Assistant Examiner* — Michael Harrison
(74) *Attorney, Agent, or Firm* — Gerald E. Hespos; Michael J. Porco; Matthew T. Hespos

(57) ABSTRACT

An image forming apparatus has a conveying element for conveying a sheet, an image forming section for forming an image on the sheet with liquid developer, and a fixing device including a rubbing mechanism for rubbing the image on the sheet. A fixing device has a rubbing mechanism for rubbing an image which is formed with liquid developer.

20 Claims, 67 Drawing Sheets

(SUSPENSION TIME PERIOD)

(CONVEYING TIME PERIOD)

FIRST REGION AREA
( INTERSECTION ANGLE IS 60° )

SECOND REGION AREA
( INTERSECTION ANGLE IS 90° )

IMAGE FORMING APPARATUS AND FIXING DEVICE

BACKGROUND OF THE INVENTION

1. Field of the Invention. The present invention is related to an image forming apparatus for forming an image on a sheet and a fixing device for fixing the image onto the sheet.

2. Description of the Related Art. An image forming apparatus which uses liquid developer is known as a device for forming an image on a sheet. This type of image forming apparatuses typically has a fixing device configured to fix images onto sheets. The fixing device generates relatively high heat in order to melt toner components in the liquid developer transferred onto the sheet.

It is not necessary for a fixing device to generate heat if the fixing device uses liquid developer which has characteristics such that its components (carrier solution) permeate into a sheet and high-molecular compounds with dispersed pigment therein deposit on the surface of the sheet. However, the present inventors have discovered disadvantageous properties which are likely to cause peel-off of the image formed on the sheet by means of such liquid developer.

SUMMARY OF THE INVENTION

An object of the present invention is to provide an image forming apparatus and fixing device which is less likely to allow the peel-off of images on a sheet.

An image forming apparatus according to one aspect of the present invention includes: a conveying element configured to convey a sheet; an image forming section configured to form the image on the sheet with liquid developer; and a fixing device configured to fix the image onto the sheet, wherein the fixing device includes a rubbing mechanism configured to rub the image on the sheet.

A fixing device according to another aspect of the present invention includes: a rubbing mechanism for rubbing an image which is formed with liquid developer.

DETAILED DESCRIPTION OF THE PREFERRED EMBODIMENTS

Various embodiments of image forming apparatuses and fixing devices are described hereinafter with reference to the accompanying drawings. It should be noted that directional terms such as "upper/above," "lower/below," "left" and "right" is merely used hereinafter to clarify the descriptions and not to limit methodologies of the image forming apparatus and the fixing device in any way.

(First Embodiment)

<Fixation Methodologies>

Figure 1A:
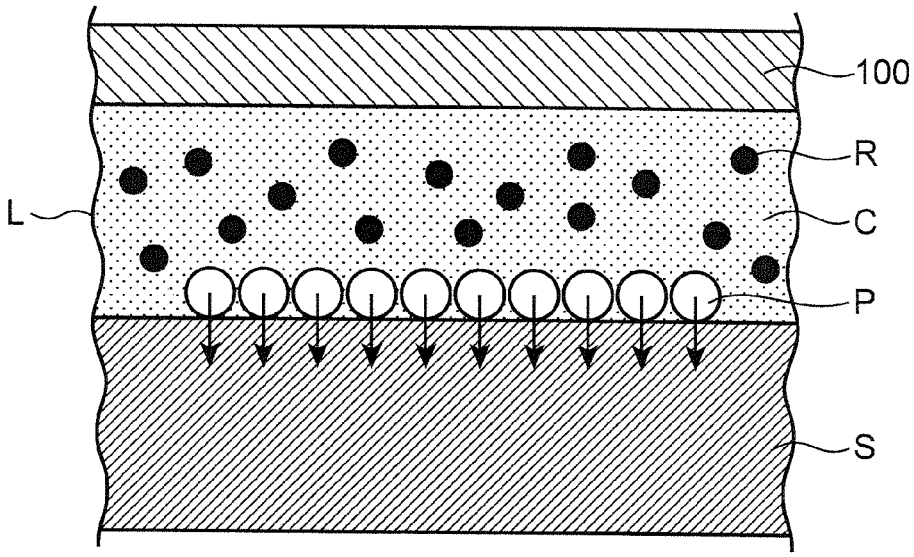
FIG. 1A is a schematic view showing a transfer process using liquid developer.
Figure 1B:
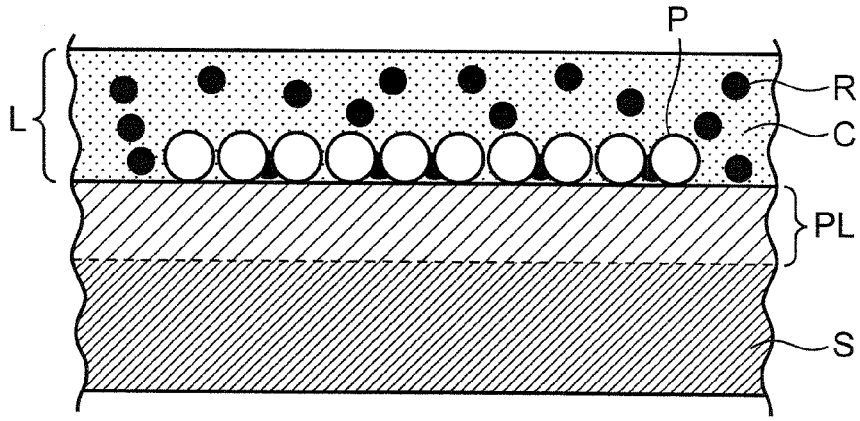
FIG. 1B is a schematic view showing the transfer process using the liquid developer.
Figure 1C:
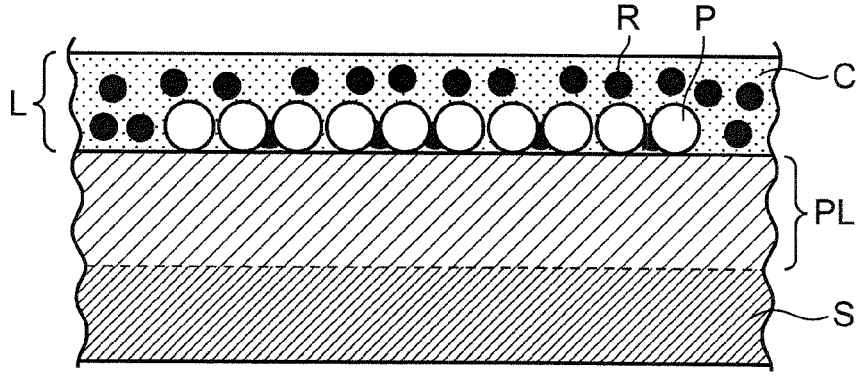
FIG. 1C is a schematic view showing the transfer process using the liquid developer.

FIGS. 1A to 1C schematically show transfer processes for transferring an image obtained by means of liquid developer, respectively. The transfer processes are sequentially performed in the order of FIGS. 1A to 1C. Transferring an image to a sheet and the image obtained after the transfer are described with reference to FIGS. 1A to 1C.

FIG. 1A is a schematic cross-sectional view of a liquid layer L of liquid developer used for forming an image, which is transferred from an image carrier 100 to a sheet S. The image carrier 100 may be, for example, a transfer belt which is provided in an image forming apparatus (e.g., a printer, a copy machine, a facsimile device, or a combined machine with these functions) for forming an image by means of liquid developer. The image carrier 100 conveys the liquid layer L of the liquid developer for forming an image to a transfer position, where the image is transferred to the sheet S.

At the transfer position, the sheet S contacts the liquid layer L on the image carrier 100. The liquid layer L of the liquid developer for forming the image includes carrier liquid C, colored particles P for coloring the image, and polymer compounds R dissolved or swollen in the carrier liquid C. The colored particles P, which are dispersed in the carrier liquid C, are electrostatically attracted to the sheet S. Consequently, the colored particles P adhere to the sheet S to form the image thereon. It should be noted that the attraction of the colored particles P to the sheet S is accomplished by, for example, an electric field, which traverses the sheet S. The methodologies relating to this attraction of the colored particles P to the sheet S is described in detail hereinafter in association with the image forming apparatus.

FIG. 1B schematically shows the carrier liquid C permeating into the sheet S. The carrier liquid C with a relatively low kinetic viscosity permeates into the sheet S and forms a permeation layer PL in a surface layer of the sheet S. The polymer compounds R in the liquid layer L of the liquid developer becomes more concentrated as the carrier liquid C permeates into the sheet S.

As shown in FIG. 1C, when the carrier liquid C further permeates into the sheet S, the polymer compounds R of the liquid layer L deposit. As described above, the electrostatic adhesion of the colored particles P to the sheet S occurs prior to the deposition of the polymer compounds R. Thus, the polymer compounds R, which deposit on the surface of the sheet S, form a coating layer which is stacked on the layer of the color particles P forming the image on the sheet S.

Figure 2A:
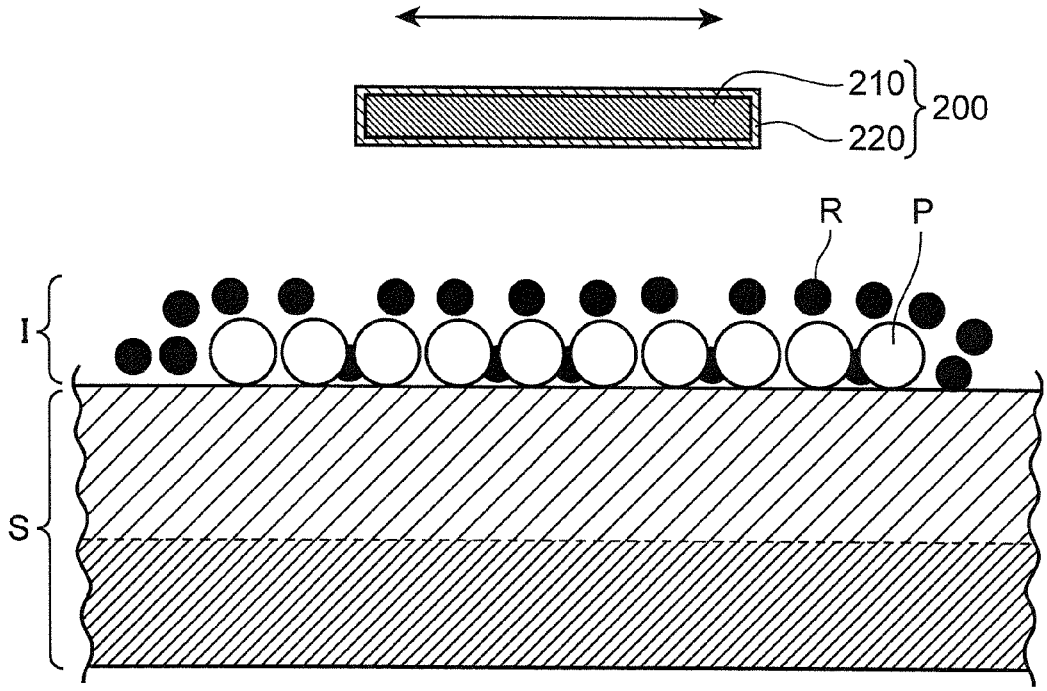
FIG. 2A is a schematic view showing methodologies of a fixation process after the transfer processes shown in FIGS. 1A to 1C.
Figure 2B:
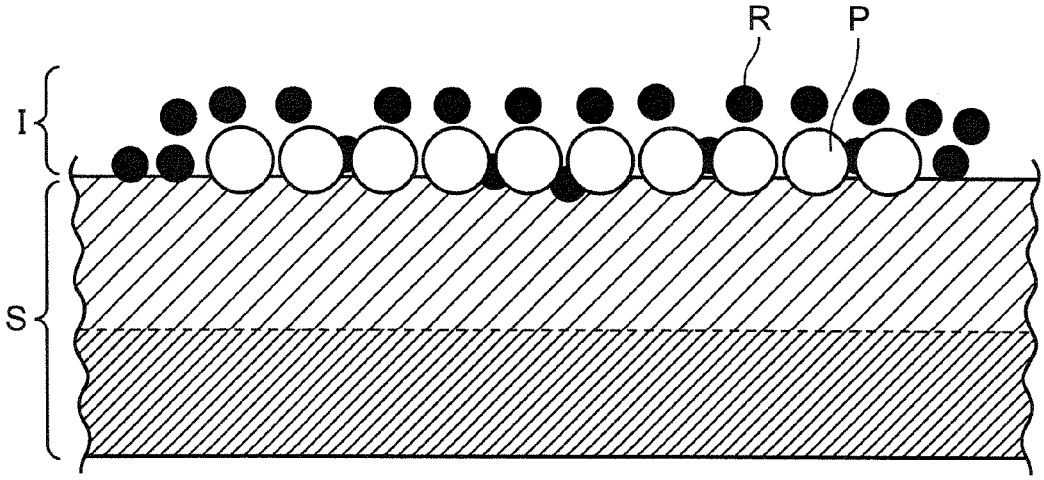
FIG. 2B is a schematic view showing the methodologies of the fixation process performed after the transfer processes shown in FIGS. 1A to 1C.

FIGS. 2A and 2B schematically show fixation processes performed after the transfer process. FIG. 2A schematically shows the fixation process. FIG. 2B is a schematic cross-sectional view of the sheet S obtained after the fixation process. Methodologies of the fixation process is described with reference to FIGS. 1A to 2B.

After the transfer process, the carrier liquid C substantially permeates into the sheet S, so that an image layer I with the polymer compounds R and the colored particles P is formed on the sheet S. In the transfer process, the image layer I is not applied with any physical force except for a pressure and electric field generated during transferring the liquid layer L (image) from the image carrier 100 to the sheet S. Therefore, before the fixation process, a physical bond between the image layer I and the sheet S is relatively weak, so that the image layer I may be peeled off as a result of a peel test using tape described hereinafter.

FIG. 2A shows a rubbing plate 200 exemplified as the fixing device and/or the rubbing mechanism. The rubbing plate 200 has, for example, a substantially cuboid substrate 210 and a nonwoven fabric 220 which covers the surface of the substrate 210. In the present embodiment, the layer of the nonwoven fabric 220 which forms the lower surface of the rubbing plate 200 and faces the image layer I is exemplified as the contact surface. In the present embodiment, a polypropylene nonwoven fabric is used as the nonwoven fabric 220. Alternatively, a polytetrafluoroethylene (PTFE) nonwoven fabric with a dynamic friction coefficient of 0.10 (referred to as "PTFE felt A" hereinafter), a polytetrafluoroethylene (PTFE) nonwoven fabric with a dynamic friction coefficient of 0.13 (referred to as "PTFE felt B" hereinafter), polyester felt, polyethylene terephthalate felt (referred to as "PET felt" hereinafter), polyamide felt, or wool felt may be used as the nonwoven fabric 220.

The rubbing plate 200, which is placed on the image layer. I of the sheet S, is moved on the image layer I along the upper surface of the sheet S. As a result, some of the components of the image layer I (the colored particles P and/or the polymer compounds R) are wedged into the surface layer of the sheet S (anchor effect), as shown in FIG. 2B. Thus, the physical bond between the image layer I and the sheet S is strengthened.

As described above, the upper surface of the image layer I is covered with the polymer compounds R. Therefore, the colored particles P for coloring the image, which are covered with the coated layer of the polymer compounds R, are appropriately protected by a strong resin film which is formed by the rubbing operation of the rubbing plate 200. Thus it becomes less likely that the rubbing operation of the rubbing plate 200 causes damages to the image.

<Experiment>

Figure 3:
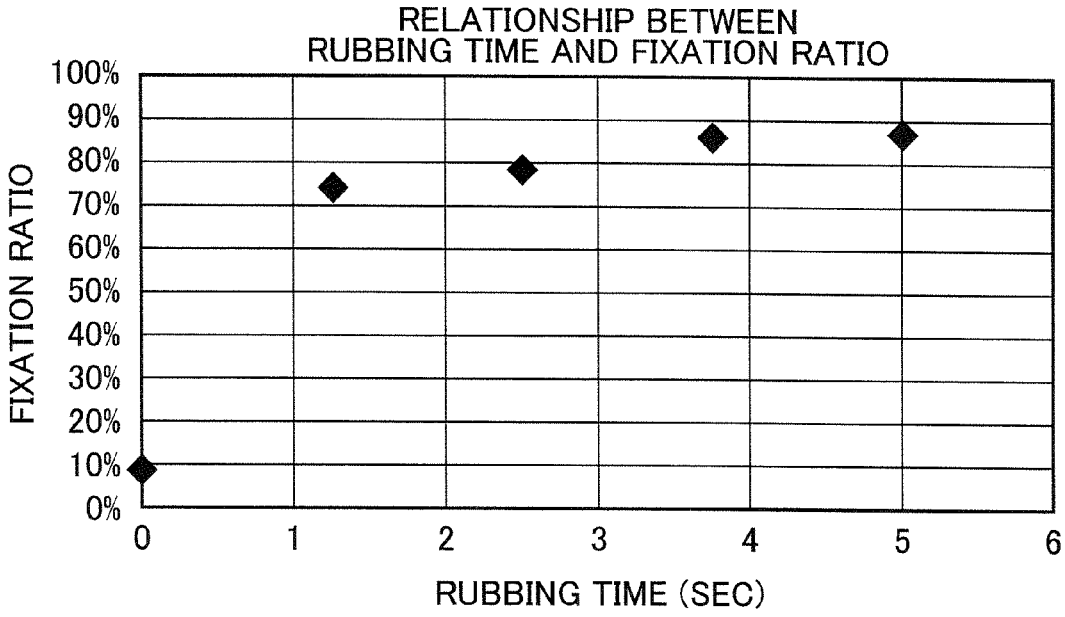
FIG. 3 is a graph schematically showing a relationship between a rubbing time and fixation ratio.

FIG. 3 is a graph schematically showing a relationship between a time period (rubbing time), during which the rubbing plate 200 slides on the image layer I, and fixation ratio of the image layer I. The relationship between the rubbing time and the fixation ratio is described with reference to FIGS. 2A to 3.

The rubbing time shown on the horizontal axis of the graph shown in FIG. 3 indicates the time length during which a given region on the image layer I is in contact with the reciprocating rubbing plate 200.

A fixation ratio FR shown on the vertical axis of the graph shown in FIG. 3 is calculated by means of the following formula, where $D_0$ represents density of the image obtained before peeling a tape attached to the image layer I, and $D_1$ represents density of the image obtained after peeling the tape attached to the image layer I.

$$FR(\%)=D_1/D_0\times 100 \quad \text{[Formula 1]}$$

The tape used for evaluating the fixation ratio FR was Mending Tape produced by 3M. The Mending Tape was attached onto the image layer I by means of a dedicated tool. Therefore, attachment strengths between the image layer I in a test sample and the Mending Tape are kept substantially constant among data points shown in the graph of FIG. 3. The Mending Tape was pressed to the image layer I of the test sample, and then was peeled off from the image layer I by means of a dedicated tool at a substantially constant peeling angle and substantially constant peeling speed.

The image density of the test sample was measured by SpectroEye, which is a spectrophotometer produced by Sakata Inx Eng. Co., Ltd.

As shown in FIG. 3, if the image layer I is rubbed for one second or longer, the image layer I may achieve a relatively high fixation ratio FR. Rubbing the image layer I for less than one second indicates a drastic increase in the fixation ratio FR of the image layer I. It should be noted that weight of the rubbing plate 200 is appropriately defined such that the surface of the image layer I is damaged.

Figure 4:
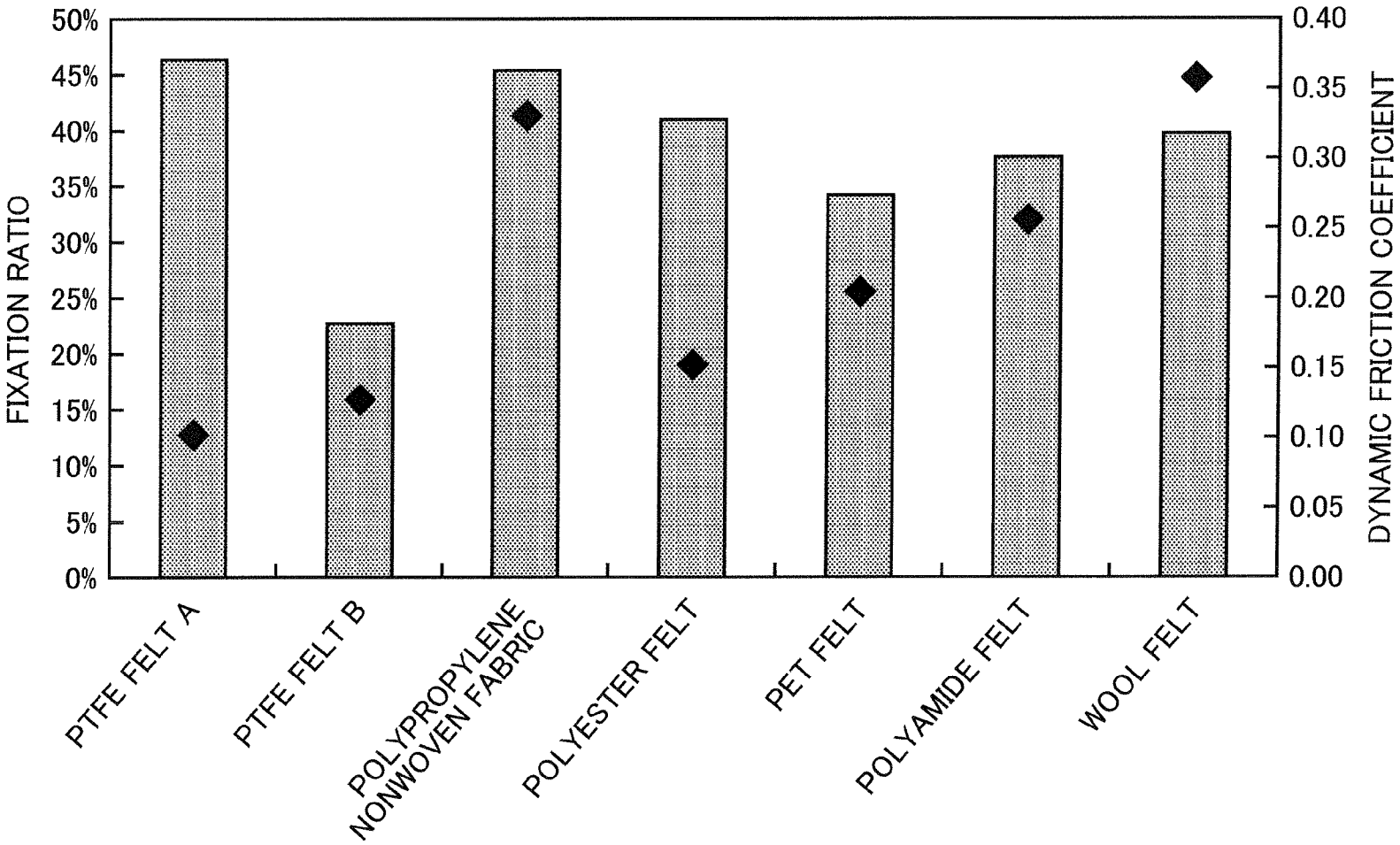
FIG. 4 is a graph schematically showing a result of a screening test performed on various nonwoven fabrics.

FIG. 4 is a graph schematically showing relationships of various nonwoven fabrics 220 to the fixation ratios FR. The relationship between each nonwoven fabric 220 and each fixation ratio FR is described with reference to FIGS. 2A to 4.

The horizontal axis of FIG. 4 represents types of nonwoven fabrics 220. The PTFE felt A, PTFE felt B, polypropylene nonwoven fabric, polyester felt, PET felt, polyamide felt, and wool felt are used in this test.

The left vertical axis of FIG. 4 represents the abovementioned fixation ratios FR. The fixation ratios FR are expressed by bar graphs in FIG. 4. It should be noted that all types of the nonwoven fabrics 220 used in this test achieved relatively high fixation ratios FR in a longer rubbing time than one second. Therefore, the fixation ratios FR shown in FIG. 4 are calculated on the basis of a rubbing time of 0.625 seconds in order to screen out relatively effective types of nonwoven fabrics 220.

The right vertical axis of FIG. 4 represents dynamic friction coefficient of each nonwoven fabric 220 shown by a dot in FIG. 4. Lower dynamic friction coefficients are advantageous because of less impingement on conveyance of the sheet S and less damage to the image layer I.

As shown in FIG. 4, the PTFE felt A achieves the lowest dynamic friction coefficient and the highest fixation ratio FR. It is, therefore, clear that the PTFE felt A is the most advantageous among the tested nonwoven fabrics 220. Any nonwoven fabric material, which is not shown in FIG. 4, may be used as the nonwoven fabric 220. Preferably, a nonwoven fabric material with a dynamic friction coefficient of 0.50 or lower is used as the nonwoven fabric 220. It is less likely that such a nonwoven fabric material with a dynamic friction coefficient of 0.50 or lower may impinge on the conveyance of the sheet S and damage to the image layer I.

<Fixing Device>

Figure 5:
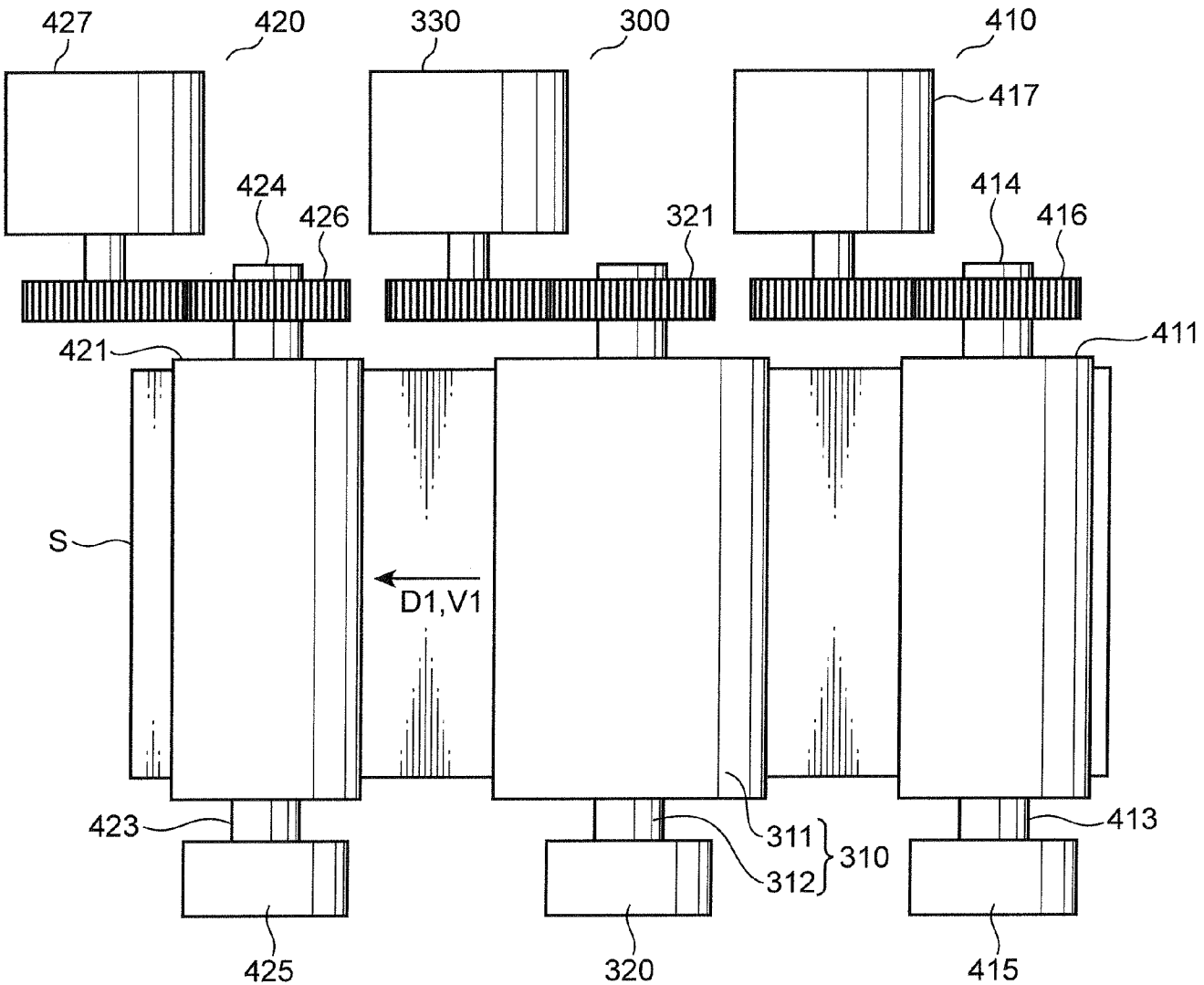
FIG. 5 is a plan view schematically showing a fixing device to which the fixation methodologies shown in FIGS. 2A and 2B are applied.

FIG. 5 is a schematic plan view of a fixing device configured to fix the image layer I to the sheet S by means of the aforementioned fixation methodologies, and a conveyor configured to convey the sheet S, which passes through the fixing device. The fixing device is described with reference to FIGS. 2A, 2B and 5.

A fixing device 300 comprises a rubbing roller 310 which comes in contact with the upper surface of the sheet S. The rubbing roller 310 includes a tubular contact cylinder 311 which contacts the upper surface of the sheet S and a shaft 312 which projects from each end surface of the contact cylinder 311. One rotatable end of the shaft 312 is supported by a bearing stored in a housing 320. A gear 321 is mounted on the other end of the shaft 312. An image is formed on the upper surface of the sheet S of FIG. 5 by means of liquid developer. The contact cylinder 311 configured to rub the image on the upper surface of the sheet S is exemplified as the rubbing mechanism.

The fixing device 300 has a motor 330 coupled to the gear 321. In the present embodiment, the motor 330 configured to rotate the contact cylinder 311 is exemplified as a drive mechanism.

The conveyor includes an upstream conveyor 410 before the upstream of the fixing device 300 and a downstream conveyor 420 after the downstream of the fixing device 300. The upstream and downstream conveyors 410, 420 are exemplified as conveying elements configured to convey the sheet S. FIG. 5 shows a vector directed from the upstream conveyor 410 to the downstream conveyor 420. The direction of the vector in FIG. 5 is exemplified as the first direction D1 indicating a conveying direction of the sheet S. The length of the vector in FIG. 5 is exemplified as the first speed V1 indicating a conveying speed for the sheet S. The upstream and downstream conveyors 410, 420 both together convey the sheet S in the first direction D1 at the first speed V1.

Figure 6:
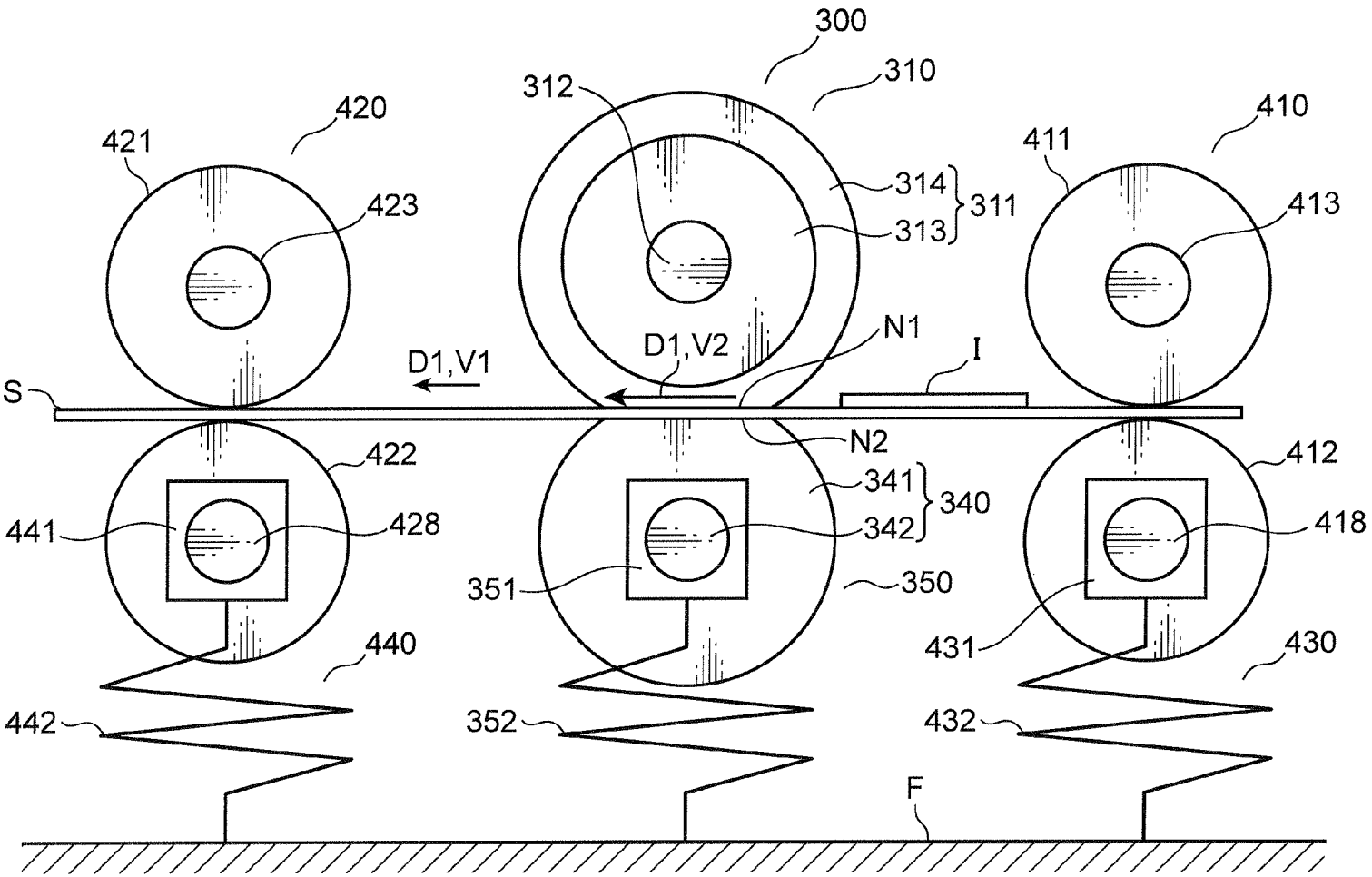
FIG. 6 is a schematic side view of the fixing device shown in FIG. 5.

FIG. 6 is a schematic side view of the fixing device 300 and the conveyors (the upstream and downstream conveyors 410, 420). The fixing device 300 and the conveyors (the upstream and downstream conveyors 410, 420) are described with reference to FIGS. 2A to 6.

The upstream conveyor 410 includes an upper roller 411 which contacts the upper surface of the sheet S, and a lower roller 412 which contacts the lower surface of the sheet S. The upper roller 411 includes a pair of journals 413, 414. The rotatable journal 413 is supported by a bearing stored in a housing 415. A gear 416 is mounted on the journal 414.

The upstream conveyor 410 comprises an upstream motor 417. The upstream motor 417 is coupled to the gear 416.

The upstream conveyor 410 comprises an upstream support mechanism 430 configured to elastically support the lower roller 412. The lower roller 412 includes a journal 418 which is connected to the upstream support mechanism 430.

The upstream support mechanism 430 comprises a bearing 431 which supports the rotatable journal 418, and an elastic element 432 (e.g., a coil spring) which connects the bearing 431 with a supporting surface F supporting the upstream conveyor 410, the downstream conveyor 420 and the fixing device 300. The lower roller 412 pushed upward by the elastic element 432 works together with the upper roller 411 to hold the sheet S therebetween. As a result, the sheet S held between the upper and lower rollers 411, 412 is conveyed to the fixing device 300 by drive of the upstream motor 417.

The downstream conveyor 420 includes an upper roller 421 which contacts the upper surface of the sheet S, and a lower roller 422 which contacts the lower surface of the sheet S. The upper roller 421 includes a pair of journals 423, 424. The rotatable journal 423 is supported by a bearing stored in a housing 425. A gear 426 is mounted on the journal 424.

The downstream conveyor 420 comprises a downstream motor 427. The downstream motor 427 is coupled to the gear 426.

The downstream conveyor 420 comprises a downstream support mechanism 440 configured to elastically support the lower roller 422. The lower roller 422 includes a journal 428 which is connected to the downstream support mechanism 440.

The downstream support mechanism 440 comprises a bearing 441 which supports the rotatable journal 428, and an elastic element 442 (e.g., a coil spring) which connects the bearing 441 with the supporting surface F supporting the upstream conveyor 410, the downstream conveyor 420 and the fixing device 300. The lower roller 422 pushed upward by the elastic element 442 works together with the upper roller 421 to hold the sheet S therebetween. As a result, the sheet S held between the upper and lower rollers 421, 422 is pulled out from the fixing device 300 by drive of the downstream motor 427.

As shown in FIG. 6, the contact cylinder 311 comprises a substantially cylindrical elastic layer 313 which surrounds the circumferential surface of the shaft 312, and a nonwoven fabric layer 314 which covers the outer circumferential surface of the elastic layer 313. The elastic layer 313 is formed by using, for example, sponge or other softer elastic material. The nonwoven fabric layer 314 is formed by using, for example, any of the nonwoven fabrics described in the context of FIG. 4.

The fixing device 300 comprises a backup roller 340 disposed below the rubbing roller 310. The backup roller 340 includes a substantially cylindrical support tube 341 formed by using sponge or other soft and elastic material, and a metallic shaft 342 inserted into the support tube 341.

The fixing device 300 includes a press mechanism 350 configured to press the backup roller 340 to the rubbing roller 310. The press mechanism 350 includes a bearing 351 which supports each of rotatable ends of the shaft 342 projecting from the end surface of the support tube 341, and an elastic element 352 (e.g., a coil spring) which connects the bearing 351 with the supporting surface F supporting the upstream conveyor 410, the downstream conveyor 420 and the fixing device 300.

The elastic element 352 biases the backup roller 340 toward the rubbing roller 310. As a result, the nonwoven fabric layer 314 and/or the elastic layer 313 is compressed and deformed to form a substantially flat upper nip surface N1 along the upper surface of the sheet S passing through the fixing device 300. The circumferential surface of the support tube 341 is compressed and deformed as well to form a substantially flat lower nip surface N2 along the lower surface of the sheet S passing through the fixing device 300. In the present embodiment, the upper nip surface N1 which contacts the image (image layer I) formed on the upper surface of the sheet S is exemplified as the contact surface.

A vector shown above the upper nip surface N1 in FIG. 6 indicates a direction and speed of the movement of the upper nip surface N1. The motor 330 rotates the rubbing roller 310 such that the upper nip surface N1 moves in the first direction D1. The rotating speed of the motor 330 is set such that the upper nip surface N1 moves at a second speed V2, which is different from the first speed V1 and defined by the upstream and downstream conveyors 410, 420. As a result, the image layer I formed on the sheet S is rubbed and fixed by the upper nip surface N1 while the sheet S passes in between the upper and lower nip surfaces N1, N2 according to the methodologies described in the context of FIGS. 2A and 2B. The second speed V2 shown in FIG. 6 is greater than the first speed V1. Alternatively, the second speed V2 may be lower than the first speed V1.

In the present embodiment, the difference between the first and second speeds V1, V2 is defined by a relationship between the rotating speed of the motor 330 and the rotating speed of the upstream/downstream motors 417, 427, and/or a relationship between the diameter of the rubbing roller 310 and the diameters of the upper rollers 411, 421. In the present embodiment, the motors 330, 417, 427 are individually allocated to the fixing device 300, the upstream conveyor 410 and the downstream conveyor 420, respectively. Alternatively, the fixing device 300, the upstream conveyor 410 and the downstream conveyor 420 may be driven by a common motor as a drive source. The difference between the first and second speeds V1, V2 may be defined by a gear mechanism formed between the common motor and each of the fixing device 300, the upstream conveyor 410 and the downstream conveyor 420.

In the present embodiment, the single fixing device 300 is situated between the upstream and downstream conveyors 410, 420. Alternatively, several fixing devices 300 may be situated between the upstream and downstream conveyors 410, 420. The fixing devices 300 may contribute to an extension of the rubbing time described in the context of FIG. 3.

Figure 7:
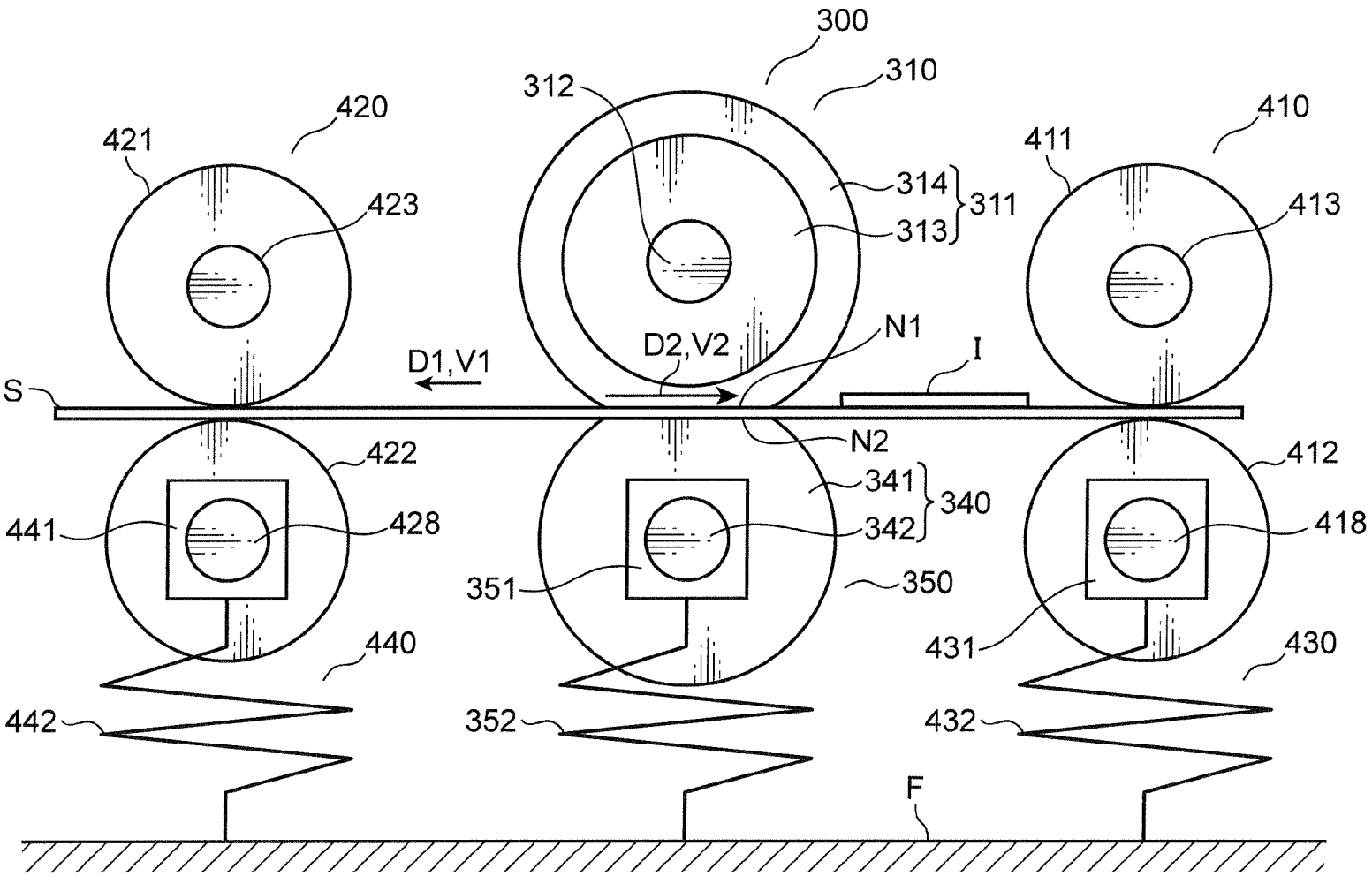
FIG. 7 is a schematic side view of the fixing device shown in FIG. 5.

FIG. 7 schematically shows other operations performed by the fixing device 300. The operations of the fixing device 300 are described with reference to FIGS. 5 to 7.

The motor 330 may rotate the rubbing roller 310 such that the upper nip surface N1 moves in a second direction D2 opposite to the first direction D1. As described above, the nonwoven fabric layer 314 with a relatively low dynamic friction coefficient allows a stable conveyance of the sheet S under the rotation of the rubbing roller 310 rotating in the opposite direction to the conveying direction of the sheet S.

<Application to Image Forming Apparatus>

Figure 8:
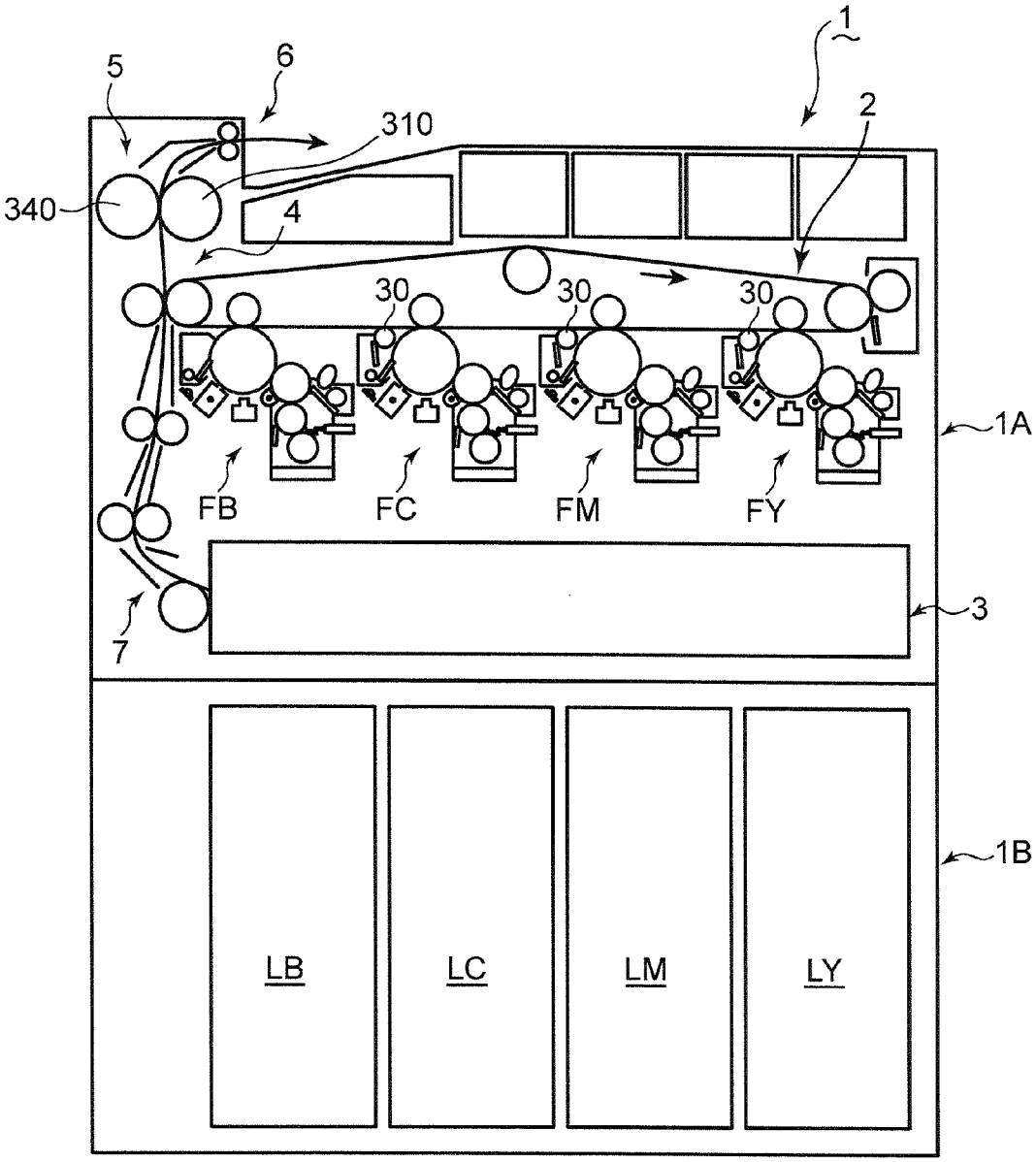
FIG. 8 is a cross-sectional view schematically showing an image forming apparatus to which the methodologies of the fixing device shown in FIG. 5 are applied.
Figure 9:
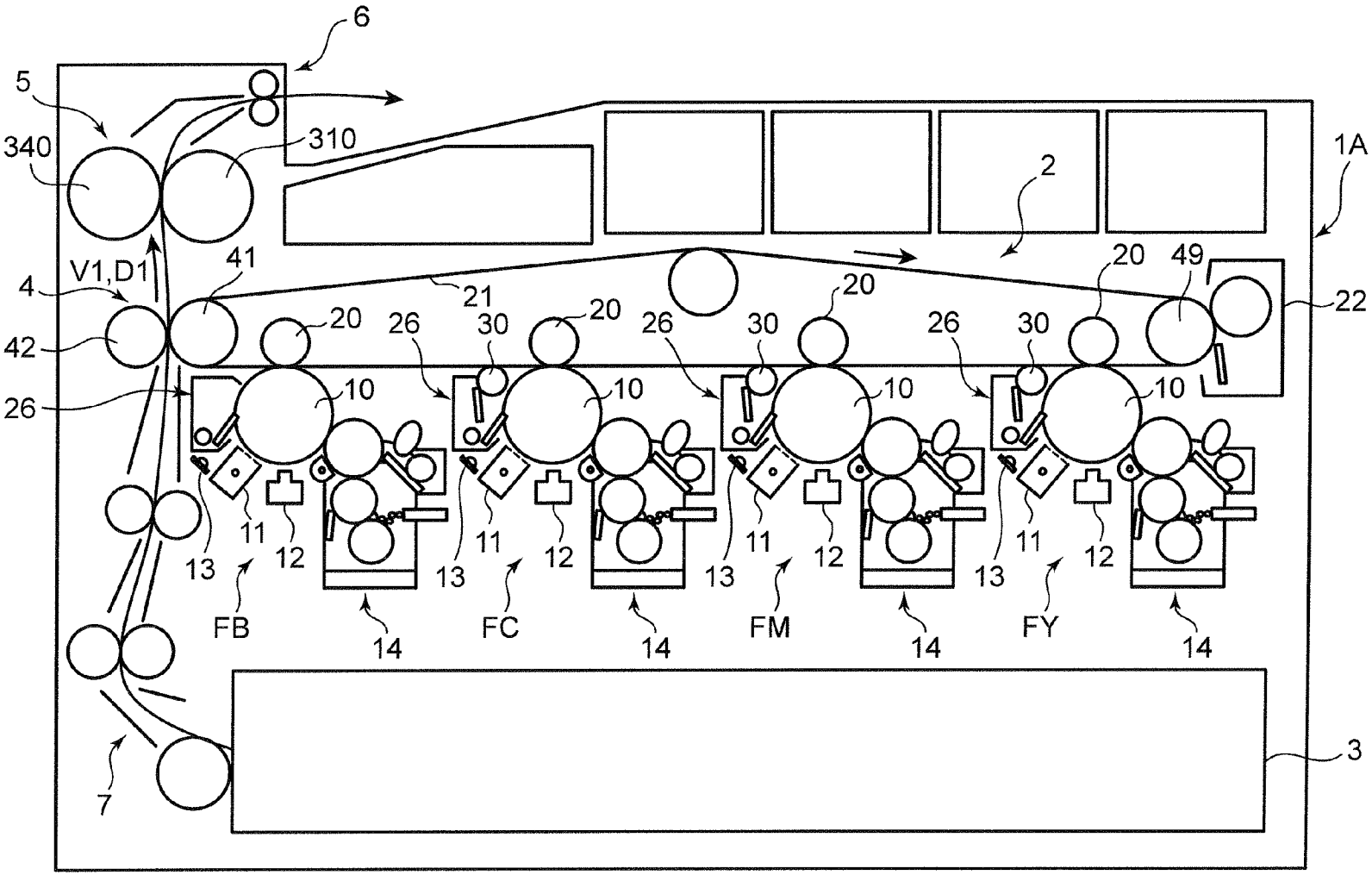
FIG. 9 is a schematic cross-sectional view of the image forming apparatus without circulation devices.
Figure 10:
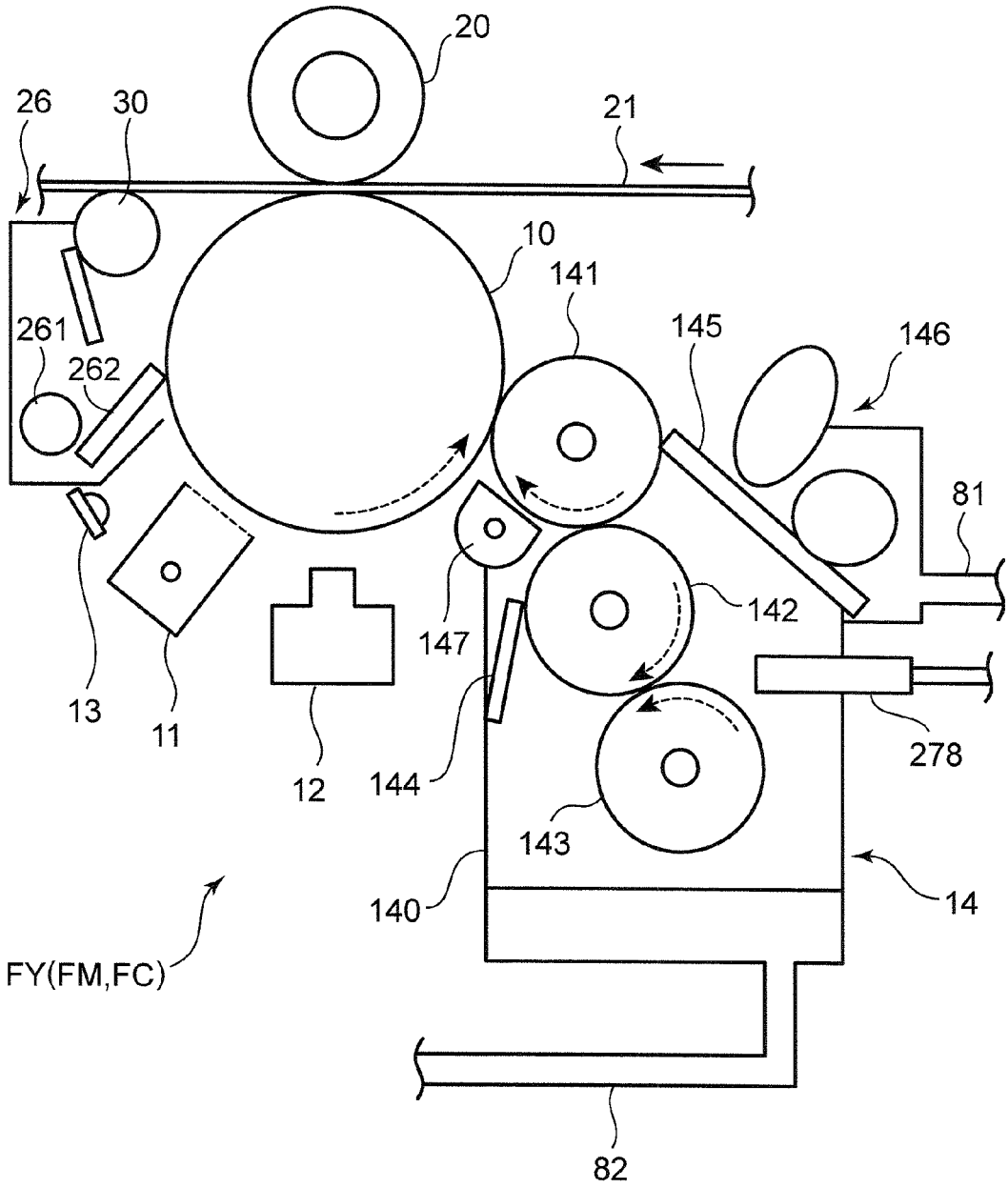
FIG. 10 is an enlarged view of one of image forming units of the image forming apparatus shown in FIG. 8.

FIG. 8 is a schematic view of an image forming apparatus to which the methodologies of the fixation technology described in the context of FIGS. 1A to 7 are applied. FIG. 9 is a schematic cross-sectional view of a color printer without circulation devices. FIG. 10 is an enlarged cross-sectional view of one of image forming units. The image forming apparatus configured to form images is described with reference to FIGS. 1A to 1C and FIGS. 5 to 10. It should be noted that the image forming apparatus shown in FIGS. 8 to 10 is a color printer. The image forming apparatus may be a copy machine, a facsimile device, a combined machine having these functions, or another device configured to form images on sheet S.

As shown in FIG. 8, the color printer 1 comprises an upper main portion 1A configured to store various units and parts for forming images, and a lower main portion 1B which is disposed under the upper main portion 1A and stores circulation devices LY, LM, LC, LB (liquid mixture supply systems) for corresponding colors. A pipe and alike for connecting the upper and lower main portions 1A, 1B to each other is omitted herein. The circulation devices LY, LM, LC, LB circulate the liquid developer which is used in an image forming process executed by the upper main portion 1A. Liquid developer circulation technologies used in a well-known image forming apparatus may be appropriately used in the configurations and methodologies of the circulation devices LY, LM, LC, LB.

As shown in FIG. 9, the upper main portion 1A includes a tandem type image forming section 2 configured to form a toner image on the basis of image data, a sheet storage 3 configured to store sheets S, a secondary transfer portion 4 configured to transfer a toner image formed by the image forming section 2 onto the sheet S, a fixing portion 5 configured to fix the transferred toner image onto the sheet S, a discharge portion 6 used to discharge the sheet S on which the toner image is completely fixed, and a conveying portion 7 configured to convey the sheet S from the sheet storage 3 to the discharge portion 6. In the present embodiment, the methodologies of the fixation technologies described in the context of FIGS. 1A to 7 are applied to the fixing portion 5.

The image forming section 2 configured to form an image on a sheet S by using the liquid developer comprises an intermediate transfer belt 21, a cleaning portion 22 configured to clean the intermediate transfer belt 21, and the image forming units FY, FM, FC and FB corresponding to colors of yellow (Y), magenta (M), cyan (C), and black (Bk). In the present embodiment, the intermediate transfer belt 21 corresponds to the image carrier 100 described in the context of FIGS. 1A to 1C.

The image forming section 2 comprises a drive roller 41 which drives the looped intermediate transfer belt 21, and an idler 49 which is rotated by a traveling motion of the intermediate transfer belt 21. The electrically-conductive intermediate transfer belt 21 is wrapped around the drive roller 41 and the idler 49. The width of the intermediate transfer belt 21 is greater than the maximum width of the sheet S accepted by the color printer 1. In the present embodiment, the drive roller 41 corresponds to the upper roller 411 of the upstream conveyor 410 described in the context of FIGS. 5 to 7. An upward conveying direction of the sheet S defined by the drive roller 41 is exemplified as the first direction D1. The conveying speed of the sheet S defined by the drive roller 41 is exemplified as the first speed V1. In the following description, the side of the intermediate transfer belt 21 which faces the outside during a circulation drive motion is referred to as "outer surface" and the other side as "inner surface."

The image forming units FY, FM, FC and FB are disposed side by side near the intermediate transfer belt 21 between the cleaning portion 22 of the intermediate transfer belt 21 and the secondary transfer portion 4. Each of the image forming units FY, FM, FC and FB comprises a photoreceptor drum 10, a charger 11, an exposure device 12, a developing device 14, a primary transfer roller 20, a cleaning device 26, a neutralization device 13, and a removing roller 30. It should be noted that the closest image forming unit FB to the secondary transfer portion 4 among the image forming units FY, FM, FC, FB is not provided with the removing roller 30, but the rest of its configurations is the same as those of the image forming units FY, FM and FC.

The circulation devices LY, LM, LC and LB correspond to the image forming units FY, FM, FC and FB, respectively. The circulation devices LY, LM, LC and LB supply and recover the liquid developer of the corresponding colors, respectively.

The circumferential surface of the tubular photoreceptor drum 10 is configured to carry a toner image with charged toner (charged to a positive polarity in the present embodiment). The photoreceptor drum 10 coming into contact with the intermediate transfer belt 21 rotates to follow the travelling direction of the intermediate transfer belt 21. The charger 11 uniformly charges the surface of the photoreceptor drum 10.

The exposure device 12 comprises, for example, an LED light source. The light source of the exposure device 12 emits light to the uniformly charged surface of the photoreceptor drum 10, on the basis of the image data input from external equipment. As a result, an electrostatic latent image is formed on the surface of the photoreceptor drum 10.

The liquid developing device 14 holding the liquid developer with the colored particles P, the carrier liquid C and the polymer compounds R faces the electrostatic latent image formed on the surface of the photoreceptor drum 10, so that the colored particles P and the polymer compounds R adhere to the electrostatic latent image. As a result, the electrostatic latent image is developed into a colored image with the colored particles P.

As shown in FIG. 10, the developing device 14 includes a developer container 140, a developing roller 141, a feed roller 142, a supporting roller 143, a blade 144 which contacts the feed roller 142, a blade 145 which cleans the developing roller 141, a recovery device 146 which recovers the liquid developer, and a charger 147 which charges the developing roller 141.

The liquid developer after adjusting concentrations of the colored particles P and the polymer compounds R in the carrier liquid C is fed from a feed nozzle 278 into the developer container 140. It should be noted that the liquid developer is fed toward a nip portion between the feed and supporting rollers 142, 143. An excess of the liquid developer drops below the supporting roller 143 and accumulates on the bottom of the developer container 140. The accumulated liquid developer is recovered through a pipe 82 by using the circulation devices LY, LM, LC LB.

The supporting roller 143, which is disposed substantially in the middle of the developer container 140, abuts the upper feed roller 142 to form the nip, portion therebetween. A groove for holding the liquid developer is formed on the circumferential surface of the feed roller 142.

The liquid developer fed from the feed nozzle 278 is temporarily accumulated in the nip portion between the supporting and feed rollers 143, 142. The liquid developer held in the groove of the feed roller 142 at the nip portion is delivered to the upper developing roller 141. The blade 144 which is brought into contact with the circumferential surface of the feed roller 142 regulates an amount of the liquid developer held in the groove of the feed roller 142. The excessive liquid developer, which is scraped off by the blade 144, is received by the bottom of the developer container 140.

The developing roller 141, which is disposed at an upper opening of the developer container 140, contacts the feed roller 142. The rotating directions of the developing and feed rollers 141, 142 are defined such that the circumferential surface of the developing roller 141 moves in an opposite direction to the feed roller 142 at the nip portion, which is formed between the developing and feed rollers 141, 142. As a result, the liquid developer held on the circumferential surface of the feed roller 142 is delivered to the circumferential surface of the developing roller 141. Because the layer thickness of the liquid developer on the feed roller 142 is appropriately regulated, the liquid developer on the surface of the developing roller 141 is adjusted to have a suitable thickness for forming images.

The surface of the developing roller 141, which receives the liquid developer, moves above the charger 147. The charger 147 provides charging potential having the same polarity as the charged polarity of the colored particles P. As a result, the colored particles P of the liquid developer carried on the developing roller 141 moves to the surface side of the developing roller 141.

The surface of the developing roller 141 contacts the photoreceptor drum 10 after passing the charger 147. The toner image based on the image data is formed on the surface of the photoreceptor drum 10 by a difference in potential between the electrostatic latent image on the surface of the photoreceptor drum 10 and a development bias applied to the developing roller 141.

The circumferential surface of the developing roller 141 contacts the photoreceptor drum 10 and then with the blade 145. The blade 145 removes the liquid developer on the surface of the developing roller 141 after the developing operation performed on the photoreceptor drum 10.

The recovery device 146 recovers the liquid developer removed by the blade 145, and then sends the liquid developer to a pipe 81 of each circulation devices LY, LM, LC, LB. The liquid developer flows downward along the surface of the blade 145. If the liquid developer is highly viscous, the recovery device 146 may preferably have delivery rollers to assist in delivering the liquid developer.

The primary, transfer roller 20 works with the photoreceptor drum 10 to hold the intermediate transfer belt 21 therebetween. Voltage having an opposite polarity (negative polarity, in the present embodiment) to that of the colored particles P on the photoreceptor drum 10 is applied from a power source (not shown) to the primary transfer roller 20. The primary transfer roller 20 applies, to the intermediate transfer belt 21, the voltage with the opposite polarity to that of the toner. As a result, the colored particles P and the polymer compounds R are attracted to the outer surface of the electrically-conductive intermediate transfer belt 21. Thus, the image formed on the surface of the photoreceptor drum 10 is transferred to the outer surface of the intermediate transfer belt 21. The intermediate transfer belt 21 then carries and conveys the toner image to the sheet S.

The cleaning device 26, which removes the liquid developer remaining on the photoreceptor drum 10 without being transferred from the photoreceptor drum 10 to the intermediate transfer belt 21, comprises a developer conveying screw 261 and a cleaning blade 262. An end of the planar cleaning blade 262 which extends toward the rotation axis of the photoreceptor drum 10 slides on the surface of the photoreceptor drum 10. The cleaning blade 262 scrapes the liquid developer remaining on the photoreceptor drum as the rotation of the photoreceptor drum 10. The scraped liquid developer is temporarily stored in the cleaning device 26. The conveying screw 261 disposed in the cleaning device 26 conveys the residual developer to the outside.

In preparation for the image formation in the next cycle, the neutralization device 13 with a neutralization light source neutralize the surface of the photoreceptor drum 10 using the light from the light source, after the liquid developer is removed by the cleaning blade 262.

The substantially tubular removing roller 30 contacts the intermediate transfer belt 21. The removing roller 30 disposed between the image forming units FY, FM removes the carrier liquid C from the liquid developer transferred from the image forming unit FY to the intermediate transfer belt 21. The removing roller 30 disposed between the image forming units FM, FC removes the carrier liquid C from the liquid developer transferred from the image forming unit FM to the intermediate transfer belt 21. The removing roller 30 disposed between the image forming units FC, FB removes the carrier liquid C from the liquid developer transferred from the image forming unit FC to the intermediate transfer belt 21. Because the image forming unit FB does not have the removing roller 30 as described above, the intermediate transfer belt 21 carries the liquid developer including the carrier liquid C, like the image carrier 100 shown in FIGS. 1A to 1C.

As shown in FIG. 9, the sheet storage 3 configured to store sheets S is disposed in a lower part of the upper main portion 1A. The sheet storage 3 includes a feed cassette configured to store sheets S.

The secondary transfer portion 4 configured to transfer the image formed on the intermediate transfer belt 21 to the sheet S comprises a secondary transfer roller 42, which faces the drive roller 41 for driving the intermediate transfer belt 21. The secondary transfer roller 42 corresponds to the lower roller 412 of the upstream conveyor 410 described in the context of FIGS. 5 to 7. The secondary transfer roller 42 generates an electric field between the secondary transfer roller 42 and the intermediate transfer belt 21 to attract the colored particles P to the sheet S, as described in the context of FIGS. 1A to 1C.

The fixing portion 5 disposed above the secondary transfer portion 4 utilizes the methodologies of the fixation technologies described in the context of FIGS. 1A to 7, to fix the toner image to the sheet S. Therefore, the fixing portion 5 comprises the rubbing roller 310 and the backup roller 340 which are described in the context of FIGS. 5 to 7. As described above, the rubbing roller 310 rubs the image on the sheet S, so that the fixation process is appropriately performed. In addition, because the rubbing roller 310 is wide enough to rub the entire image, gloss of the image is evenly changed by the contact with the rubbing roller 310. As a result, it is less likely that the gloss of the image is locally changed even if a user touches the image on the sheet S.

The sheet S onto which the toner image is fixed by the fixing portion 5 is discharged to the discharge portion 6 disposed in an upper part of the color printer 1. The conveying portion 7 having several conveying roller pairs conveys the sheet S from the sheet storage 3 to the secondary transfer portion 4, the fixing portion 5, and the discharge portion 6 sequentially in this order.

<Liquid Developer>

The liquid developer includes the electrically insulating carrier liquid C and the colored particles P dispersed in the carrier liquid C. This liquid developer also contains the polymer compounds R. The liquid developer preferably has a viscosity of to 400 mPa·s at a measurement temperature of 25° C. The viscosity of the liquid developer (at the measurement temperature of 25° C.) is preferably 40 to 300 mPa·s, and more preferably 50 to 250 mPa·s.

<Carrier Liquid>

The electrically insulating carrier liquid C which generally works as liquid carrier enhances electrical insulation of the liquid developer. For example, electrically insulating organic solvent having a volume resistivity of $10^{12}$ Ω·cm or above at 25° C. (i.e., an electrical conductivity of 1.0 pS/cm or lower) is preferably used as the electrically insulating carrier liquid C. In addition, carrier liquid, which may further dissolve the polymer compounds R described hereinafter, is preferably used (the one with relatively high solubility for the polymer compounds R).

The viscosity and type of the carrier liquid C as well as the compounding amount therein are appropriately adjusted and selected in order to obtain the 30 to 400 mPa·s viscosity (at the measuring temperature of 25° C.) in the entire liquid developer. The viscosity of the liquid developer depends on a combination of the organic solvent used as the carrier liquid C and the organic polymer compounds R, which is described hereinafter. Therefore, the type and compounding amount of the organic solvent are appropriately determined in response to a desired viscosity of the liquid developer and the selected type of polymer compounds R.

Aliphatic hydrocarbons and vegetable oil, which are liquid at an ordinary temperature, are exemplified the electrically insulating organic solvent.

Liquid n-paraffinic hydrocarbons, iso-paraffinic hydrocarbons, halogenated aliphatic hydrocarbons, branched aliphatic hydrocarbons, and a mixture thereof are exemplified as the aliphatic hydrocarbons. For example, n-hexane, n-heptane, n-octane, nonane, decane, dodecane, hexadecane, heptadecane, cyclohexane, perchloroethylene, trichloroethane, and alike may be used as the aliphatic hydrocarbons. Nonvolatile organic solvent and organic solvent of relatively low volatility (with, for example, a boiling point of 200° C. or higher) are preferred from the perspective of environmental responsiveness (VOC measures). In addition, liquid paraffins which include a relatively large amount of aliphatic hydrocarbon with 16 or more carbon atoms may be preferably used.

Tall oil fatty acid (major components: oleic acid, linoleic acid), vegetable oil-based fatty acid ester, soybean oil, sunflower oil, castor oil, flaxseed oil, and tung oil are exemplified as the vegetable oil. The tall oil fatty acid and alike among them are preferably used.

Liquid paraffins "Moresco White P-55," "Moresco White P-40," "Moresco White P-70," and "Moresco White P-200" manufactured by Matsumura Oil Co., Ltd.; tall oil fatty acids "Hartall FA-1," "Hartall FA-1P," and "Hartall FA-3" manufactured by Harima Chemicals, Inc.; vegetable oil-based solvents "Vege-Sol™ MT," "Vege-Sol™ CM," "Vege-Sol™ MB," "Vege-Sol™ PR," and tung oil manufactured by Kaneda Co., Ltd.; "Isopar™ G," "Isopar™ H," "Isopar™ K," "Isopar™ L," "Isopar™ M," and "Isopar™ V" manufactured by ExxonMobil Corporation; liquid paraffins "Cosmo White P-60," "Cosmo White P-70," and "Cosmo White P-120" manufactured by Cosmo Oil Co., Ltd.; vegetable oils "refined soybean oil S," "flaxseed oil," and "sunflower oil" manufactured by The Nisshin Oillio Group, Ltd.; and "castor oil LAV" and "castor oil I" manufactured by Ito Oil Chemicals Co., Ltd. are exemplified as the carrier liquid C.

In the present embodiment, any carrier liquid C may be used as long as it dissolves the polymer compounds R. In other words, the one with relatively high solubility for the polymer compounds R (the one which dissolves the polymer compounds R successfully) may be used alone as the carrier liquid C, or it may be combined with the one with relatively low solubility for the polymer compounds R (the one that poorly dissolves the polymer compounds R). It should be noted that the electrical conductivity of the entire carrier liquid C (the electrical conductivity of the liquid developer) is adjusted according to types of the carrier liquid C so that the electrical conductivity of the liquid developer does not becomes excessively high. For instance, vegetable oils such as tall oil fatty acids generally have higher electrical conductivities than the aliphatic hydrocarbons such as liquid paraffins. Therefore, if the aforementioned vegetable oils are included as the carrier liquid C in order to successfully dissolve the polymer compounds R in the carrier liquid C, the electrical conductivities should be carefully adjusted.

Carrier liquid C which has a greater amount of the aforementioned oil is more advantageous in terms of the solubility for the polymer compounds R whereas it may be disadvantageous in terms of the electrical conductivity. Carrier liquid C which has a less amount of the aforementioned oil is more advantageous in terms of the electrical conductivity whereas it may be disadvantageous in terms of the solubility for the polymer compounds R.

As described above, the content of the aforementioned oils in the entire carrier liquid C depends on the type and content of the polymer compounds R contained in the liquid developer, and is preferably, for example, 2 to 80 mass %, and more preferably 5 to 60 mass %. It becomes difficult to successfully dissolve the polymer compounds R in the carrier liquid C if the content of the oils is less than 2 mass %. The electrical conductivities of the entire carrier liquid C and the liquid developer become excessively high if the content of the oils exceeds 80 mass %. Excessively high electrical conductivity of the liquid developer leads to low image density.

In the present embodiment, the electrical conductivity of the liquid developer is preferably, for example, 200 pS/cm or lower. Therefore, the electrical conductivity of the entire carrier liquid C (the electrical conductivity of the liquid developer) is preferably adjusted to, for example, 200 pS/cm or lower by mixing a highly electrically resistant aliphatic hydrocarbon with resultant solution from dissolving the polymer compounds R in the oils such as tall oil fatty acids (often referred to as "resin solvent" hereinafter).

<Colored Particles>

Pigment itself may be used as the colored particles P in the present embodiment. The liquid developer containing pigment may perform the non-thermal fixation process described in the context of FIGS. 1A to 7. As a result, the pigment serving as the colored particles P are fixed onto a recording medium without consuming much thermal energy or optical energy.

For example, conventionally known organic pigment or inorganic pigment may be used as the pigments of the present embodiment without any limitation. Azine dyes such as carbon black, oil furnace black, channel black, lampblack, acetylene black, and aniline black, metal salt azo dyes, metallic oxides, and combined metal oxides are exemplified as black pigment. Cadmium yellow, mineral fast yellow, nickel titanium yellow, navels yellow, naphthol yellow S, hansa yellow G, hansa yellow 10G, benzidine yellow GR, quinoline yellow lake, permanent yellow NCG, and tartrazine lake are exemplified as yellow pigment. Molybdenum orange, permanent orange GTR, pyrazolone orange, Vulcan orange, indanthrene brilliant orange RK, benzidine orange G, and indanthrene brilliant orange GK are exemplified as orange pigment. Colcothar, cadmium red, permanent red 4R, lithol red, pyrazolone red, watching red calcium salt, lake red D, brilliant carmine 6B, eosin lake, rhodamine lake B, alizarin lake, and brilliant carmine 3B are exemplified as red pigment. Fast violet B and methyl violet lake are exemplified as purple pigment. C.I. Pigment Blue 15:3, cobalt blue, alkali blue, Victoria blue lake, phthalocyanine blue, non-metal phthalocyanine blue, partial chloride of phthalocyanine blue, fast sky blue, and indanthrene blue BC are exemplified as blue pigment. Chrome green, chromium oxide, pigment green B, and malachite green lake are exemplified as green pigment.

The content of each pigment in the liquid developer is preferably 1 to 30 mass %, more preferably 3 mass % or more, and more preferably 5 mass % or more. The content of each pigment is also more preferably 20 mass % or less, and more preferably 10 mass % or less.

An average particle diameter of each pigment in the liquid developer, which is a volume basis median diameter ($D_{50}$), is preferably 0.1 to 1.0 μm. The average particle diameter less than 0.1 μm leads to, for example, low image density. The average particle diameter above 1.0 μm leads to, for example, low fixation properties. The volume basis median diameter ($D_{50}$) here generally denotes a particle diameter at the point where a cumulative curve based on the total volume 100% of one group of particles with a determined particle distribution attains 50%.

<Dispersion Stabilizer>

The liquid developer according to the present embodiment may contain dispersion stabilizer for facilitating and stabilizing dispersion of the particles in the liquid developer. Dispersion stabilizer "BYK-116" manufactured by BYK Co., Ltd., for example, may be suitably used as the dispersion stabilizer according to the present embodiment. In addition, "Solsperse 9000," "Solsperse 11200," "Solsperse 13940," "Solsperse 16000," "Solsperse 17000, and "Solsperse 18000" manufactured by The Lubrizol Corporation, and "Antaron™ V-216" and "Antaron™ V-220" manufactured by International Specialty Products, Inc. may be preferably used.

The content of the dispersion stabilizer in the liquid developer is approximately 1 to 10 mass %, and preferably approximately 2 to 6 mass %.

<Polymer Compounds>

The polymer compounds R contained in the liquid developer according to the present embodiment are organic polymer compounds such as cyclic olefin copolymer, styrene elastomer, cellulose ether and polyvinyl butyral. A material which increases viscosity the liquid developer to prevent bleeding during the image formation may be selected as the organic polymer compounds with high solubility for the carrier liquid C. A cyclic olefin copolymer, styrene elastomer, cellulose ether, and polyvinyl butyral are exemplified as the organic polymer compounds. Preferably, styrene elastomer is used as the organic polymer compounds. A single type of organic polymer compound or several types of organic polymer compounds may be used as the polymer compounds R.

The liquid developer of the present embodiment contains the polymer compounds dissolved in the carrier liquid C. The organic polymer compounds dissolved in the carrier liquid C may be gel-like polymer compounds. Depending on the types and molecular weights of the organic polymer compounds, the organic polymer compounds are mutually entwined in the carrier liquid C and form gel. The gel-like organic polymer compounds have a relatively low fluidity. For example, if concentration of the organic polymer compounds is high or if affinity of the organic polymer compounds for the carrier liquid C is low or if the ambient temperature is low, the organic polymer compounds are likely to form gel. On the other hand, if the organic polymer compounds hardly entwine mutually in the carrier liquid C, solution with a relatively fluidity is obtained.

The content of the organic polymer compounds in the liquid developer is appropriately determined according to the type of the organic polymer compounds. The content of the organic polymer compounds is preferably, for example, 1 to 10 mass %.

If the content of the polymer compounds is less than 1 mass %, sufficient viscosity may not be obtained in the liquid developer, which may ineffectively prevent bleeding during the image formation. The content of the polymer compounds exceeding 10 mass % leads to formation of an excessively thick film of the organic polymer compounds on the surface of the sheet S, which significantly deteriorates drying characteristics of the film, increases the adherence (tackiness) of the film, and worsens scratch resistance of the image.

The organic polymer compounds which may be preferably used in the present embodiment are described hereinafter in more detail.

(Cyclic Olefin Copolymer)

Cyclic olefin copolymer is amorphous, thermoplastic cyclic olefin resin which has a cyclic olefin skeleton in its main chain without environmental load substance and is excellent in transparency, lightweight properties, and low water absorption properties. The cyclic olefin copolymer of the present embodiment is an organic polymer compound with a main chain composed of a carbon-carbon bond, in which at least a part of the main chain has a cyclic hydrocarbon structure. The cyclic hydrocarbon structure is introduced by using, as a monomer, a compound having at least one olefinic double bond in the cyclic hydrocarbon structure (cyclic olefin), such as norbornene and tetracyclododecene.

Examples of the cyclic olefin copolymer that may be used in the present embodiment include (1) cyclic olefin-based addition (co) polymer or its hydrogenated product, (2) an addition copolymer of a cyclic olefin and an α-olefin, or its hydrogenated product, and (3) a cyclic olefin-based ring-opening (co) polymer or its hydrogenated product.

Specific examples of the cyclic olefin copolymer are as follows:

(a) Cyclopentene, cyclohexane, cyclooctene;

(b) Cyclopentadiene, 1,3-cyclohexadiene and other one-ring cyclic olefins;

(c) Bicyclo [2.2.1]hept-2-ene (norbornene), 5-methyl-bicyclo [2.2.1]hept-2-ene, 5,5-dimethyl-bicyclo [2.2.1]hept-2-ene, 5-ethyl-bicyclo [2.2.1]hept-2-ene, 5-butyl-bicyclo [2.2.1]hept-2-ene, 5-ethylidene-bicyclo [2.2.1]hept-2-ene, 5-hexyl-bicylo [2.2.1]hept-2-ene, 5-octyl-bicyclo [2.2.1] hept-2-ene, 5-octadecyl-bicylo[2.2.1]hept-2-ene, 5-methylidene-bicyclo [2.2.1]hept-2-ene, 5-vinyl-bicyclo [2.2.1] hept-2-ene, 5-propenyl -bicyclo [2.2.1]hept-2-ene, and other two-ring cyclic olefins;

(d) Tricyclo [4.3.0.12,5]deca-3,7-diene (dicyclopentadiene), tricyclo [4.3.0.12,5]deca-3-ene;

(e) Tricyclo [4.4.0.12,5]undeca-3,7-diene or tricyclo [4.4.0.12,5]undeca-3,8-diene or tricyclo [4.4.0.12,5]undeca-3-ene that is a partially hydrogenated product (or an adduct of cyclopentadiene and cyclohexane) thereof;

(f) 5-cyclopentyl bicyclo [2.2.1]hept-2-ene, 5-cyclohexyl-bicyclo [2.2.1]hept-2-ene, 5-cyclohexenyl bicyclo [2.2.1]hept-2-ene, 5-phenyl-bicyclo [2.2.1]hept-2-ene, and other three-ring cyclic olefins;

(g) Tetracyclo [4.4.0.12, 5.17,10]dodeca-3-ene (tetracyclododecene), 8-methyltetracyclo [4.4.0.12, 5.17,10]dodeca-3-ene, 8-ethyltetracyclo [4.4.0.12, 5.17,10]dedeca-3-ene, 8-methylidenetetracyclo [4.4.0.12, 5.17,10]dodeca-3-ene, 8-ethylidenetetracyclo [4.4.0.12, 5.17,10]dodeca-3-ene, 8-vinyltetracyclo [4.4.0.12, 5.17,10]dodeca-3-ene, 8-propenyl-tetracyclo [4.4.0.12, 5.17,10]dodeca-3-ene, and other four-ring cyclic olefins;

(h) 8-cyclopentyl-tetracyclo [4.4.0.12, 5.17,10]dodeca-3-ene, 8-cyclohexyl-tetracyclo [4.4.0.12, 5.17,10]dodeca-3-ene, 8-cyclohexenyl-tetracyclo [4.4.0.12, 5.17,10]dodeca-3-ene, and 8-phenyl-cyclopentyl-tetracyclo [4.4.0.12, 5.17,10] dodeca-3-ene;

(i) Tetracyclo [7.4.13, 6.01,9.02,7]tetradeca-4,9,11,13-tetraene (1,4-methano-1,4,4a,9a-tetrahydrofluorene), tetracyclo [8.4.14, 7.01,10.03,8]pentadeca-5,10,12,14-tetraene (1,4-methano-1,4,4a,5,10,10a-hexahydroanthracene);

(j) Pentacyclo [6.6.1.13, 6.02,7.09,14]-4-hexadecene, pentacyclo [6.5.1.13, 6.02,7.09,13]-4-pentadecene, pentacyclo [7.4.0.02, 7.13,6.110,13]-4-pentadecene, heptacyclo [8.7.0.12, 9.14,7.111, 17.03,8.012,16]-5-eicosene, heptacyclo [8.7.0.12, 9.03,8.14, 7.012,17.113,16]-14-eicosene; and (k) Polycyclic olefins such as tetramers of cyclopentadiene. These cyclic olefins may be used alone or in combinations of two or more thereof.

An α-olefin having 2 to 20 carbon atoms, and preferably 2 to 8 carbon atoms is preferable for the abovementioned α-olefin. Specific examples thereof include ethylene, propylene, 1-butene, 1-pentene, 1-hexene, 3-methyl-1-butene, 3-methyl-1-pentene; 3-ethyl-1-pentene, 4-methyl-1-pentene, 4-methyl-1-hexene, 4,4-dimethyl-1-hexene, 4,4-dimethyl-1-pentene, 4-ethyl-1-hexene, 3-ethyl-1-hexene, 1-octene, 1-decene, 1-dodecene, 1-tetradecene, 1-hexadecene, 1-octadecene, and 1-eicosene. These α-olefins may be used alone or in combinations of two or more thereof.

In the present embodiment, a method for polymerizing cyclic olefins, a method for polymerizing cyclic olefins with a-olefins, and a method for hydrogenating the resultant polymer are not particularly limited and may be carried out according to well-known methods.

In the present embodiment, the structure of the cyclic olefin copolymer is not particularly limited and may be linear, branched or crosslinked. In the present embodiment, the cyclic olefin copolymer is preferably linear.

In the present embodiment, a copolymer of norbornene and ethylene, or of tetracyclododecene and ethylene may be preferably used as the cyclic olefin copolymer, and the copolymer of norbornene and ethylene is more preferred. In this case, the content of norbornene in the copolymer is preferably 60 to 82 mass %, more preferably 60 to 79 mass %, yet more preferably 60 to 76 mass %, and most preferably 60 to 65 mass %. If the content of norbornene is less than 60 mass %, glass transition temperature of the cyclic olefin copolymer film may become excessively low, which may lead to a risk of lowering film formation properties of the cyclic olefin copolymer. If the content of norbornene exceeds 82 mass %, glass transition temperature of the cyclic olefin copolymer film may become excessively high, which may lead to a risk of lowering fixation properties of the pigments, that is, fixation properties of images by the film of the cyclic olefin copolymer. Or the solubility of the cyclic olefin copolymer for the carrier liquid C may also be reduced.

In the present embodiment, a commercially available cyclic olefin copolymer may be used. Examples of the copolymer of norbornene and ethylene include "TOPAS™ TM" (norbornene content: approximately 60 mass %), "TOPAS™ TB" (norbornene content: approximately 60 mass %), "TOPAS™ 8007" (norbornene content: approximately 65 mass %), "TOPAS™ 5013" (norbornene content: approximately 76 mass %), "TOPAS™ 6013" (norbornene content: approximately 76 mass %), "TOPAS™ 6015" (norbornene content: approximately 79 mass %), and "TOPAST™ 6017" (norbornene content: approximately 82 mass %), which are manufactured by TOPAS Advanced Polymers GmbH. These copolymers may be used alone or in combinations of two or more thereof, depending on the circumstances.

(Styrene Elastomer)

A conventionally known styrene elastomer may be used as the styrene elastomer available in the present embodiment. Specific examples thereof include a block copolymer composed of an aromatic vinyl compound and a conjugated diene compound or olefinic compound. Examples of the block copolymer include a block copolymer that has a structure expressed by Chemical Formula where A is a polymer block composed of an aromatic vinyl compound and B is a polymer block composed of an olefinic compound or a conjugated diene compound.

[C1]

$[A\text{-}B]_x\text{-}A$ (Chemical Formula 1)

(Where x represents an integer chosen such that the number molecular average weight ranges from 1,000 to 100,000.)

Examples of the aromatic vinyl compound constituting the block copolymer include styrene, α-methylstyrene, o-methylstyrene, m-methylstyrene, p-methylstyrene, 2,3-dimethylstyrene, 2,4-dimethylstyrene, monochlorostyrene, dichlorostyrene, p-bromostyrene, 2,4,5-tribromostyrene, 2,4,6-tribromostyrene, o-tert-butylstyrene, m-tert-butylstyrene, p-tert-butylstyrene, ethylstyrene, vinylnaphthalene, and vinylanthracene.

The polymer block A may be composed of one or two or more types of the aforementioned aromatic vinyl compounds. The one composed of styrene and/or α-methylstyrene among these aromatic vinyl compounds provides suitable properties for the liquid developer of the present embodiment.

Examples of the olefinic compound constituting the block copolymer include ethylene, propylene, 1-butene, 2-butene, isobutene, 1-pentene, 2-pentene, cyclopentene, 1-hexene, 2-hexene, cyclohexene, 1-heptene, 2-heptene, cycloheptene, 1-octene, 2-octene, cyclooctene, vinylcyclopentene, vinylcyclohexene, vinylcycloheptene, and vinylcyclooctene.

Examples of the conjugated diene compound constituting the block copolymer include butadiene, isoprene, chloroprene, 2,3-dimethyl-1,3-butadiene, 1,3-pentadien, and 1,3-hexadien.

The polymer block B may be composed of one or two or more types of each of the olefinic compounds and the conjugated diene compounds. The one composed of butadiene and/or isoprene among these compounds provides suitable properties for the liquid developer of the present embodiment.

Specific examples of the block copolymer include a polystyrene-polybutadiene-polystyrene triblock copolymer or its hydrogenated product, polystyrene-polyisoprene-polystyrene triblock copolymer or its hydrogenated product, polystyrene-poly (isoprene/butadiene)-polystyrene triblock copolymer or its hydrogenated product, poly (α-methylstyrene)-polybutadiene-poly (α-methylstyrene) triblock copolymer or its hydrogenated product, poly (α-methylstyrene)-polyisoprene-poly (α-methylstyrene) triblock copolymer or its hydrogenated product, poly α-methylstyrene)-poly (isoprene/butadiene)-poly (α-methylstyrene) triblock copolymer or its hydrogenated product, polystyrene-polyisobutene-polystyrene triblock copolymer, and poly (α-methylstyrene)-polyisobutene-poly (α-methylstyrene) triblock copolymer.

As the styrene elastomer which may be used in the present embodiment, it is preferred to use a styrene-butadiene elastomer (SBS) that has a structure in which the polymer block A and polymer block B are expressed by Chemical Formula 2.

(Chemical Formula 2)

[C 2]

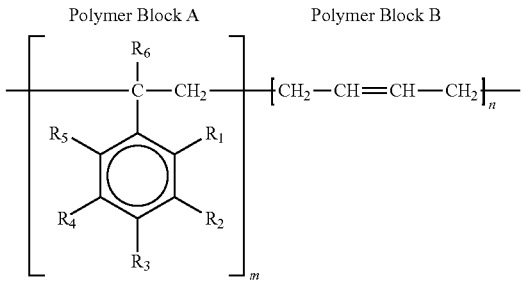

(where $R_1$, $R_2$, $R_4$, $R_5$ and $R_6$ each represent a hydrogen atom or methyl group; $R_3$ represents a hydrogen atom, a halogen atom, a phenyl group or a saturated alkyl group, a methoxy group or ethoxy group having 1 to 20 carbon atoms; and m, n each represent an integer chosen such that the content of the polymer block A ranges from 5 to 75 mass %.)

The styrene-butadiene elastomer is obtained by copolymerizing styrene monomer and butadiene, which is the conjugated diene compound. Examples of preferred styrene monomer include styrene, α-methylstyrene, o-methylstyrene, m-methylstyrene, p-methylstirene, p-ethylstyrene, 2,4-dimethylstyrene, p-n-butylstyrene, p-dodecylstyene, p-methoxystyrene, p-phenylstyrene, and p-chlorostyrene.

The styrene-butadiene elastomer has a number average molecular weight Mn in a range of, preferably, 1,000 to 100,000 (see Chemical Formula 1) and more preferably 2,000 to 50,000, in a molecular weight distribution measured by means of a GPC (gel permeation chromatography). A weight-average molecular weight Mw of the styrene-butadiene elastomer is in a range of, preferably, 5,000 to 1,000,000 and more preferably 10,000 to 500,000. In this case, at least one peak is present in the weight-average molecular weight Mw range of 2,000 to 200,000 and preferably in the weight-average molecular weight Mw range of 3,000 to 150,000.

In the styrene-butadiene elastomer, the value of ratio (weight-average molecular weight Mw/number average molecular weight Mn) is preferably equal to or lower than 3.0, and more preferably equal to or lower than 2.0.

The content of styrene in the styrene-butadiene elastomer (the content of the polymer block A) is in a range of, preferably, 5 to 75 mass % (see Chemical Formula 2) and more preferably 10 to 65 mass %. If the styrene content is less than 5 mass %, glass transition temperature of the styrene elastomer film becomes excessively low and deteriorates the film formation properties of the styrene elastomer. If the styrene content exceeds 75 mass %, a softening point of the styrene elastomer film becomes excessively high and worsens fixation properties of the pigments, that is, fixation properties of images by the styrene elastomer film.

In the present embodiment, a commercially available styrene elastomer may be used. For example, "Klayton" manufactured by Shell, "Asaprene™" T411, T413, T437, "Tufprene™" A, 315P, which are manufactured by Asahi Kasei Chemicals Corporation, and "JSR TR1086," "JSR TR2000," "JSR TR2250" and "JSR TR2827" manufactured by JSR Corporation, may be used as a styrene-conjugated diene block copolymer. "Septon" S1001, S2063, S4055, S8007, "Hybrar" 5127, 7311, which are manufactured by Kuraray Co., Ltd., "Dynaron" 6200P, 4600P, 1320P manufactured by JSR Corporation may be used as a hydrogenated product of the styrene-conjugated diene block copolymer. Also, "Index" manufactured by The Dow Chemical Company may be used as styrene-ethylene copolymer. As other styrene elastomers, "Aron AR" manufactured by Aronkasei Co., Ltd. and "Rabalon" manufactured by Mitsubishi Chemical Corporation may be used. These materials may be used alone or in combinations of two or more types thereof.

(Cellulose Ether)

Cellulose ether is a polymer formed by substituting a hydroxyl group of a cellulose molecule with an alkoxy group. The substitution rate is preferably 45 to 49.5%. The alkyl moiety of the alkoxy group may be substituted with, for example, hydroxyl group or alike. A film formed by cellulose ether is excellent in toughness and thermal stability.

Examples of the cellulose ether which may be used in the present embodiment include: alkyl cellulose such as methylcellulose and ethylcellulose; hydroxyalkyl cellulose such as hydroxyethyl cellulose and hydroxypropyl cellulose; hydroxy alkyl alkyl cellulose such as hydroxyethyl methyl cellulose, hydroxypropyl methyl cellulose, and hydroxyethyl ethyl cellulose; carboxy alkyl cellulose such as carboxymethyl cellulose; and carboxy-alkyl hydroxy-alkyl cellulose such as carboxymethyl hydroxyethyl cellulose. These cellulose ethers may be used alone or in combinations of two or more thereof. Alkyl celluloses are preferred among these cellulose ethers. Ethyl celluloses are preferred among these alkyl celluloses.

In the present embodiment, a commercially available cellulose ether may be used. Examples of ethylcellulose include "Ethocel™ STD4," "Ethocel™ STD7," and "Ethocel™ STD10" manufactured by Nissin-Kasei Co., Ltd. These ethyl celluloses may be used alone or in combinations of two or more thereof, depending on the circumstances.

(Polyvinyl Butyral)

The polyvinyl butyral which may be used in the present embodiment (butyral resin: alkyl acetalized polyvinyl alcohol) is, as shown in Chemical Formula 3, a copolymer of a hydrophilic vinyl alcohol unit having a hydroxyl group, a hydrophobic vinyl acetal unit having a butyral group, and a vinyl acetate unit having an intermediate property between a vinyl alcohol unit and vinyl acetal unit and having an acetyl group. Polyvinyl butyral which has a degree of butyralization (the ratio between a hydrophilic moiety and a hydrophobic moiety) between 60 to 85 mol % is preferred in the liquid developer of the present embodiment in terms of its excellent film formation properties (film formation properties). The polyvinyl butyral has a vinyl acetal unit indicating the solubility of the polyvinyl butyral for nonpolar solvent and a vinyl alcohol unit for improving the bonding properties of the recording medium such as a paper sheet. Therefore, the polyvinyl butyral has high affinity with both the carrier liquid C and the recording medium.

(Chemical Formula 3)

[C 3]

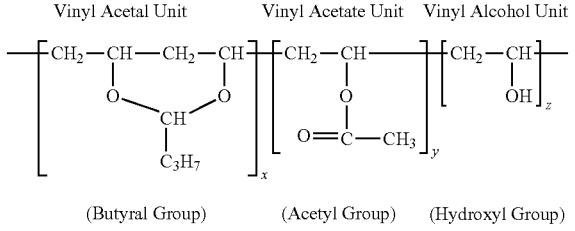

The polyvinyl butyral which may be used in the present embodiment is not particularly limited. Examples thereof include Mowital™ B20H, B30B, B30H, B60T, B60H, B60HH and B70H manufactured by Hoechst AG; "S-LEC™" BL-1 (degree of butyralization: 63±3 mol %), BL-2 (degree of butyralization: 63±3 mol %), BL-S (degree of butyralization: 70 mol % or more), BL-L, BH-3 (degree of butyralization: 65±3 mol %), BM-1 (degree of butyralization: 65±3 mol %), BM-2 (degree of butyralization: 68±3 mol %), BM-5 (degree of butyralization: 63±3 mol %) and BM-S, manufactured by Sekisui Chemical Co., Ltd.; and "Denka butyral" #2000-L, #3000-1, #3000-2, #3000-3, #3000-4, #3000-K, #4000-1, #5000-A, and #6000-C manufactured by Denki Kagaku Kogyo KK. These polyvinyl butyrals may be used alone or in combinations of two or more thereof.

(Manufacturing Method)

The liquid developer according to the present embodiment may be produced by sufficiently dissolving or mixing/dispersing the carrier liquid C, pigments, polymer compounds and optionally the dispersion stabilizer for several minutes to over 10 hours, as appropriate, by using, for example, a ball mill, sand grinder, Dyno mill, rocking mill or alike (or a media distributed machine using zirconia beads and alike may be used).

Mixing/dispersing these components pulverize the pigments into fine pieces. The mixing/dispersion time and the rotating speed of the machine are adjusted so that the average particle diameter ($D_{50}$) of the pigments in the liquid developer becomes, preferably, 0.1 to 1.0 μm as described above. If the dispersion time is excessively short or if the rotating speed is excessively low, the average particle diameter of the pigments ($D_{50}$) exceeds 1.0 μm, and deteriorates the fixation properties as described above. If the dispersion time is excessively long or if the rotating speed is excessively high, the average particle diameter of the pigments ($D_{50}$) becomes less than 0.1 μm, which in turn leads to poor developing properties and low image density.

In the present embodiment, the liquid developer may be produced by dissolving the polymer compounds in the carrier liquid C and then mixing/dispersing the pigments (along with the dispersion stabilizer, as appropriate). The liquid developer may also be produced by preparing solution obtained by dissolving the polymer compounds in the carrier liquid C and a pigment dispersion (obtained by mixing/dispersing the pigments in the carrier liquid C (along with the dispersion stabilizer, as appropriate)), and then mixing the resin solution with the pigment dispersion at an appropriate mixing ratio (mass ratio).

A particle size distribution needs to be measured in order to calculate the average particle diameter ($D_{50}$) of the pigments. The particle size distribution of the pigments may be measured as follows.

A given amount of produced liquid developer or prepared pigment dispersion is sampled and diluted to 10 to 100 times of its volume with the same carrier liquid C as the one used in the liquid developer or the pigment dispersion. The particle size distribution of thus obtained liquid is measured on the basis of a flow system using a laser diffraction type particle size distribution measuring device "Mastersizer 2000" manufactured by Malvern Instruments Ltd.

The viscosity of the produced liquid developer may be measured at a measurement temperature of 25° C. by using a vibrational viscometer "Viscomate VM-10A-L" manufactured by CBC Co., Ltd.

(Second Embodiment)

<Fixation Methodologies>

Fixation methodologies according to the second embodiment are described hereinafter. The fixation methodologies of the second embodiment are associated with effects of a number of rubbing directions on the fixation ratios FR. It should be noted that the fixation methodologies described in the context of the first embodiment is preferably applied to the fixation methodologies of the second embodiment as well. Therefore, some descriptions overlapping with those of the first embodiment are omitted. Hereinafter, the same reference numerals are used for describing the same elements as those of the first embodiment. The descriptions in the context of the first embodiment are preferably incorporated into the elements which are not described hereinafter.

<Experiments>

FIGS. 11A to 11D are schematic views showing experimental methods, respectively, for investigating effects of a number of rubbing directions on the fixation ratios FR. FIGS. 11A to 11D depict experimental conditions according to the present embodiment.

In the present experiment, a sheet S having the image layer I formed thereon was prepared. The image layer I is rubbed by the rubbing plate 200 like the experiment described in the context of the first embodiment. The image layer I was rubbed under four conditions shown in FIGS. 11A to 11D. The other experimental conditions are the same as those described in the context of the first embodiment.

Under the first experimental condition (FIG. 11A), the image layer I was rubbed in a first experimental direction (from the right to the left). The rubbing was continued for 5 seconds. Meanwhile the image layer I was rubbed 80 times.

In the second experimental condition (FIG. 11B), the image layer I was rubbed in the first experimental direction and a second experimental direction (from the left to the right) opposite to the first experimental direction. The rubbing was continued for 5 seconds in total. The image layer I was rubbed 40 times in the first experimental direction and 40 times in the second experimental direction, respectively.

In the third experimental condition (FIG. 11C), the image layer I was rubbed in the first experimental direction, the second experimental direction and a third experimental direction (from the bottom to the top) perpendicular to the first and second experimental directions. The rubbing was continued for 5 seconds in total. Meanwhile the image layer I was rubbed 27 times in the first and second experimental directions, respectively, and 26 times in the third experimental direction.

In the fourth experimental condition (FIG. 11D), the image layer I was rubbed in the first experimental direction, the second experimental direction, the third experimental direction and a fourth experimental direction (from the top to the bottom) opposite to the third experimental direction. The rubbing was continued for 5 seconds in total. Meanwhile the image layer I was rubbed 20 times in the first to fourth directions, respectively.

Figure 11B:
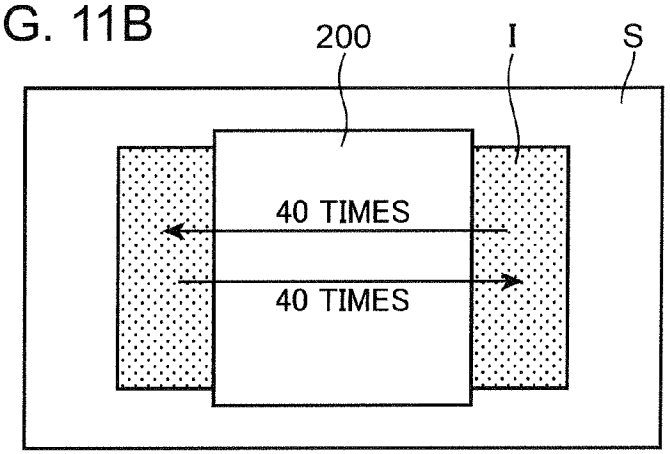
FIG. 11B is a schematic view of the experiment performed for verifying the fixation methodologies according to the second embodiment.
Figure 11A:
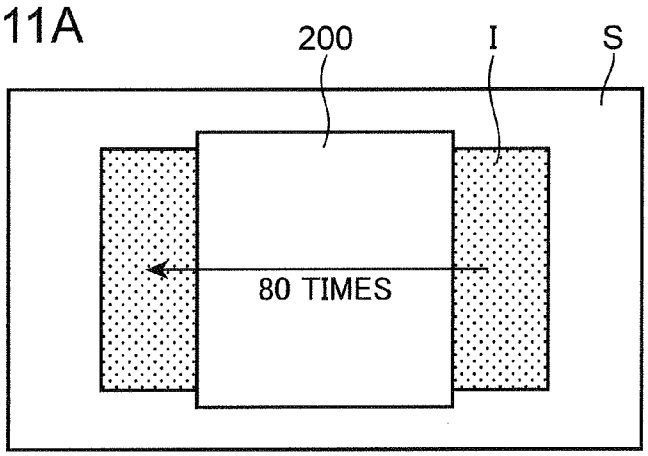
FIG. 11A is a schematic view of an experiment performed for verifying the fixation methodologies according to the second embodiment.
Figure 11D:
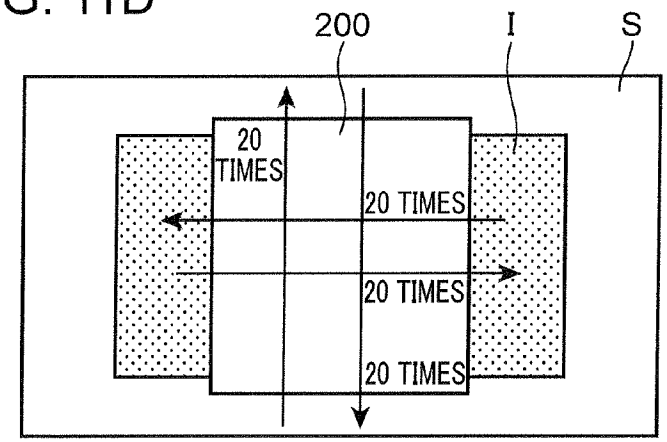
FIG. 11D is a schematic view of the experiment performed for verifying the fixation methodologies according to the second embodiment.
Figure 11C:
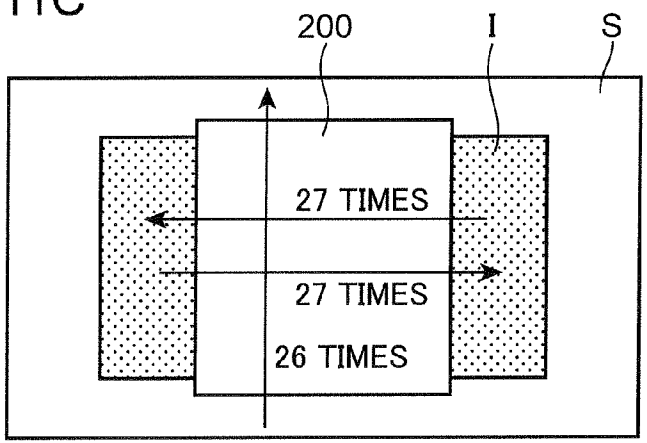
FIG. 11C is a schematic view of the experiment performed for verifying the fixation methodologies according to the second embodiment.
Figure 12:
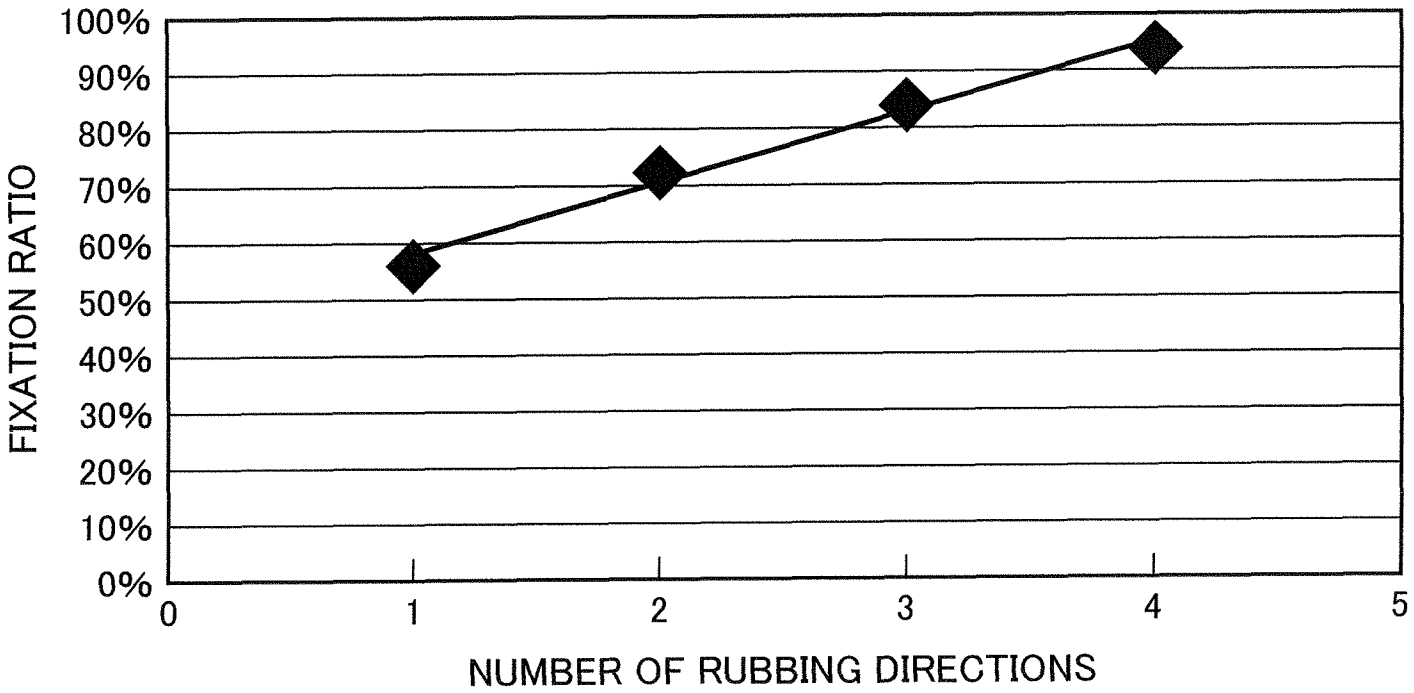
FIG. 12 is a graph showing results of the experiments shown in FIGS. 11A to 11D.

FIG. 12 is a graph showing fixation ratios FR obtained under the experimental conditions described in the context of FIGS. 11A to 11D. The horizontal axis of the graph shown in FIG. 12 represents the number of the rubbing directions described in the context of FIGS. 11A to 11D. The vertical axis of the graph shown in FIG. 12 represents the fixation ratios FR of the image layer I on the sheet S. The method for calculating the fixation ratios FR shown in FIG. 12 is based on the calculation method described in the context of the first embodiment. The effects of the number of the rubbing directions on the fixation ratios FR are described with reference to FIGS. 11A to 12.

As shown in FIG. 12, the fixation ratio FR linearly went up as an increase in the number of rubbing directions. Under the first experimental condition described in the context of FIG. 11A, the fixation ratio FR was 56%. Under the second experimental condition described in the context of FIG. 11B, the fixation ratio FR was 73%. Under the third experimental condition described in the context of FIG. 11C, the fixation ratio FR was 84%. Under the fourth experimental condition described in the context of FIG. 11D, the fixation ratio FR was 94%.

It is clear from the graph shown in FIG. 12 that the increase in the number of the rubbing directions causes a high fixation ratio FR in a relatively short period of time.

<Fixing Device>

Figure 13:
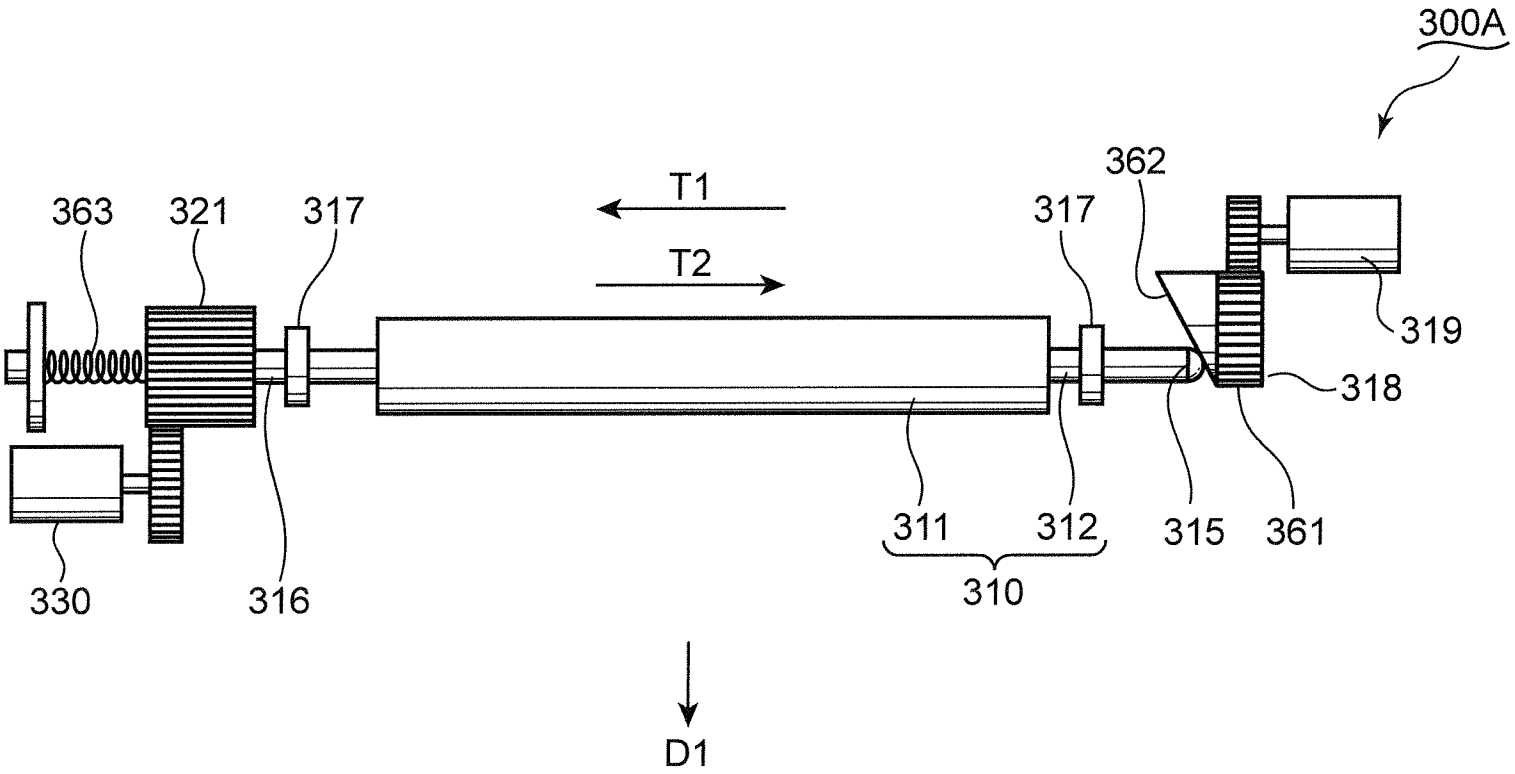
FIG. 13 is a schematic plan view of a fixing device according to the second embodiment.

FIG. 13 is a schematic plan view of a fixing device 300A configured to perform the three-directional rubbing operations shown in FIG. 11C. The fixing device 300A is described with reference to FIGS. 11A to 11D and 13.

The fixing device 300A comprises the rubbing roller 310 described in the context of the first embodiment. The rubbing roller 310 includes the tubular contact cylinder 311 which contacts the image layer I, and the shaft 312 which supports the rotatable contact cylinder 311. The shaft 312 includes a first end 315 and a second end 316 opposite to the first end 315.

The fixing device 300A has a gear 321 mounted on the second end 316 of the shaft 312, and a motor 330 coupled to the gear 321. The motor 330 rotates the shaft 312 by means of the gear 321. As a result, the contact cylinder 311 is integrally rotated with the shaft 312.

The fixing device 300A has a pair of thrust bearings 317 configured to support the rotatable shaft 312. The paired thrust bearings 317 are situated between the first end 315 of the shaft 312 and the contact cylinder 311 as well as between the gear 321 and the contact cylinder 311. The thrust bearings 317 allow the shaft 312 not only to rotate but also to be displaced in an axial direction thereof.

The fixing device 300A includes a cam gear 318 which contacts the first end 315 of the shaft 312, and a motor 319 connected to the cam gear 318. The cam gear 318 eccentrically situated with respect to the shaft 312 includes a circumferential surface 361 engaged with the motor 319 and a pressing surface 362 which contacts the first end 315 of the shaft 312. The pressing surface 362 has a thickness that gradually increases toward the second end 316 of the shaft 312. The vector shown in FIG. 13 exemplifies the first direction D1 indicating the conveying direction of the sheet S. The motor 319 eccentrically rotates the cam gear 318 with respect to the shaft 312. As a result, the shaft 312 and the contact cylinder 311 are pressed and displaced in a first traverse direction T1 perpendicular to the first direction D1. In the present embodiment, the cam gear 318 is exemplified as the cam element.

The fixing device 300A has a coil spring 363 adjacent to the second end 316 of the shaft 312. The coil spring 363 biases the gear 321 mounted on the second end 316 in a second traverse direction T2 opposite to the first traverse direction T1. In the present embodiment, the motor 319 and the coil spring 363 which reciprocate the contact cylinder 311 in the first and second traverse directions T1, T2 are exemplified as the drive mechanism.

Figure 14:
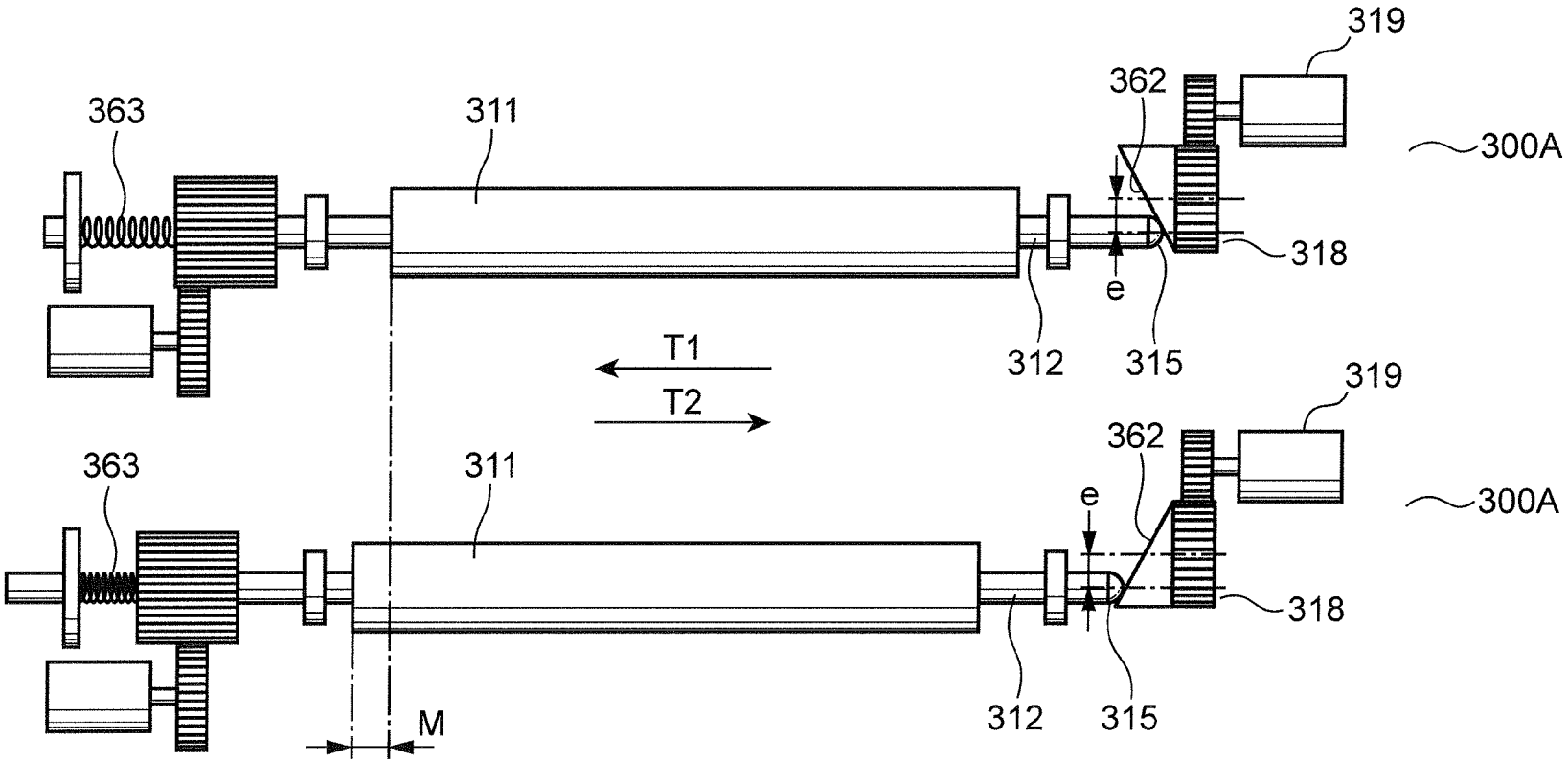
FIG. 14 is a plan view schematically showing operations of the fixing device shown in FIG. 13.

FIG. 14 shows a reciprocating movement of the rubbing roller 310 caused by the motor 319. The upper drawing of FIG. 14 is a schematic plan view of the fixing device 300A having the contact cylinder 311 near the cam gear 318. The lower drawing of FIG. 14 is a schematic plan view of the fixing device 300A having the contact cylinder 311 apart from the cam gear 318. The fixing device 300A is further described with reference to FIGS. 11A to 11D, 13 and 14.

As described above, the cam gear 318 is eccentrically situated with respect to the shaft 312. In FIG. 14, the eccentric amount between the cam gear 318 and the shaft 312 is expressed by an alphabet "e." As shown in the upper drawing of FIG. 14, when the first end 315 of the shaft 312 abuts a thin section of the cam gear 318, the contact cylinder 311 approaches the cam gear 318. As shown in the lower drawing of FIG. 14, when the first end 315 of the shaft 312 abuts a thick section of the cam gear 318, the contact cylinder 311 moves away from the cam gear 318. In FIG. 14, the displacement amount of the contact cylinder 311 in the first or second traverse direction T1, T2 is expressed by an alphabet As shown in the lower drawing of FIG. 14, when the contact cylinder 311 moves away from the cam gear 318, the coil spring 363 becomes compressed. Thereafter the first end 315 of the shaft 312 moves on the pressing surface 362 of the cam gear 318, so that an abutting position between the first end 315 and the pressing surface 362 of the cam gear 318 moves to the thin section of the cam gear 318, which in turn stretches the coil spring 363. Thus, the coil spring 363 appropriately maintains the contact between the first end 315 of the shaft 312 and the cam gear 318, which appropriately accomplishes the reciprocating movement of the contact cylinder 311 due to the rotation of the cam gear 318 by the motor 319.

Figure 15B:
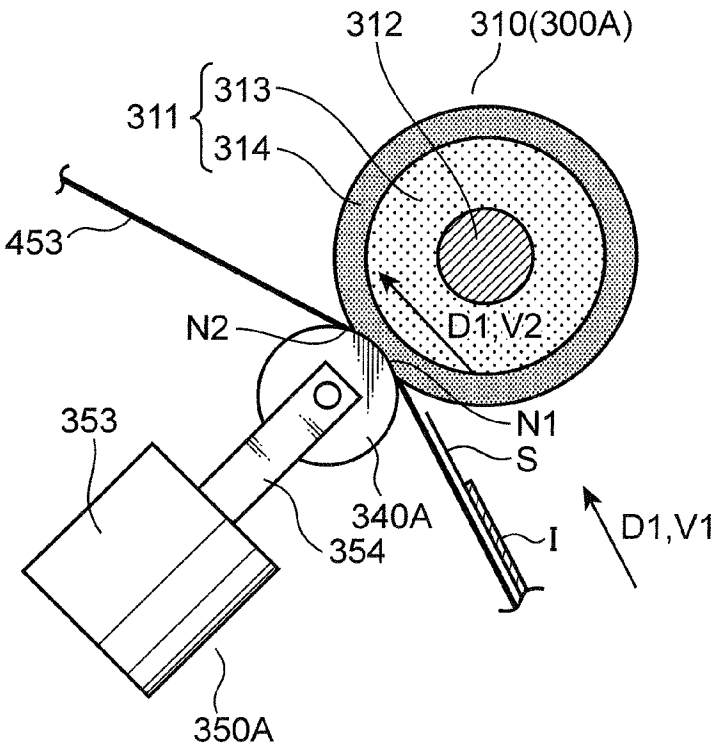
FIG. 15B is a side view schematically showing the operations performed by the fixing device shown in FIG. 13.
Figure 15A:
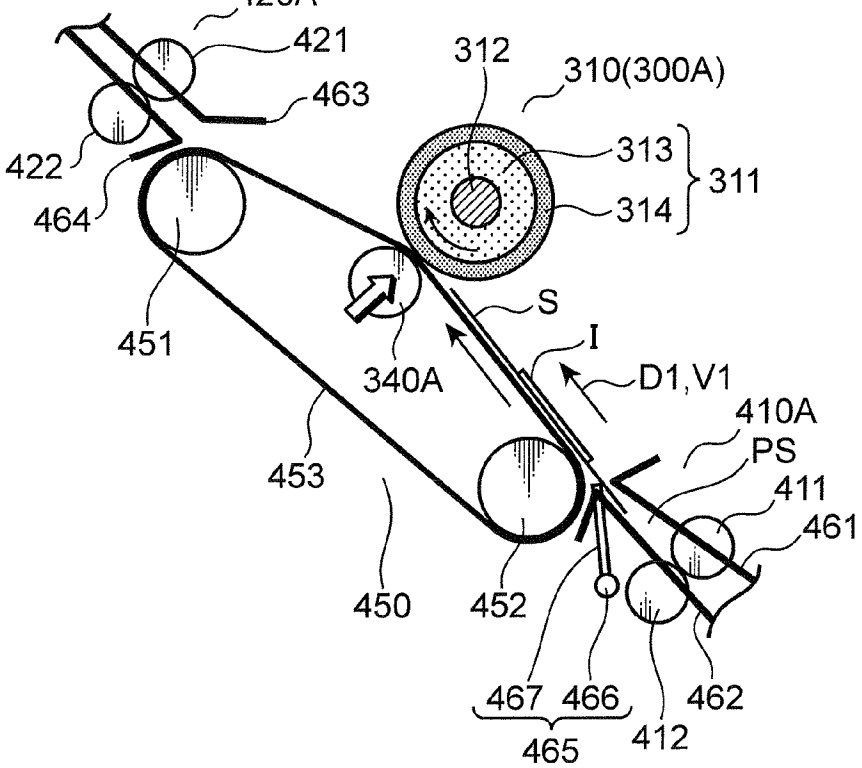
FIG. 15A is a side view schematically showing the operations performed by the fixing device shown in FIG. 13.

FIGS. 15A and 15B are schematic side views of the fixing device 300A and a conveyor which works with the fixing device 300A to fix the image layer I on the sheet S. FIG. 15A entirely shows the fixing device 300A and the conveyor. FIG. 15B is an enlarged view around the rubbing roller 310. The fixing device 300A is further described with reference to FIGS. 4, 13, 15A and 15B.

The conveyor includes an upstream conveyor 410A disposed before the fixing device 300A, and a downstream conveyor 420A disposed after the fixing device 300A. The upstream and downstream conveyors 410A, 420A are exemplified as the conveying elements configured to convey the sheet S, like the first embodiment.

The conveyor comprises an intermediate conveyor 450 situated between the upstream and downstream conveyors 410A, 420A. In the present embodiment, in addition to the upstream and downstream conveyors 410A, 420A, the intermediate conveyor 450 is also exemplified as the conveying element.

As in the first embodiment, the upstream conveyor 410A comprises the upper and lower rollers 411, 412. The upstream conveyor 410A comprises an upper guide plate 461 configured to stably convey the sheet S to the intermediate conveyor 450, and a lower guide plate 462 situated below the upper guide plate 461. The sheet S conveyed by the upper and lower rollers 411, 412 is guided by the upper and lower guide plates 461, 462 and fed to the intermediate conveyor 450.

Like the first embodiment, the downstream conveyor 420A comprises the upper and lower rollers 421, 422. The downstream conveyor 420A has an upper guide plate 463 configured to stably convey the sheet S from the intermediate conveyor 450 to a nip portion between the upper and lower rollers 421, 422, and a lower guide plate 464 situated below the upper guide plate 463. The sheet S conveyed by the intermediate conveyor 450 is guided by the upper and lower guide plates 463, 464 and fed to the nip portion between the upper and lower rollers 421, 422.

FIGS. 15A and 15B schematically show the contact cylinder 311 and the shaft 312 of the rubbing roller 310 as the fixing device 300A. Like the first embodiment, the contact cylinder 311 comprises the substantially cylindrical elastic layer 313 which surrounds the circumferential surface of the shaft 312, and the nonwoven fabric layer 314 which covers the outer circumferential surface of the elastic layer 313. The elastic layer 313 is formed by using, for example, sponge or other soft and elastic material. The nonwoven fabric layer 314 is formed by using, for example, any of the nonwoven fabrics described in the context of FIG. 4.

The intermediate conveyor 450 includes a drive roller 451, an idler 452, and an endless belt 453 extending between the drive roller 451 and the idler 452. The sheet S is sent from the upstream conveyor 410A onto the endless belt 453. The drive roller 451 revolves the endless belt 453 to convey the sheet S toward the downstream conveyor 420A. The idler 452 is rotated in response to the revolution of the endless belt 453. The directions of the vectors shown in FIGS. 15A and 15B are exemplified as the first direction D1 indicating the conveying direction of the sheet S, respectively. The lengths of the vectors shown in FIGS. 15A and 15B are exemplified as the first speed V1 indicating the conveying speed for the sheet S, respectively. In the present embodiment, the endless belt 453 is exemplified as the conveying belt.

The intermediate conveyor 450 has a backup roller 340A and a cylinder device 350A connected to the backup roller 340A. The cylinder device 350A causes the backup roller 340A to separate from or approach the rubbing roller 310. In the present embodiment, the cylinder device 350A is exemplified as the separating/approaching mechanism. Alternatively, another mechanism configured to cause the backup roller 340A to separate from or approach the rubbing roller 310 may be used as the separating/approaching mechanism Like a commercially available cylinder device, the cylinder device 350A comprises a shell 353 and a rod 354 which is stored in the shell 353. The rod 354 includes a tip end configured to support the rotatable backup roller 340A. The rod 354 is pushed from the shell 353 by, for example, working fluid (e.g., oil or air) which is fed into the shell 353. As a result, the backup roller 340A is displaced toward the rubbing roller 310. The backup roller 340A displaced toward the rubbing roller 310 pushes the endless belt 453 against the rubbing roller 310. Thus, the circumferential surface of the rubbing roller 310 is deformed to form the upper nip surface N1 along the upper surface of the sheet S passing through the fixing device 300A, like the first embodiment. The outer surface of the endless belt 453, which is deformed along the circumferential surface of the backup roller 340A, forms the lower nip surface N2. In the present embodiment, the upper nip surface N1 which contacts the image (image layer I) formed on the upper surface of the sheet S is exemplified as the contact surface.

The sheet S conveyed by the intermediate conveyor 450 passes between the endless belt 453 and the rubbing roller 310. The motor 330, which is described in the context of FIG. 13, rotates the rubbing roller 310 such that the upper nip surface N1 moves in the first direction D1 at the second speed V2 different from the first speed V1. In the present embodiment, the second speed V2 is greater than the first speed V1. Alternatively, the second speed V2 may be lower than the first speed V1.

As described in the context of FIG. 13, the rotation of the cam gear 318 reciprocates the upper nip surface N1 in the first and second traverse directions T1, T2. Furthermore, rubbing the image layer I in the first direction D1 is accomplished by the speed difference of the upper nip surface N1 of the sheet S in the first direction D1. In the present embodiment, the motor 330 moves the upper nip surface N1 in the first direction D1. Alternatively, the motor 330 may move the upper nip surface N1 in the second direction opposite to the first direction D1. In addition, the motor 330 and the gear 321 may be removed from the fixing device 300A. In this case, rubbing the image layer I is accomplished by the reciprocating movement of the contact cylinder 311 in the first and second traverse directions T1, T2. It is preferred that the shaft 312 supports the rotatable contact cylinder 311.

Figure 16:
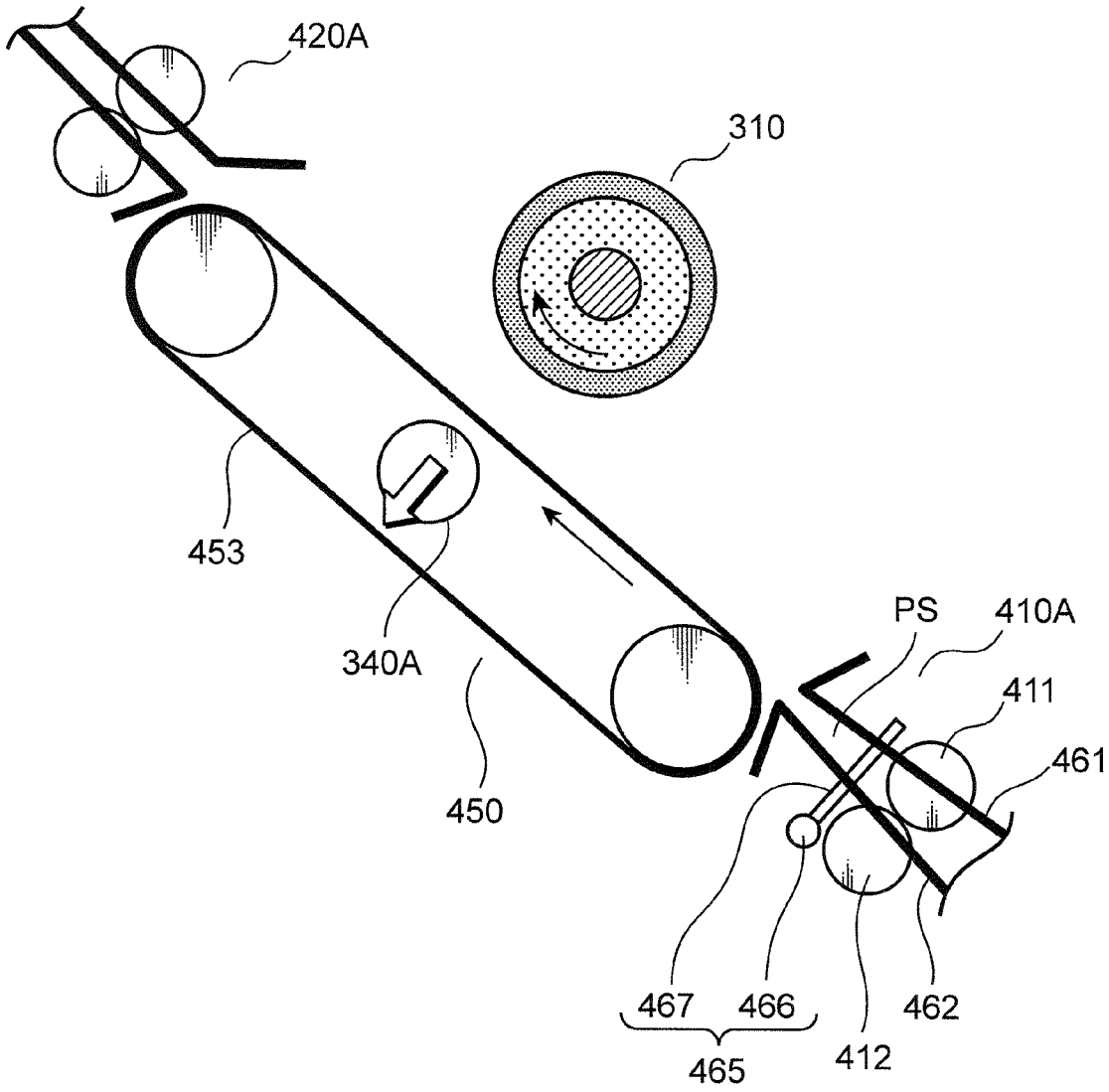
FIG. 16 is a side view schematically showing the operations performed by the fixing device shown in FIG. 13.

FIG. 16 is a schematic side view of the fixing device 300A and the conveyor after the sheet S passes through the intermediate conveyor 450. The fixing device 300A and the conveyor are further described with reference to FIGS. 15A to 16.

The upstream conveyor 410A comprises a switch lever 465. The switch lever 465 includes a turning shaft 466 adjacent to the lower roller 412, and an arm 467 extending from the turning shaft 466. The arm 467 turns between a reference position (see FIG. 16) where the arm 467 traverses a conveyance path PS defined by the upper and lower guide plates 461, 462 after the nip portion between the upper and lower rollers 411, 412, and an inclined position (see FIG. 15A) where the arm 467 is inclined with respect to the reference position.

The arm 467 at the reference position is turned to the inclined position by the leading edge of the sheet S sent by the upper and lower rollers 411, 412. A biasing element (not shown), such as a twisted coil, is mounted on the turning shaft 466. The biasing element biases the switch lever 465 to return the arm 467 to the reference position. Thus, once the conveyance of the sheet S from the upstream conveyor 410A to the intermediate conveyor 450 completes, the arm 467 is returned to the reference position by the biasing element.

If the arm 467 reaches the inclined position, the switch lever 465 outputs a first trigger signal to a fluid controller (not shown) configured to control flow of the working fluid to the shell 353 of the cylinder device 350A. Based on the first trigger signal, the fluid controller supplies the working fluid into the shell 353 to extend the rod 354 from the shell 353. As a result, the backup roller 340A approaches the rubbing roller 310. If the arm 467 reaches the reference position, the switch lever 465 outputs a second trigger signal to the fluid controller. Based on the second trigger signal, the fluid controller discharges the working fluid from the shell 353 to retract the rod 354 in the shell 353. As a result, the backup roller 340A and the endless belt 453 separate from the rubbing roller 310, as shown in FIG. 16. Therefore it is less likely that there are unnecessary rubbing operations between the endless belt 453 and the rubbing roller 310.

The fixing device 300A according to the second embodiment and the conveyor (the upstream, intermediate and downstream conveyor 410A, 450, 420A), which is used for conveying the sheet S to the fixing device 300A, are preferably incorporated in the color printer 1 described in the context of FIGS. 8 to 10, in place of the fixing device 300 and the conveyor described in the context of the first embodiment.

(Third Embodiment)

<Fixing Device>

Figure 17:
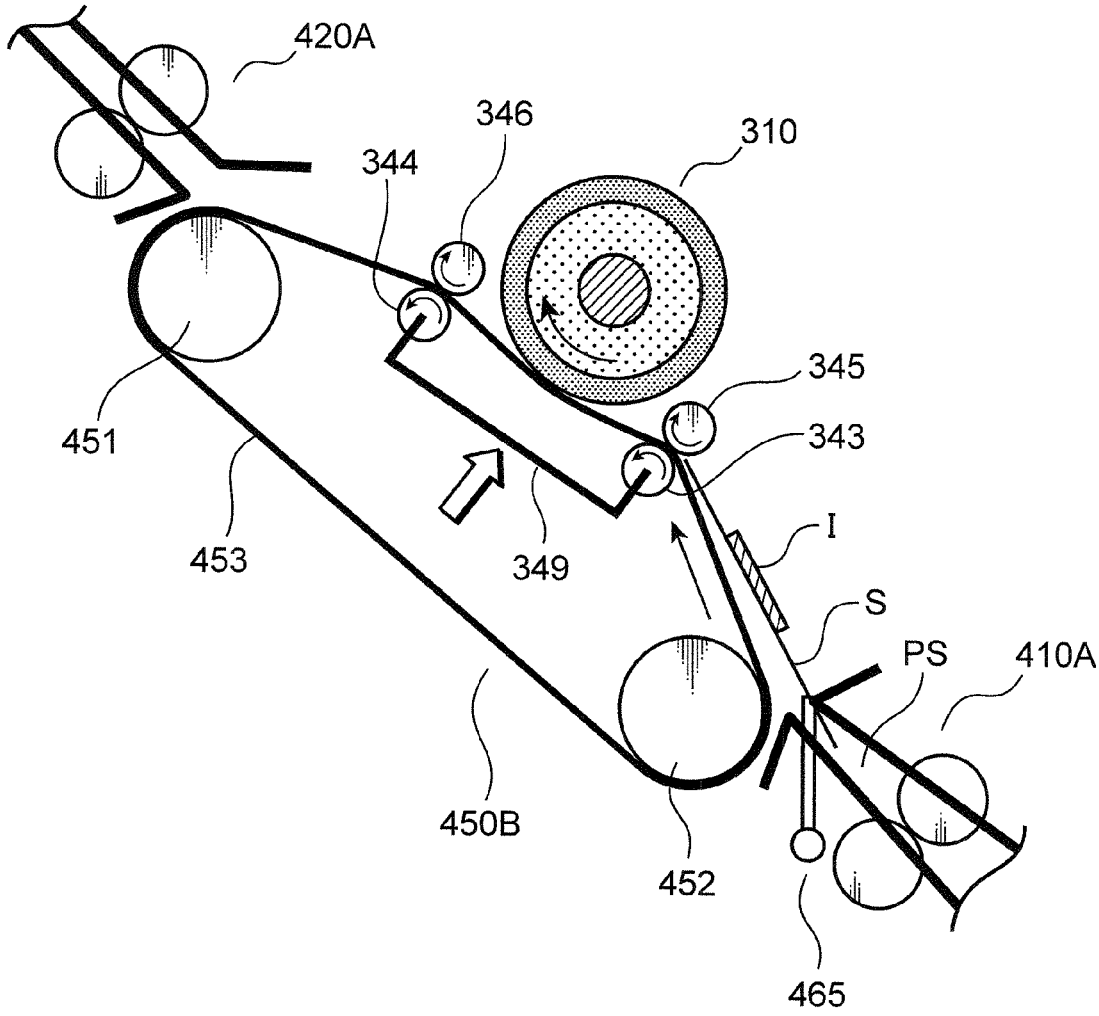
FIG. 17 is a schematic side view of a fixing device according to the third embodiment.
Figure 18:
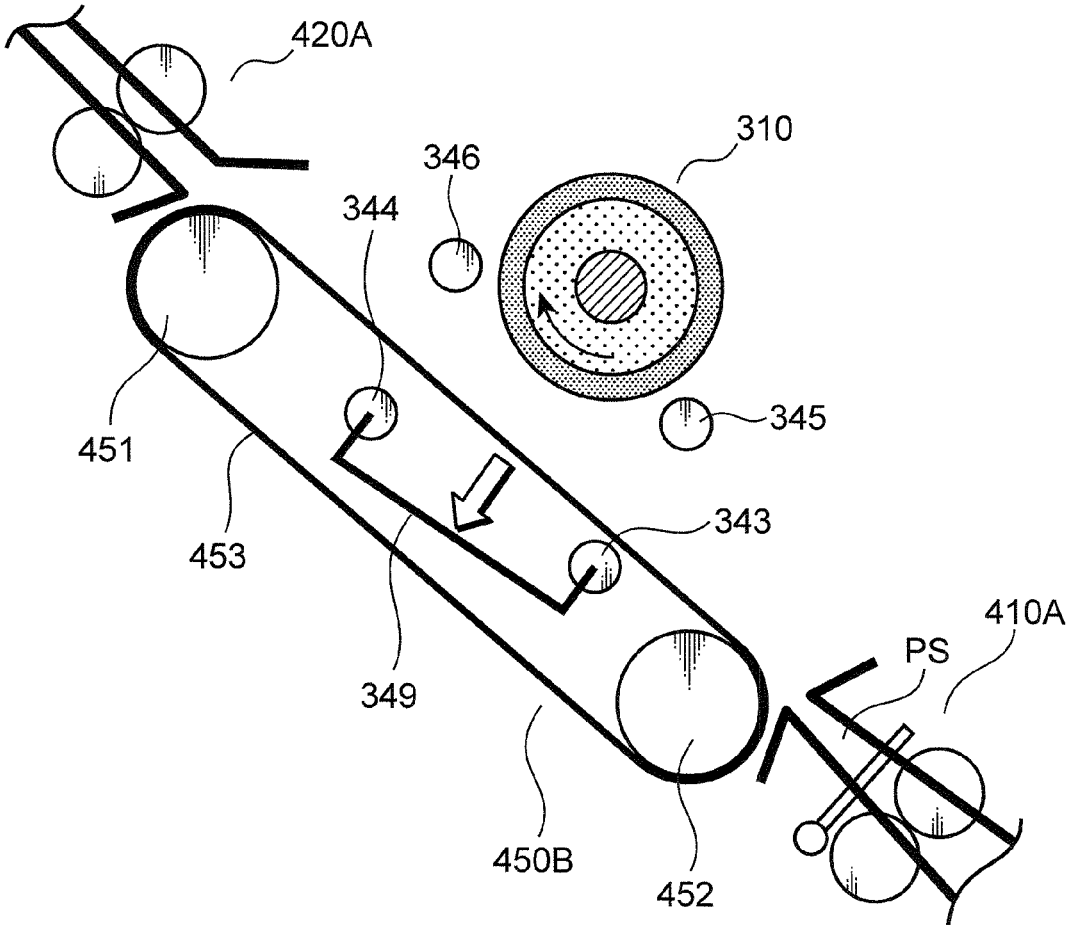
FIG. 18 is a schematic side view of the fixing device according to the third embodiment.

FIGS. 17 and 18 are side views schematically showing a fixing device and a conveyor according to the third embodiment, respectively. Different features from those of the second embodiment are described hereinafter. Therefore, some descriptions overlapping with those of the second embodiment are omitted. Hereinafter, the same reference numerals are used for describing the same elements as those of the second embodiment. The descriptions associated with the second embodiment are preferably incorporated into the elements which are not described hereinafter. The fixing device and the conveyor according to the third embodiment are described with reference to FIGS. 3, 17 and 18.

The conveyor includes the upstream conveyor 410A situated before the fixing device 300A, and the downstream conveyor 420A situated after the fixing device 300A. The upstream and downstream conveyors 410A, 420A are exemplified as the conveying elements configured to convey the sheet S, like the second embodiment.

The conveyor has an intermediate conveyor 450B situated between the upstream and downstream conveyors 410A, 420A. In the present embodiment, in addition to the upstream and downstream conveyors 410A, 420A, the intermediate conveyor 450B is also exemplified as the conveying element.

The intermediate conveyor 450B includes the drive roller 451, the idler 452, and the endless belt 453 extending between the drive roller 451 and the idler 452. The sheet S is sent from the upstream conveyor 410A onto the endless belt 453. The drive roller 451 revolves the endless belt 453 to convey the sheet S toward the downstream conveyor 420A. The idler 452 is rotated in response to the revolution of the endless belt 453.

The intermediate conveyor 450B comprises an upstream backup roller 343 and a downstream backup roller 344 disposed between the drive roller 451 and the idler 452. The intermediate conveyor 450B further comprises a frame 349 configured to support the rotatable upstream and downstream backup rollers 343, 344. The frame 349 moves the endless belt 453 nearby the rubbing roller 310 or separates the endless belt 453 from the rubbing roller 310 by means of the same separating/approaching mechanism as that of the cylinder device 350A described in the context of the second embodiment. Like the second embodiment, the switch lever 465 provided in the upstream conveyor 410A controls the approaching and separating motions of the endless belt 453 with respect to the rubbing roller 310. The rubbing roller 310 rubs the image layer I on the sheet S in three directions by means of the mechanism described in the context of the second embodiment. In the present embodiment, the upstream and downstream backup rollers 343, 344 works like the backup roller 340A described in the context of the second embodiment.

The intermediate conveyor 450B comprises an upstream holding roller 345 and a downstream holding roller 346 situated after the rubbing roller 310. The upstream holding roller 345 is disposed in correspondence with the upstream backup roller 343. The downstream holding roller 346 is disposed in correspondence with the downstream backup roller 344.

The upstream backup roller 343 pushes the endless belt 453 against the upstream holding roller 345 in response to the movement of the switch lever 465 to the inclined position. The downstream backup roller 344 pushes the endless belt 453 against the downstream holding roller 346 in response to the movement of the switch lever 465 to the inclined position. As a result, the endless belt 453 between the upstream backup roller 343/upstream holding roller 345 and the downstream backup roller 344/downstream holding roller 346 is pushed against the circumferential surface of the rubbing roller 310. Thus, the rubbing roller 310 defines a travel path of the endless belt 453 curved toward the frame 349. As a result, relatively long rubbing time between the rubbing roller 310 and the image layer I on the sheet S is ensured. This preferably contributes to higher fixation ratio FR, as described in the context of FIG. 3.

While the rubbing roller 310 rubs the image layer I on the sheet S, the sheet S is appropriately held between the upstream backup roller 343 and the upstream holding roller 345, as well as between the downstream backup roller 344 and the downstream holding roller 346. As described in the context of the second embodiment, the rubbing roller 310 also reciprocally rubs the image layer I in the perpendicular direction to the conveying direction of the sheet S. It is likely that conveyance failures of the sheet S, which is caused by the reciprocal rubbing in the perpendicular direction to the conveying direction of the sheet S, are prevented by causing the upstream backup roller 343, the upstream holding roller 345, the downstream backup roller 344 and the downstream holding roller 346 to hold the sheet S.

In the present embodiment, the sheet S is held by the upstream backup roller 343, the upstream holding roller 345, the downstream backup roller 344 and the downstream holding roller 346. Alternatively, the sheet S may be held only between the upstream backup roller 343 and the upstream holding roller 345. Further alternatively, the sheet S may be held only between the downstream backup roller 344 and the downstream holding roller 346.

(Fourth Embodiment)

<Rubbing Roller>

Figure 19B:
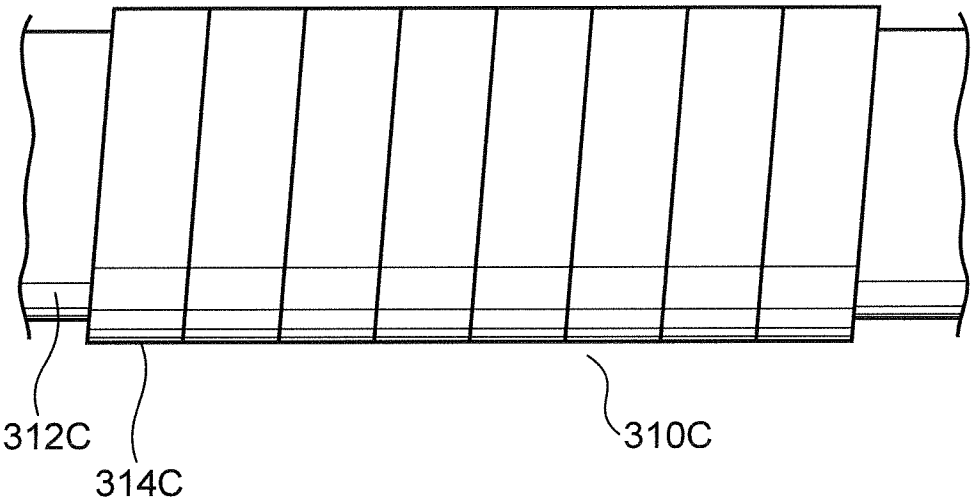
FIG. 19B is a schematic view of the rubbing roller of the fixing device according to the fourth embodiment.
Figure 19A:
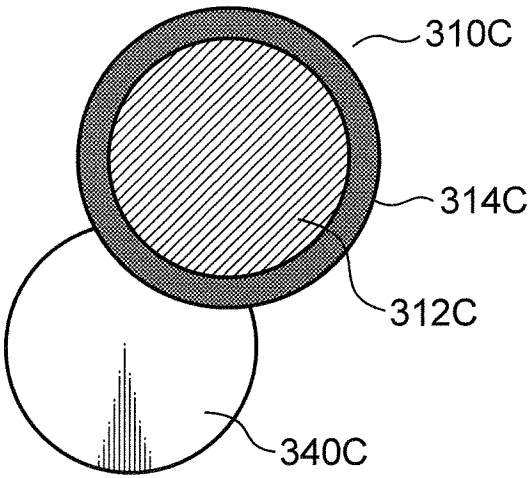
FIG. 19A is a schematic view of a rubbing roller of a fixing device according to the fourth embodiment.

FIGS. 19A and 19B schematically show a rubbing roller according to the fourth embodiment. FIG. 19A is a schematic cross-sectional view of the rubbing roller. FIG. 19B is a schematic plan view of the rubbing roller. The rubbing roller according to the fourth embodiment is preferably applied in place of the rubbing roller 310 described in the context of the aforementioned embodiments.

In the present embodiment, a rubbing roller 310C comprises a hard shaft 312C (e.g., a metallic shaft) and a nonwoven fabric band 314C spirally wrapped around the circumferential surface of the shaft 312C. The nonwoven fabric band 314C may be formed, for example, from any of the nonwoven fabrics described in the context of FIG. 4.

In the present embodiment, a backup roller 340C is formed from a softer elastic material than the shaft 312C. If the backup roller 340C is pressed to the shaft 312C, the backup roller 340C is elastically deformed to form an appropriate nip portion between the backup and rubbing rollers 340C, 310C. Rubbing on the sheet S which passes in between the backup and rubbing rollers 340C, 310C is performed on the basis of the fixation methodologies described in the context of the aforementioned embodiments. Thus, the image layer I is preferably fixed on the sheet S.

(Fifth Embodiment)

<Fixing Device>

Figure 20:
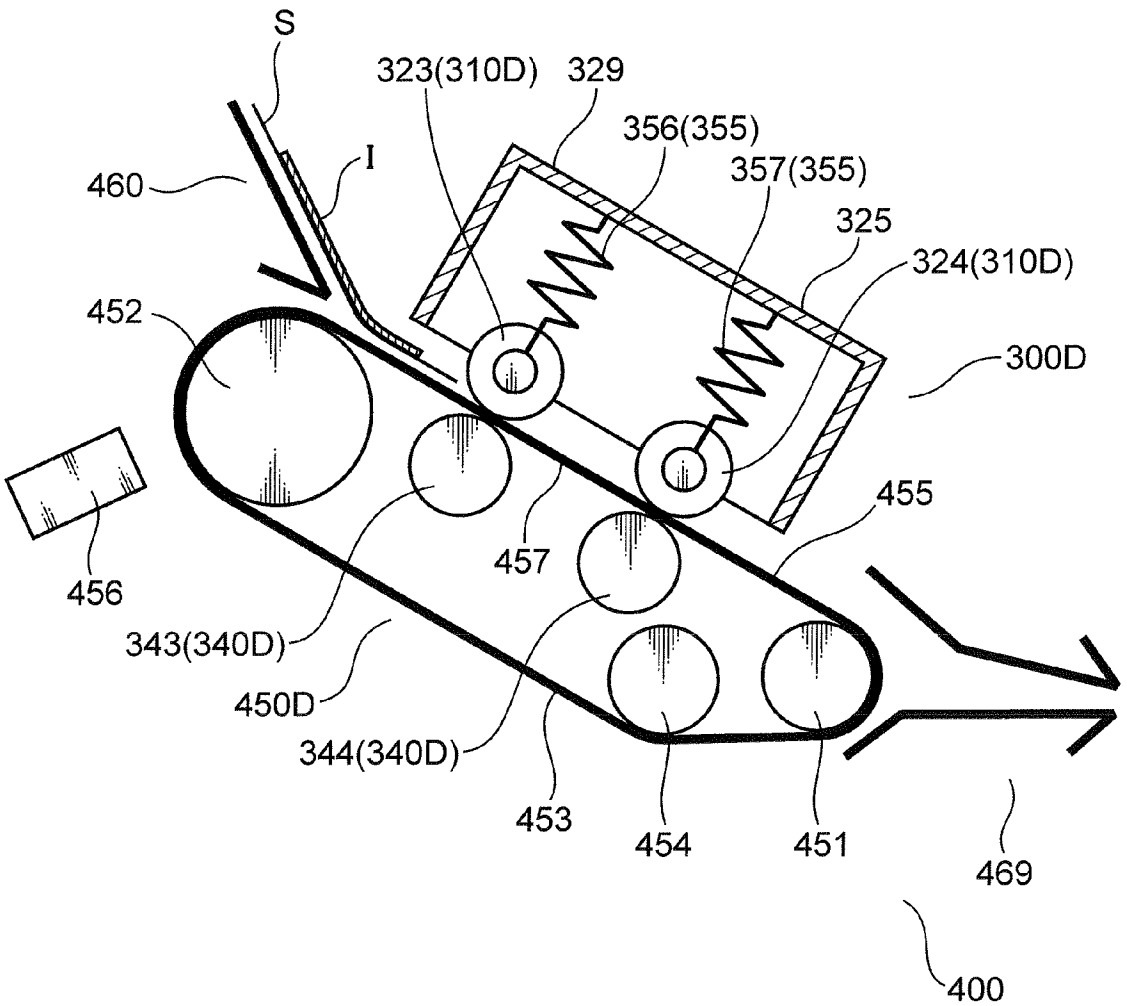
FIG. 20 is a cross-sectional view schematically showing a fixing device and a conveyor according to the fifth embodiment.

FIG. 20 is a schematic view of a fixing device and a conveyor according to the fifth embodiment. The fixing device and the conveyor according to the fifth embodiment are described with reference to FIG. 20. Hereinafter, the same reference numerals are used for describing the same elements as those of the first embodiment. The descriptions associated with the first embodiment are preferably incorporated into the elements which are not described hereinafter.

A conveyor 400 configured to convey the sheet S with the image layer I thereon comprises a belt unit 450D, an upstream guider 460 situated before the belt unit 450D, and a downstream guider 469 situated after the belt unit 450D. The sheet S is guided by the upstream guider 460 and sent to the belt unit 450D. Thereafter, the sheet S is sent to the downstream guide 469 by the belt unit 450D:

The belt unit 450D comprises the drive roller 451, the idler 452, the endless belt 453 extending between the drive roller 451 and the idler 452, and a tension roller 454 applying tension to the endless belt 453. Rotation of the drive roller 451 causes the endless belt 453 to revolve around the drive roller 451, the idler 452 and the tension roller 454. As a result, the sheet S, which is sent from the upstream guider 460 to the outer surface 455 of the endless belt 453, moves toward the downstream guider 469 in response to the revolution of the endless belt 453. In the present embodiment, the belt unit 450D is exemplified as the conveying element. The endless belt 453 is exemplified as the conveying belt.

The belt unit 450D further comprises a charger 456 configured to charge the outer surface 455 of the endless belt 453. The outer surface 455 of the endless belt 453 which is charged by the charger 456 causes the sheet S to electrostatically stick thereto. Therefore, the sheet S is stably conveyed by the endless belt 453. In the present embodiment, the endless belt 453 is preferably formed from resin such as PVDF.

The endless belt 453 includes the inner surface 457 opposite to the outer surface 455 to which the sheet S sticks. The belt unit 450D has a backup roller 340D which abuts the inner surface 457 of the endless belt 453. The backup roller 340D includes the upstream and downstream backup rollers 343, 344. The downstream backup roller 344 is closer to the downstream guider 469 than the upstream backup roller 343.

The fixing device 300D comprises a rubbing roller 310D configured to rub the image layer I on the sheet S. The rubbing roller 310D includes an upstream rubbing roller 323 corresponding to the upstream backup roller 343, and a downstream rubbing roller 324 corresponding to the downstream backup roller 344. The downstream rubbing roller 324 rubs the image layer I after the upstream rubbing roller 323. In the present embodiment, the rubbing roller 310D is exemplified as the rubbing mechanism. The upstream and downstream rubbing rollers 323, 324 are exemplified as an upstream rubbing mechanism and a downstream rubbing mechanism, respectively.

The fixing device 300D comprises a housing 329 configured to partially store the upstream and downstream rubbing rollers 323, 324. The housing 329 opens toward the endless belt 453. The upstream and downstream rubbing rollers 323, 324 protrude from the opening of the housing 329 to abut the outer surface 455 of the endless belt 453 or the sheet S.

The fixing device 300D comprises a presser 355 configured to press the rubbing roller 310D against the sheet S. In the present embodiment, the presser 355 includes an upstream coil spring 356 configured to push the upstream rubbing roller 323 against the sheet S, and a downstream coil spring 357 configured to push the downstream rubbing roller 324 against the sheet S. Alternatively, the presser 355 may be a cylinder device configured to press the rubbing roller 310D against the sheet S.

The upper end of the presser 355 is connected to a top plate 325 of the housing 329. The lower end of the presser 355 is connected to, for example, a bearing (not shown) configured to support a rotatable shaft (not shown) of the rubbing roller 310D.

Figure 21:
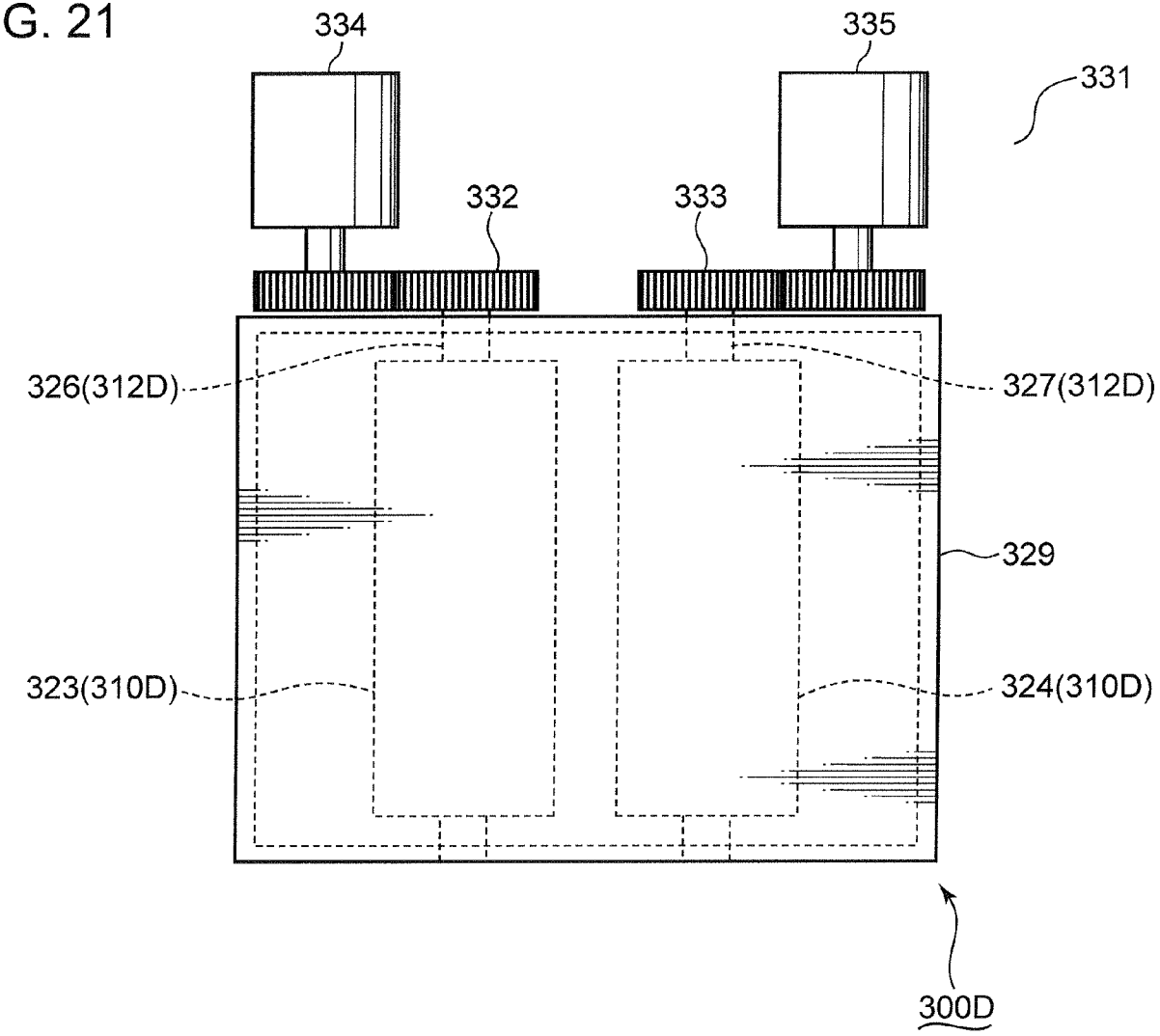
FIG. 21 is a schematic plan view of the fixing device shown in FIG. 20.

FIG. 21 is a schematic plan view of the fixing device 300D. The fixing device 300D is further described with reference to FIGS. 20 and 21.

The fixing device 300D includes a drive mechanism 331 mounted on an outer surface of the housing 329. The drive mechanism 331 includes an upstream gear 332 connected to a shaft 326 of the upstream rubbing roller 323, a downstream gear 333 connected to a shaft 327 of the downstream rubbing roller 324, an upstream motor 334 connected to the upstream gear 332, and a downstream motor 335 connected to the downstream gear 333. The upstream motor 334 rotates the upstream rubbing roller 323 on the image layer I. The downstream motor 335 rotates the downstream rubbing roller 324 on the image layer I. In the present embodiment, the upstream and downstream motors 334, 335 are exemplified as the drive mechanisms, respectively.

The housing 329 and the drive mechanism 331 are configured to allow the rubbing roller 310D to be displaced as the presser 355 expands or contracts. Thus, the rubbing roller 310D is appropriately pressed against the image layer I on the sheet S.

Figure 22:
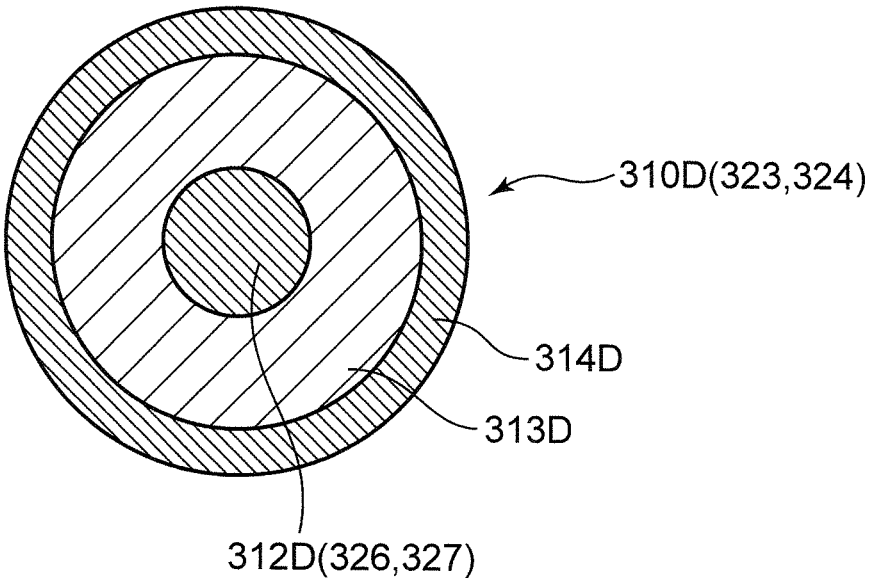
FIG. 22 is a schematic cross-sectional view of a rubbing roller of the fixing device shown in FIG. 20.

FIG. 22 is a schematic cross-sectional view of the rubbing roller 310D. The rubbing roller 310D is described with reference to FIGS. 4 and 22.

The rubbing roller 310D comprises a metallic shaft 312D, an elastic layer 313D configured to cover the circumferential surface of the shaft 312D, and a nonwoven fabric layer 314D configured to cover the circumferential surface of the elastic layer 313D. The nonwoven fabric layer 314D of the upstream rubbing roller 323 is preferably formed from a material different from the nonwoven fabric layer 314D of the downstream rubbing roller 324. The upstream rubbing roller 323 may fix the image layer I to the sheet S at a different fixation ratio FR from that of the downstream rubbing roller 324 due to the difference between the materials of the nonwoven fabric layers 314D, as described in the context of FIG. 4. In the present embodiment, because the nonwoven fabric layer 314D covers the elastic layer 313D, the circumferential surface of the rubbing roller 310D includes an elastic circumferential surface.

Figure 23:
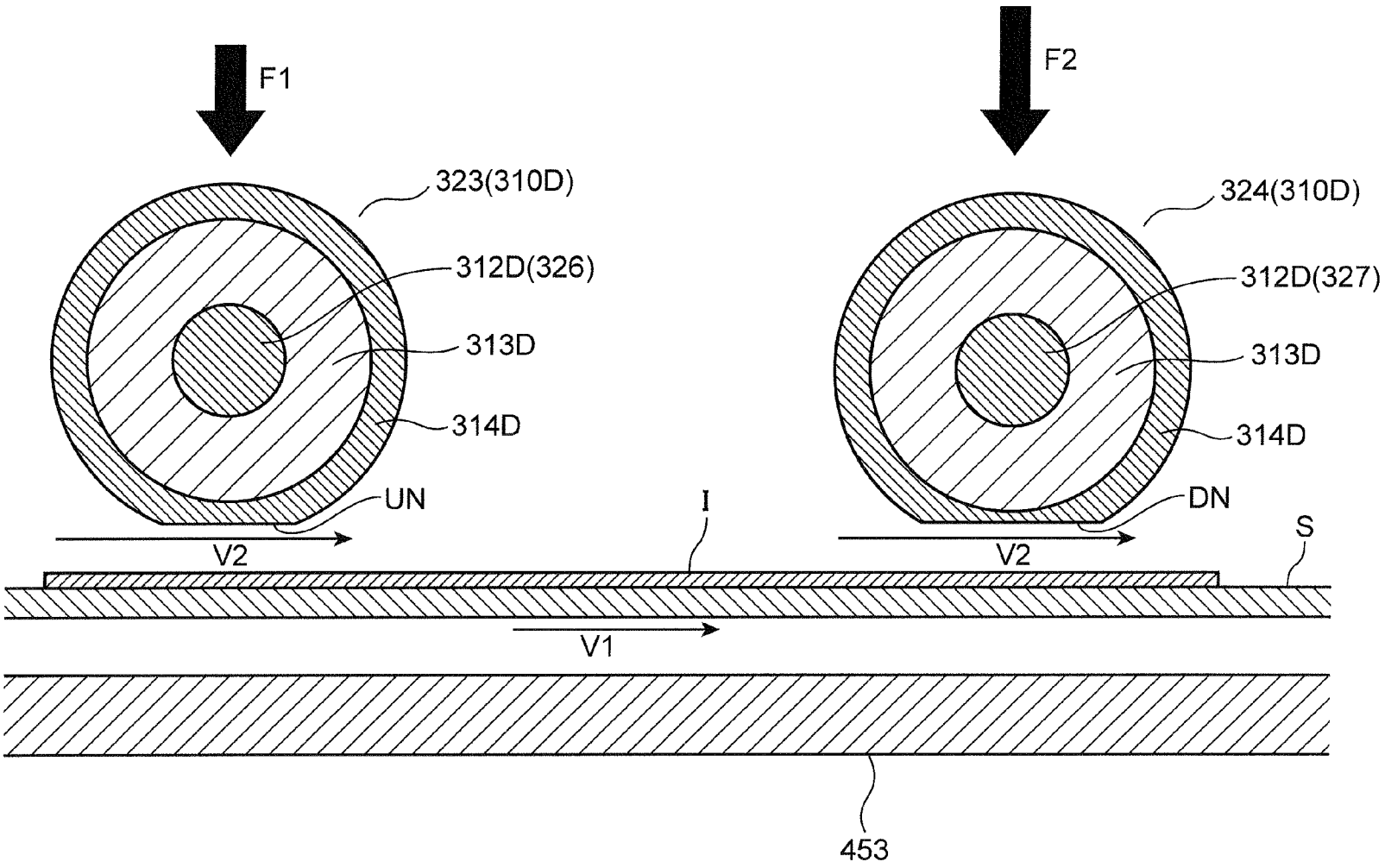
FIG. 23 is a schematic cross-sectional view of a rubbing roller configured to rub an image layer on a sheet conveyed by the conveyor shown in FIG. 20.

FIG. 23 is a schematic cross-sectional view of the upstream and downstream rubbing rollers 323, 324 which are pressed against the image layer I. The rubbing roller 310D is further described with reference to FIGS. 1A to 1C, 20, 21 and 23.

The upstream coil spring 356 biases the upstream rubbing roller 323 downward with a force F1. The downstream coil spring 357 biases the downstream rubbing roller 324 downward with a force F2 greater than the force F1. Therefore, the downstream rubbing roller 324 presses the image layer I with a greater force than the upstream rubbing roller 323.

A flat upstream nip surface UN along the image layer I is formed on the circumferential surface of the upstream rubbing roller 323 pressed with the force F1. A flat downstream nip surface DN along the image layer I is formed on the circumferential surface of the downstream rubbing roller 324 pressed with the force F2.

In the present embodiment, the downstream rubbing roller 324 has the same structure as the upstream rubbing roller 323. Therefore, the upstream nip surface UN of the upstream rubbing roller 323, which is pressed by the smaller force F1 than the force F2, is narrower than the downstream nip surface DN of the downstream rubbing roller 324. Alternatively, the elastic layer 313D of the downstream rubbing roller 324 may be less hard than the elastic layer 313D of the upstream rubbing roller 323. In this case, if the force F2 is equal to or greater than the force F1, the area of the downstream nip surface DN is larger than the area of the upstream nip surface UN. Alternatively, the elastic layer 313D of the downstream rubbing roller 324 may be harder than the elastic layer 313D of the upstream rubbing roller 323. In this case, if the force F2 is greater than the force F1, it is less likely that an area between the upstream and downstream nip surfaces UN, DN changes. As a result, it is less likely that the rubbing times during which the upstream and downstream rubbing rollers 323, 324 rub the image layer I changes, which result in facilitating parameter management on the fixation process.

As described above, the upper surface of the colored particles P in the image layer I is covered with the film formed from the polymer compounds R. The rubbing operation of the rubbing roller 310D makes the covering film stronger, so that the image is appropriately protected. In other words, it becomes less likely that the image layer I which is protected by the film layer reinforced by the upstream rubbing roller 323 is damaged as the sheet S is conveyed toward the downstream. Therefore, the pressing force from the upstream rubbing roller 323 (i.e., the force F1) or the area of the upstream nip surface UN is preferably smaller than the pressing force from the downstream rubbing roller 324 (i.e., the force F2) or the area of the downstream nip surface DN. In the present embodiment, the surface pressure of the upstream nip surface UN is set at, for example, 0.02 g/cm$^2$. The surface pressure of the downstream nip surface DN is set at, for example, 0.20 g/cm$^2$.

As shown in FIG. 23, the endless belt 453 conveys the sheet S at the first speed V1. The upstream motor 334 rotates the shaft 312D such that the upstream nip surface UN, which is exemplified as the contact surface, moves in the conveying direction of the sheet S at the second speed V2 greater than the first speed V1. The downstream motor 335 rotates the shaft 312D such that the downstream nip surface DN, which is exemplified as the contact surface, moves in the conveying direction of the sheet S at the second speed V2. As a result, the rubbing roller 310D rotates with rubbing the image layer I. In the present embodiment, the first speed V1 is set at, for example, 300.0 mm/sec. The second speed V2 is set at, for example, 301.5 mm/sec or above.

Figure 24:
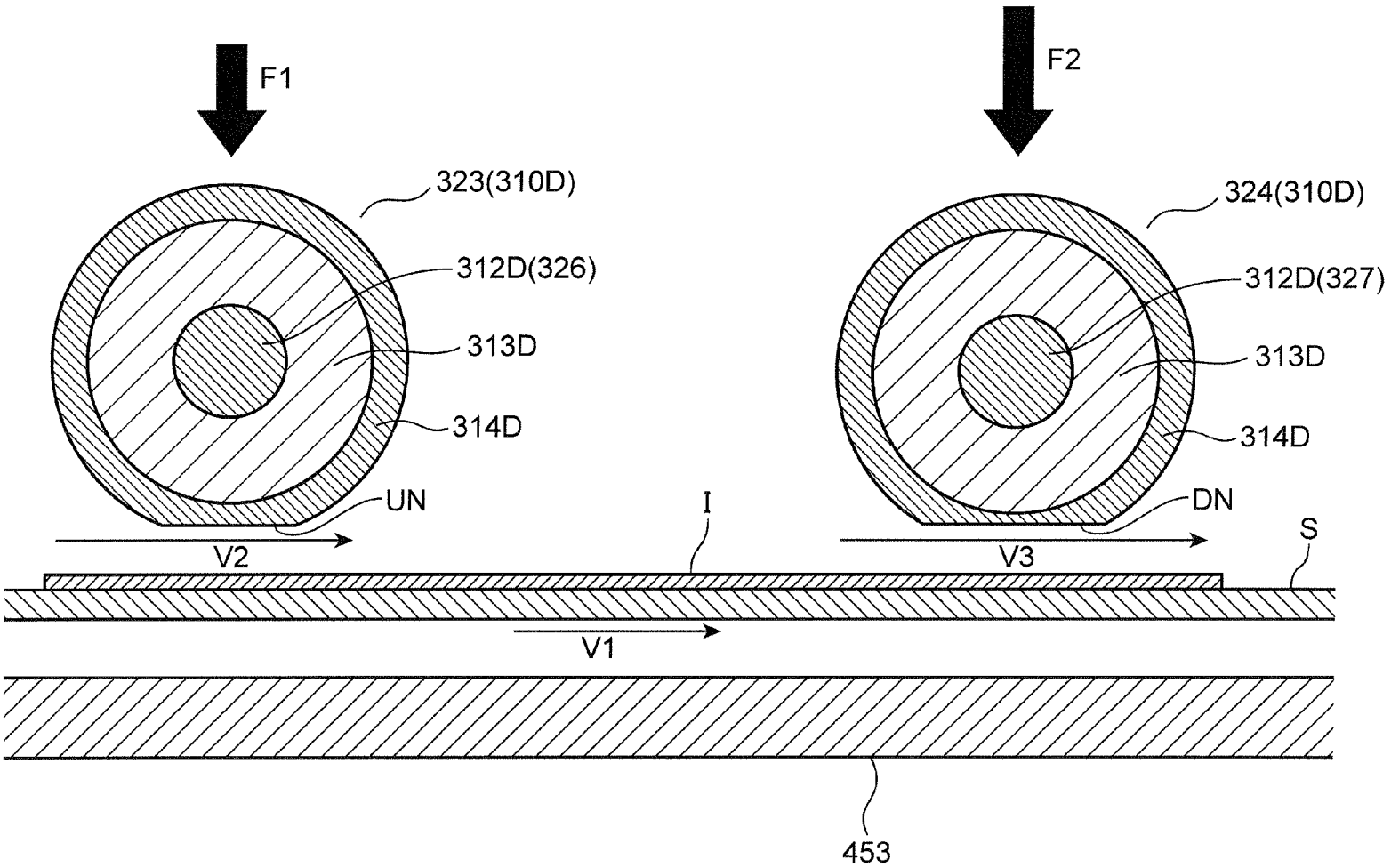
FIG. 24 is a schematic cross-sectional view of the rubbing roller configured to rub the image layer on the sheet conveyed by the conveyor shown in FIG. 20.
Figure 25:
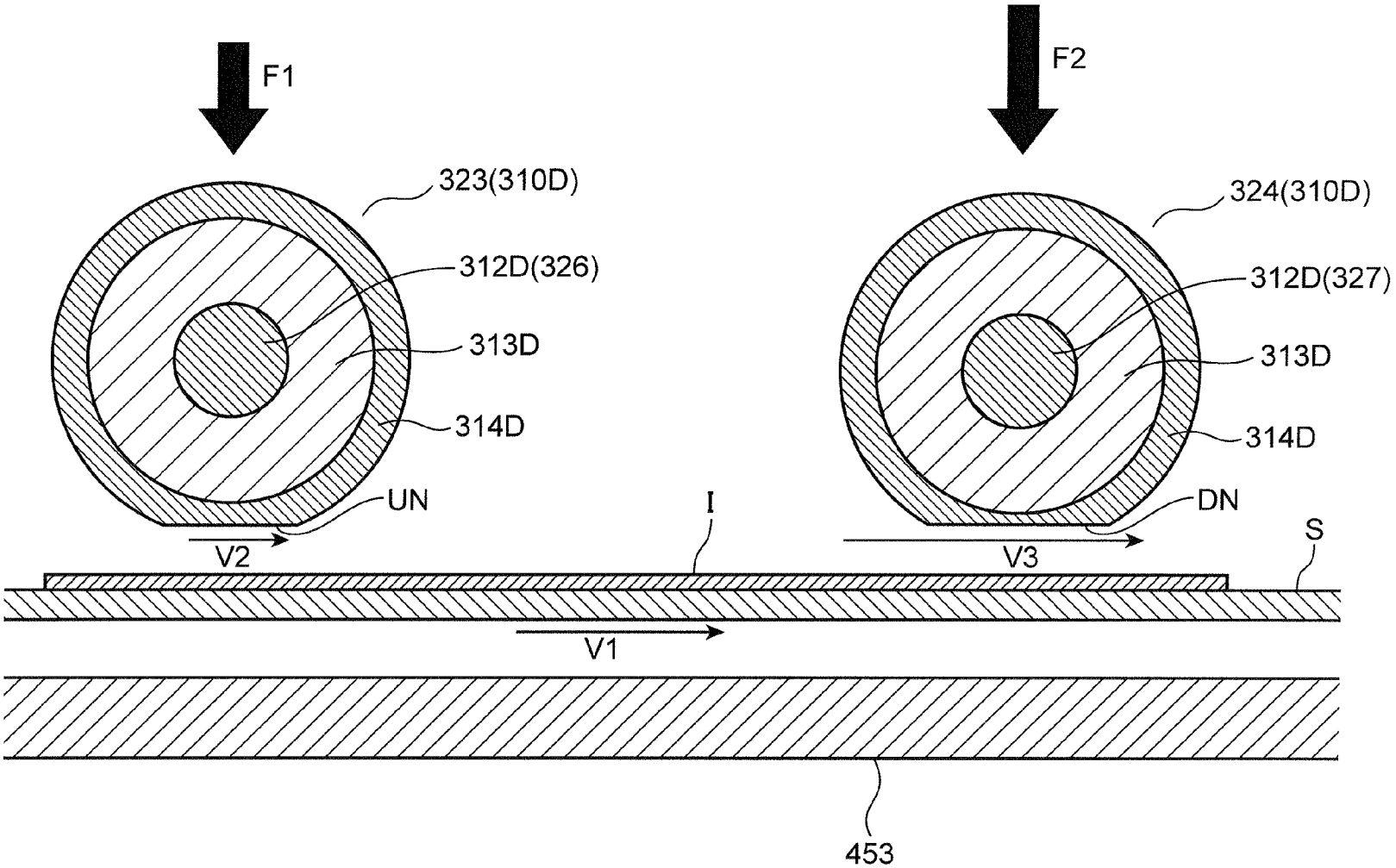
FIG. 25 is a schematic cross-sectional view of the rubbing roller configured to rub the image layer on the sheet conveyed by the conveyor shown in FIG. 20.

FIGS. 24 and 25 show another control method for controlling the rubbing roller 310D by means of the upstream and downstream motors 334, 335 (See FIG. 21). The rubbing roller 310D is further described with reference to FIGS. 21, 24 and 25.

If the movement speed of the upstream nip surface UN/downstream nip surface DN is different from the first speed V1, the upstream nip surface UN/downstream nip surface DN rubs the image layer I. Therefore, as shown in FIG. 24, the upstream motor 334 may rotate the shaft 312D such that the upstream nip surface UN moves in the conveying direction of the sheet S at the second speed V2 greater than the first speed V1. In addition, the downstream motor 335 may rotate the shaft 312D such that the downstream nip surface UN moves in the conveying direction of the sheet S at a third speed V3 greater than the second speed V2. In this case, the third speed V3 may be set at, for example, 303.0 mm/sec, while the second speed V2 is set at 301.5 mm/sec. The difference between the third and first speeds V3, V1 is greater than the difference between the second and first speeds V2, V1. Thus, the image layer I is rubbed in response to a relatively small speed difference in the upstream. The image layer I is rubbed in response to a relatively large speed difference in the downstream. Thus, the image layer I is fixed at a relatively high fixation ratio FR without excessive damages.

As shown in FIG. 25, the upstream motor 334 may rotate the shaft 312D such that the upstream nip surface UN moves in the conveying direction of the sheet S at the second speed V2 lower than the first speed V1. The downstream motor 335 may rotate the shaft 312D such that the downstream nip surface UN moves in the conveying direction of the sheet S at the third speed V3 greater than the second speed V2.

Furthermore, the upstream motor 334 and the downstream motor 335 may rotate the rubbing roller 310D to move the upstream and downstream nip surfaces UN, DN, respectively, in an opposite direction to the conveying direction of the sheet S.

The fixing device 300D according to the fifth embodiment and the conveyor 400 which conveys the sheet S to the fixing device 300D, are preferably incorporated in the color printer 1 described in the context of FIGS. 8 to 10, in place of the fixing device 300 and the conveyor that are described in the context of the first embodiment.

(Sixth Embodiment)

<Fixing Device>

Figure 26:
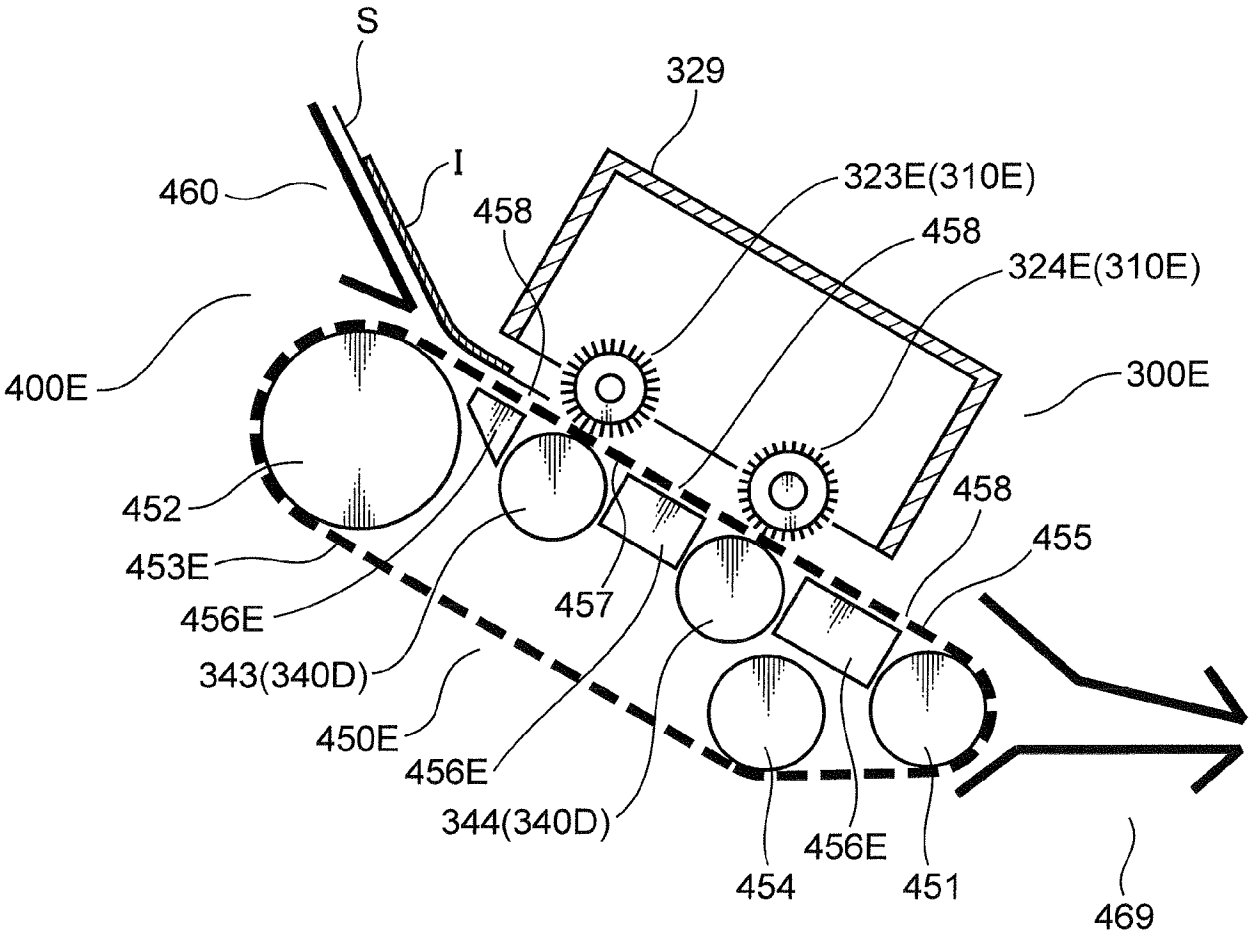
FIG. 26 is a cross-sectional view schematically showing a fixing device and a conveyor according to the sixth embodiment.

FIG. 26 is a schematic view of a fixing device and a conveyor according to the sixth embodiment. Different features from those of the fifth embodiment are described hereinafter. Therefore, some descriptions overlapping with those of the fifth embodiment are omitted. Hereinafter, the same reference numerals are used for describing the same elements as those of the fifth embodiment. The descriptions associated with the fifth embodiment are preferably incorporated into the elements which are not described hereinafter. The fixing device and the conveyor according to the sixth embodiment are described with reference to FIG. 26.

A conveyor 400E configured to convey the sheet S with the image layer I formed thereon has a belt unit 450E, the upstream guider 460 situated before the belt unit 450E, and the downstream guider 469 situated after the belt unit 450E. The sheet S is guided by the upstream guider 460 and sent to the belt unit 450E. Thereafter, the sheet S is sent to the downstream guide 469 by the belt unit 450E.

The belt unit 450E comprises the drive roller 451, the idler 452, an endless belt 453E extending between the drive roller 451 and the idler 452, and the tension roller 454 applying tension to the endless belt 453E. Rotation of the drive roller 451 causes the endless belt 453E to revolve around the drive roller 451, the idler 452 and the tension roller 454. As a result, the sheet. S, which is sent from the upstream guider 460 to the outer surface 455 of the endless belt 453E, moves toward the downstream guider 469 in response to the revolution of the endless belt 453E. In the present embodiment, the belt unit 450E is exemplified as the conveying element. The endless belt 453E is exemplified as the conveying belt.

The belt unit 450E has a vacuum device 456E. Several through-holes 458 are formed on the endless belt 453E. While the sheet S is conveyed by the belt unit 450E, the vacuum device 456E suctions the sheet S on the endless belt 453E through the through-holes 458.

The endless belt 453E includes the inner surface 457 opposite to the outer surface 455 to which the sheet S sticks. The belt unit 450E has the backup roller 340D which abuts the inner surface 457 of the endless belt 453E. The backup roller 340D includes the upstream and downstream backup rollers 343, 344. The downstream backup roller 344 is closer to the downstream guider 469 than the upstream backup roller 343.

The fixing device 300E has a rubbing roller 310E configured to rub the image layer I on the sheet S. The rubbing roller 310E comprises an upstream rubbing roller 323E corresponding to the upstream backup roller 343, and a downstream rubbing roller 324E corresponding to the downstream backup roller 344. The downstream rubbing roller 324E rubs the image layer I after the upstream rubbing roller 323E. In the present embodiment, the rubbing roller 310E is exemplified as the rubbing mechanism. The upstream and downstream rubbing rollers 323E, 324E are exemplified as the upstream and downstream rubbing mechanisms, respectively.

The fixing device 300E comprises the housing 329 configured to partially store the upstream and downstream rubbing rollers 323E, 324E. The housing 329 opens toward the endless belt 453E. The upstream and downstream rubbing rollers 323E, 324E protrude from the opening of the housing 329 to abut the outer surface 455 of the endless belt 453E or the sheet S.

Unlike the fifth embodiment, the upstream and downstream rubbing rollers 323E, 324E are fixedly mounted in the housing 329. Therefore, the upstream and downstream rubbing rollers 323E, 324E may not separate from or approach the endless belt 453E. It should be noted that the upstream and downstream rubbing rollers 323E, 324E are rotated by the same drive mechanism as that of the fifth embodiment.

Figure 27:
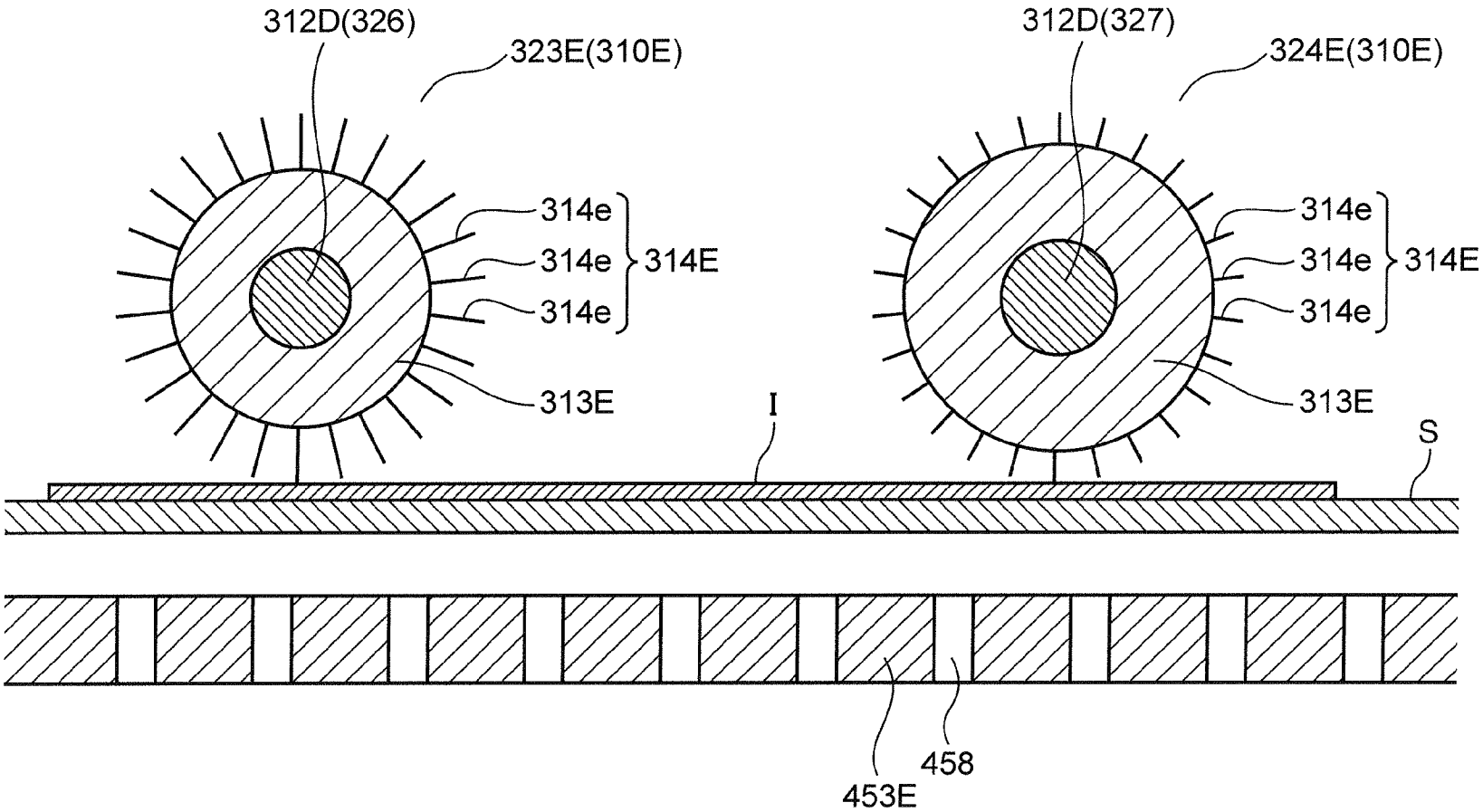
FIG. 27 is a schematic cross-sectional view of a rubbing roller configured to rub an image layer on a sheet conveyed by the conveyor shown in FIG. 26.

FIG. 27 is a schematic cross-sectional view of the upstream and downstream rubbing rollers 323E, 324E which rub the image layer I. The rubbing roller 310E is further described with reference to FIGS. 26 and 27.

The rubbing roller 310E comprises the metallic shaft 312D, a base layer 313E covering the circumferential surface of the shaft 312D, and a brush layer 314E configured by brush 314*e* implanted in the base layer 313E. The brush 314*e* may be formed from rayon (pile fineness: 300D/100F) or polyester (pile fineness 75D/12F). The rubbing roller 310E includes a circumferential surface having the brush 314*e* disposed thereon.

In the present embodiment, the brush 314*e* is mounted on the shaft 312D via the base layer 313E. Alternatively, the brush 314 may be directly glued to the shaft 312D with adhesive.

In the present embodiment, the brush 314*e* of the upstream rubbing roller 323E is the same as the brush 314*e* of the downstream rubbing roller 324E. The brush 314*e* of the upstream rubbing roller 323E significantly projects from the base layer 313E, compared to the brush 314*e* of the downstream rubbing roller 324E. It should be noted that the diameter of the upstream rubbing roller 323E is equal to the diameter of the downstream rubbing roller 324E, and the degree of the projection of the brush 314*e* is adjusted on the basis of the thickness of the base layer 313E.

In the present embodiment, a degree of interference between the image layer I and the brush layer 314E of the upstream rubbing roller 323E is substantially equal to a degree of interference between the image layer I and the brush layer 314E of the downstream rubbing roller 324E. In addition, the upstream rubbing roller 323E is rotated at a rotating speed substantially equal to the downstream rubbing roller 324E.

As described above, the brush 314*e* of the upstream rubbing roller 323E significantly projects from the base layer 313E, compared to the brush 314*e* of the downstream rubbing roller 324E. Therefore, a load applied to the image layer I by the brush 314*e* of the upstream rubbing roller 323E while the rubbing roller 310E is rotated, becomes smaller than a load applied to the image layer I by the brush 314*e* of the downstream rubbing roller 324E. Hence, the image layer I is fixed at a relatively high fixation ratio FR without excessive damages.

It should be noted that there may be differences in bending strength, thickness and other characteristics between the upstream and downstream rubbing rollers 323E, 324E. The load applied to the image layer by the brush 314*e* of the upstream rubbing roller 323E may be smaller than the load applied to the image layer I by the brush 314*e* of the downstream rubbing roller 324E, in response to the differences in characteristics between, the upstream and downstream rubbing rollers 323E, 324E.

The fixing device 300E according to the sixth embodiment and the conveyor 400E which is used for conveying the sheet S to the fixing device 300E, are preferably incorporated in the color printer 1 described in the context of FIGS. 8 to 10, in place of the fixing device 300 and the conveyor which are described in the context of the first embodiment.

(Seventh Embodiment)

<Fixing Device>

Figure 28:
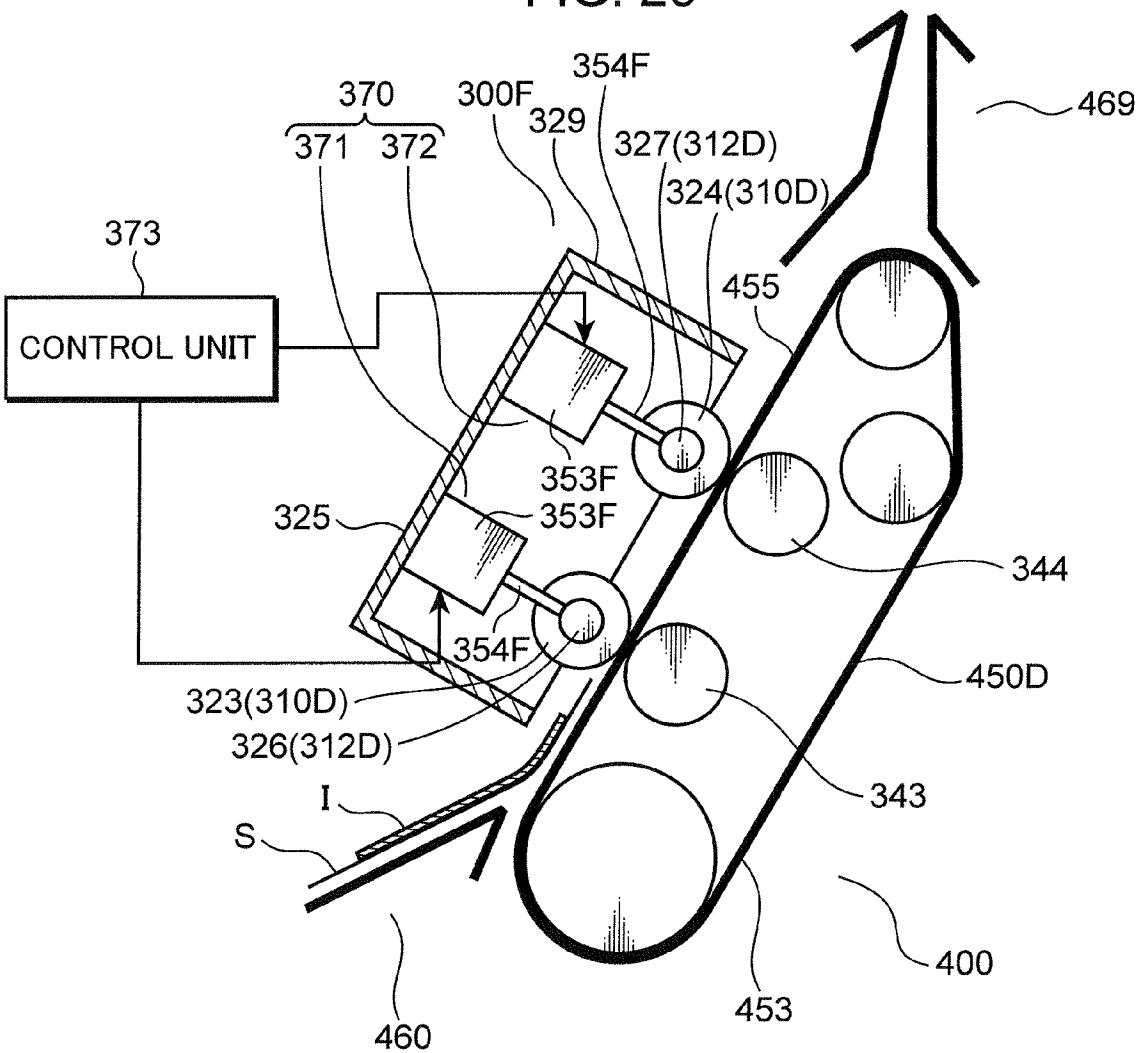
FIG. 28 is a cross-sectional view schematically showing a fixing device and a conveyor according to the seventh embodiment.

FIG. 28 is a schematic view of a fixing device and a conveyor according to the seventh embodiment. Different features from those of the fifth embodiment are described hereinafter. Therefore, some descriptions overlapping with those of the fifth embodiment are omitted. Hereinafter, the same reference numerals are used for describing the same elements as those of the fifth embodiment. The descriptions associated with the fifth embodiment are preferably incorporated into the elements which are not described hereinafter. The fixing device and the conveyor according to the seventh embodiment are described with reference to FIG. 28.

Like the fifth embodiment, the conveyor 400 configured to convey the sheet S having the image layer I thereon comprises the belt unit 450D, the upstream guider 460 situated before the belt unit 450D, and the downstream guider 469 situated after the belt unit 450D. The sheet S is guided by the upstream guider 460 and sent to the belt unit 450D. Thereafter, the sheet S is sent to the downstream guide 469 by the belt unit 450D.

A fixing device 300F comprises the rubbing roller 310D configured to rub the image layer I on the sheet S. The rubbing roller 310D comprises the upstream rubbing roller 323 corresponding to the upstream backup roller 343, and the downstream rubbing roller 324 corresponding to the downstream backup roller 344. The downstream rubbing roller 324 rubs the image layer I after the upstream rubbing roller 323.

The fixing device 300F comprises the housing 329 configured to partially store the upstream and downstream rubbing rollers 323, 324. The housing 329 opens toward the endless belt 453. The upstream and downstream rubbing rollers 323, 324 protrude from the opening of the housing 329 to abut the outer surface 455 of the endless belt 453 or the sheet S.

The fixing device 300F comprises a cylinder mechanism 370. The cylinder mechanism 370 causes the rubbing roller 310D to separate from or approach the image layer I of the sheet S on the endless belt 453. In the present embodiment, the cylinder mechanism 370 is exemplified as a separating/approaching mechanism. Alternatively, the separating/approaching mechanism may have another structure configured to cause the rubbing roller 310D to separate from or approach the endless belt 453. For instance, the rubbing roller 310D may separate from or approach the endless belt 453 by means of a lever arm.

The cylinder mechanism 370 includes an upstream cylinder device 371 configured to cause the upstream rubbing roller 323 to separate from or approach the image layer I of the sheet S on the endless belt 453, and a downstream cylinder device 372 configured to cause the downstream rubbing roller 324 to separate from or approach the image layer I of the sheet S on the endless belt 453.

The cylinder mechanism 370 includes a shell 353F configured to receive working fluid, and a rod 354F stored the shell 353F. The shell 353F is mounted on the top plate 325 of the housing 329. The rod 354F of the upstream cylinder device 371 is mounted on the shaft 326 of the upstream rubbing roller 323. The rod 354F of the downstream cylinder device 372 is mounted on the shaft 327 of the downstream rubbing roller 324.

The fixing device 300F comprises a controller 373 configured to control the cylinder mechanism 370. The controller 373 controls flow of the working fluid to the shell 353F. If the working fluid flows to the shell 353F under the control of the controller 373, the rod 354F extends from the shell 353F and pushes the rubbing roller 310D against the image layer I. If the working fluid flows out from the shell 353F, the rod 354F retracts in the shell 353F, so that the rubbing roller 310D separates from the image layer I.

The controller 373 controls the upstream and downstream cylinder devices 371, 372 independently. Therefore, the controller 373 may push one of the upstream and downstream rubbing rollers 323, 324 against the image layer I, and separate the other one from the image layer I. Alternatively, the controller 373 may push both the upstream and downstream rubbing rollers 323, 324 against the image layer I. The controller 373 may separate both the upstream and downstream rubbing rollers 323, 324 from the image layer I, as appropriate. For example, unless the sheet S is conveyed, the controller 373 may separate the upstream and downstream rubbing rollers 323, 324 from the image layer I.

The rubbing roller 310D may separate from or approach the image layer I in response to passage of the sheet S. Alternatively, the rubbing roller 310D may determine to separate from or approach the image layer I depending on types of liquid developer or the sheet S, which is used for forming the image layer I. For instance, if an image layer I formed by means of liquid developer is likely to be damaged, position of the upstream and/or downstream rubbing rollers 323, 324 may be controlled such that a degree of interference between the upstream rubbing roller 323 and the endless belt 453 becomes smaller than a degree of interference between the downstream rubbing roller 324 and the endless belt 453.

The fixing device 300F according to the seventh embodiment and the conveyor 400 which is used for conveying the sheet S to the fixing device 300F, are preferably incorporated in the color printer 1 described in the context of FIGS. 8 to 10, in place of the fixing device 300 and the conveyor which are described in the context of the first embodiment.

(Eighth Embodiment)

<Fixing Device>

Figure 29:
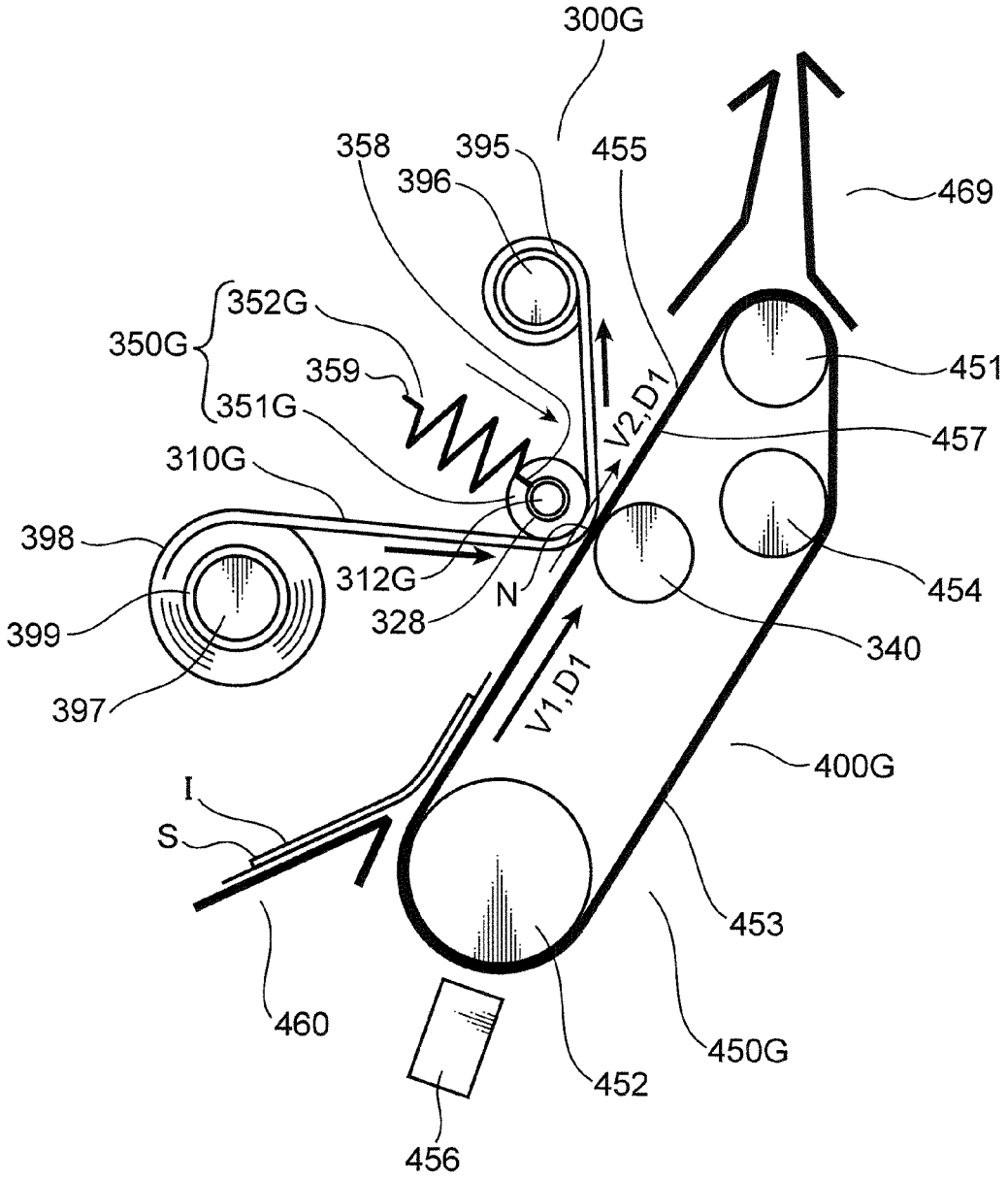
FIG. 29 is a schematic view of a fixing device and a conveyor according to the eighth embodiment.

FIG. 29 is a schematic view of a fixing device and a conveyor according to the eighth embodiment. The fixing device and the conveyor according to the eighth embodiment are described with reference to FIG. 29. Hereinafter, the same reference numerals are used for describing the same elements as those of the aforementioned embodiments. The descriptions associated with the aforementioned embodiments are preferably incorporated into the elements which are not described hereinafter.

A conveyor 400G configured to convey the sheet S having the image layer I formed thereon comprises a belt unit 450G, the upstream guider 460 situated before the belt unit 450G, and the downstream guider 469 situated after the belt unit 450G. The sheet S is guided by the upstream guider 460 and sent to the belt unit 450G. Thereafter, the sheet S is sent to the downstream guide 469 by the belt unit 450G.

The belt unit 450G comprises the drive roller 451, the idler 452, the endless belt 453 extending between the drive roller 451 and the idler 452, and the tension roller 454 applying tension to the endless belt 453. Rotation of the drive roller 451 causes the endless belt 453 to revolve around the drive roller 451, the idler 452 and the tension roller 454. The idler 452 and the tension roller 454 rotate in response to the revolution of the endless belt 453. As a result, the sheet S, which is sent from the upstream guider 460 to the outer surface 455 of the endless belt 453, moves toward the downstream guider 469 in response to the revolution of the endless belt 453. The sheet S is conveyed from the upstream guider 460 to the downstream guider 469 at the first speed V1. In the present embodiment, the direction from the upstream guider 460 to the downstream guider 469 is referred to as "first direction D1". The belt unit 450G is exemplified as the conveying element. The endless belt 453 is exemplified as the conveying belt.

The belt unit 450G further comprises the charger 456 configured to charge the outer surface 455 of the endless belt 453. The outer surface 455 of the endless belt 453, which is charged by the charger 456, causes the sheet S to electrostatically stick thereto. Therefore, the sheet S is stably conveyed by the endless belt 453. In the present embodiment, the endless belt 453 is preferably formed from resin such as PVDF.

The endless belt 453 includes the inner surface 457 opposite to the outer surface 455 to which the sheet S sticks. The belt unit 450G comprises the backup roller 340 which abuts the inner surface 457 of the endless belt 453.

The fixing device 300G comprises a rubbing band 310G configured to rub the image layer I on the sheet S. The rubbing band 310G is prepared as a nonwoven fabric roll 398 wrapped around a substantially cylindrical core 399. The rubbing band 310G may be a nonwoven fabric band which is formed by using, for example, any of the nonwoven fabrics described in the context of FIG. 4. In the present embodiment, the rubbing band 310G is exemplified as the rubbing belt.

The fixing device 300G has an unwinding spindle 397 installed with the nonwoven fabric roll 398. The unwinding spindle 397 is inserted into the core 399. The unwinding spindle 397 preferably includes a chuck mechanism (not shown) configured to hold the core 399. The chuck mechanism stably holds the nonwoven fabric roll 398 on the unwinding spindle 397. The rubbing band 310G is unwound from the nonwoven fabric roll 398 on the reel spindle 397. The unwinding spindle 397 rotates and unwinds the rubbing band 310G from the nonwoven fabric roll 398. In the present embodiment, the unwinding spindle 397 is exemplified as the unwinder.

The fixing device 300G has a winding spindle 396 configured to rotate in cooperation with the unwinding spindle 397. The winding spindle 396 is inserted into a substantially cylindrical core 395. Like the unwinding spindle 397, the winding spindle 396 comprises a chuck mechanism (not shown) configured to hold the core 395. An end of the rubbing band 310G, which is unwound by the unwinding spindle 397, is connected to the outer circumferential surface of the core 395. The rubbing band 310G is wrapped around the core 395 as the winding spindle 396 rotates. Thus, the winding spindle 396 may wind the rubbing band 310G. In the present embodiment, the winding spindle 396 is exemplified as the winder.

The fixing device 300G has a press mechanism 350G configured to press the rubbing band 310G to the image layer I on the sheet S, the rubbing band 310G extending between the unwinding and winding spindles 397, 396. The press mechanism 350G comprises a press roller 351G provided in correspondence with the backup roller 340, and a coil spring 352G configured to bias the press roller 351G toward the rubbing band 310G. In the present embodiment; the press mechanism 350G is exemplified as the first press mechanism.

The rubbing band 310G, which is unwound by the unwinding spindle 397, passes between the press roller 351G and the endless belt 453, and is then wrapped around the winding spindle 396. The coil spring 352G configured to bias the press roller 351G toward the endless belt 453 forms a nip portion N between the rubbing band 310G and the endless belt 453 to hold the sheet S therebetween. When the sheet S passes through the nip portion N, the press roller 351G presses the rubbing band 310G to the image layer I. The coil spring 352G further biases the press roller 351G toward the image layer I. In the present embodiment, the press roller 351G is exemplified as the press piece. The coil spring 352G is exemplified as the biasing element.

The press roller 351G comprises a rotating shaft 312G and a bearing 328 configured to hold the rotating shaft 312G. In the present embodiment, the press roller 351G rotates around the rotating shaft 312G as the rubbing band 310G moves from the unwinding spindle 397 to the winding spindle 396. Alternatively, a rod or other elements with a surface on which the rubbing band 310G slides during the movement from the unwinding spindle 397 to the winding spindle 396 may be used as the press piece.

In the present embodiment, the coil spring 352G connected to the bearing 328 is used as the biasing element. Alternatively, a cylinder device or other biasing mechanisms configured to bias the press piece toward the image layer I may be used as the biasing element.

In the present embodiment, the winding spindle 396 winds the rubbing band 310G while the endless belt 453 conveys the sheet S. The rubbing band 310G held between the press roller 351G and the endless belt 453 moves in the first direction D1 at the second speed V2 lower than the first speed V1 while the winding spindle 396 rotates. The difference between the conveying speed of the sheet S (the first speed V1) and the winding speed of the winding spindle 396 (the second speed V2) causes rubbing between the image layer I and the rubbing band 310G. In the present embodiment, therefore, the winding spindle 396, the unwinding spindle 397 and the press mechanism 350G are exemplified as the sliding mechanisms.

The fixing device 300G according to the eighth embodiment and the conveyor 400G which is used for conveying the sheet S to the fixing device 300G, are preferably incorporated in the color printer 1 described in the context of FIGS. 8 to 10, in place of the fixing device 300 and the conveyor which are described in the context of the first embodiment.

(Ninth Embodiment)

<Fixing Device>

A fixing device according to the ninth embodiment is different from the fixing device 300G according to the eighth embodiment, in terms of a separator configured to separate the press roller 351G from the endless belt. The separator is described hereinafter. Some descriptions overlapping with those of the eighth embodiment are omitted for clarification. Hereinafter, the same reference numerals are used for describing the same elements as those of the eighth embodiment. The descriptions associated with the eighth embodiment are preferably incorporated into the elements which are not described hereinafter.

Figure 30A:
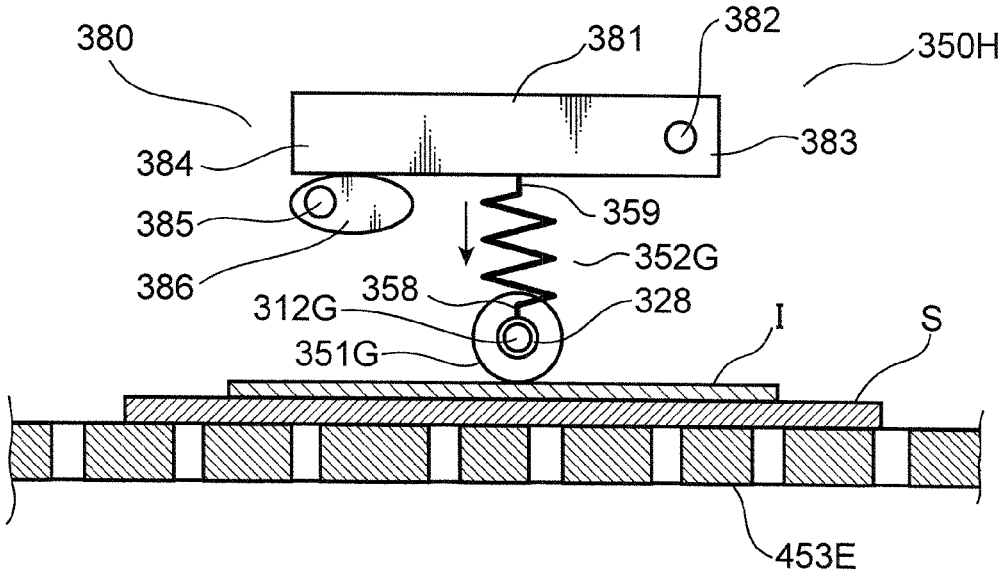
FIG. 30A is a schematic view of a separator and a conveyor which are used in a fixing device according to the ninth embodiment.
Figure 30B:
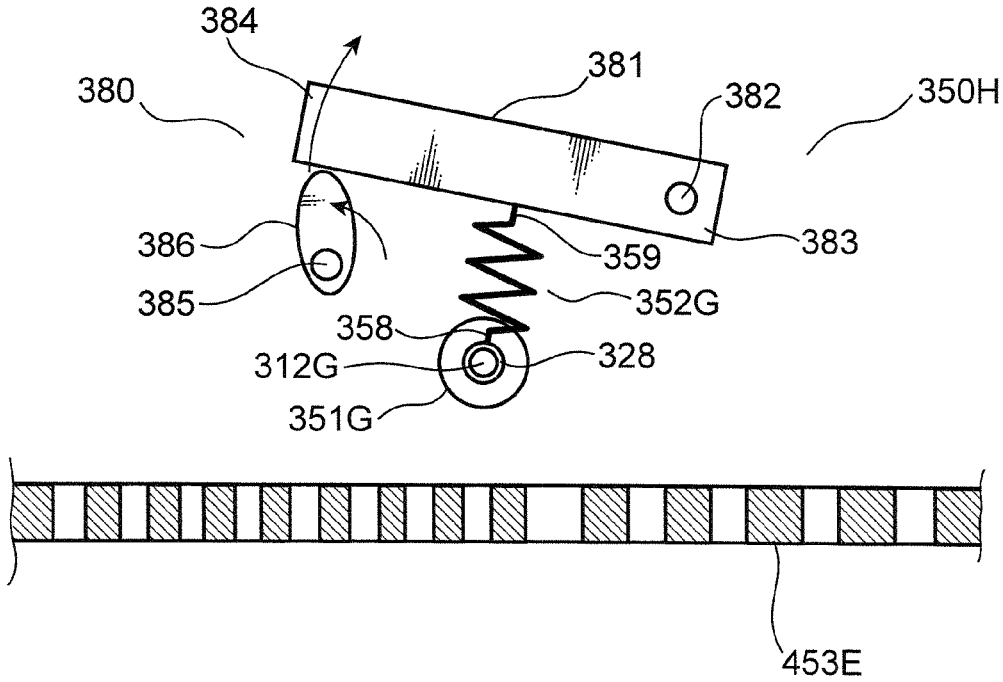
FIG. 30B is a schematic view of the separator and the conveyor which are used in the fixing device according to the ninth embodiment.

FIGS. 30A and 30B are schematic views of a separator configured to separate the press roller 351G from the endless belt. FIG. 30A shows the press roller 351G situated in a proximal position near the endless belt. FIG. 30B shows the press roller 351G situated in a separation position away from the endless belt. It should be noted that neither FIGS. 30A nor 30B shows the rubbing band in order to clarify the separator. The separator is described with reference to FIGS. 30A and 30B.

A press mechanism 350H has a separator 380 configured to separate the press roller 351G from the endless belt 453E. The aforementioned coil spring 352G includes a first end 358 connected to the bearing 328 which holds the rotating shaft 312G of the press roller 351G, and a second end 359 opposite to the first end 358. The separator 380 has a rod arm 381 connected to the second end 359. In the present embodiment, the press mechanism 350H is exemplified as the first press mechanism.

The separator 380 comprises a turning shaft 382 configured to support the rotatable arm 381. The arm 381 includes a base end 383 connected to the turning shaft 382, and a tip end 384 opposite to the base end 383. The base end 383 of the arm 381 is mounted on the turning shaft 382 via, for example, a twisted coil spring (not shown). The twisted coil spring biases the arm 381 downward. As a result, while the press roller 351G is present in the proximal position, the coil spring 352G is compressed to bias the press roller 351G toward the image layer I on the sheet S.

The separator 380 comprises a rotating shaft 385 and an eccentric cam piece 386 integrally mounted on the rotating shaft 385. The rotating shaft 385 is rotated by, for example, a solenoid switch (not shown) or other appropriate actuators. As a result, the eccentric cam piece 386 eccentrically rotates around the rotating shaft 385 to push the tip end 384 of the arm 381 upward. As a result, the press roller 351G is moved to the separation position.

Figure 31B:
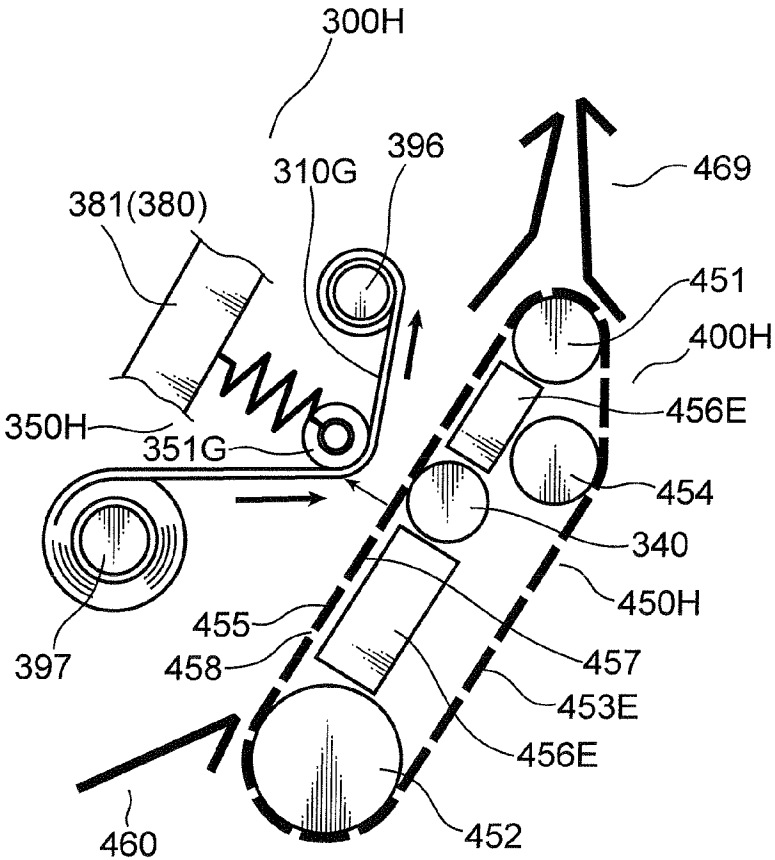
FIG. 31B is a schematic view of the operations performed by the fixing device shown in FIGS. 30A and 30B.
Figure 31A:
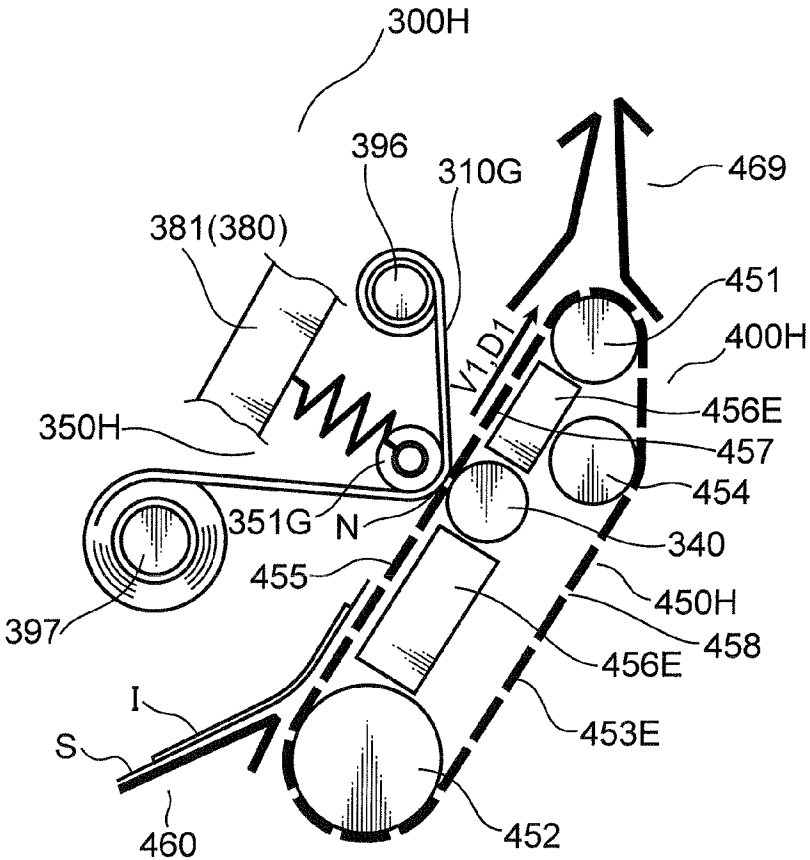
FIG. 31A is a schematic view of operations performed by the fixing device shown in FIGS. 30A and 30B.

FIGS. 31A and 31B are schematic views of the fixing device and the conveyor according to the ninth embodiment. FIG. 31A shows the fixing device and the conveyor during a conveying time period in which the conveyor conveys the sheet S. FIG. 31B shows the fixing device and the conveyor during a suspension time period in which the conveyor does not convey the sheet S. The fixing device and the conveyor according to the ninth embodiment are described with reference to FIGS. 30A to 31B.

A conveyor 400H configured to convey the sheet S having the image layer I formed thereon comprises a belt unit 450H, the upstream guider 460 situated before the belt unit 450H, and the downstream guider 469 situated after the belt unit 450H. Like the eighth embodiment, during the conveying time period, the sheet S is guided by the upstream guider 460 and sent to the belt unit 450H. Thereafter, the sheet S is sent to the downstream guide 469 by the belt unit 450H. On the other hand, during the suspension time period, the belt unit 450H is stopped, and hence the sheet S is not sent to the conveyor 400H.

The belt unit 450H comprises the drive roller 451, the idler 452, the endless belt 453E extending between the drive roller 451 and the idler 452, and the tension roller 454 applying tension to the endless belt 453E. Rotation of the drive roller 451 causes the endless belt 453E to revolve around the drive roller 451, the idler 452 and the tension roller 454. The idler 452 and the tension roller 454 are rotated as the endless belt 453E revolves. During the conveying time period, the sheet S, which is sent from the upstream guider 460 to the outer surface 455 of the endless belt 453E, moves toward the downstream guider 469 in response to the revolution of the endless belt 453E. The sheet S is conveyed from the upstream guider 460 to the downstream guider 469 at the first speed V1. In the present embodiment, the direction from the upstream guider 460 to the downstream guider 469 is referred to as "first direction D1". The belt unit 450H is exemplified as the conveying element. The endless belt 453E is exemplified as the conveying belt.

The belt unit 450H comprises the vacuum device 456E which is disposed along the inner surface 457 opposite to the outer surface 455 of the endless belt 453E configured to convey the sheet S, and the backup roller 340. Several through-holes 458 are formed on the endless belt 453E. During the conveying time period, the vacuum device 456E suctions the sheet S through the through-holes 458. As a result, the sheet S, which is conveyed by the traveling motion of the endless belt 453E, sticks to the outer surface 455 of the endless belt 453E.

Like the eighth embodiment, a fixing device 300H comprises the rubbing band 310G, the unwinding spindle 397, and the winding spindle 396. The fixing device 300H also comprises the press mechanism 350H described in the context of FIGS. 30A and 30B. The arm 381 is partially shown as the separator 380 of the press mechanism 350H.

The winding and unwinding spindles 396, 397 are stopped during the conveying time period. The separator 380 keeps the press roller 351G at the proximal position. Therefore, the rubbing band 310G and the endless belt 453E are held between the backup roller 340 and the press roller 351G. The sheet S conveyed by the belt unit 450H passes through the nip portion N between the rubbing band 310G and the endless belt 453E. Meanwhile, the image layer I on the sheet S is rubbed by the rubbing band 310G.

If the belt unit 450H is stopped thereafter, the separator 380 moves the press roller 351G to the separation position, as described in the context of FIGS. 30A and 30B. Meanwhile, the winding spindle 396 winds the rubbing band 310G which sags as a result of the movement of the press roller 351G to the separation position.

If the belt unit 450H is activated again, the separator 380 moves the press roller 351G to the proximal position. Meanwhile, the unwinding spindle 397 unwinds the rubbing band 310G such that the tension added to the rubbing band 310G becomes constant. Accordingly, when the belt unit 450H is newly activated, a new section of the rubbing band 310G rubs the image layer I. As a result, excessive abrasion or contamination of the rubbing band 310G (e.g., contamination caused by paper dust, oil component, dust and alike on the sheet S). In addition, stopping the rubbing band 310G during the conveying time period reduces frequency of replacing the rubbing band 310G.

Figure 32B:
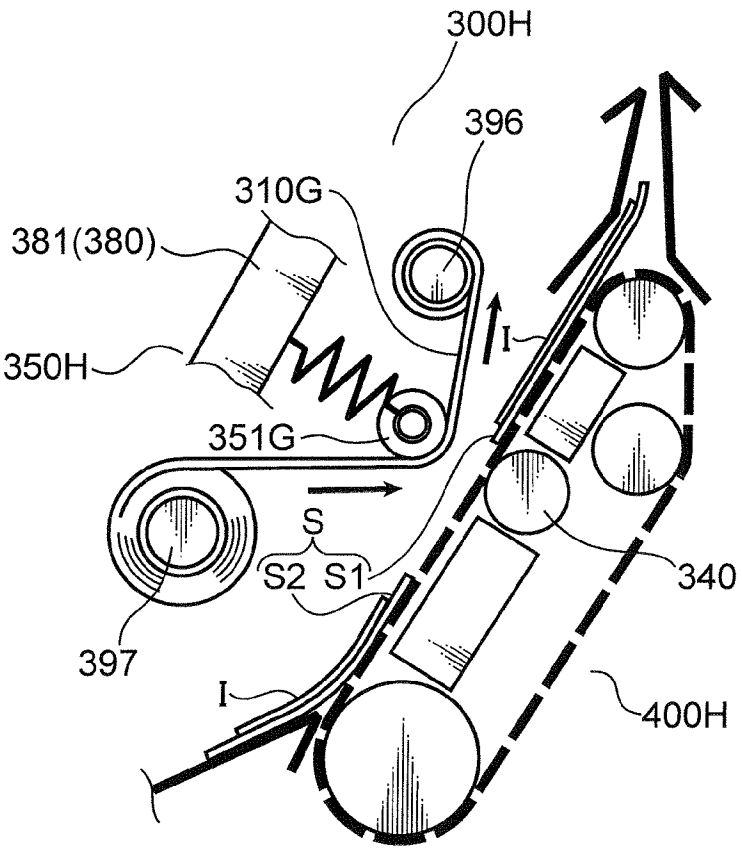
FIG. 32B is a schematic view of other operations performed by the fixing device shown in FIGS. 30A and 30B.
Figure 32A:
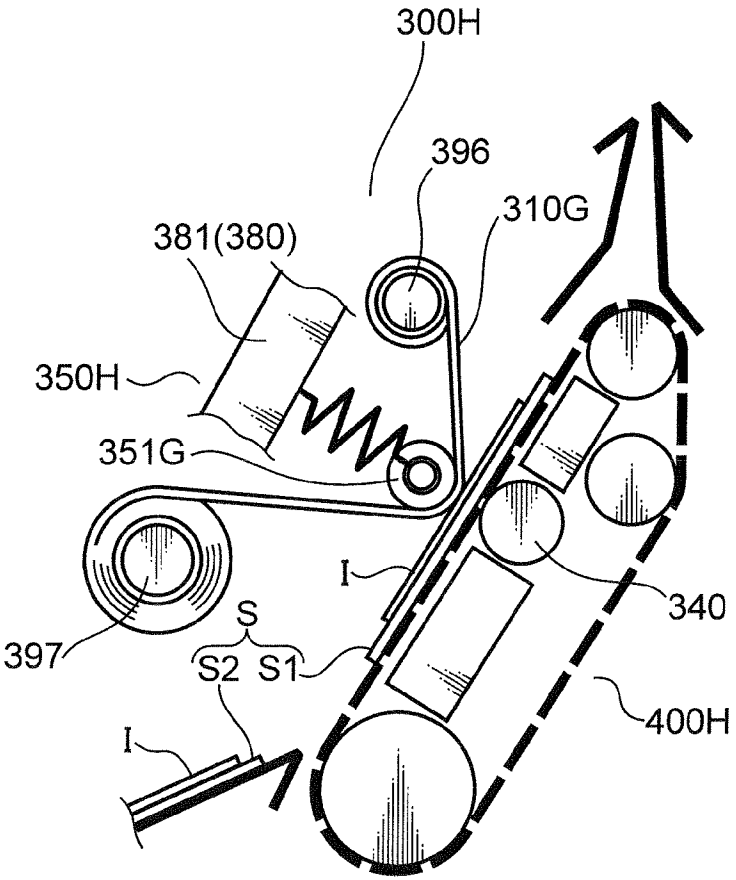
FIG. 32A is a schematic view of other operations performed by the fixing device shown in FIGS. 30A and 30B.

FIGS. 32A and 32B show other operations performed by the fixing device 300H. FIG. 32A shows the press roller 351G at the proximal position. FIG. 32B shows the press roller 351G at the separation position. Other operations performed by the fixing device 300H are described with reference to FIGS. 30A, 30B, 32A and 32B. It should be noted that FIGS. 32A and 32B partially show the arm 381 as the separator 380 of the press mechanism 350H.

The conveyor 400H conveys sheets S sequentially. FIGS. 32A and 32B show a sheet S1 and a sheet S2 conveyed after the sheet S1. In the present embodiment, the sheet S1 is exemplified as the preceding sheet. The sheet S2 is exemplified as the subsequent sheet.

As shown in FIG. 32A, when the sheet S1 starts passing between the press and backup rollers 351G, 340, the separator 380 moves the press roller 351G to the proximal position.

The separator 380 then keeps the press roller 351G to the proximal position while the sheet S1 passes between the press and backup rollers 351G, 340. Meanwhile, the rubbing band 310G rubs the image layer I on the sheet S1. It should be noted that the winding and unwinding spindles 396, 397 are stopped while the press roller 351G exists in the proximal position.

As shown in FIG. 32B, after the sheet S1 passes between the press and backup rollers 351G, 340, the separator 380 moves the press roller 351G to the separation position. Meanwhile, the winding spindle 396 winds the rubbing band 310G which sags as a result of the movement of the press roller 351G to the separation position.

Thereafter, the separator 380 keeps the press roller 351G in the separation position until the sheet S2 starts passing between the press and backup rollers 351G, 340. When the sheet S starts passing between the press and backup rollers 351G, 340, the separator 380 moves the press roller 351G to the proximal position again. While the press roller 351G is moved to the proximal position, the unwinding spindle 397 unwinds the rubbing band 310G such that the tension applied to the rubbing band 310G becomes constant.

In the present embodiment, whenever the press roller 351G separates from or approaches the endless belt 453E, the rubbing band 310G is wound by the winding spindle 396 and unwound by the unwinding spindle 397. Alternatively, whenever a given number of the sheets S pass between the press and backup rollers 351G, 340, the rubbing band 310G may be wound by the winding spindle 396 and unwound by the unwinding spindle 310G. For instance, the rubbing band 310G is wound by the winding spindle 396 and unwound by the unwinding spindle 397, whenever 40 to 50 sheets S pass between the press and backup rollers 351G, 340, which result in less replacing frequency of the rubbing band 310G.

The fixing device 300H according to the ninth embodiment and the conveyor 400H which is used for conveying the sheets S to the fixing device 300H, are preferably incorporated in the color printer 1 described in the context of FIGS. 8 to 10, in place of the fixing device 300 and the conveyor which are described in the context of the first embodiment.

(Tenth Embodiment)

<Fixing Device>

A fixing device according to the tenth embodiment is different from the fixing device 300G according to the eighth embodiment, in terms of arrangement of the winding and unwinding spindles. The differences from the eighth embodiment are described hereinafter. Some descriptions overlapping with those of the eighth embodiment are omitted for clarification. Hereinafter, the same reference numerals are used for describing the same elements as those of the eighth embodiment. The descriptions associated with the eighth embodiment are preferably incorporated into the elements which are not described hereinafter.

Figure 33:
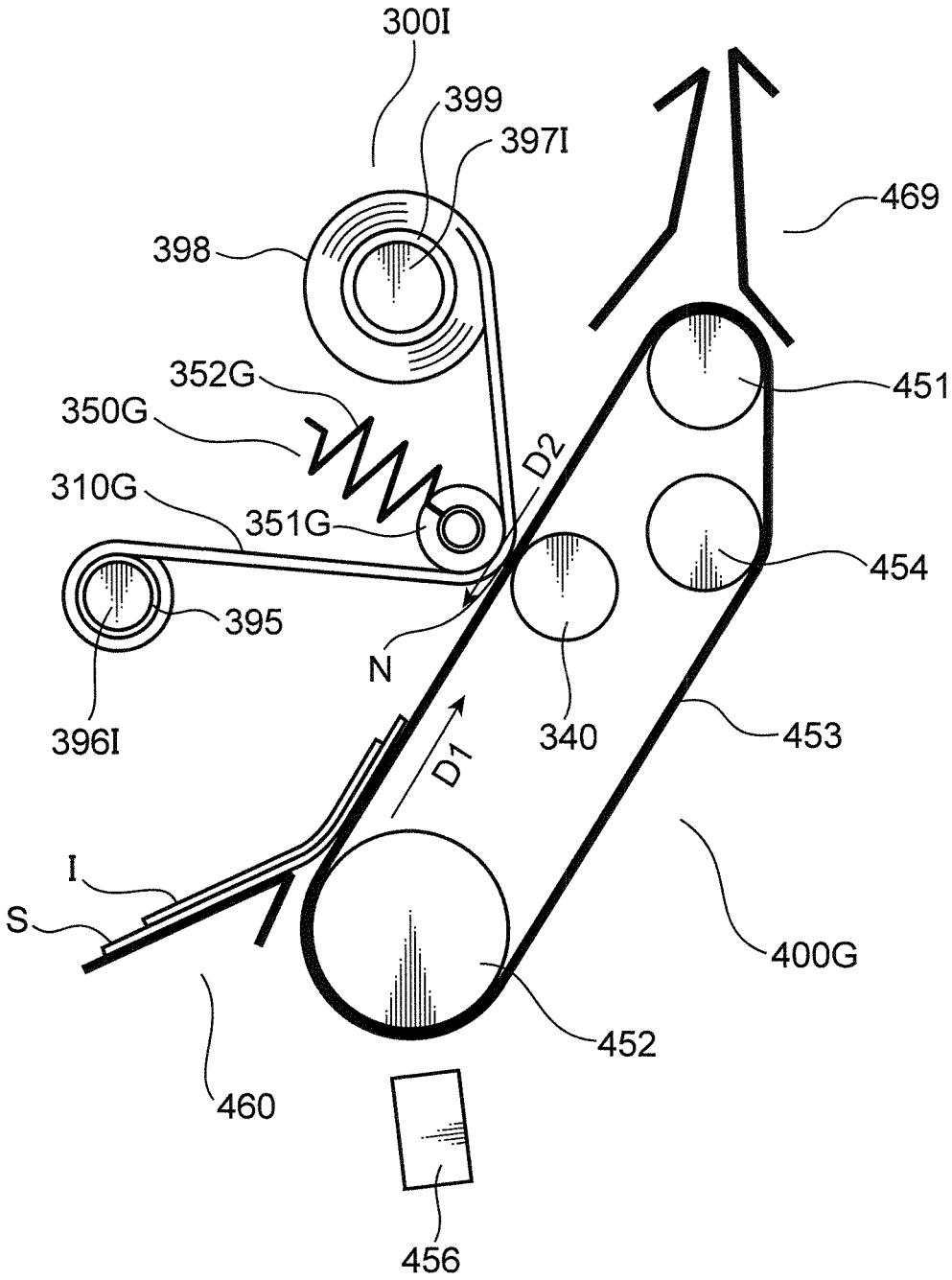
FIG. 33 is a schematic view of a conveyor and a fixing device according to the tenth embodiment.

FIG. 33 is a schematic view of a fixing device and a conveyor according to the tenth embodiment. The fixing device and the conveyor according to the tenth embodiment are described with reference to FIG. 33.

FIG. 33 shows the same conveyor 400G as that of the eighth embodiment. A fixing device 300I according to the present embodiment is adjacent to the conveyor 400G, like the eighth embodiment.

The fixing device 300I comprises an unwinding spindle 397I and a winding spindle 396I, in addition to the rubbing band 310G and the press mechanism 350G of the eighth embodiment. Unlike the eighth embodiment, the unwinding spindle 397I is disposed near the downstream guider 469 of the conveyor 400G. The winding spindle 3961 is disposed near the upstream guider 460 of the conveyor 400G.

Like the eighth embodiment, the unwinding spindle 397I is inserted into the core 399 of the nonwoven fabric roll 398. The unwinding spindle 397I preferably comprises a chuck mechanism (not shown) configured to hold the core 399. The chuck mechanism stably holds the nonwoven fabric roll 398 on the unwinding spindle 397I. The rubbing band 310G is unwound from the nonwoven fabric roll 398 on the unwinding spindle 397I. The unwinding spindle 397I rotates and unwinds the rubbing band 310G from the nonwoven fabric roll 398. In the present embodiment, the unwinding spindle 397I is exemplified as the unwinder.

The winding spindle 396I rotates in cooperation with the unwinding spindle 397I. The winding spindle 396I is inserted into the substantially cylindrical core 395. Like the unwinding spindle 397I, the winding spindle 396I comprises a chuck mechanism (not shown) configured to hold the core 395. An end of the rubbing band 310G which is unwound by the unwinding spindle 397I is connected to the outer circumferential surface of the core 395. The rubbing band 310G is wrapped around the core 395 as the winding spindle 396I rotates. Thus, the winding spindle 396I may wind the rubbing band 310G. In the present embodiment, the winding spindle 396I is exemplified as the winder.

The rubbing band 310G, which is unwound by the unwinding spindle 397I, passes between the press roller 351G and the endless belt 453, and is then wrapped around the winding spindle 396I. The coil spring 352G configured to bias the press roller 351G toward the endless belt 453 forms a nip portion N between the rubbing band 310G and the endless belt 453 to hold the sheet S therebetween. When the sheet S passes through the nip portion N, the press roller 351G presses the rubbing band 310G to the image layer I. The coil spring 352G biases the press roller 351G toward the image layer I.

In the present embodiment, the winding spindle 396I winds the rubbing band 310G, while the endless belt 453 conveys the sheet S. The rubbing band 310G held between the press roller 351G and the endless belt 453 moves in the second direction D2, while the winding spindle 396I rotates. The difference between the conveying direction of the sheet S (the first direction D1) and the winding direction of the winding spindle 396I (the second direction D2) causes rubbing between the image layer I and the rubbing band 310G. In the present embodiment, therefore, the winding spindle 396I, the unwinding spindle 397I and the press mechanism 350G are exemplified as the sliding mechanism.

The fixing device 300I according to the tenth embodiment and the conveyor 400G which is used for conveying the sheet S to the fixing device 300I, are preferably incorporated in the color printer 1 described in the context of FIGS. 8 to 10, in place of the fixing device 300 and the conveyor which are described in the context of the first embodiment.

(Eleventh Embodiment

<Fixing Device>

Figure 34:
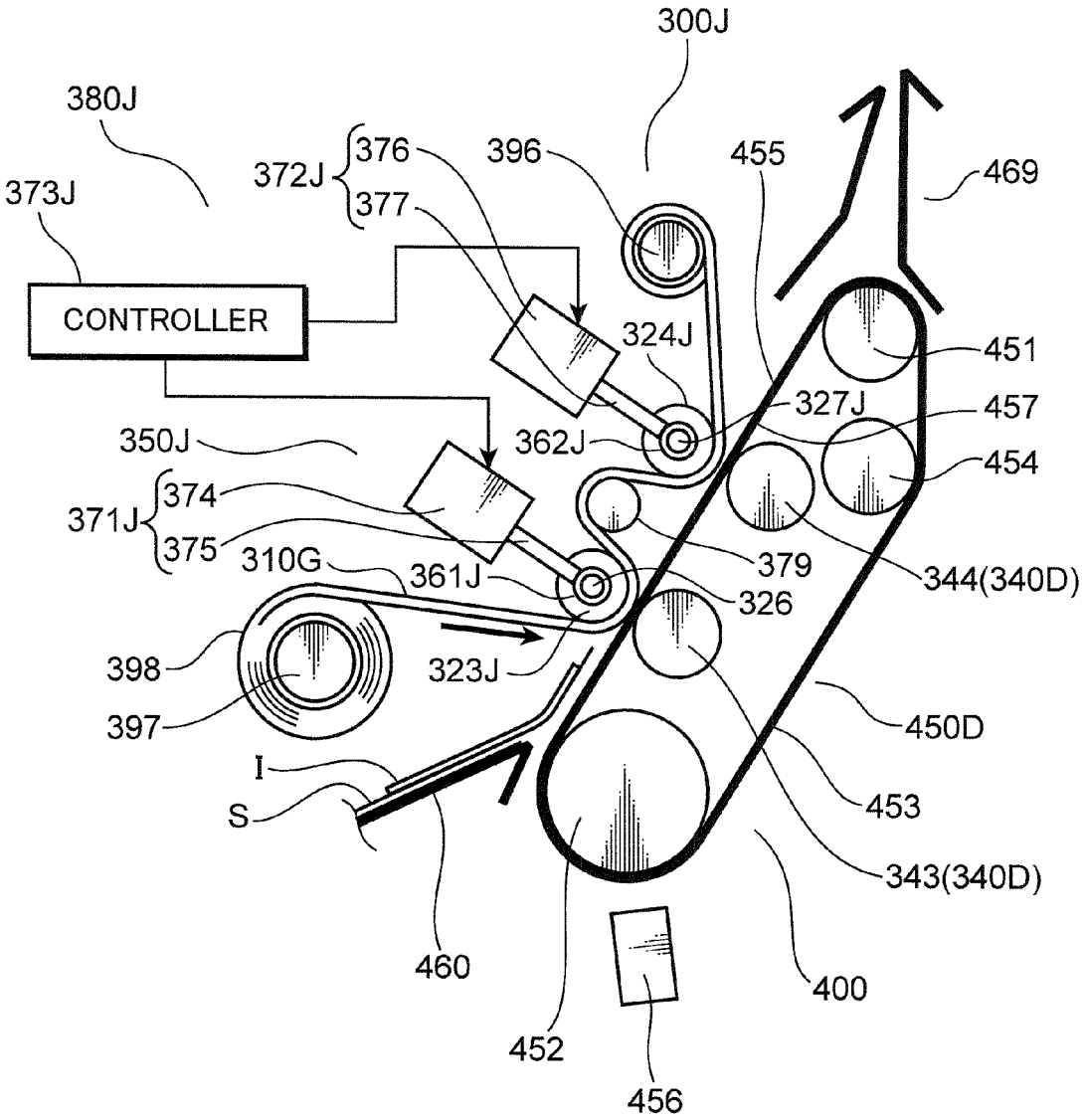
FIG. 34 is a schematic view of a separator and a conveyor which are used in a fixing device according to the eleventh embodiment.

FIG. 34 is a schematic view of a fixing device and a conveyor according to the eleventh embodiment. Hereinafter, Differences from the eighth embodiment are described with reference to FIG. 34. It should be noted that some descriptions overlapping with those of the eighth embodiment are omitted for clarification. Hereinafter, the same reference numerals are used for describing the same elements as those of the eighth embodiment. The descriptions associated with the eighth embodiment are preferably incorporated into the elements which are not described hereinafter.

The conveyor 400 configured to convey the sheet S having the image layer I thereon comprises the belt unit 450D, the upstream guider 460 situated before the belt unit 450D, and the downstream guider 469 situated after the belt unit 450D. The sheet S is guided by the upstream guider 460 and sent to the belt unit 450D. Thereafter, the sheet S is sent to the downstream guide 469 by the belt unit 450D.

The belt unit 450D comprises the drive roller 451, the idler 452, the endless belt 453 extending between the drive roller 451 and the idler 452, and the tension roller 454 applying tension to the endless belt 453. Rotation of the drive roller 451 causes the endless belt 453 to revolve around the drive roller 451, the idler 452 and the tension roller 454. As a result, the sheet S, which is sent from the upstream guider 460 to the outer surface 455 of the endless belt 453, moves toward the downstream guider 469 in response to the revolution of the endless belt 453.

The belt unit 450D comprises the charger 456 configured to charge the outer surface 455 of the endless belt 453, like the eighth embodiment. The outer surface 455 of the endless belt 453, which is charged by the charger 456, causes the sheet S to electrostatically stick thereto.

The endless belt 453 includes the inner surface 457 opposite to the outer surface 455 to which the sheet S sticks. The belt unit 450D comprises the backup roller 340D which abuts the inner surface 457 of the endless belt 453. In the present embodiment, the backup roller 340D includes the upstream backup roller 343 disposed near the upstream guider 460, and the downstream backup roller 344 disposed near the downstream guider 469.

A fixing device 300J comprises, like the eighth embodiment, the rubbing band 310G configured to rub the image layer I on the sheet S, the unwinding spindle 397 configured to unwind the rubbing band 310G from the nonwoven fabric roll 398, and the winding spindle 396 configured to wind the rubbing band 310G, which is unwound by the unwinding spindle 397. The fixing device 300J comprises a press mechanism 350J configured to press the rubbing band 310G to the image layer I. In the present embodiment, the press mechanism 350J is exemplified as the first press mechanism.

The press mechanism 350J includes an intermediate roller 379 situated between the unwinding and winding spindles 397, 396. The intermediate roller 379 defines a travel path of the rubbing band 310G so that the rubbing band 310G separates from the endless belt 453. In the present embodiment, the intermediate roller 379 is exemplified as the intermediate piece.

The press mechanism 350J includes an upstream press roller 323J, which is provided in correspondence with the upstream backup roller 343, and a downstream press roller 324J, which is provided in correspondence with the downstream backup roller 344. Before a sheet S passes between the intermediate roller 379 and the endless belt 453, the upstream press roller 323I presses the rubbing band 310G to the image layer I. After the sheet S passes between the intermediate roller 379 and the endless belt 453, the downstream press roller 324I presses the rubbing band 310G to the image layer I. In the present embodiment, the upstream press roller 323J is exemplified as the upstream press piece. The downstream press roller 324J is exemplified as the downstream press piece.

The upstream press roller 323J comprises a rotating shaft 326J and a bearing 361J configured to hold the rotating shaft 326J. In the present embodiment, the upstream press roller 323J rotates around the rotating shaft 326J as the rubbing band 310G moves from the unwinding spindle 397 to the winding spindle 396.

The upstream press roller 324J comprises a rotating shaft 327J and a bearing 362J configured to hold the rotating shaft 327J. In the present embodiment, the downstream press roller 324J rotates around the rotating shaft 327J as the rubbing band 310G moves from the unwinding spindle 397 to the winding spindle 396.

The press mechanism 350J comprises a separator 380J configured to separate the upstream and downstream press rollers 323J, 324J from the endless belt 453.

The separator 380J comprises an upstream cylinder device 371J connected to the bearing 361J of the upstream press roller 323J. The upstream cylinder device 371J comprises a shell 374 configured to receive working fluid, and a rod 375 which is stored in the shell 374. A tip end of the rod 375 is connected to the bearing 361J. In the present embodiment, the upstream cylinder device 371J may be a commercially available cylinder device.

If the working fluid flows out of the shell 374, the rod 375 retracts in the shell 374. As a result, the upstream press roller 323J connected to the rod 375 moves to a separation position where the upstream press roller 323J is separated from the endless belt 453.

If the working fluid flows into the shell 374, the rod 375 extends from the shell 374. Compressive elasticity of the working fluid in the shell 374 bias the upstream press roller 323J toward the image layer I on the sheet S conveyed by the endless belt 453. Therefore, the upstream cylinder device 371J is also used as the biasing element.

The separator 380J comprises a downstream cylinder device 372J connected to the bearing 362J of the downstream press roller 324J. The downstream cylinder device 372J comprises a shell 376 configured to receive the working fluid, and a rod 377 which is stored in the shell 376. A tip end of the rod 377 is connected to the bearing 362J. In the present embodiment, the downstream cylinder 372J may be a commercially available cylinder device.

If the working fluid flows out of the shell 376, the rod 377 retracts in the shell 376. As a result, the downstream press roller 324J connected to the rod 377 moves to a separation position where the downstream press roller 324J is separated from the endless belt 453.

If the working fluid flows into the shell 376, the rod 377 extends from the shell 376. Compressive elasticity of the working fluid in the shell 376 biases the downstream press roller 324J toward the image layer I on the sheet S conveyed by the endless belt 453. Therefore, the downstream cylinder device 372J is also used as the biasing element.

The separator 380J comprises a controller 373J configured to control the upstream and downstream cylinder devices 371J, 372J. The controller 373J independently controls the inflow and outflow of the working fluid to and from the shells 374, 376. Therefore, the upstream and downstream cylinder devices 371J, 372J are independently operated.

The controller 373J may control the upstream and/or downstream cylinder devices 371J, 372J such that one of the upstream and downstream press rollers 323J, 324J is disposed in the separation position away from the endless belt 453 and that the other is disposed in the proximal position near the endless belt 453. For instance, if the image layer I has a high print ratio, both the upstream and downstream press rollers 323J, 324J may be disposed in the proximal position. On the other hand, if the image layer I has a low print ratio, one of the upstream and downstream press rollers 323J, 324J may be disposed in the separation position.

Alternatively, the upstream and/or downstream cylinder devices 371J, 372J may be controlled such that the downstream press roller 324I presses the rubbing band 310G to the image layer I on the sheet S with a greater force than the upstream press roller 323J. As a result, the rubbing band 310G rubs the image layer I with a weak force in the upstream process where the image layer I is likely to be damaged, and then the rubbing band 310G rubs the image layer with a strong force in the downstream process. Accordingly, less damage to the image layer I and high fixation ratio FR may be achieved.

The fixing device 300J according to the eleventh embodiment and the conveyor 400 which is used for conveying the sheet S to the fixing device 300J, are preferably incorporated in the color printer 1 described in the context of FIGS. 8 to 10, in place of the fixing device 300 and the conveyor which are described in the context of the first embodiment.

(Twelfth Embodiment)

<Fixing Device>

Figure 35:
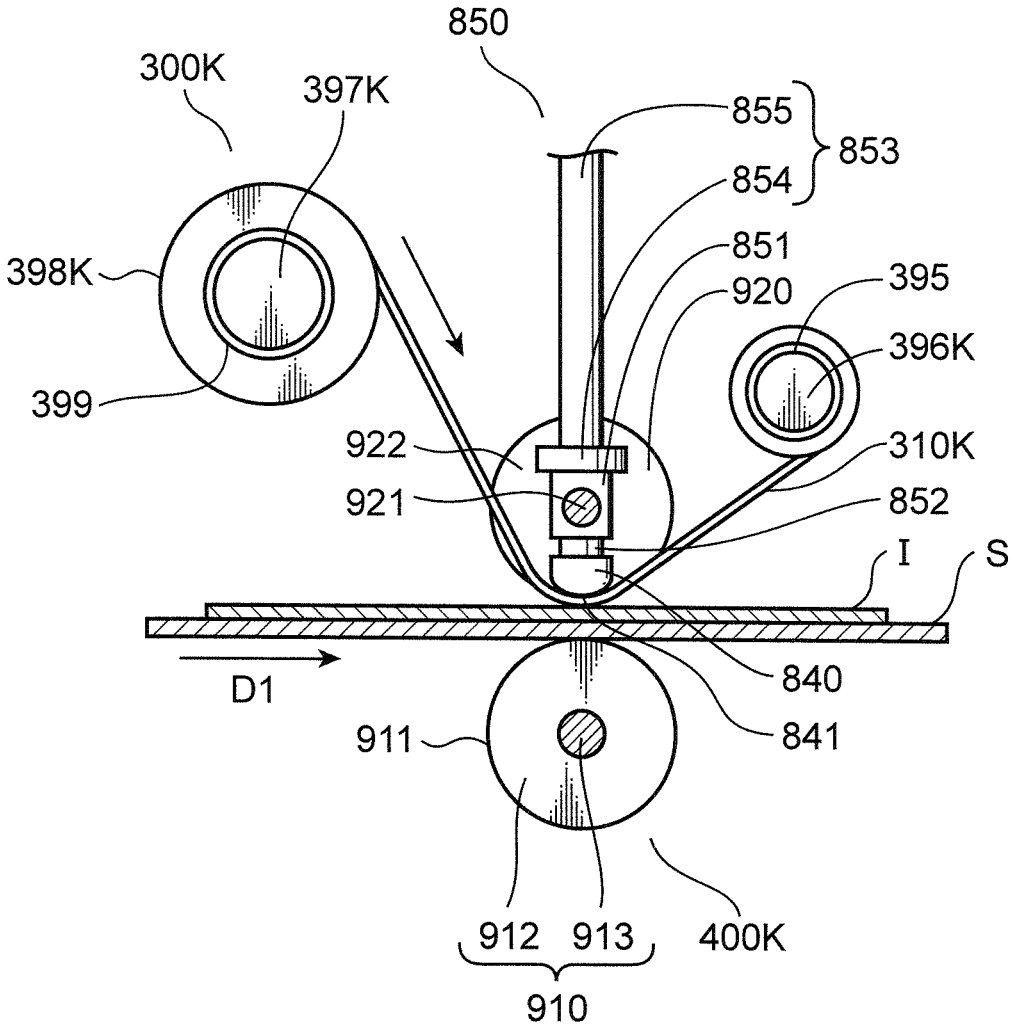
FIG. 35 is a side view schematically showing a fixing device and a conveyor according to the twelfth embodiment.
Figure 36:
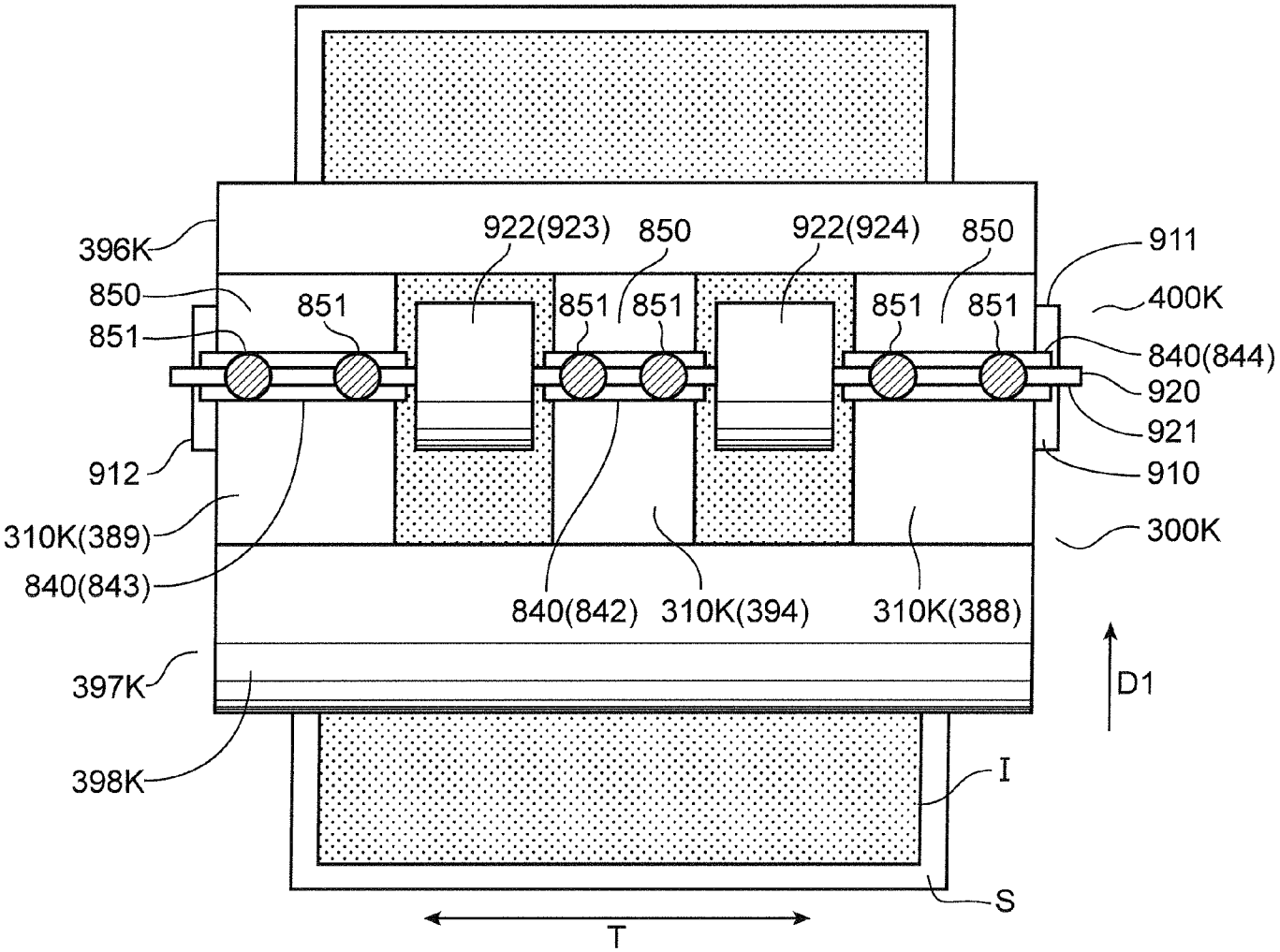
FIG. 36 is a plan view schematically showing the fixing device and the conveyor according to the twelfth embodiment.
Figure 37:
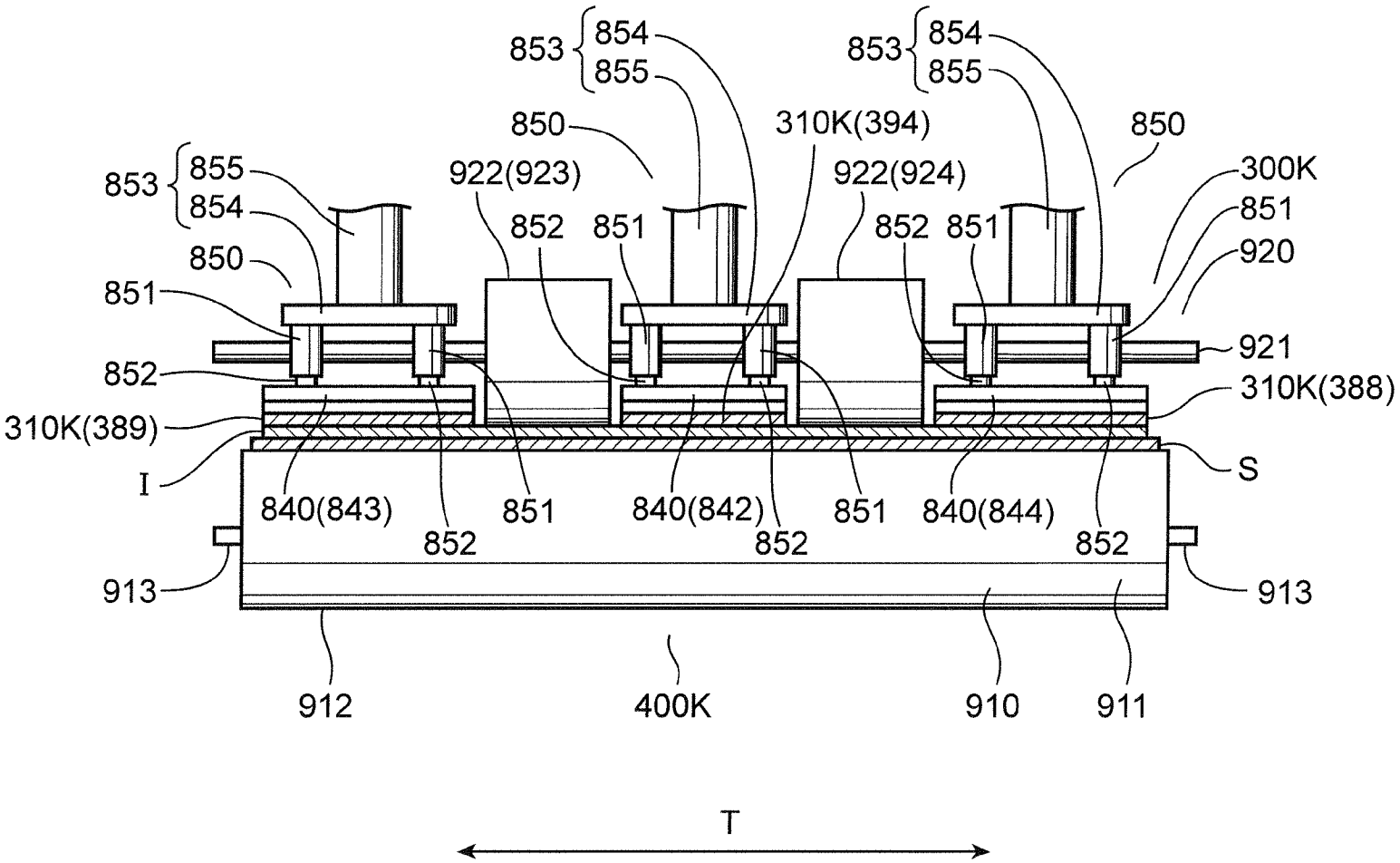
FIG. 37 is a front view schematically showing the fixing device and the conveyor according to the twelfth embodiment.

FIG. 35 is a schematic side view showing a fixing device and a conveyor according to the twelfth embodiment. FIG. 36 is a schematic plan view showing the fixing device and the conveyor according to the twelfth embodiment. FIG. 37 is a schematic front view showing the fixing device and the conveyor according to the twelfth embodiment. The fixing device and the conveyor according to the twelfth embodiment are described with reference to FIGS. 4 and 35 to 37. Hereinafter, the same reference numerals are used for describing the same elements as those described in the aforementioned embodiments. The descriptions associated with the aforementioned embodiments are preferably incorporated into the elements which are not described hereinafter.

A conveyor 400K configured to convey the sheet S having the image layer I formed thereon in the first direction D1 comprises a substantially tubular backup roller 910 situated under the sheet S, and a substantially tubular nip roller 920 situated above the sheet S. The backup roller 910 is connected to a drive source such as a motor (not shown) and rotated to convey the sheet S in the first direction D1. The nip roller 920 contacts the circumferential surface 911 of the backup roller 910, and works together with the backup roller 910 to form a nip portion for holding the sheet S therebetween. The nip roller 920 rotates in response to the rotation of the backup roller 910 and/or the conveyance of the sheet S. In the present embodiment, the backup roller 910 is exemplified as the conveying element. The nip roller 920 is exemplified as the nip element.

As shown in FIGS. 36 and 37, the backup roller 910 extends in a traverse direction T (a direction perpendicular to the conveying direction of the sheet S (the first direction D1)), and appropriately supports the sheet S during the conveyance thereof. The backup roller 910 comprises a substantially tubular trunk 912, of which circumferential surface 911 is pressed to the nip roller 920, and journals 913 which project from the end surfaces of the trunk 912 in the traverse direction T. One of the journals 913 is connected to the abovementioned drive source. The other rotatable journal 913 is supported, for example, by a bearing mounted to a wall of a housing (not shown) configured to store the conveyor 400K.

The nip roller 920 comprises a rotating shaft 921 extending in the traverse direction T, and a substantially tubular rolling piece 922 mounted on the rotating shaft 921. The rolling piece 922 includes a first rolling piece 923 and a second rolling piece 924. The first and second rolling pieces 923, 924 are aligned in the traverse direction T. The rolling piece 922, which is pressed to the circumferential surface 911 of the backup roller 910, rotates along with the rotating shaft 921 in response to the rotation of the backup roller 910 and/or the conveyance of the sheet S.

A fixing device 300K comprises a nonwoven fabric band 310K configured to rub the image layer I on the sheet S, an unwinding spindle 397K around which the nonwoven fabric band 310K is wrapped, and a winding spindle 396K which winds the nonwoven fabric band 310K. The nonwoven fabric band 310K may be formed from any of the various nonwoven fabric materials described in the context of FIG. 4. In the present embodiment, the nonwoven fabric band 310K is exemplified as the rubbing belt. The unwinding spindle 397K is exemplified as the unwinder. The winding spindle 396K is exemplified as the winder.

As shown in FIG. 35, the nonwoven fabric band 310K is unwound from a nonwoven fabric roll 398K installed on the unwinding spindle 397K. The nonwoven fabric roll 398K includes the substantially cylindrical core 399 and the nonwoven fabric band 310K wrapped around the core 399. The unwinding spindle 397K is inserted into the core 399. The unwinding spindle 397K may have, for example, a chuck mechanism (not shown) configured to hold the core 399. The nonwoven fabric band 310K is unwound from the nonwoven-fabric roll 398K as the unwinding spindle 397K rotates.

The winding spindle 396K is inserted into the substantially cylindrical core 395. The winding spindle 396K may include, for example, a chuck mechanism (not shown) configured to hold the core 395. The leading end of the nonwoven fabric band 310K, which is unwound from the nonwoven fabric roll 398K, is connected to the circumferential surface of the core 395. The nonwoven fabric band 310K is wrapped around the core 395 as the winding spindle 396K rotates.

The nonwoven fabric band 310K includes a central band 394 passing between the first and second rolling pieces 923, 924, a first edge band 389 adjacent to the first rolling piece 923, and a second edge band 388 adjacent to the second rolling piece 924. The first rolling piece 923 rolls between the first edge band 389 and the central band 394. The second rolling piece 924 rolls between the second edge band 388 and the central band 394.

As shown in FIG. 35, the fixing device 300K comprises a pressing rod 840 which defines a travel path of the nonwoven fabric band 310K such that the nonwoven fabric band 310K contacts the image layer I on the sheet S between the unwinding and winding spindles 397K, 396K. A rubbing position, which is defined by the pressing rod 840 so that the nonwoven fabric band 310K rubs the image layer I, and a nip portion defined between the nip and backup rollers 920, 910, are aligned in the traverse direction T. In the present embodiment, the pressing rod 840 is exemplified as the pressing member.

The pressing rod 840 includes a curved surface 841, which is curved to project toward the backup roller 910. The curved surface 841 defines a downwardly curved travel path of the nonwoven fabric band 310K. The nonwoven fabric band 310K rubs the image layer I on the sheet S between the curved surface 841 and the backup roller 910.

As shown in FIGS. 36 and 37, the pressing rod 840 extends in the traverse direction T. The pressing rod 840 includes a central rod 842 configured to press the central band 394 against the image layer I, a first edge rod 843 configured to press the first edge band 389 against the image layer I, and a second edge rod 844 configured to press the second edge band 388 against the image layer I. The first edge rod 843, the central rod 842 and the second edge rod 844 are aligned in the traverse direction T. The first edge rod 843, the central rod 842 and the second edge rod 844 are situated between the rotating shaft 921 of the nip roller 920 and the backup roller 910, respectively.

As shown in FIG. 35, the fixing device 300K comprises a connector 850 configured to connect the pressing rod 840 with the rotating shaft 921 of the nip roller 920. The connector 850 comprises a bearing block 851 configured to support the rotating shaft 921 of the nip roller 920, a rod 852 stored in the bearing block 851, and a connecting frame 853 which connects a housing (not shown) for storing the fixing device 300K to the bearing block 851.

As shown in FIGS. 36 and 37, the connectors 850 correspond to the first edge rod 843, the central rod 842, and the second edge rod 844, respectively. The paired rods 852 and the bearing block 851 connected to each rod 852 are disposed on the first edge rod 843. The tip ends of the rods 852 are connected to both ends of the upper surface of the first edge rod 843, respectively. The paired rods 852 and the bearing block 851 connected to each rod 852 are disposed on the central rod 842. The tip ends of the rods 852 are connected to both ends of the upper surface of the central rod 842, respectively. The paired rods 852 and the bearing block 851 connected to each rod 852 are disposed on the second edge rod 844. The tip ends of the rods 852 are connected to both ends of the upper surface of the second edge rod 844, respectively.

As shown in FIG. 37, the connecting frame 853 of the connector 850, which is provided in correspondence with the first edge rod 843, comprises a connecting plate 854 connected to the upper surfaces of the paired bearing blocks 851 corresponding to the first edge rod 843, and a connecting arm 855 configured to connect the connecting plate 854 with the abovementioned housing. The connecting frame 853 of the connector 850, which is provided in correspondence with the central rod 842, comprises a connecting plate 854 connected to the upper surfaces of the paired bearing blocks 851 corresponding to the central rod 842, and a connecting arm 855 configured to connect the connecting plate 854 with the abovementioned housing. The connecting frame 853 of the connector 850, which is provided in correspondence with the second edge rod 844, comprises a connecting plate 854 connected to the upper surfaces of the paired bearing blocks 851 corresponding to the second edge rod 844, and a connecting arm 855 configured to connect the connecting plate 854 with the abovementioned housing.

Figure 38:
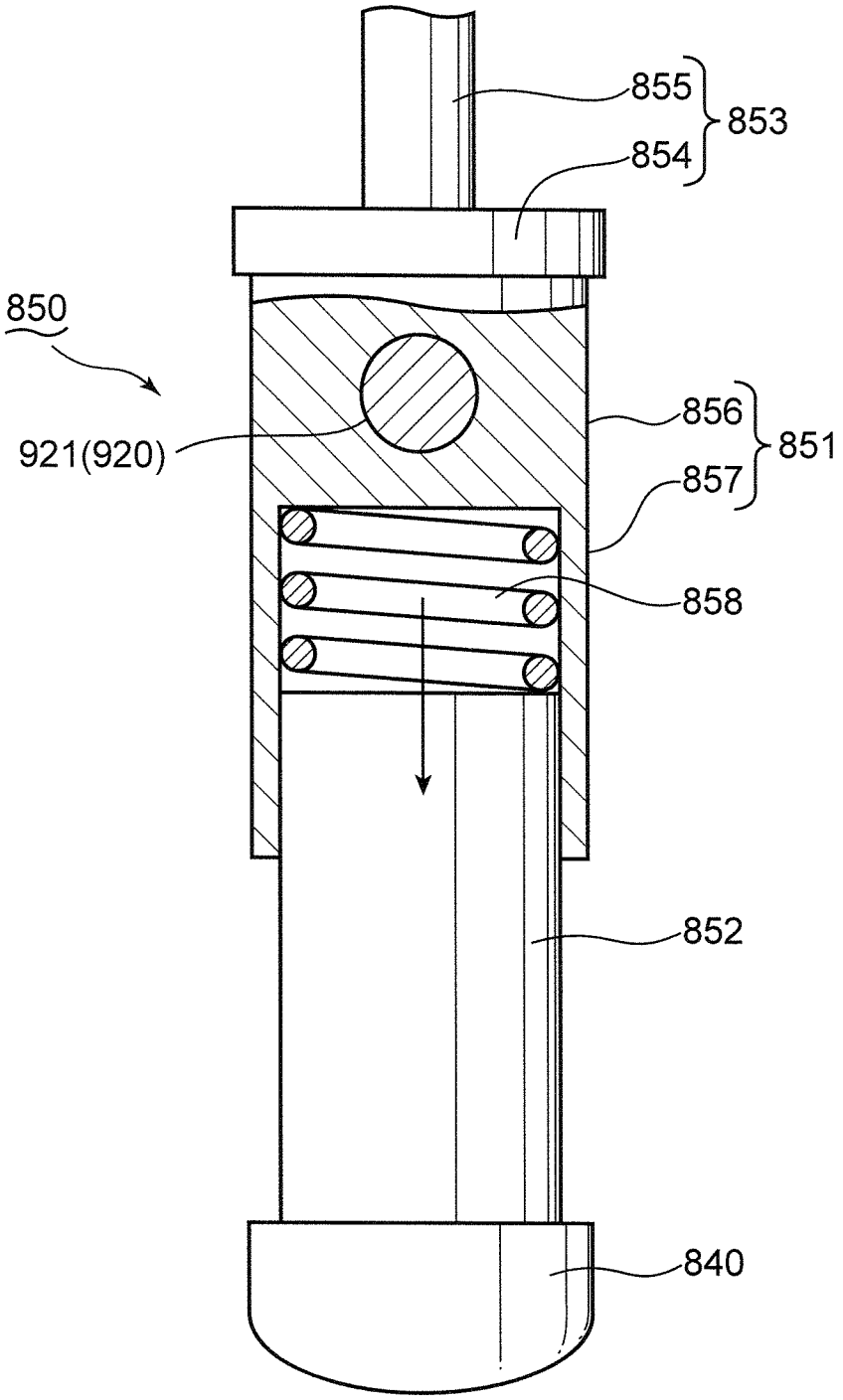
FIG. 38 is a cross-sectional view schematically showing one of connectors of the fixing device shown in FIGS. 35 to 37.

FIG. 38 is a schematic cross-sectional view of the connector 850. The connector 850 is described with reference to FIGS. 35 to 38.

Each bearing block 851 comprising an upper portion 856 into which the rotating shaft 921 of the nip roller 920 is inserted, and a hollow lower portion 857. The connector 850 comprises a coil spring 858 buried in the lower portion 857. The rod 852 is inserted into the lower portion 857. The coil spring 858 biases the rod 852 and the pressing rod 840 downward (i.e., toward the backup roller 910). As a result, the pressing rod 840, which is biased toward the backup roller 910, presses the nonwoven fabric band 310K against the image layer I on the sheet S.

While the conveyor 400K conveys the sheet S in the first direction D1, the winding spindle 396K winds the nonwoven fabric band 310K at a speed different from the conveying speed of the sheet S. The difference between the winding speed of the nonwoven fabric band 310K and the conveying speed of the sheet S makes the image layer I on the sheet S appropriately rubbed. Alternatively, while the conveyor 400K conveys the sheet S in the first direction D1, the winding spindle 396K may be stopped. While the nonwoven fabric band 310K pressed by the pressing rod 840 stops, the sheet S is conveyed by the backup roller 910 in the first direction D1, so that the image layer I is appropriately rubbed by the nonwoven fabric band 310K. The unwinding and winding spindles 397K, 396K may be arranged such that the travelling direction of the nonwoven fabric band 310K pressed by the pressing rod 840 becomes opposite to the conveying direction of the sheet S (i.e., the first direction D1). The image layer I is appropriately rubbed by the nonwoven fabric band 310K due to the difference between the conveying direction of the sheet S and the travelling direction of the nonwoven fabric band 310K.

Figure 39:
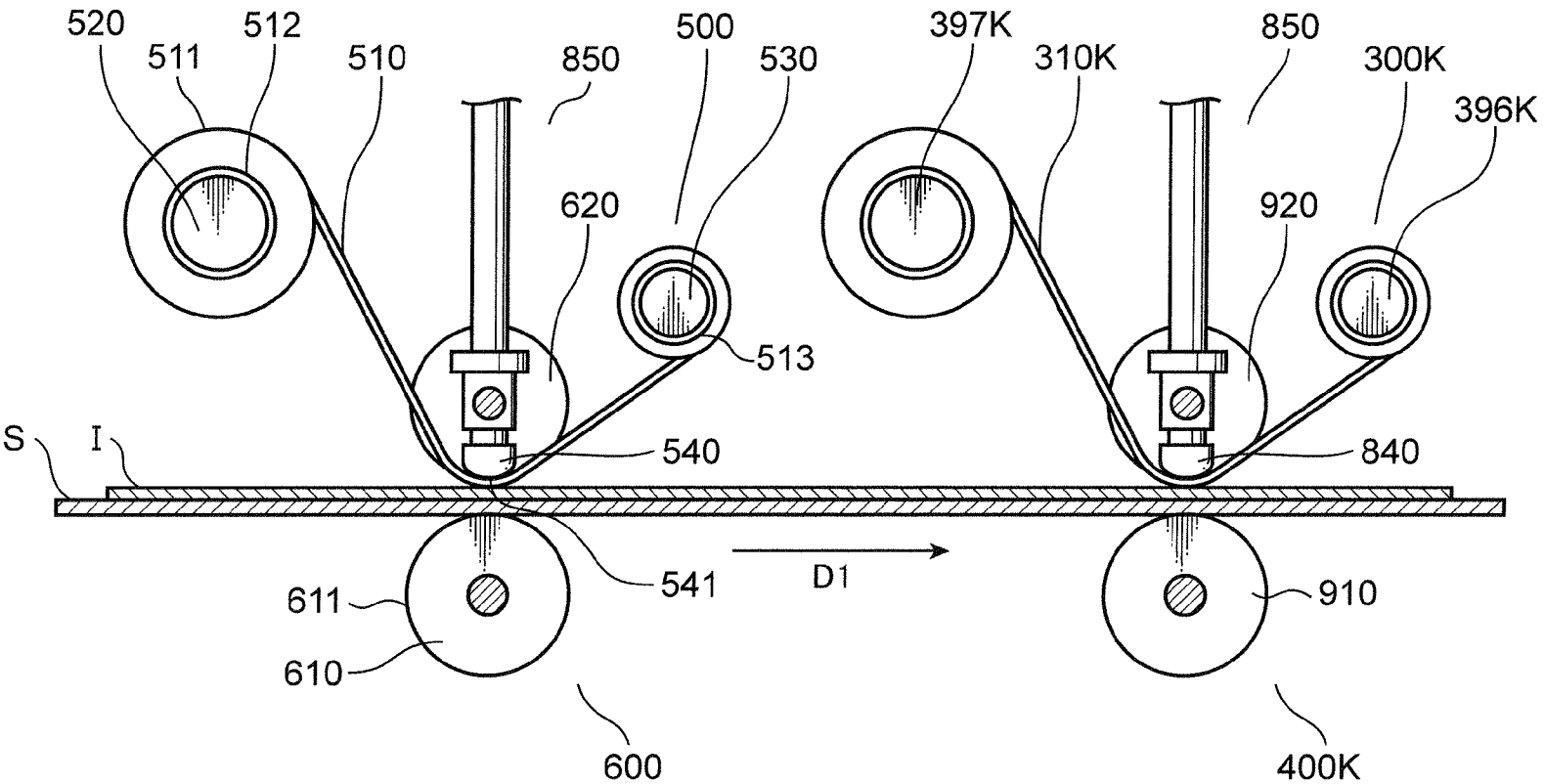
FIG. 39 is a side view schematically showing an improved fixing device and a conveyor according to the twelfth embodiment.
Figure 40:
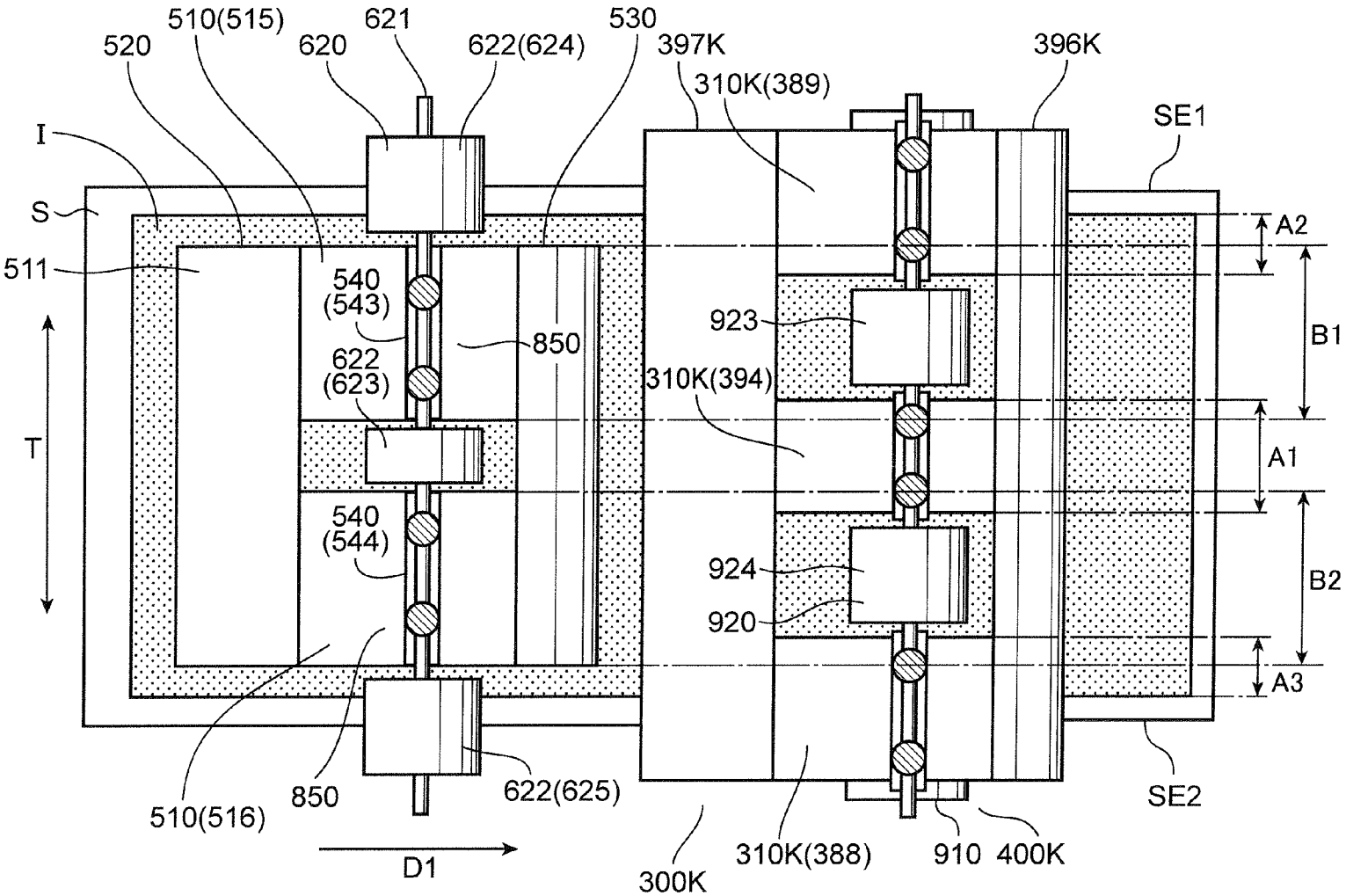
FIG. 40 is a plan view schematically showing the improved fixing device and a conveyor according to the twelfth embodiment.

FIG. 39 is a schematic side view showing an improved fixing device and conveyor based on the methodologies described with respect to FIGS. 35 to 38. FIG. 40 is a schematic plan view showing the improved fixing device and conveyor. The improved features are described with reference to FIGS. 4 and 38 to 40. Some descriptions overlapping with those associated with FIGS. 35 and 38 are omitted for clarification. Hereinafter, the same reference numerals are used for describing the same elements as those described in the context of FIGS. 35 to 38. The descriptions associated with FIGS. 35 to 38 are preferably incorporated into the elements which are not described hereinafter.

In addition to the conveyor 400K and the fixing device 300K described above, FIGS. 39 and 40 show an auxiliary conveyor 600 and an auxiliary fixing device 500 corresponding to the auxiliary conveyor 600. The auxiliary conveyor 600 is situated before the conveyor 400K. The auxiliary fixing device 500 is situated before the fixing device 300K. After the auxiliary fixing device 500 rubs the image layer I on the sheet S, the fixing device 300K rubs the image layer I.

Like the conveyor 400K, the auxiliary conveyor 600 conveys the sheet S having the image layer I formed thereon, in the first direction D1. The auxiliary conveyor 600 has a substantially tubular backup roller 610 disposed under the sheet S, and a substantially tubular nip roller 620 disposed above the sheet S. The backup roller 610 is connected to a drive source such as a motor (not shown), and rotated to convey the sheet S in the first direction D1. The nip roller 620 is pressed to the circumferential surface 611 of the backup roller 610, and works together with the backup roller 610 to form a nip portion for holding the sheet S therebetween. The nip roller 620 rotates in response to the rotation of the backup roller 610 and/or the conveyance of the sheet S. In the present embodiment, the backup roller 610 of the auxiliary conveyor 600 is exemplified as the conveying element, as well as the backup roller 910 of the conveyor 400K. The nip roller 620 of the auxiliary conveyor 600 is exemplified as the nip element, as well as the nip roller 920 of the conveyor 400K.

As shown in FIG. 40, the backup roller 610 of the auxiliary conveyor 600 (c.f. FIG. 39) has the same structure as the backup roller 910 of the conveyor 400K. The nip roller 620 of the auxiliary conveyor 600 comprises a rotating shaft 621 extending in the traverse direction T, and a substantially tubular rolling piece 622 mounted on the rotating shaft 621. The rolling piece 622 includes a third rolling piece 623, a fourth rolling piece 624, and a fifth rolling piece 625. The third rolling piece 623 is situated in the upstream of the central band 394 of the fixing device 300K. The fourth rolling piece 624 is situated in the upstream of the first edge band 389. The fifth rolling piece 625 is situated in the upstream of the second edge band 388. The third, fourth and fifth rolling pieces 623, 624, 625 are aligned in the traverse direction T. The rolling piece 622, which is pressed to the circumferential surface 611 of the backup roller 610, rotates along with the rotating shaft 621 in response to the rotation of the backup roller 610 and/or the conveyance of the sheet S.

The auxiliary fixing device 500 has a nonwoven fabric band 510 configured to rub the image layer I on the sheet S, an unwinding spindle 520 around which the nonwoven fabric band 510 is wrapped, and a winding spindle 530 configured to wind the nonwoven fabric band 510. The nonwoven fabric band 510 may be formed from any of the various nonwoven fabric materials described in the context of FIG. 4. In the present embodiment, the nonwoven fabric band 510 of the auxiliary fixing device 500 is exemplified as the rubbing belt, as well as the nonwoven fabric band 310K of the fixing device 300K. The unwinding spindle 520 of the auxiliary fixing device 500 is exemplified as the unwinder, as well as the unwinding spindle 397K of the fixing device 300K. The winding spindle 530 of the auxiliary fixing device 500 is exemplified as the winder, as well as the winding spindle 396K of the fixing device 300K.

As shown in FIG. 39, the nonwoven fabric band 510 is unwound from a nonwoven fabric roll 511 installed on the unwinding spindle 520. The nonwoven fabric roll 511 includes a substantially cylindrical core 512 and the nonwoven fabric band 510 wrapped around the core 512. The unwinding spindle 520 is inserted into the core 512. The unwinding spindle 520 may include, for example, a chuck mechanism (not shown) configured to hold the core 512. The nonwoven fabric band 510 is unwound from the nonwoven fabric roll 511 as the unwinding spindle 520 rotates.

The winding spindle 530 is inserted into a substantially cylindrical core 513. The winding spindle 530 may include, for example, a chuck mechanism (not shown) configured to hold the core 513. The leading end of the nonwoven fabric band 510, which is unwound from the nonwoven fabric roll 511, is connected to the circumferential surface of the core 513. The nonwoven fabric band 510 is wrapped around the core 513 as the winding spindle 530 rotates.

As shown in FIG. 40, the nonwoven fabric band 510 includes a first auxiliary band 515 passing between the third and fourth rolling pieces 623, 624, and a second auxiliary band 516 passing between the third and fifth rolling pieces 623, 625. The first auxiliary band 515 rubs the image layer I in the upstream of the first rolling piece 923. The second auxiliary band 516 rubs the image layer I in the upstream of the second rolling piece 924.

As shown in FIG. 39, the auxiliary fixing device 500 comprises a pressing rod 540 which defines a travel path of the nonwoven fabric band 510 such that the nonwoven fabric band 510 contacts the image layer I on the sheet S between the unwinding and winding spindles 520, 530. A rubbing position, which is defined by the pressing rod 540 so that the nonwoven fabric band 510 rubs the image layer I, and a nip portion defined between the nip and backup rollers 620, 610 are aligned in the traverse direction T. In the present embodiment, the pressing rod 540 of the auxiliary fixing device 500 is exemplified as the pressing member, as well as the pressing rod 840 of the fixing device 300K.

The pressing rod 540 has a curved surface 541, which is curved to project toward the backup roller 610. The curved surface 541 defines a downwardly curved travel path of the nonwoven fabric band 510. The nonwoven fabric band 510 rubs the image layer I on the sheet S between the curved surface 541 and the backup roller 610.

As shown in FIG. 40, the pressing rod 540 extends in the traverse direction T. The pressing rod 540 includes a first auxiliary rod 543 configured to press the first auxiliary band 515 against the image layer I, and a second auxiliary rod 544 configured to press the second auxiliary band 516 against the image layer I. The first and second auxiliary rods 543, 544 are aligned in the traverse direction T. The first and second auxiliary rods 543, 544 are held between the rotating shaft 621 of the nip roller 620 and the backup roller 610, respectively, by the connector 850 described in the context of with FIG. 38.

The central band 394 of the fixing device 300K rubs a strip area A1 extending in the first direction D1 at substantially the center of the image layer I formed on the sheet S. The first edge band 389 of the fixing device 300K rubs a strip area A2 extending in the first direction D1 along one edge of the image layer I. The second edge band 388 of the fixing device 300K rubs a strip area A3 extending along the other edge opposite to the one edge corresponding to the strip area A2.

The first auxiliary band 515 of the auxiliary fixing device 500 rubs a strip area B1 between the strip areas A1, A2. The second auxiliary band 516 of the auxiliary fixing device 500 rubs a strip area B2 between the strip areas A1, A3.

Because the third rolling piece 623 of the auxiliary conveyor 600 rolls on the strip area A1, the strip area A1 is not rubbed by the nonwoven fabric band 510 of the auxiliary fixing device 500. However, the strip area A1 is appropriately rubbed by the central band 394 of the fixing device 300K after the image layer I goes through the auxiliary fixing device 500.

In cooperation with the backup roller 610, the fourth rolling piece 624 of the auxiliary conveyor 600 holds a lateral edge SE1 of the sheet S, which extends in the first direction D1. Therefore, the strip area A2 nearby the lateral edge SE1 of the sheet S is not rubbed by the nonwoven fabric band 510 of the auxiliary fixing device 500. However, after the image layer I passes through the auxiliary fixing device 500, the strip area A2 is appropriately rubbed by the first edge band 389 of the fixing device 300K.

In cooperation with the backup roller 610, the fifth rolling piece 625 of the auxiliary conveyor 600 holds a lateral edge SE2 opposite to the lateral edge SE1 of the sheet S. Therefore, the strip area A3 nearby the lateral edge SE2 of the sheet S is not rubbed by the nonwoven fabric band 510 of the auxiliary fixing device 500. However, after the image layer I passes through the auxiliary fixing device 500, the strip area A3 is appropriately rubbed by the second edge band 388 of the fixing device 300K.

Because the first rolling piece 923 of the conveyor 400K rolls on the strip area B1, the strip area B1 is not rubbed by the nonwoven fabric band 310K of the fixing device 300K. However, before the image layer I reaches the fixing device 300K, the strip area B1 is appropriately rubbed by the first auxiliary band 515 of the auxiliary fixing device 500.

Because the second rolling piece 924 of the conveyor 400K rolls on the strip area B2, the strip area B2 is not rubbed by the nonwoven fabric band 310K of the fixing device 300K. However, before the image layer I reaches the fixing device 300K, the strip area B2 is appropriately rubbed by the second auxiliary band 516 of the auxiliary fixing device 500.

As described above, the entire image layer I is appropriately rubbed, because the fixing device 300K rubs the strip areas A1, A2, A3, which are different from the strip areas B1, B2 rubbed by the auxiliary fixing device 500. It should be noted that the first auxiliary band 515 is arranged such that edges of the strip area B1 preferably overlap with edges of the strip areas A1, A2. The second auxiliary band 516 is arranged such that edges of the strip area B2 preferably overlap with edges of the strip areas A1 and A3.

The fixing device 300K, the auxiliary fixing device 500, and the conveyor 400K and the auxiliary conveyor 600 which are used for conveying the sheet S to the fixing device 300K and the auxiliary fixing device 500, respectively, according to the present embodiment, are preferably incorporated in the color printer 1 described in the context of FIGS. 8 to 10, in place of the fixing device 300 and the conveyor described in the context of the first embodiment.

(Thirteenth Embodiment)

<Fixing Device>

Figure 41:
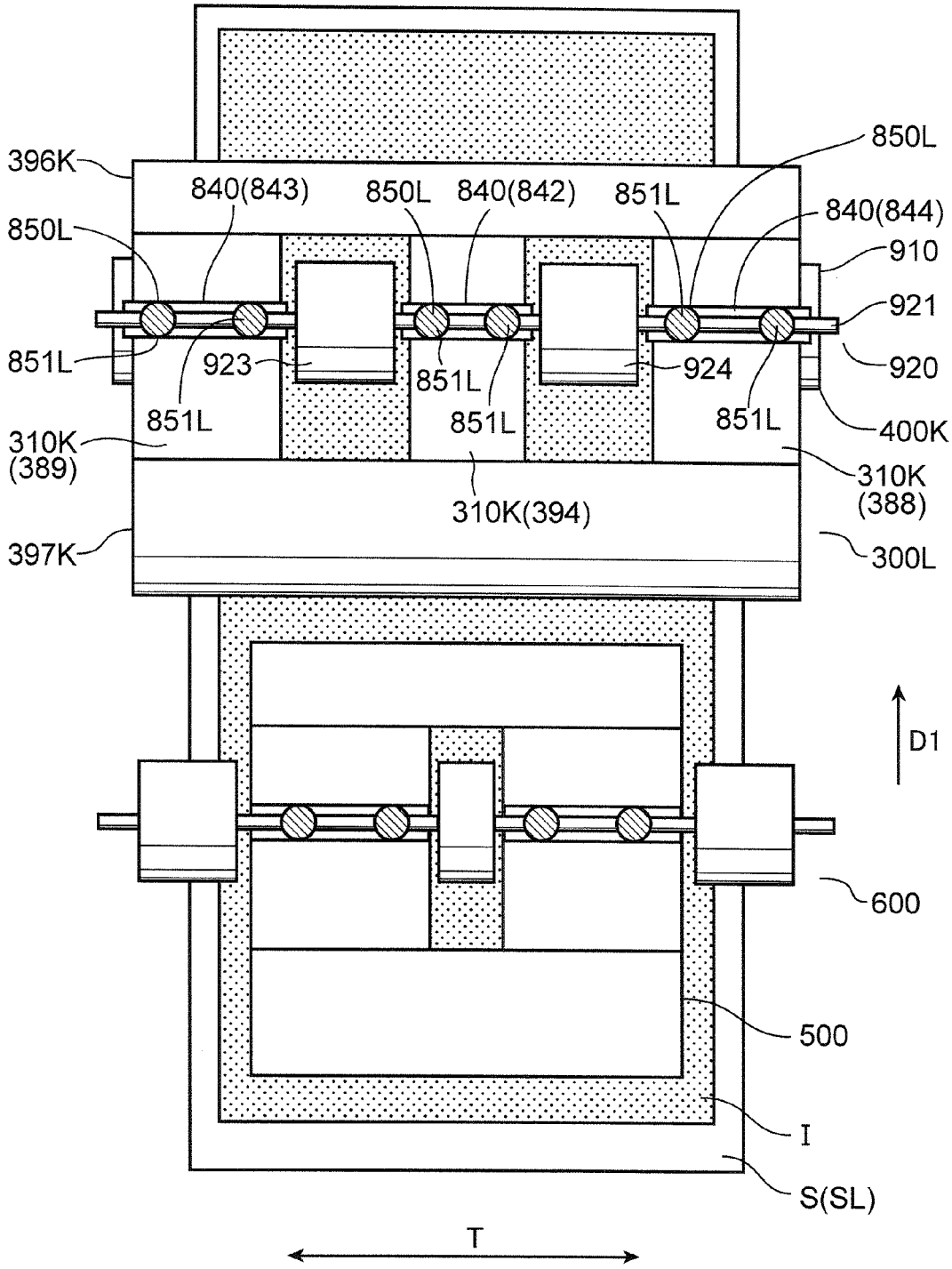
FIG. 41 is a plan view schematically showing a fixing device and a conveyor according to the thirteenth embodiment.

FIG. 41 is a schematic plan view showing a fixing device and a conveyor according to the thirteenth embodiment. The differences from the twelfth embodiment are described hereinafter with reference to FIGS. 38 and 41. Some descriptions overlapping with those of the twelfth embodiment are omitted for clarification. Hereinafter, the same reference numerals are used for describing the same elements as those of the twelfth embodiment. The descriptions associated with the twelfth embodiment are preferably incorporated into the elements which are not described hereinafter.

In addition to the conveyor 400K, the auxiliary conveyor 600 and the auxiliary fixing device 500, which are described in the context of the twelfth embodiment, FIG. 41 shows a fixing device 300L corresponding to the conveyor 400K.

The fixing device 300L has the nonwoven fabric band 310K configured to rub the image layer I on the sheet S, the unwinding spindle 397K around which the nonwoven fabric band 310K is wrapped, and the winding spindle 396K which winds the nonwoven fabric band 310K.

The nonwoven fabric band 310K includes the central band 394 passing between the first and second rolling pieces 923, 924, the first edge band 389 adjacent to the first rolling piece 923, and the second edge band 388 adjacent to the second rolling piece 924. The first rolling piece 923 rolls between the first edge band 389 and the central band 394. The second rolling piece 924 rolls between the second edge band 388 and the central band 394.

The fixing device 300L comprises the pressing rod 840, which defines a travel path of the nonwoven fabric band 310K such that the nonwoven fabric band 310K contacts the image layer I on the sheet S between the unwinding and winding spindles 397K, 396K.

The pressing rod 840 extends in the traverse direction T. The pressing rod 840 includes the central rod 842 configured to define a travel path in which the central band 394 is brought into contact with the image layer I on the sheet S, the first edge rod 843 configured to define a travel path in which the first edge band 389 is brought into contact with the image layer I on the sheet S, and the second edge rod 844 configured to define a travel path in which the second edge band 388 is brought into contact with the image layer I on the sheet S. The first edge rod 843, the central rod 842 and the second edge rod 844 are aligned in the traverse direction T. The first edge rod 843, the central rod 842 and the second edge rod 844 are arranged between the rotating shaft 921 of the nip roller 920 and the backup roller 910, respectively.

The fixing device 300L comprises three connectors 850L connected to the first edge rod 843, the central rod 842, and the second edge rod 844, respectively. The connector 850L connects the pressing rod 840 (the first edge rod 843, the central rod 842, and the second edge rod 844) and the rotating shaft 921 of the nip roller 920 to each other.

Figure 42:
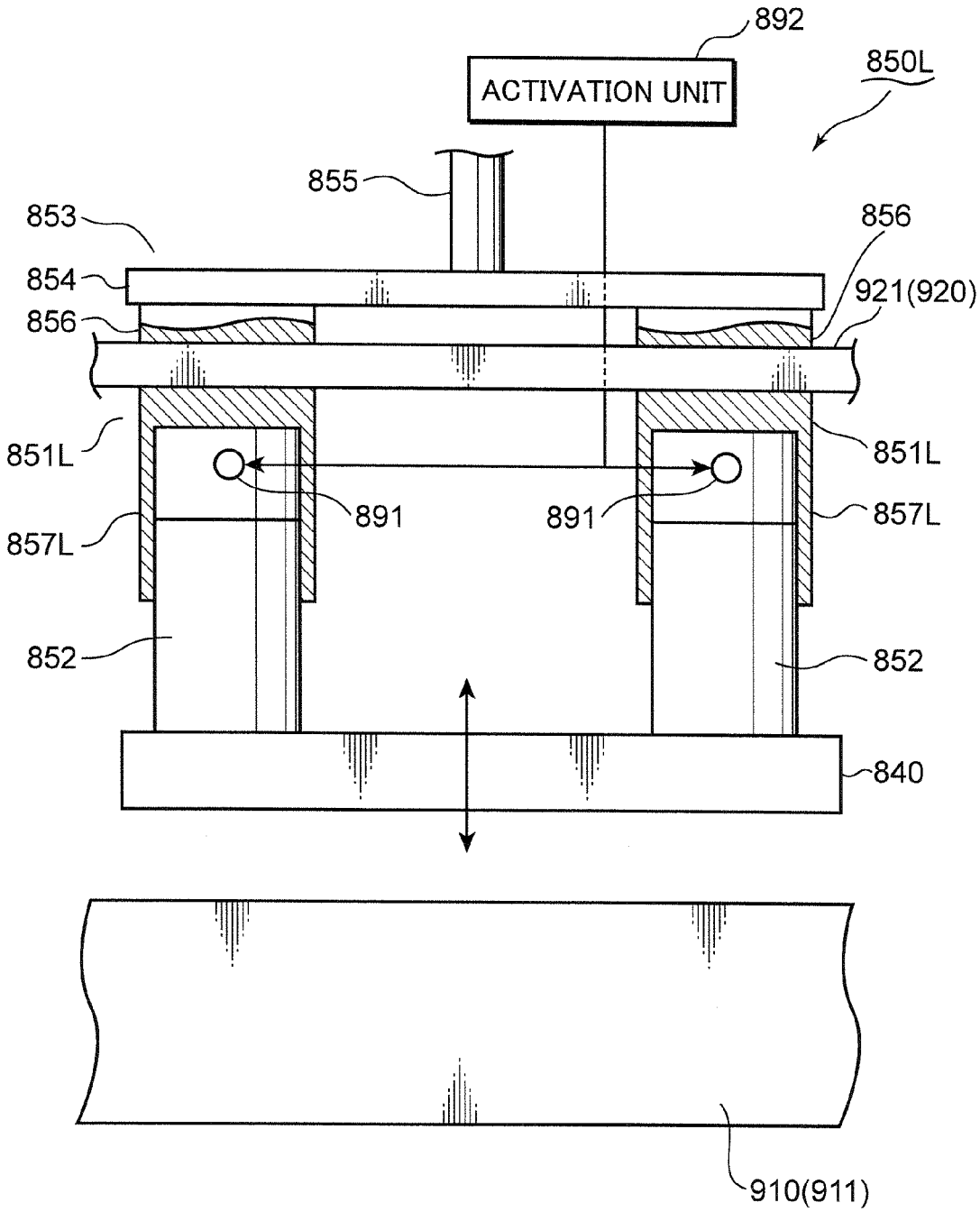
FIG. 42 is a cross-sectional view schematically showing one of connectors of the fixing device shown in FIG. 41.

FIG. 42 is a schematic cross-sectional view of one of the connectors 850L. The connectors 850L are described with reference to FIGS. 41 and 42.

Each connector 850L has the paired rods 852 connected to the upper surface of the pressing rod 840, and a bearing block 851L connected to each rod 852. Tip ends of the paired rods 852 are connected to both ends of the upper surface of the pressing rod 840.

The connector 850L comprises the connecting frame 853 connected to the paired bearing blocks 851L. The connecting frame 853 comprises the connecting plate 854 connected to the upper end surfaces of the paired bearing blocks 851, and the connecting arm 855 configured to connect the connecting plate 854 with a housing (not shown) for storing the fixing device 300L.

Each bearing block 851L comprises the upper portion 856 into which the rotating shaft 921 of the nip roller 920 is inserted, and the hollow lower portion 857L. Each rod 852 is inserted into the lower portion 857L. The rod 852 closes an opening formed in the lower end of the lower portion 857L.

A through-hole 891 is formed on a circumferential wall of the lower portion 857L of each bearing block 851L. The connector 850L comprises an activation unit 892, which flows working fluid into and out of the lower portion 857L of the bearing block 851L via the through-hole 891. If the activation unit 892 flows the working fluid into the lower portion 857L, the pressing rod 840 is displaced downward and approaches the circumferential surface 911 of the backup roller 910. If the activation unit 892 draws the working fluid from the lower portion 857L, the pressing rod 840 is displaced upward and separates from the circumferential surface 911 of the backup roller 910.

Figure 43:
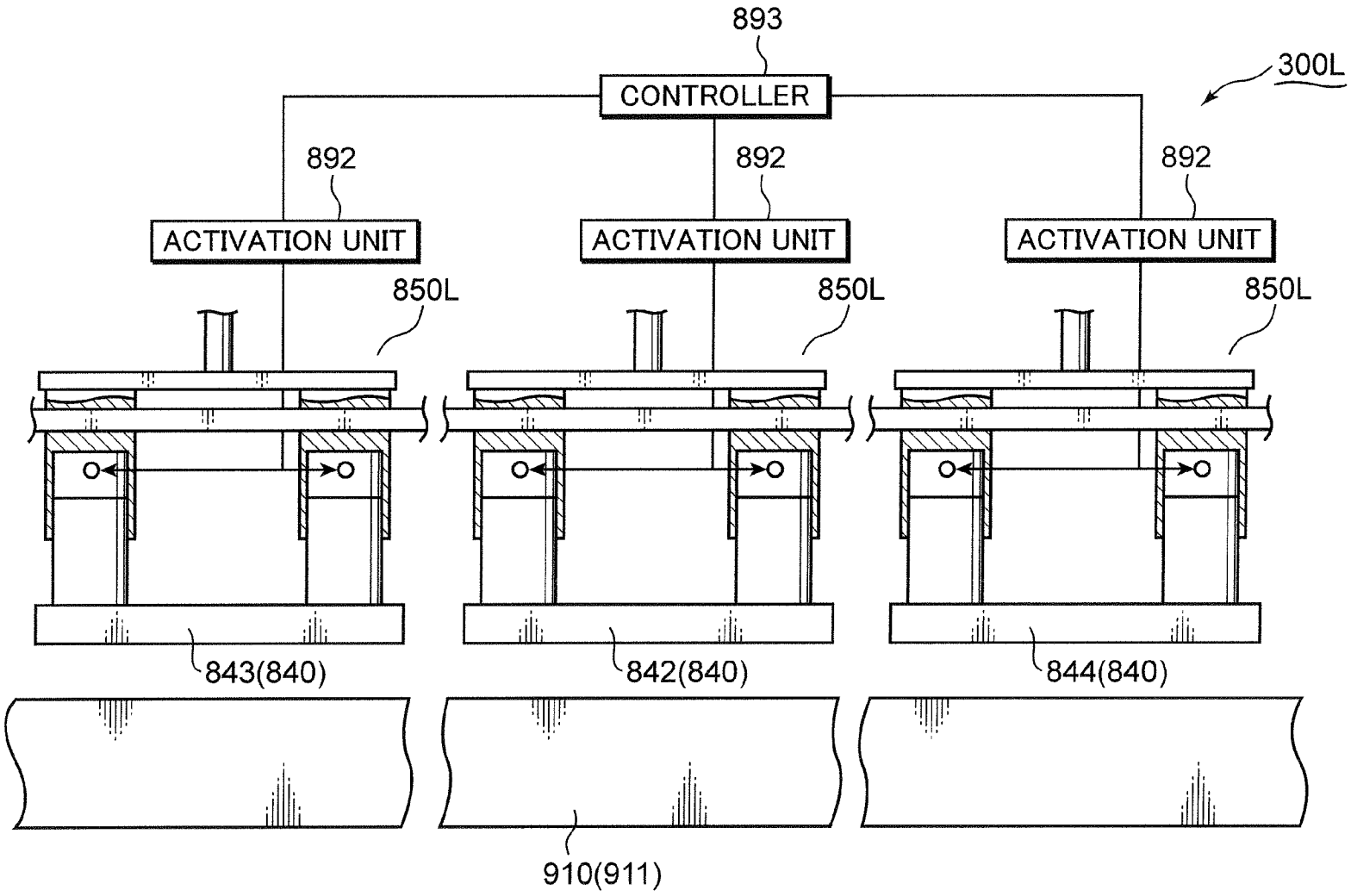
FIG. 43 is a schematic view of a connection between the connectors shown in FIG. 42.

FIG. 43 is a cross-sectional view schematically showing connections among the three connectors 850L. The connectors 850L are further described with reference to FIGS. 42 and 43.

The fixing device 300L has a controller 893, which independently control the activation units 892 for causing the central rod 842 to separate from or approach the circumferential surface 911 of the backup roller 910, the activation unit 892 for causing the first edge rod 843 to separate from or approach the circumferential surface 911 of the backup roller 910, and the activation unit 892 for causing the second edge rod 844 to separate from or approach the circumferential surface 911 of the backup roller 910. Under the control of the controller 893, the central rod 842, the first edge rod 843 and the second edge rod 844 independently separate from or approach the circumferential surface 911 of the backup roller 910.

Figure 44:
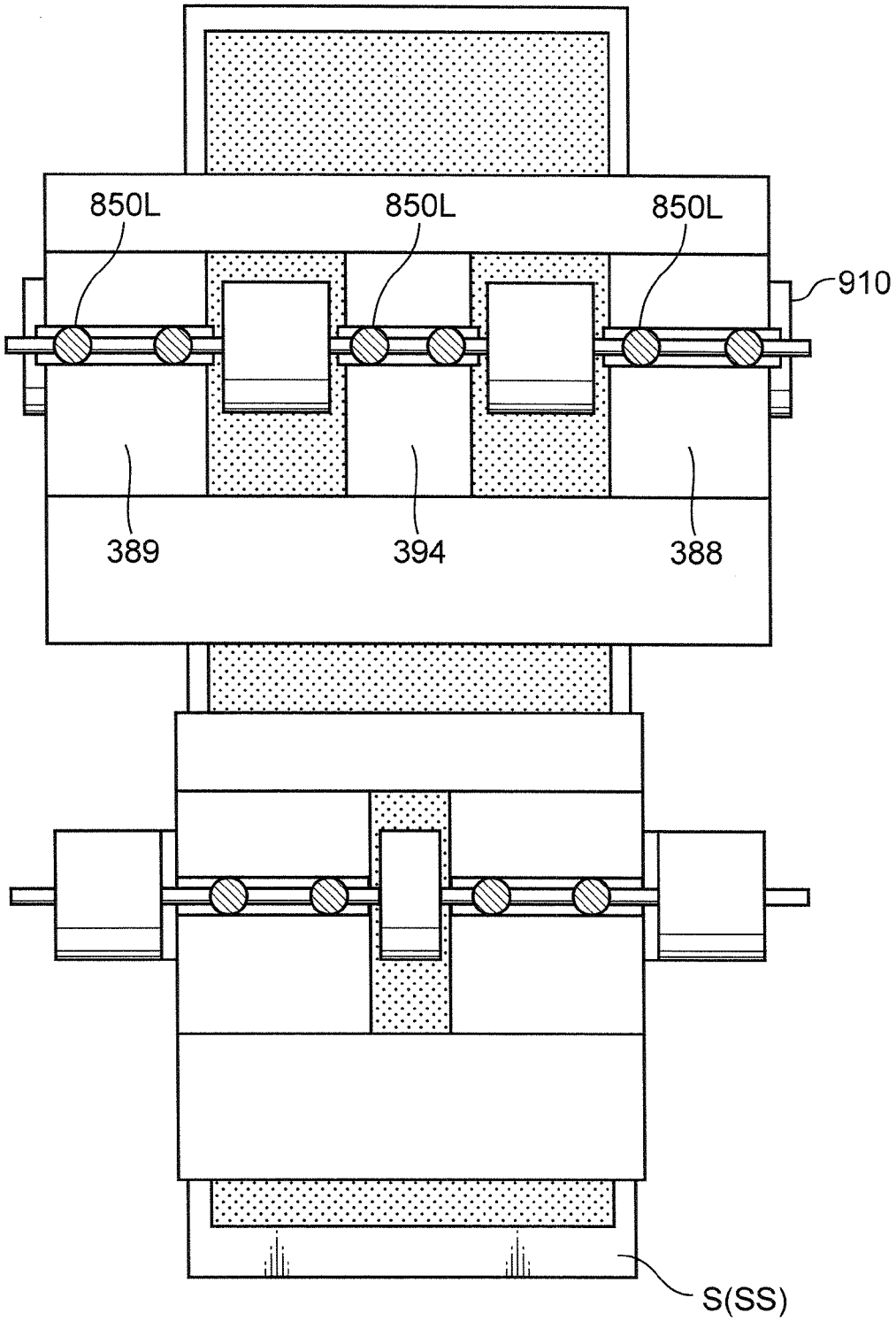
FIG. 44 is a plan view schematically showing the fixing device of the thirteenth embodiment which performs a fixation process on a relatively small sheet.
Figure 45:
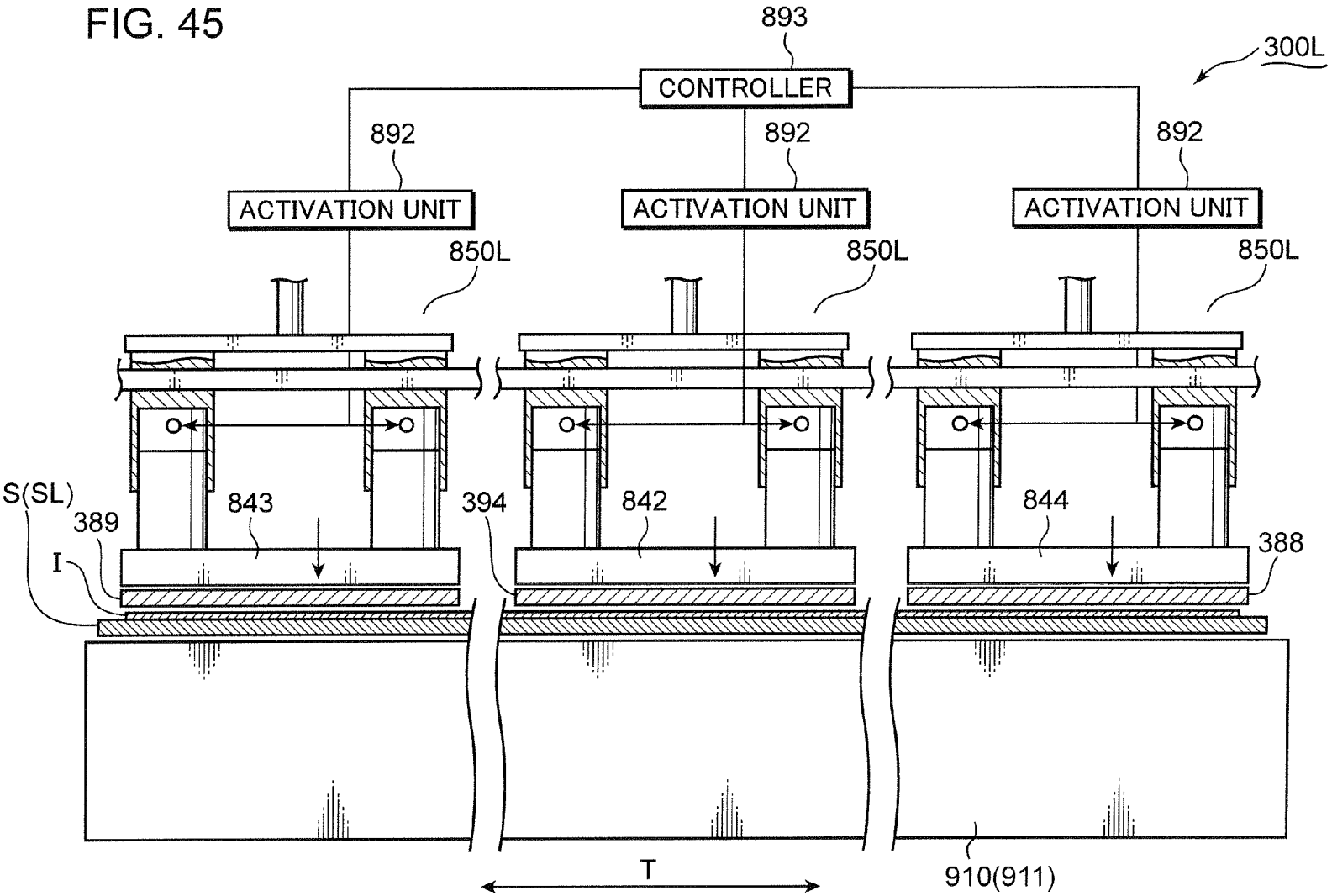
FIG. 45 is a plan view schematically showing operations of the fixing device according to the thirteenth embodiment which performs the fixation process on a relatively large sheet.
Figure 46:
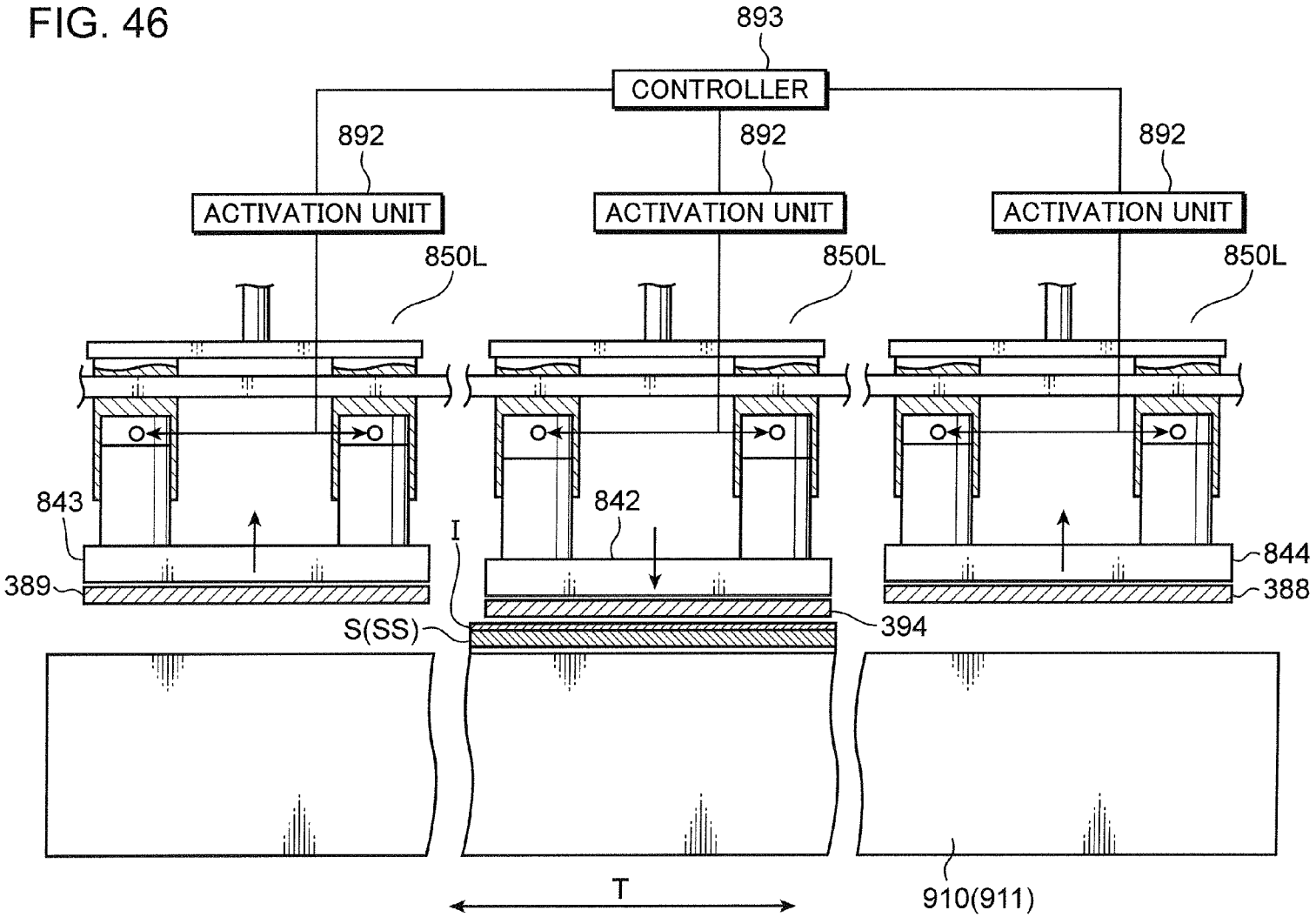
FIG. 46 is a plan view schematically showing operations of the fixing device according to the thirteenth embodiment which performs the fixation process on a relatively small sheet.

FIG. 44 is a schematic plan view showing the fixing device and the conveyor. FIGS. 45 and 46 are cross-sectional views schematically showing the operations performed by the three connectors 850L, respectively. The operations of the connectors 850L are described with reference to FIGS. 41 and 44 to 46.

FIGS. 41, 45 show, as a sheet S, a first sheet SL that is relatively large in the traverse direction T. FIGS. 44, 46 show, as the sheet S, a second sheet SS that is relatively small in the traverse direction T.

As shown in FIGS. 41 and 45, the first sheet SL passes between the central band 394 and the backup roller 910, between the first edge band 389 and the backup roller 910, as well as between the second edge band 388 and the backup roller 910. As shown in FIGS. 44 and 46, the second sheet SS passes between the central band 394 and the backup roller 910, but not between the first edge band 389 and the backup roller 910 or between the second edge band 388 and the backup roller 910.

As shown in FIG. 45, while the backup roller 910 conveys the first sheet SL, each of the three activation units 892 brings the central rod 842, the first edge rod 843 and the second edge rod 844 close to the circumferential surface 911 of the backup roller 910 under the control of the controller 893. As a result, the central band 394, the first edge band 389 and the second edge band 388 may preferably rub the image layer I.

As shown in FIG. 46, while the backup roller 910 conveys the second sheet SS, the central activation unit 892 brings the central rod 842 close to the circumferential surface 911 of the backup roller 910 under the control of the controller 893. The remaining activation units 892 separate the first and second edge rods 843, 844, respectively, from the circumferential surface 911 of the backup roller 910 under the control of the controller 893. As a result, the central band 394 rubs the image layer I, but the first and second edge bands 389, 388 are not rubbed by the circumferential surface 911 of the backup roller 910 to prevent unnecessary abrasion of the first and second edge bands 389, 388.

In a series of the aforementioned embodiments, the non-woven fabric bands 310K and 510 are used as the rubbing belts. Alternatively, a strip member configured to rub the image layer I may be used as the rubbing belt. For instance, a strip member having a brush implanted therein may be used as the rubbing belt.

The fixing device 300L, the auxiliary fixing device 500, and the conveyor 400K and the auxiliary conveyor 600, which are used for conveying the sheet S to the fixing device 300L and the auxiliary fixing device 500, respectively, according to the thirteenth embodiment, are preferably incorporated in the color printer 1 described in the context of FIGS. 8 to 10, in place of the fixing device 300 and the conveyor, which are described in the context of the first embodiment.

(Fourteenth Embodiment)

<Fixing Device>

Figure 47:
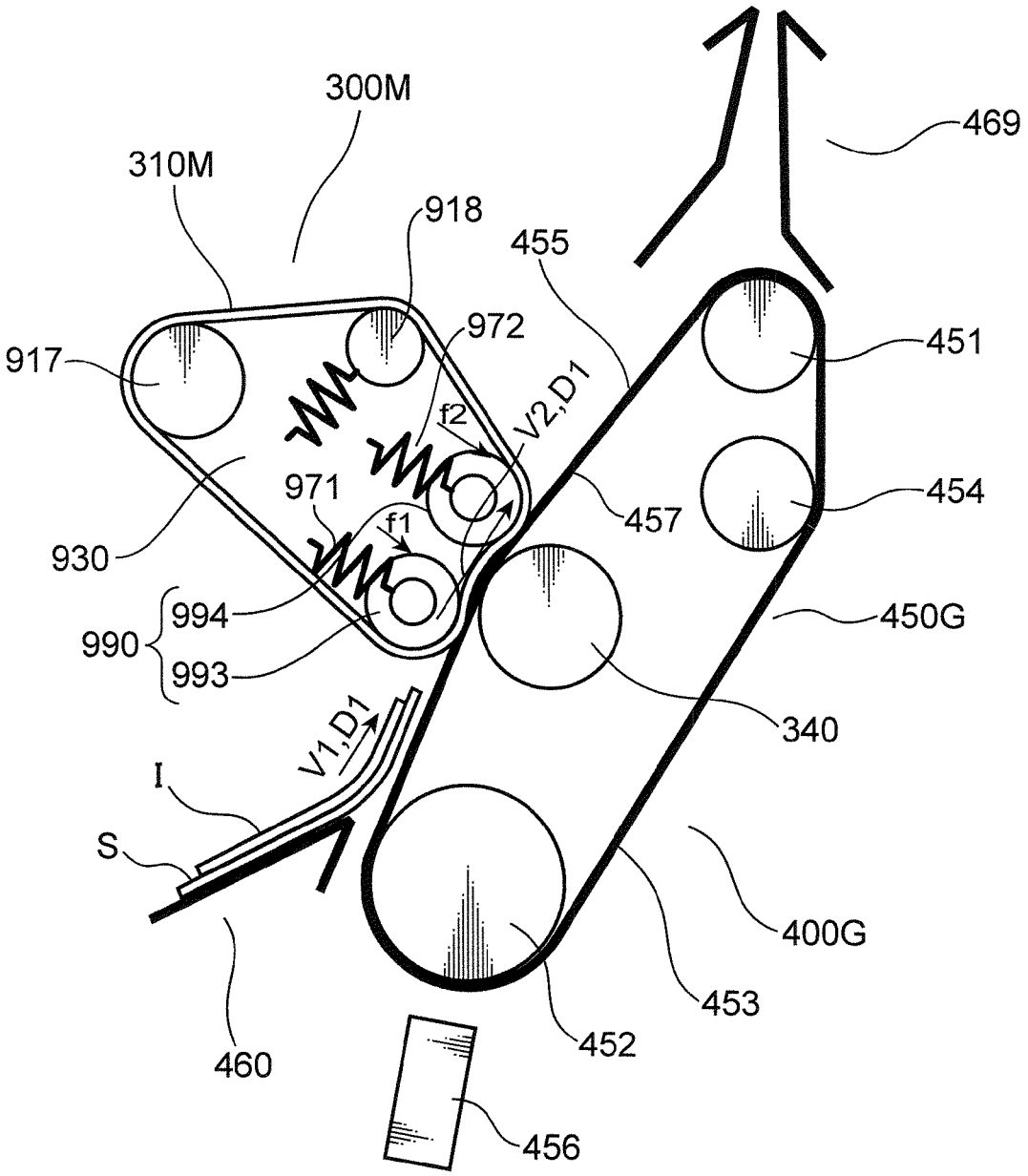
FIG. 47 is a schematic view of a fixing device and a conveyor according to the fourteenth embodiment.

FIG. 47 is a schematic view of a fixing device and a conveyor according to the fourteenth embodiment. The fixing device and the conveyor according to the fourteenth embodiment are described with reference to FIGS. 1A to 1C and FIGS. 4 and 47. Hereinafter, the same reference numerals are used for describing the same elements as those of the aforementioned embodiments. The descriptions associated with the aforementioned embodiments are preferably incorporated into the elements which are not described hereinafter.

The conveyor 400G configured to convey the sheet S having the image layer I formed thereon comprises the belt unit 450G, the upstream guider 460 situated before the belt unit 450G, and the downstream guider 469 situated after the belt unit 450G. The sheet S is guided by the upstream guider 460 and sent to the belt unit 450G. Thereafter, the sheet S is sent to the downstream guide 469 by the belt unit 450G.

The belt unit 450G comprises the drive roller 451, the idler 452, the endless belt 453 extending between the drive roller 451 and the idler 452, and the tension roller 454 applying tension to the endless belt 453. Rotation of the drive roller 451 causes the endless belt 453 to revolve around the drive roller 451, the idler 452 and the tension roller 454. The idler 452 and the tension roller 454 rotate in response to the revolution of the endless belt 453.

The endless belt 453 includes the outer surface 455 configured to receive the sheet S from the upstream guider 460, and the inner surface 457 opposite to the outer surface 455. The inner surface 457 abuts the drive roller 451, the idler 452, and the tension roller 454. The sheet S, which is sent from the upstream guider 460 to the outer surface 455 of the endless belt 453, moves toward the downstream guider 469 in response to the revolution of the endless belt 453. The sheet S is conveyed from the upstream guider 460 to the downstream guider 469 at the first speed V1. In the following descriptions, the direction from the upstream guider 460 to the downstream guider 469 is referred to as "first direction D1". In the present embodiment, the belt unit 450G is exemplified as the conveying element. The endless belt 453 is exemplified as the conveying belt. The outer surface 455 of the endless belt 453 is exemplified as the conveying surface.

The belt unit 450G further comprises the charger 456 configured to charge the outer surface 455 of the endless belt 453. The outer surface 455 of the endless belt 453, which is charged by the charger 456, causes the sheet S to electrostatically stick thereto. Therefore, the sheet S is stably conveyed by the endless belt 453. In the present embodiment, the endless belt 453 is preferably formed from resin such as PVDF.

The belt unit 450G comprises the backup roller 340, which abuts the inner surface 457 of the endless belt 453. The backup roller 340 defines a travel path of the endless belt 453, which is curved and protruded between the drive roller 451 and the idler 452.

A fixing device 300M has a nonwoven fabric band loop 310M which rubs the image layer I on the sheet S, and a roller mechanism 930 which revolves the nonwoven fabric band loop 310M. The nonwoven fabric band loop 310M surrounds the roller mechanism 930. The nonwoven fabric band loop 310M may be formed from, for example, any of the nonwoven fabrics described in the context of FIG. 4. In the present embodiment, the nonwoven fabric band loop 310M is exemplified as the rubbing loop. The roller mechanism 930, which is used as a drive mechanism for the nonwoven fabric band loop 310M, is exemplified as the revolving mechanism.

The roller mechanism 930 has a drive roller 917 configured to revolve the nonwoven fabric band loop 310M, a tension roller 918 configured to apply tension to the nonwoven fabric band loop 310M, and a compression portion 990 configured to press the nonwoven fabric band loop 310M to the image layer I on the sheet S. The compression portion 990 includes a first press roller 993 configured to push the nonwoven fabric band loop 310M to the image layer I, and a second press roller 994 configured to push the nonwoven fabric band loop 310M to the image layer I after the first press roller 993. The compression portion 990 includes a first coil spring 971 connected to the first press roller 993, and a second coil spring 972 connected to the second press roller 994. In the present embodiment, the compression portion 990 is exemplified as the second press mechanism.

The first and second press rollers 993, 994 define a travel path of the nonwoven fabric band loop 310M along the outer surface 455 of the endless belt 453. As described above, the backup roller 340 defines a travel path of the endless belt 453 protruding toward the roller mechanism 930. The top of the travel path of the endless belt 453, which is protruded by the backup roller 340, enters in between the first and second press rollers 993, 994. Accordingly, the image layer I on the sheet S keeps in contact with the nonwoven fabric band loop 310M for relatively long time.

The first coil spring 971 biases the first press roller 993 toward the endless belt 453 with a biasing force f1. The second coil spring 972 biases the second press roller 994 toward the endless belt 453 with a biasing force f2. The biasing force f2 is preferably greater than the biasing force f1. As a result, the second press roller 994 presses the nonwoven fabric band loop 310M to the image layer I with a stronger force than the first press roller 993.

A layer of the polymer compounds R, which deposit on the surface of the image layer I, becomes hardened over time and increases scratching resistance. Therefore, rubbing the image layer I by means of the nonwoven fabric band loop 310M under a relatively low pressing force in the upstream and scratching the image layer I by means of the nonwoven fabric band loop 310M under a relatively high pressing force in the downstream may prevent damage to the image layer I and increase the fixation ratio FR of the image layer I to the sheet S.

The drive roller 917 revolves the nonwoven fabric band loop 310M at the second speed V2. As a result of the rotation of the drive roller 917, the nonwoven fabric band loop 310M between the first and second press rollers 993, 994 travels in the first direction D1 at the second speed V2. In the present embodiment, the revolution speed of the nonwoven fabric band loop 310M (the second speed V2) is greater than the conveying speed (the first speed V1) at which the sheet S is conveyed by the belt unit 450G. The difference between the revolution speed of the nonwoven fabric band loop 310M (the second speed V2) and the conveying speed of the sheet S (the first speed V1) makes the image layer I appropriately rubbed by the nonwoven fabric band loop 310M. Alternatively, the drive roller 917 may revolve the nonwoven fabric band loop 310M at a lower speed than the conveying speed of the sheet S (the first speed V1). The drive roller 917 may revolve the nonwoven fabric band loop 310M such that the nonwoven fabric band loop 310M between the first and second press rollers 993, 994 travels in an opposite direction to the conveying direction (the first direction D1) of the sheet S.

The fixing device 300M according to the fourteenth embodiment and the conveyor 400G which is used for conveying the sheet S to the fixing device 300M, are preferably incorporated in the color printer 1 described in the context of FIGS. 8 to 10, in place of the fixing device 300 and the conveyor which are described in the context of the first embodiment.

(Fifteenth Embodiment)

<Fixing Device>

Figure 48:
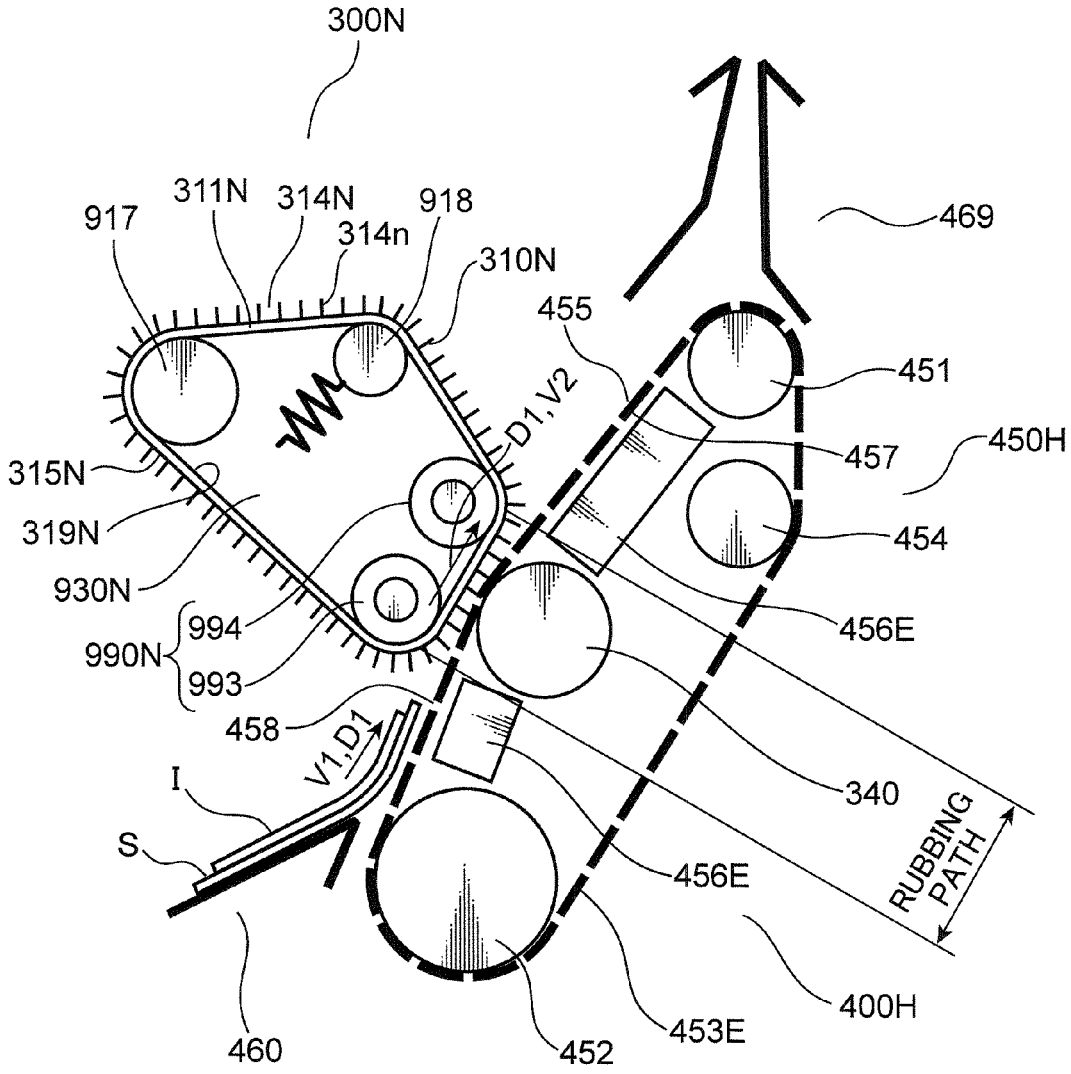
FIG. 48 is a schematic view of a conveyor and a fixing device according to the fifteenth embodiment.

FIG. 48 is a schematic view of a fixing device and a conveyor according to a fifteenth embodiment. The differences with the fourteenth embodiment are described hereinafter with reference to FIG. 48. Some descriptions overlapping with those of the fourteenth embodiment are omitted for clarification. Hereinafter, the same reference numerals are used for describing the same elements as those of the fourteenth embodiment. The descriptions associated with the fourteenth embodiment are preferably incorporated into the elements which are not described hereinafter.

The conveyor 400H configured to convey the sheet S having the image layer I formed thereon comprises the belt unit 450H, the upstream guider 460 situated before the belt unit 450H, and the downstream guider 469 situated after the belt unit 450H. The sheet S is guided by the upstream guider 460 and sent to the belt unit 450H. Thereafter, the sheet S is sent to the downstream guide 469 by the belt unit 450H.

The belt unit 450H comprises the drive roller 451, the idler 452, the endless belt 453E extending between the drive roller 451 and the idler 452, and the tension roller 454 applying tension to the endless belt 453E. Rotation of the drive roller 451 causes the endless belt 453E to revolve around the drive roller 451, the idler 452 and the tension roller 454. The idler 452 and the tension roller 454 are rotated as the endless belt 453E revolves.

The endless belt 453E includes the outer surface 455 configured to receive the sheet S from the upstream guider 460, and the inner surface 457 opposite to the outer surface 455. The inner surface 457 abuts the drive roller 451, the idler 452, and the tension roller 454. The sheet S, which is sent from the upstream guider 460 to the outer surface 455 of the endless belt 453E, moves toward the downstream guider 469 in response to the revolution of the endless belt 453E. The sheet S is conveyed from the upstream guider 460 to the downstream guider 469 at the first speed V1. In the present embodiment, the belt unit 450H is exemplified as the conveying element. The endless belt 453E is exemplified as the conveying belt. The outer surface 455 of the endless belt 453E is exemplified as the conveying surface.

The belt unit 450H comprises the vacuum device 456E nearby the inner surface 457 opposite to the outer surface 455 of the endless belt 453E, which is used as the conveying surface for conveying the sheet S. Several through-holes 458 are formed on the endless belt 453E. The vacuum device 456E suctions the sheet S on the outer surface 455 through the through-holes 458. As a result, the sheet S is stably conveyed by the endless belt 453E. In the present embodiment, the endless belt 453E is preferably formed from resin such as urethane.

The belt unit 450H comprises the backup roller 340, which abuts the inner surface 457 of the endless belt 453E. The backup roller 340 defines a travel path of the endless belt 453E which is curved and protruded between the drive roller 451 and the idler 452.

A fixing device 300N includes a brush band loop 310N configured to rub the image layer I on the sheet S, and a roller mechanism 930N configured to revolve the brush band loop 310N. The brush band loop 310N includes a strip 311N surrounding the roller mechanism 930N, and a brush layer 314N which includes multiple brushes 314*n* implanted in the strip 311N. In the present embodiment, the brush band loop 310N is exemplified as the rubbing loop.

The roller mechanism 930N comprises the drive roller 917 configured to revolve the brush band loop 310N, the tension roller 918 configured to apply tension to the brush band loop 310N, and a compression portion 990N configured to push the brush band loop 310N to the image layer I on the sheet S. The compression portion 990N comprises the first press roller 993 configured to push the brush band loop 310N to the image layer I, and the second press roller 994 configured to push the brush band loop 310N to the image layer I after the first press roller 993.

The strip 311N of the brush band loop 310N includes an outer surface 315N which holds the brushes 314*n*, and an inner surface 319N which contacts the drive roller 917, the tension roller 918, the first press roller 993, and the second press roller 994. The compression portion 990N defines a rubbing path which extends along the first direction D1 between the outer surfaces 455, 315N of the endless belt 453E and the strip 311N. The compression portion 990N defines a distance between the outer surfaces 455, 315N of the endless belt 453E and the strip 311N in the rubbing path to be shorter than a length of each brush 314*n* (the thickness of the brush layer 314N). As a result, the brush layer 314N appropriately rubs the image layer I on the sheet S traveling along the rubbing path. Preferably, the second press roller 994 sets the distance between the outer surfaces 455, 315N of the endless belt 453E and the strip 311N to be shorter than the distance defined by the first press roller 993. As a result, the image layer I is rubbed more strongly as the sheet S is conveyed to the downstream.

As described above, the layer of the polymer compounds R, which deposit on the surface of the image layer I, becomes hardened over time and increases the scratching resistance. Therefore, rubbing the image layer I with the gradually increasing force may prevent damage to the image layer I and increase the fixation ratio FR of the image layer I to the sheet S.

The drive roller 917 revolves the brush band loop 310N at the second speed V2. As a result of the rotation of the drive roller 917, the brush band loop 310N defining the rubbing path travels in the first direction D1 at the second speed V2. In the present embodiment, the revolution speed of the brush band loop 310N (the second speed V2) is greater than the conveying speed (the first speed V1) at which the sheet S is conveyed by the belt unit 450H. The difference between the revolution speed of the brush band loop 310N (the second speed V2) and the conveying speed of the sheet S (the first speed V1) makes the image layer I appropriately rubbed by the brush band loop 310N. Alternatively, the drive roller 917 may revolve the brush band loop 310N at a lower speed than the conveying speed of the sheet S (the first speed V1). The drive roller 917 may revolve the brush band loop 310N such that the brush band loop 310N defining the rubbing path travels in an opposite direction to the conveying direction of the sheet S (the first direction D1).

The fixing device 300N according to the fifteenth embodiment and the conveyor 400H which is used for conveying the sheet S to the fixing device 300N, are preferably incorporated in the color printer 1 described in the context of FIGS. 8 to 10, in place of the fixing device 300 and the conveyor which are described in the context of the first embodiment.

(Sixteenth Embodiment)

<Fixing Device>

A fixing device according to a sixteenth embodiment is different from the fixing device 300M according to the fourteenth embodiment, in terms of a separating/approaching device configured to cause the compression portion 990 to separate from or approach the endless belt 453. Some descriptions overlapping with those of the fourteenth embodiment are omitted for clarification. Hereinafter, the same reference numerals are used for describing the same elements as those of the fourteenth embodiment. The descriptions associated with the fourteenth embodiment are preferably incorporated into the elements which are not described hereinafter.

Figure 49A:
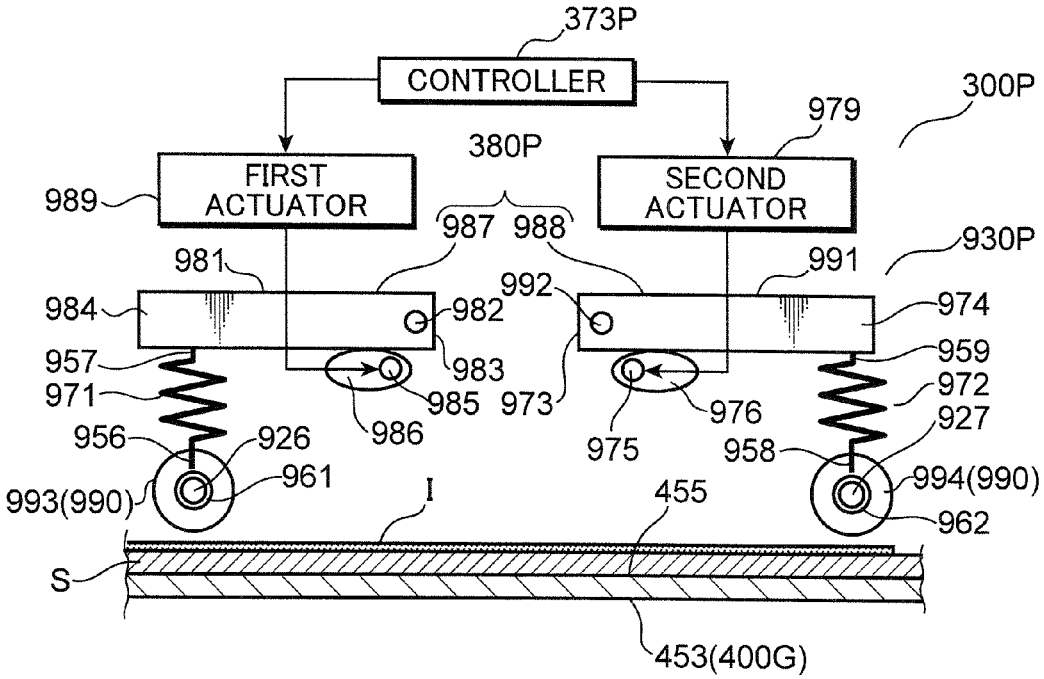
FIG. 49A is a schematic view of a separator and a conveyor which are used in a fixing device according to the sixteenth embodiment.
Figure 49B:
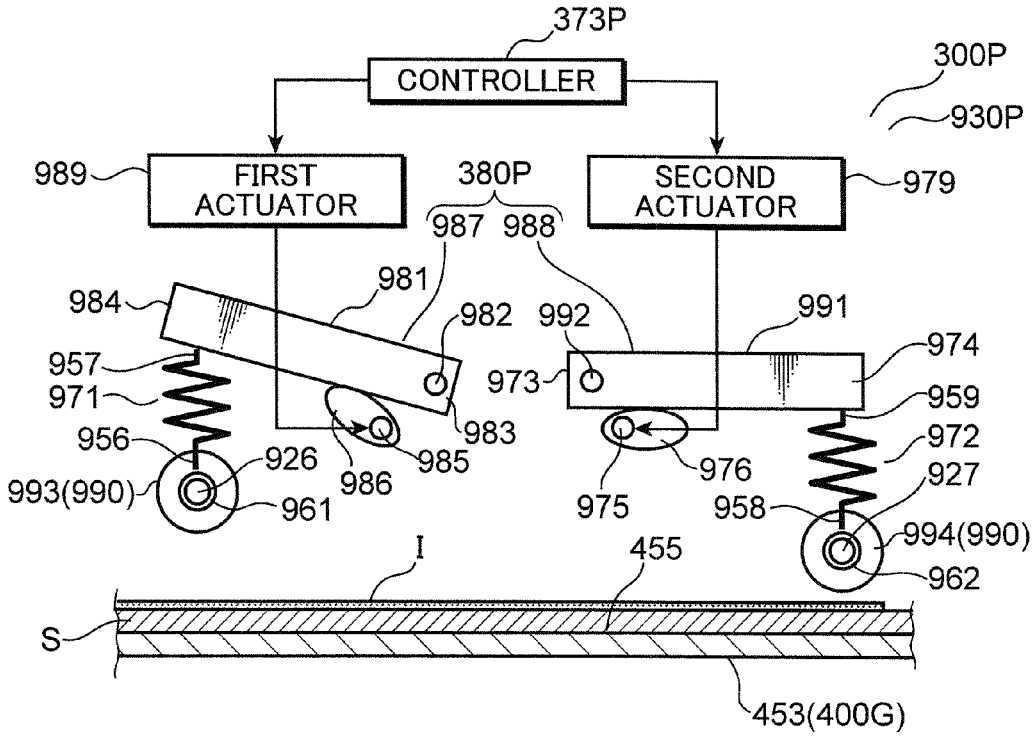
FIG. 49B is a schematic view of the separator and conveyor which are used in the fixing device according to the sixteenth embodiment.
Figure 50:
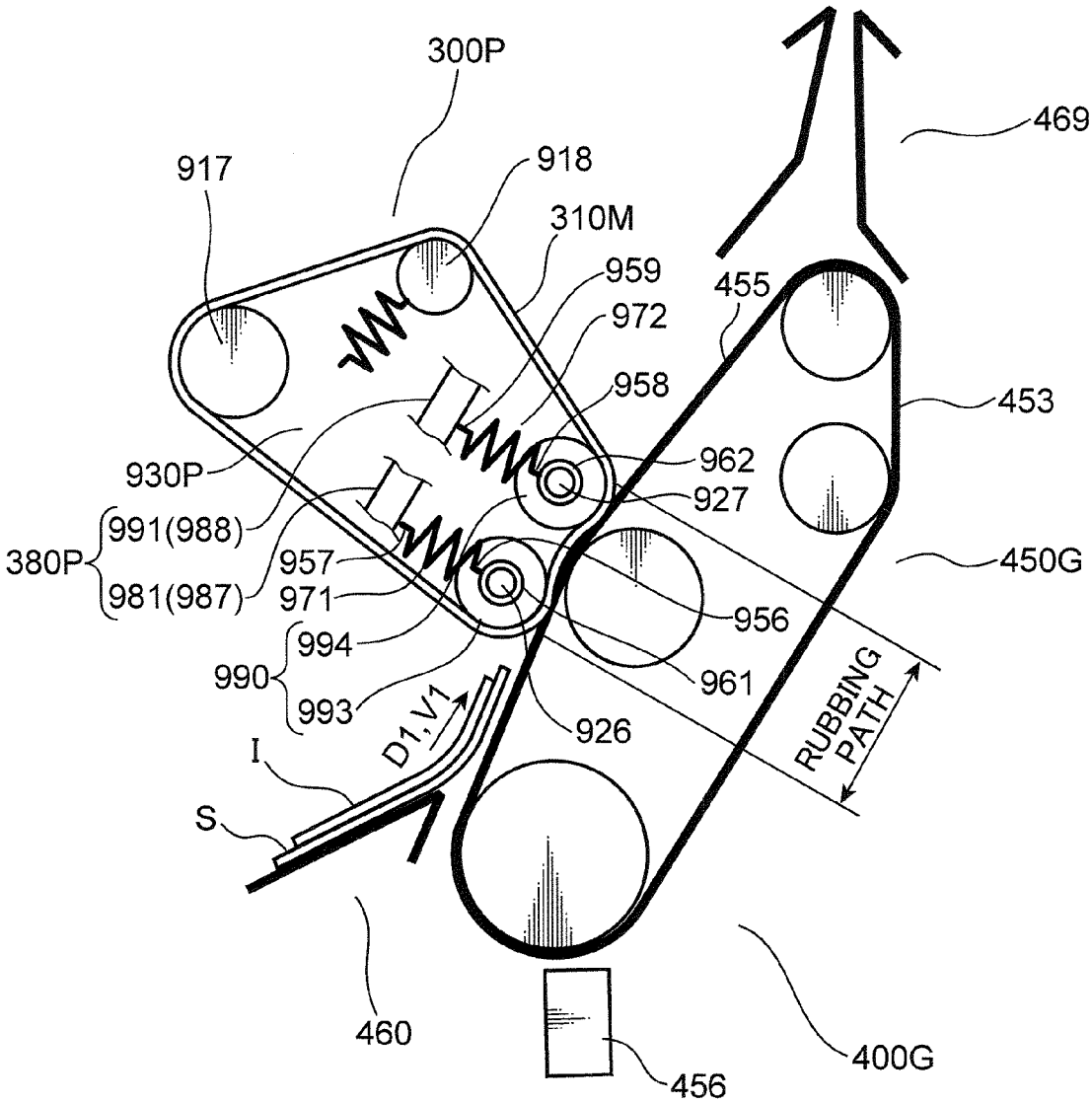
FIG. 50 is a schematic view of the separator and conveyor which are used in the fixing device according to the sixteenth embodiment.

FIGS. 49A and 49B are schematic views of a separating/approaching device configured to separate the compression portion 990 from the endless belt 453. FIG. 49A shows the compression portion 990 situated in a proximal position near the endless belt 453. FIG. 49B shows the first press roller 993 situated in a separation position away from the endless belt 453, and the second press roller 994 situated in the proximal position. It should be noted that neither FIGS. 49A nor 49B shows the nonwoven fabric band loop in order to clarify the separating/approaching device. FIG. 50 is a schematic view of the fixing device and a conveyor according to the sixteenth embodiment.

A fixing device 300P adjacent to the conveyor 400G configured to convey the sheet S includes the nonwoven fabric band loop 310M which rubs the image layer I on the sheet S, and a roller mechanism 930P configured to revolve the nonwoven fabric band loop 310M. The roller mechanism 930P is exemplified as the revolving mechanism.

The roller mechanism 930P comprises the drive roller 917 configured to revolve the nonwoven fabric band loop 310M, the tension roller 918 configured to apply tension to the nonwoven fabric band loop 310M, and the compression portion 990 configured to press the nonwoven fabric band loop 310M to the image layer I on the sheet S. The compression portion 990 includes the first press roller 993 configured to press the nonwoven fabric band loop 310M to the image layer I, and the second press roller 994 configured to press the nonwoven fabric band loop 310M to the image layer I after the first press roller 993. The compression portion 990 includes the first coil spring 971 connected to the first press roller 993, and the second coil spring 972 connected to the second press roller 994.

The first press roller 993 includes a rotating shaft 926 and a bearing 961 configured to support the rotating shaft 926. The second press roller 994 includes a rotating shaft 927 and a bearing 962 configured to support the rotating shaft 927. The first coil spring 971 includes a first end 956 connected to the bearing 961, and a second end 957 opposite to the first end 956. The second coil spring 972 includes a first end 958 connected to the bearing 962, and a second end 959 opposite to the first end 958.

The roller mechanism 930P comprises a separating/approaching device 380P. The separating/approaching device 380P includes a first separating/approaching device 987 configured to cause the first press roller 993 to separate from or approach the outer surface 455 of the endless belt 453, and a second separating/approaching device 988 configured to cause the second press roller 994 to separate from or approach the outer surface 455 of the endless belt 453.

The first separating/approaching device 987 comprises a rod arm 981 connected to the second end 957 of the first coil spring 971, and a turning shaft 982 configured to support the rotatable arm 981. The arm 981 includes a base end 983 connected to the turning shaft 982, and a tip end 984 opposite to the base end 983. The first coil spring 971 is connected to the tip end 984 of the arm 981. The base end 983 of the arm 981 is mounted on the turning shaft 982 via, for example, a twisted coil spring (not shown). The twisted coil spring biases the tip end 984 of the arm 981 toward the outer surface 455 of the endless belt 453. As a result, while the first press roller 993 exists in the proximal position, the compressed first coil spring 971 biases the first press roller 993 toward the image layer I on the sheet S.

The first separating/approaching device 987 comprises a rotating shaft 985 and an eccentric cam piece 986 integrally mounted on the rotating shaft 985. The rotating shaft 985 is rotated by, for example, a first actuator 989 such as a solenoid switch (not shown). As a result, the eccentric cam piece 986 eccentrically rotates around the rotating shaft 985 to separate the tip end 984 of the arm 981 from the endless belt 453. Consequently, the first press roller 993 is moved to the separation position.

The second separating/approaching device 998 comprises a rod arm 991 connected to the second end 959 of the second coil spring 972, and a turning shaft 992 configured to support the rotatable arm 991. The arm 991 includes a base end 973 connected to the turning shaft 992, and a tip end 974 opposite to the base end 973. The second coil spring 972 is connected to the tip end 974 of the arm 991. The base end 973 of the arm 991 is mounted on the turning shaft 992 via, for example, a twisted coil spring (not shown). The twisted coil spring biases the tip end 974 of the arm 991 toward the outer surface 455 of the endless belt 453. As a result, while the second press roller 994 exists in the proximal position, the compressed second coil spring 972 biases the second press roller 994 toward the image layer I on the sheet S.

The second separating/approaching device 988 comprises a rotating shaft 975 and an eccentric cam piece 976 integrally mounted on the rotating shaft 975. The rotating shaft 975 is rotated by, for example, a second actuator 979 such as a solenoid switch (not shown). As a result, the eccentric cam piece 976 eccentrically rotates around the rotating shaft 975 to separate the tip end 974 of the arm 991 from the endless belt 453. Consequently, the second press roller 994 is moved to the separation position.

The roller mechanism 930P has a controller 373P configured to independently control the first and second separating/approaching devices 987, 988. Under the control of the controller 373P, the first and second separating/approaching devices 987, 988 independently causes the first and second press rollers 993, 994 to separate from or approach the outer surface 455 of the endless belt 453. Therefore, a length of the rubbing path extending in the first direction D1 is adjusted under the control of the controller 373P.

The controller 373P may cause the first or second press roller 993, 994 to separate from or approach the outer surface 455 of the endless belt 453, for example, in response to the print ratio of the image layer I. For instance, if the print ratio of the image layer I is relatively low, the controller 373P may separate the first press roller 993 from the outer surface 455 of the endless belt 453 and keep the second press roller 994 at the proximal position. If the print ratio of the image layer I is relatively high, the controller 373P may keep both the first and second press rollers 993, 994 at the proximal position.

Figure 51A:
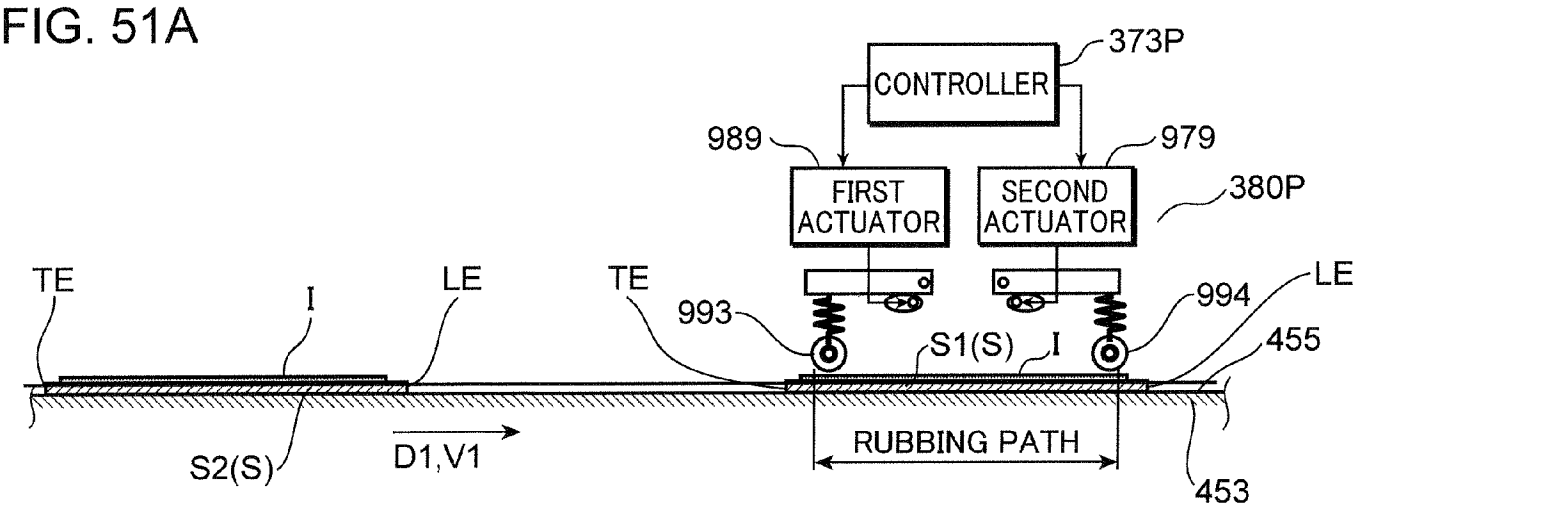
FIG. 51A is a schematic view of other operations performed by the fixing device according to the sixteenth embodiment.
Figure 51B:
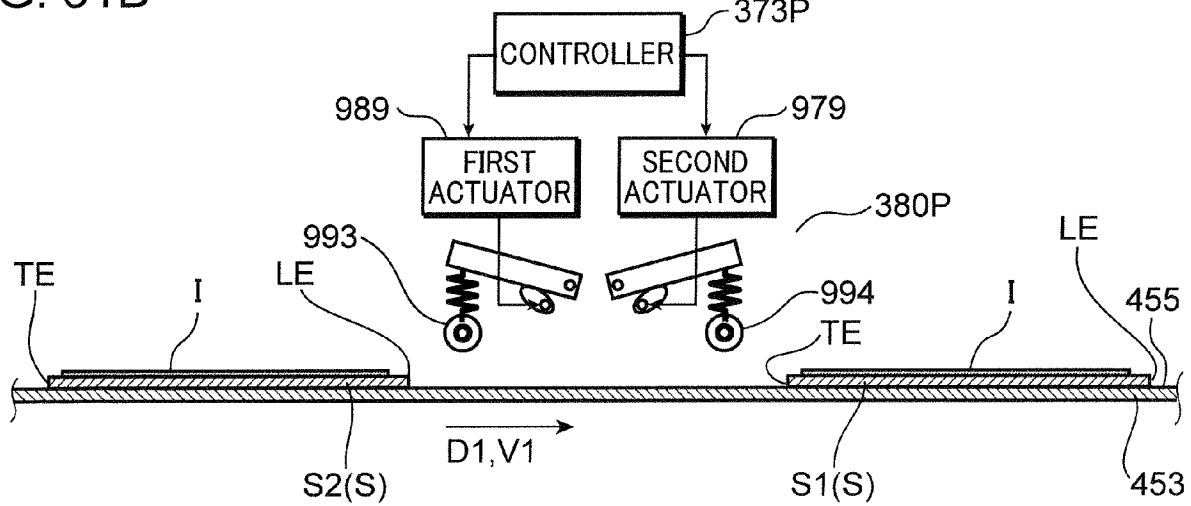
FIG. 51B is a schematic view of other operations performed by the fixing device according to the sixteenth embodiment.

FIGS. 51A and 51B schematically show the operations performed by the separating/approaching device 380P. FIG. 51A schematically shows the separating/approaching device 380P which keeps the first and second press rollers 993, 994 at the proximal position. FIG. 51B schematically shows the separating/approaching device which displaces the first and second press rollers 993, 994 to the separation position. The operations of the separating/approaching device 380P are described with reference to FIGS. 50 to 51B.

The sheets S are sequentially sent from the upstream guider 460 to the belt unit 450G. The sheets S, which electrostatically stick to the outer surface 455 of the endless belt 453 charged by the charger 456, are sequentially conveyed toward the downstream guider 469.

FIGS. 51A and 51B show the sheet S1 and the sheet S2 following the sheet S1, as the sheets S. Each sheet S includes a leading edge LE which first enters into the rubbing path and a trailing edge TE opposite to the leading edge LE. The leading edge LE of the sheet S2 is away from the trailing edge TE of the preceding sheet S1. The conveyance of the sheets S shown in FIGS. 51A and 51B is adopted in various image forming apparatuses such as copy machines, printers, facsimile devices, and combined machines.

As shown in FIGS. 51A and 51B, the sheets S1 and S2 are conveyed by the endless belt 453 in the first direction D1 at the first speed V1. If the controller 373P controls the first and second actuators 989, 979 so that the first and second press rollers 993, 994 approach the outer surface 455 of the endless belt 453, the rubbing path extending in the first direction D1 is defined between the nonwoven fabric band loop 310M and the outer surface 455 of the endless belt 453. While each sheet S passes through the rubbing path, the image layer I is rubbed by the nonwoven fabric band loop 310M.

If the sheet S1 passes through the rubbing path, the controller 373P controls the first and second actuators 989, 979 to displace the first and second press rollers 993, 994 to the separation position away from the outer surface 455 of the endless belt 453. Subsequently, immediately before the sheet S2 passes between the first press roller 993 and the endless belt 453, the controller 373P controls the first and second actuators 989, 979 so that the first and second press rollers 993, 994 approach the outer surface 455 of the endless belt 453. As a result, the rubbing path is defined. Therefore, it is less likely that the nonwoven fabric band loop 310M and the endless belt 453 rub each other between the sheet S1 and the sheet S2.

The fixing device 300P according to the sixteenth embodiment and the conveyor 400G which is used for conveying the sheet S to the fixing device 300P, are preferably incorporated in the color printer 1 described in the context of FIGS. 8 to 10, in place of the fixing device 300 and the conveyor which are described in the context of the first embodiment.

(Seventeenth Embodiment)

<Fixing Device>

Figure 52:
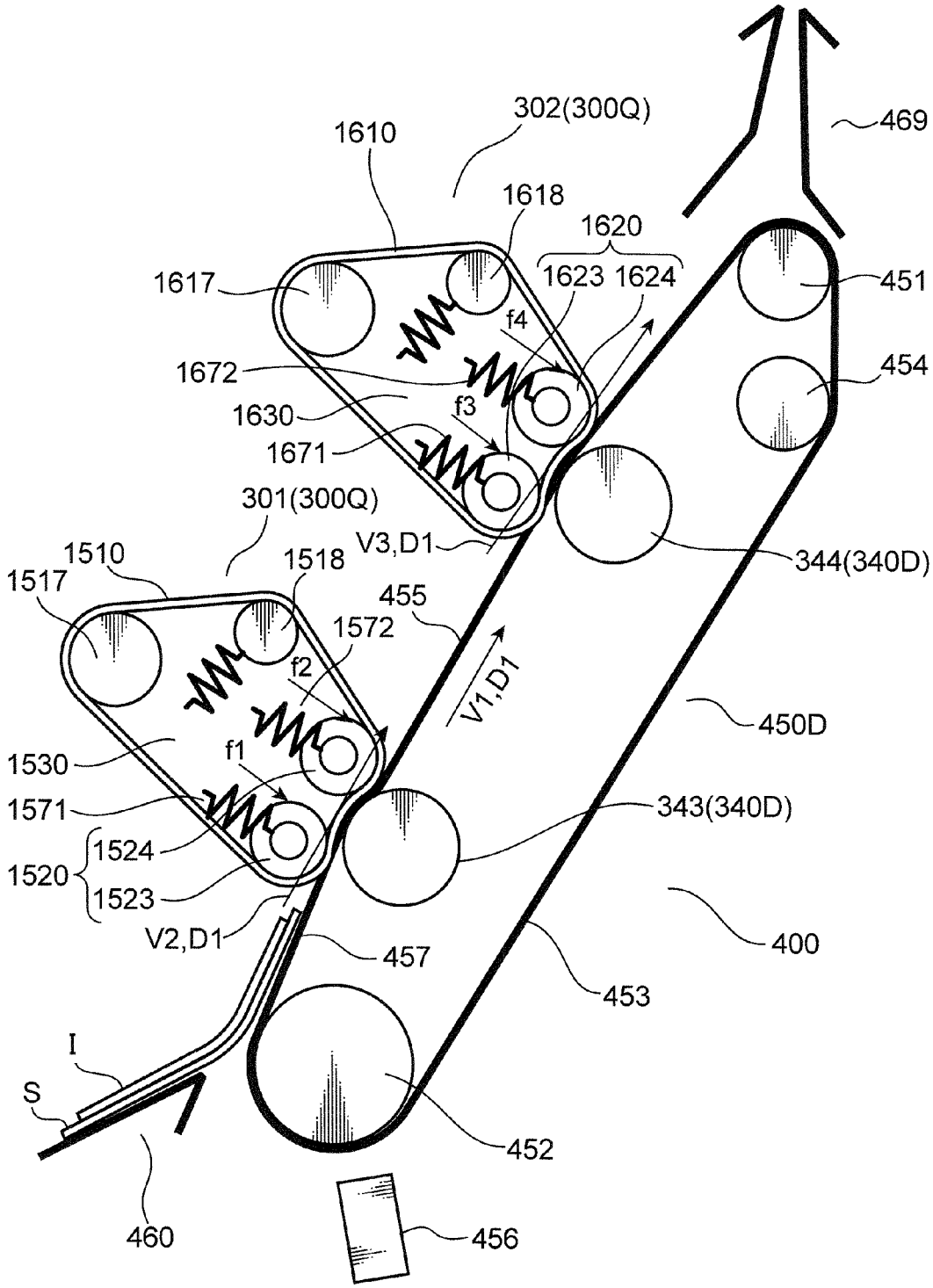
FIG. 52 is a schematic view of a conveyor and a fixing device according to the seventeenth embodiment.

FIG. 52 is a schematic view of a fixing device and a conveyor according to the seventeenth embodiment. The differences from the fourteenth embodiment are described hereinafter with reference to FIGS. 1A to 1C and FIGS. 4 and 52. Some descriptions overlapping with those of the fourteenth embodiment are omitted for Clarification. Hereinafter, the same reference numerals are used for describing the same elements as those of the fourteenth embodiment. The descriptions associated with the fourteenth embodiment are preferably incorporated into the elements which are not described hereinafter.

The conveyor 400 configured to convey the sheet S having the image layer I formed thereon comprises the belt unit 450D, the upstream guider 460 situated before the belt unit 450D, and the downstream guider 469 situated after the belt unit 450D. The sheet S is guided by the upstream guider 460 and sent to the belt unit 450D. Thereafter, the sheet S is sent to the downstream guide 469 by the belt unit 450D.

The belt unit 450D comprises the drive roller 451, the idler 452, the endless belt 453 extending between the drive roller 451 and the idler 452, and the tension roller 454 applying tension to the endless belt 453. Rotation of the drive roller 451 causes the endless belt 453 to revolve around the drive roller 451, the idler 452 and the tension roller 454. The idler 452 and the tension roller 454 are rotated as the endless belt 453 revolves.

The endless belt 453 includes the outer surface 455 configured to receive the sheet S from the upstream guider 460, and the inner surface 457 opposite to the outer surface 455. The inner surface 457 abuts the drive roller 451, the idler 452, and the tension roller 454. The sheet S, which is sent from the upstream guider 460 to the outer surface 455 of the endless belt 453, moves toward the downstream guider 469 in response to the revolution of the endless belt 453. The sheet S is conveyed from the upstream guider 460 to the downstream guider 469 at the first speed V1.

The belt unit 450D further comprises the charger 456 configured to charge the outer surface 455 of the endless belt 453. The sheet S electrostatically sticks to the outer surface 455 of the endless belt 453 charged by the charger 456. Therefore, the sheet S is stably conveyed by the endless belt 453.

The belt unit 450D comprises the backup roller 340D, which abuts the inner surface 457 of the endless belt 453. The backup roller 340D includes the upstream backup roller 343 nearby the idler 452, and the downstream backup roller 344 near the drive roller 451.

A fixing device 300Q includes an upstream fixing device 301 corresponding to the upstream backup roller 343, and a downstream fixing device 302 corresponding to the downstream backup roller 344. The upstream fixing device 301 first rubs the image layer I on the sheet S, which has sent from the upstream guider 460 to the endless belt 453. Subsequently, the downstream fixing device 302 rubs the image layer I. This increases the rubbing time for rubbing the image layer I.

The upstream fixing device 301 includes an upstream nonwoven fabric band loop 1510 configured to rub the image layer I on the sheet S, and an upstream roller mechanism 1530 configured to revolve the upstream nonwoven fabric band loop 1510. The upstream nonwoven fabric band loop 1510 surrounds the upstream roller mechanism 1530. The upstream nonwoven fabric band loop 1510 may be formed from any of the nonwoven fabrics described in the context of FIG. 4.

The upstream roller mechanism 1530 comprises a drive roller 1517 configured to revolve the upstream nonwoven fabric band loop 1510, a tension roller 1518 configured to apply tension to the upstream nonwoven fabric band loop 1510, and an upstream compression portion 1520 configured to press the upstream nonwoven fabric band loop 1510 to the image layer I on the sheet S. The upstream compression portion 1520 comprises a first press roller 1523 configured to press the upstream nonwoven fabric band loop 1510 to the image layer I, and a second press roller 1524 configured to press the upstream nonwoven fabric band loop 1510 to the image layer I after the first press roller 1523. The upstream compression portion 1520 comprises a first coil spring 1571 connected to the first press roller 1523, and a second coil spring 1572 connected to the second press roller 1524.

The first and second press rollers 1523, 1524 define a travel path of the upstream nonwoven fabric band loop 1510 along the outer surface 455 of the endless belt 453. The upstream backup roller 343 defines a travel path of the endless belt 453 protruding toward the upstream roller mechanism 1530. The top of the travel path of the endless belt 453, which is protruded by the upstream backup roller 343, enters between the first and second press rollers 1523, 1524. Accordingly, the image layer I on the sheet S keeps in contact with the upstream nonwoven fabric band loop 1510 for relatively long time.

The downstream fixing device 302 includes a downstream nonwoven fabric band loop 1610 configured to rub the image layer I on the sheet S, and a downstream roller mechanism 1630 configured to revolve the downstream nonwoven fabric band loop 1610. The downstream nonwoven fabric band loop 1610 surrounds the downstream roller mechanism 1630. The downstream nonwoven fabric band loop 1610 may be formed from, for example, any of the nonwoven fabrics described in the context of FIG. 4.

The downstream roller mechanism 1630 comprises a drive roller 1617 configured to revolve the downstream nonwoven fabric band loop 1610, a tension roller 1618 configured to apply tension to the downstream nonwoven fabric band loop 1610, and a downstream compression portion 1620 configured to press the downstream nonwoven fabric band loop 1610 to the image layer I on the sheet S. The downstream compression portion 1620 comprises a third press roller 1623 configured to press the downstream nonwoven fabric band loop 1610 to the image layer I, and a fourth press roller 1624 configured to press the downstream nonwoven fabric band loop 1610 to the image layer I after the third press roller 1623.

The downstream compression portion 1620 comprises a third coil spring 1671 connected to the third press roller 1623, and a fourth coil spring 1672 connected to the fourth press roller 1624.

The third and fourth press rollers 1623, 1624 define a travel path of the downstream nonwoven fabric band loop 1610 along the outer surface 455 of the endless belt 453. The downstream backup roller 344 defines a travel path of the endless belt 453 protruding toward the downstream roller mechanism 1630. The top of the travel path of the endless belt 453, which is protruded by the downstream backup roller 344, enters between the third and fourth press rollers 1623, 1624. Accordingly, the image layer I on the sheet S keeps in contact with the downstream nonwoven fabric band loop 1610 for relatively long time.

The first coil spring 1571 biases the first press roller 1523 toward the endless belt 453 with the biasing force f1. The second coil spring 1572 biases the second press roller 1524 toward the endless belt 453 with the biasing force f2. The biasing force f2 is preferably greater than the biasing force f1. As a result, the second press roller 1524 presses the upstream nonwoven fabric band loop 1510 to the image layer I with a stronger force than the first press roller 1523.

The third coil spring 1671 biases the third press roller 1623 toward the endless belt 453 with a biasing force f3. The fourth coil spring 1672 biases the fourth press roller 1624 toward the endless belt 453 with a biasing force f4. The biasing force f4 is preferably greater than the biasing force f3. As a result, the fourth press roller 1624 presses the downstream nonwoven fabric band loop 1610 to the image layer I with a stronger force than the third press roller 1623.

A total force of the biasing forces f3, f4 is preferably greater than a total force of the biasing forces f1, f2. The layer of the polymer compounds R, which deposit on the surface of the image layer I, becomes hardened over time and increases scratching resistance. Therefore, rubbing the image layer I by means of the upstream nonwoven fabric band loop 1510 under a relatively low pressing force in the upstream and rubbing the image layer I by means of the downstream nonwoven fabric band loop 1610 under a relatively high pressing force in the downstream may prevent damage to the image layer I and increase the fixation ratio FR of the image layer I to the sheet S.

The drive roller 1517 of the upstream roller mechanism 1530 revolves the upstream nonwoven fabric band loop 1510 at the second speed V2. As a result of the rotation of the drive roller 1517, the upstream nonwoven fabric band loop 1510 between the first and second press rollers 1523, 1524 travels in the first direction D1 at the second speed V2. In the present embodiment, the revolution speed of the upstream nonwoven fabric band loop 1510 (the second speed V2) is greater than the conveying speed (the first speed V1) at which the sheet S is conveyed by the belt unit 450D. The difference between the revolution speed of the upstream nonwoven fabric band loop 1510 (the second speed V2) and the conveying speed (the first speed V1) of the sheet S makes the image layer I appropriately rubbed by the upstream nonwoven fabric band loop 1510.

The drive roller 1617 of the downstream roller mechanism 1630 revolves the downstream nonwoven fabric band loop 1610 at the third speed V3. As a result of the rotation of the drive roller 1617, the downstream nonwoven fabric band loop 1610 between the third and fourth press rollers 1623, 1624 travels in the first direction D1 at the third speed V3. In the present embodiment, the revolution speed of the downstream nonwoven fabric band loop 1610 (the third speed V3) is greater than the revolution speed of the upstream nonwoven fabric band loop 1510 (the second speed V2). As a result, the image layer I is rubbed more by the downstream nonwoven fabric band loop 1610 than the upstream nonwoven fabric band loop 1510.

The fixing device 300Q according to the seventeenth embodiment and the conveyor 400, which is used for conveying the sheet S to the fixing device 300Q, are preferably incorporated in the color printer 1 described in the context of FIGS. 8 to 10, in place of the fixing device 300 and the conveyor which are described in the context of the first embodiment.

(Eighteenth Embodiment)

<Fixing Device>

Figure 53:
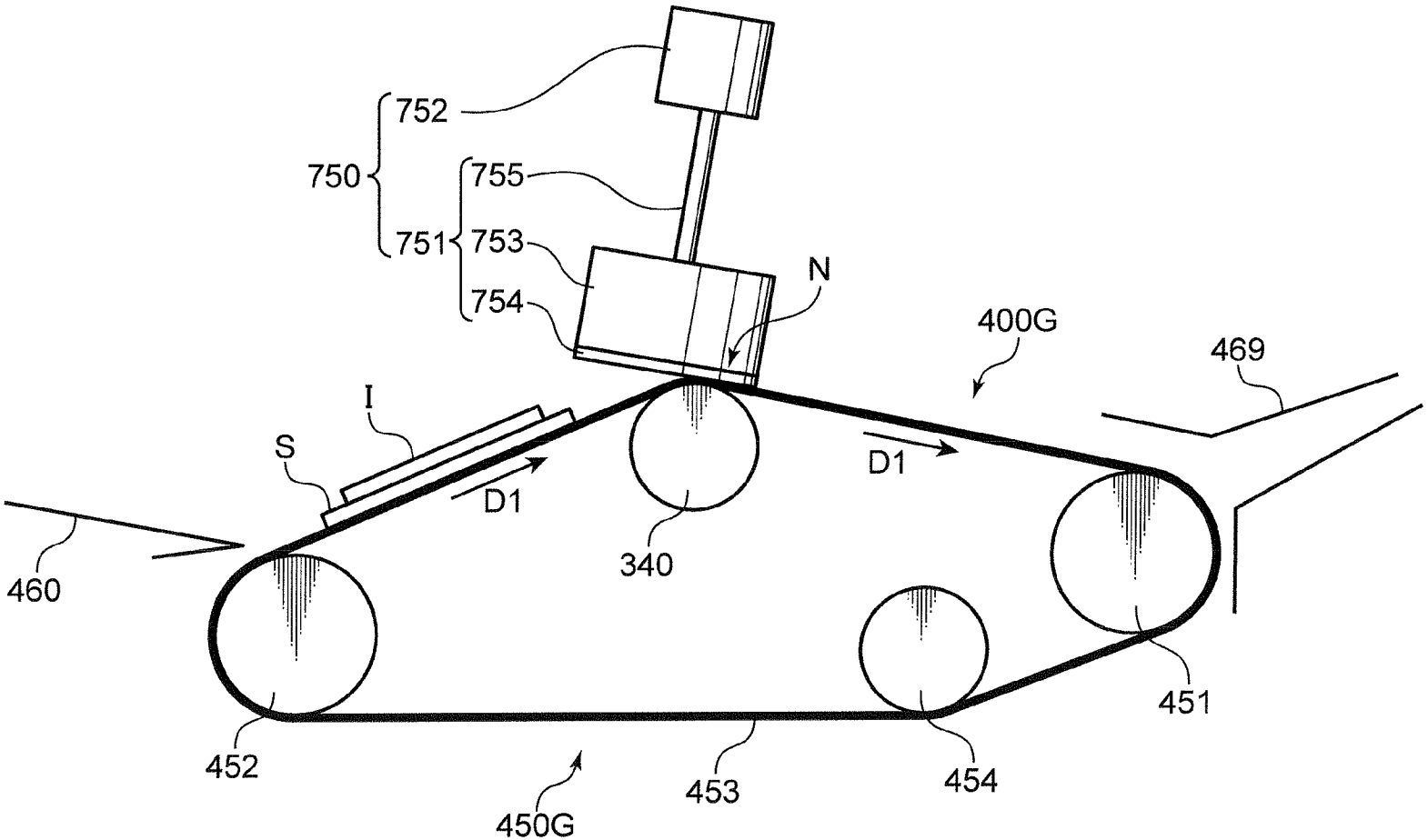
FIG. 53 is a schematic view of a fixing device and a conveyor according to the eighteenth embodiment.

FIG. 53 is a schematic view of a fixing device 750 and conveyor 400G according to the eighteenth embodiment. The fixing device 750 and the conveyor 400G according to the eighteenth embodiment are described with reference to FIG. 53. Hereinafter, the same reference numerals are used for describing the same elements as those of the aforementioned embodiments. The descriptions associated with the aforementioned embodiments are preferably incorporated into the elements which are not described hereinafter.

The sheet S having the image layer I formed thereon is conveyed to the fixing device 750 by the conveyor 400G. The conveyor 400G comprises the belt unit 450G, the upstream guider 460 situated before the belt unit 450G, and the downstream guider 469 situated after the belt unit 450G. The sheet S is guided by the upstream guider 460 and sent to the belt unit 450G. Thereafter, the sheet S is sent to the downstream guide 469 by the belt unit 450G. In the present embodiment, the surface of the sheet S, on which the image layer I is formed, is exemplified as the formation surface.

The belt unit 450G comprises the drive roller 451, the idler 452, the endless belt 453 extending between the drive roller 451 and the idler 452, and the tension roller 454 applying tension to the endless belt 453. Rotation of the drive roller 451 causes the endless belt 453 to revolve around the drive roller 451, the idler 452 and the tension roller 454. The idler 452 and the tension roller 454 rotate in response to the revolution of the endless belt 453. As a result, the sheet S, which is sent from the upstream guider 460 to the endless belt 453, moves toward the downstream guider 469 in response to the revolution of the endless belt 453. The sheet S is conveyed from the upstream guider 460 to the downstream guider 469 at the first speed V1. Reference numeral D1 represents the direction in which the sheet S is moved from the upstream guider 460 toward the downstream guider 469 by the belt unit 450G. The belt unit 450G is exemplified as the conveying element.

The belt unit 450G further comprises the backup roller 340 arranged inside the endless belt 453. The backup roller 340 abuts with the inner surface of the endless belt 453 at a position between the drive roller 451 and the idler 452, which is situated on the opposite side to the tension roller 454.

The fixing device 750 rubs and fixes the image layer I on the sheet S. The fixing device 750 includes a rubbing member 751 situated on the opposite side of the backup roller 340 so that the endless belt 453 intervenes between the rubbing member 751 and the backup roller 340, and a drive source 752 configured to drive the rubbing member 751.

The rubbing member 751 includes a supporting member 753, a nonwoven fabric layer 754, and a shaft 755.

Figure 54:
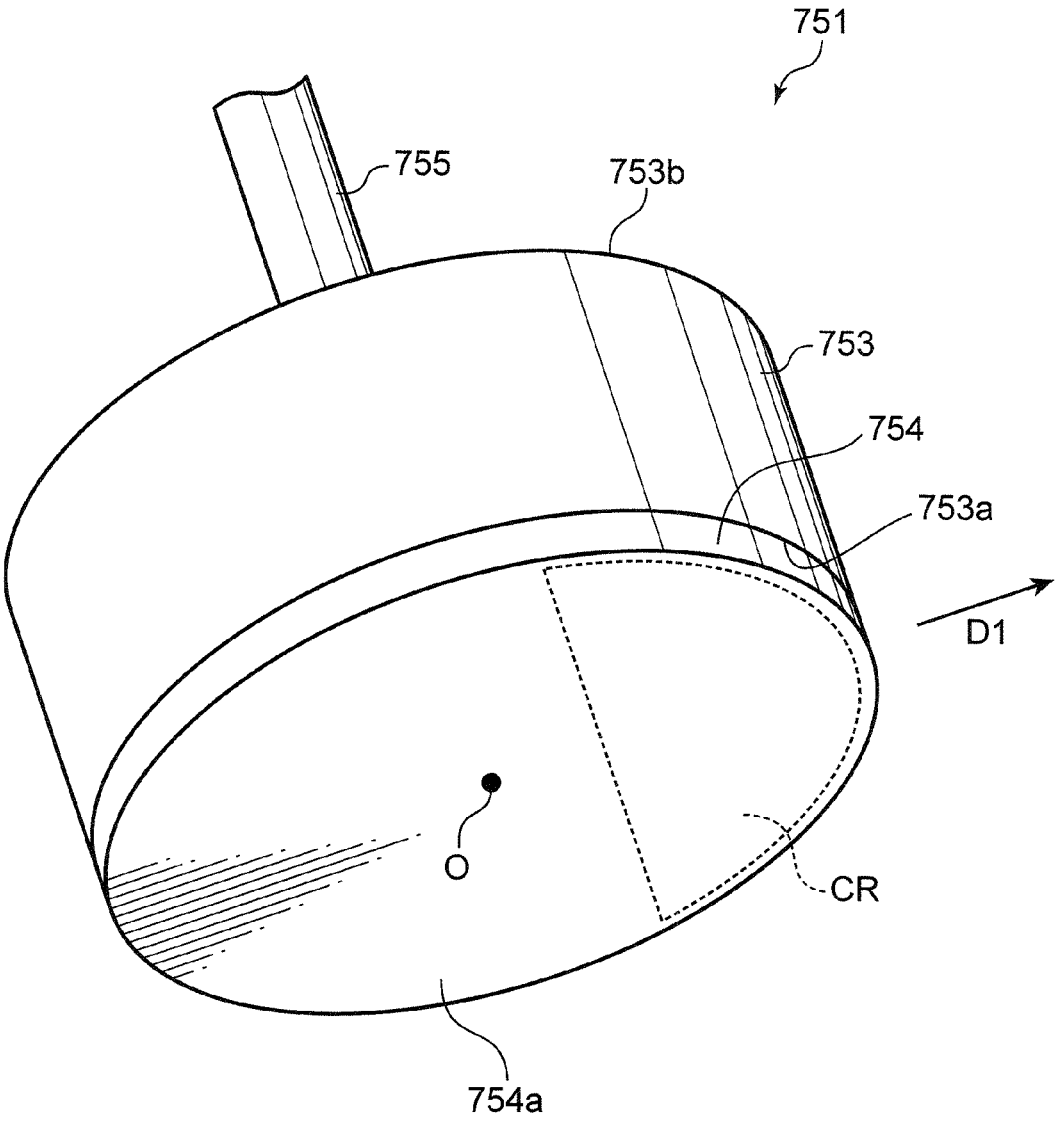
FIG. 54 is a perspective view of a rubbing member.

FIG. 54 is a perspective view of the rubbing member 751. The supporting member 753 is a cylindrical block member. The supporting member 753 includes a first supporting surface 753*a*, which is an end surface facing the endless belt 453, and a second supporting surface 753*b*, which is an end surface opposite to the first supporting surface 753*a* in the axial direction. The first and second supporting surfaces 753*a*, 753*b* are substantially circular.

The nonwoven fabric layer 754 rubs the image layer I on the sheet S. The nonwoven fabric layer 754, which is made of a nonwoven fabric, is mounted on the entire first supporting surface 753*a* and looks circular in a plane. Any of the nonwoven fabrics described in the context of FIG. 4 may be used as the nonwoven fabric. The dynamic friction coefficient of the nonwoven fabric is no more than 0.50. The backup roller 340 of the belt unit 450G is arranged such that the surface pressure between the backup roller 340 and a layer surface 754*a* of the nonwoven fabric layer 754 becomes, for example, 0.2 g/mm$^2$. Therefore, the nonwoven fabric layer 754 keeps in surface contact with the endless belt 453. The layer surface 754*a* of the nonwoven fabric layer 754, which contacts the endless belt 453, forms a rubbing surface. The layer thickness of the nonwoven fabric layer 754 is appropriately set such that the nonwoven fabric layer 754 and the image layer I come into smooth contact with each other.

Figure 55:
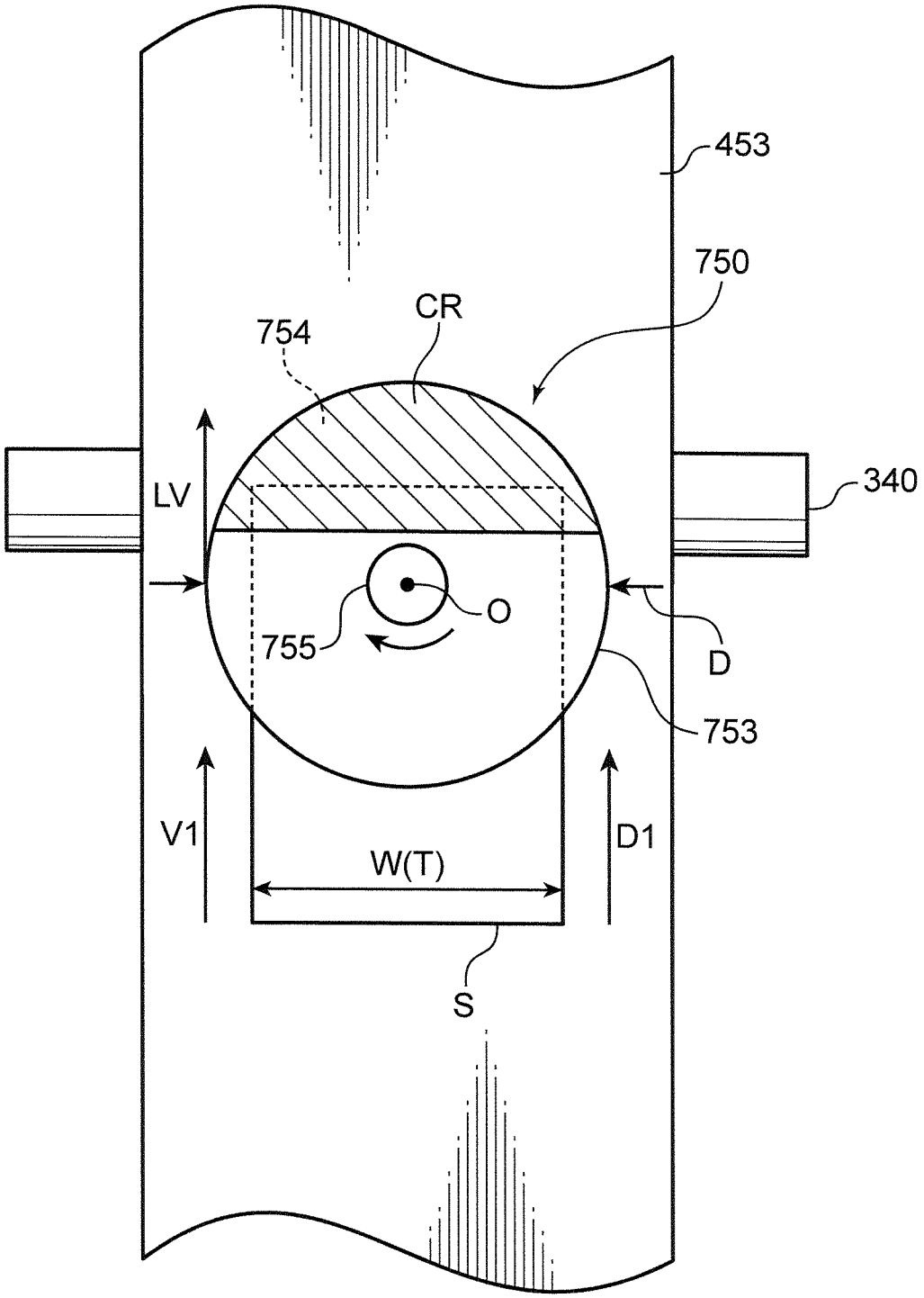
FIG. 55 is a plan view of the rubbing member and an endless belt.

The nonwoven fabric layer 754 has a rubbing region CR in which the nonwoven fabric layer 754 rubs the image layer I while keeping in surface contact with the image layer I. The rubbing region CR is described with reference to FIGS. 53 to 55. FIG. 55 is a plan view of the rubbing member 751 and the endless belt 453. The shaft 755 is fixed to the second supporting surface 753*b* of the supporting member 753 at a position where one end of the shaft 755 aligns with the central axis of the supporting member 753. The drive source 752 is, for example, a motor, which is coupled to the other end of the shaft 755 and rotates the shaft 755 in the clockwise direction in FIG. 55. The nonwoven fabric layer 754 has a rotation center O, which conforms with the central axis of the supporting member 753, and a rotation axis of the shaft 755 (a rotation axis extending in an intersecting direction with the surface of the sheet on which the image layer I is formed). When the shaft 755 rotates, the supporting member 753 rotates around the central axis. The nonwoven fabric layer 754 mounted on the first supporting surface 753*a* of the supporting member 753 also rotates around the rotation center O while keeping in contact with the endless belt 453. In the present embodiment, the layer surface 754*a* of the nonwoven fabric layer 754 is exemplified as the rotation surface.

The rubbing region CR is a region which is set on the downstream side from the rotation center O of the nonwoven fabric layer 754 when viewed from the conveying direction (the first direction D1) of the sheet S, and looks a substantially semicircular shape in a plane. The nonwoven fabric layer 754 contacts the endless belt 453 to form a nip portion N with the endless belt only in the rubbing region CR. The entire rubbing region CR of the nonwoven fabric layer 754 comes into surface contact with the sheet S at the nip portion N. The position where the backup roller 340 abuts the endless belt 453 and the inclination angle of the shaft 755 with respect to the rubbing member 751 are appropriately adjusted such that the rubbing region CR becomes semicircular.

Therefore, when the sheet S is conveyed to the nip portion N, the nonwoven fabric layer 754 rotates around the rotation center O while keeping in surface contact with the sheet S in the rubbing region CR and rubs the image layer I. FIG. 55 shows a state in which the leading end of the sheet S in the conveying direction (the first direction D1) is in surface contact with the rubbing region CR.

In the eighteenth embodiment, a linear speed in a tangential direction of the supporting member 753 rotated by the shaft 755 (that is a linear speed LV of the nonwoven fabric layer 754) may be greater than the first speed V1 of conveying the sheet S. In addition, the diameter of the supporting member 753 (that is the diameter D of the nonwoven fabric layer 754) is greater than a sheet width W perpendicular to the conveying direction (the first direction D1) of the sheet S, so that the entire image layer I is rubbed.

According to the aforementioned fixing device 750 of the eighteenth embodiment, the rubbing region CR of the nonwoven fabric layer 754, which rotates around the rotation center O, keeps in surface contact with the sheet S to rub the image layer I. In addition, the linear speed LV of the nonwoven fabric layer 754 may be greater than the first speed V1 of conveying the sheet S. Thus, the time period in which the image layer I is rubbed by the nonwoven fabric layer 754 becomes long, compared to a configuration in which a roller rubs the image layer I while keeping in linear contact with the sheet S. Therefore, the components of the liquid developer, which forms the image layer I, are facilitated to enter into the surface layer of the sheet S, which results in shorter time period required for the fixation of the image layer I. Therefore it becomes less likely that the image layers I peels off because the image layer I is strongly fixed.

In the eighteenth embodiment, the nonwoven fabric layer 754 made of a nonwoven fabric is used as the rubbing surface. Therefore, it becomes easier for the nonwoven fabric layer 754 to bring into surface contact with the sheet S.

The nonwoven fabric, which forms the nonwoven fabric layer 754, has a dynamic friction coefficient of 0.50 or lower, which is less likely to impinge on the conveyance of the sheet S and to cause a damaged image layer I under the rubbing operation.

It should be noted that the planar nonwoven fabric layer 754 described in the eighteenth embodiment is circular, but the planar nonwoven fabric layer 754 is not particularly limited thereto. The planar nonwoven fabric layer 754 may be, for example, a ring shape without a central portion where there is no rubbing region CR of the nonwoven fabric layer 754.

The fixing device 750 according to the eighteenth embodiment and the conveyor 400G which is used for conveying the sheet S to the fixing device 750, are preferably incorporated in the color printer 1 described in the context of FIGS. 8 to 10, in place of the fixing device 300 and the conveyor which are described in the context of the first embodiment.

(Nineteenth Embodiment)

<Fixing Device>

Figure 56:
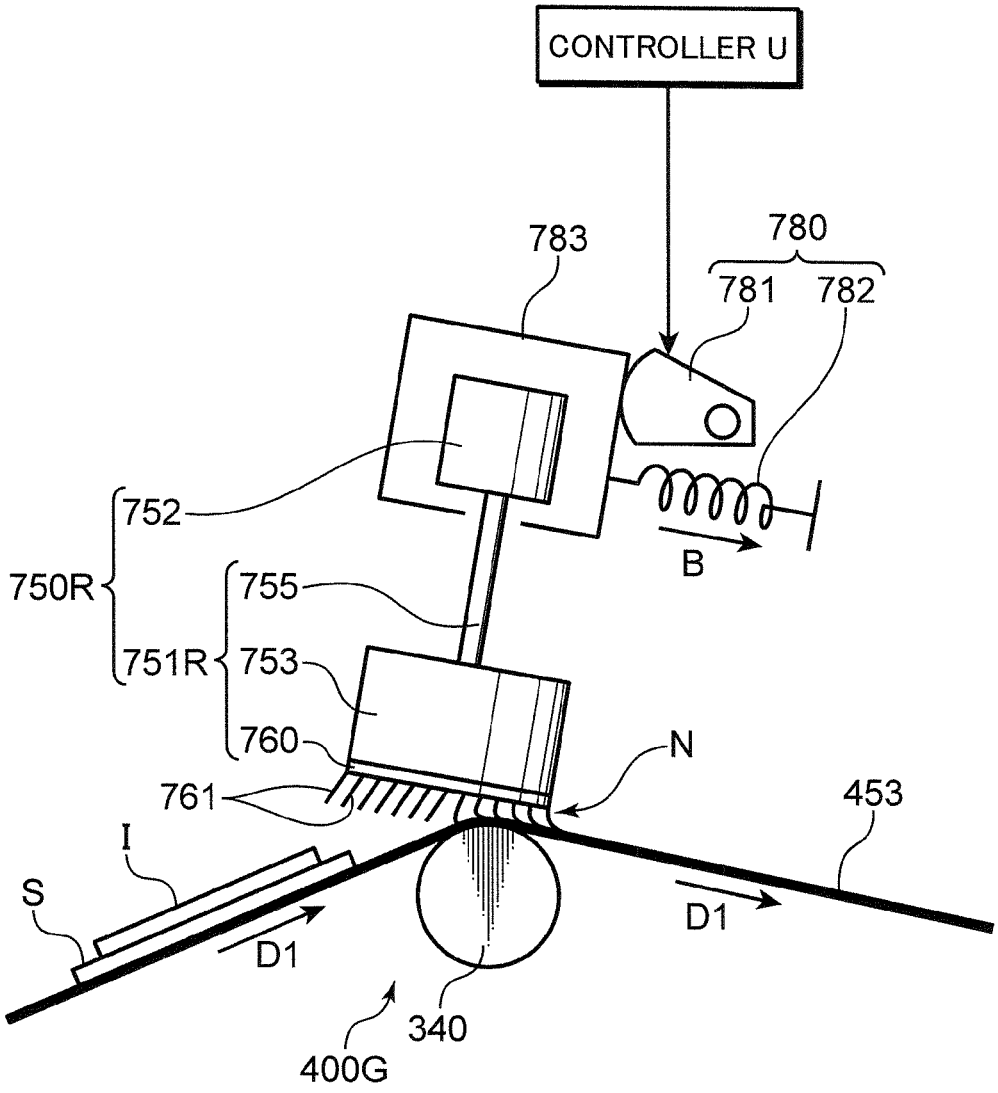
FIG. 56 is a schematic view of a fixing device and a conveyor according to the nineteenth embodiment.

FIG. 56 is a schematic view of a fixing device 750R and conveyor 400G according to the nineteenth embodiment. The sheet S having the image layer I formed thereon is conveyed to the fixing device 750R by the conveyor 400G. The configuration of the conveyor 400G is described with reference to FIG. 53. The fixing device 750R rubs and fixes the image layer I on the sheet S. The fixing device 750R includes a rubbing member 751R situated in an opposite side to the backup roller 340 so that the endless belt 453 intervenes between the rubbing member 751 R and the backup roller 340, and the drive source 752 configured to drive the rubbing member 751R.

The rubbing member 751R includes the supporting member 753 (brush supporting member), a rubbing brush 760, and the shaft 755.

Like the supporting member 753 shown in FIGS. 53 and 54, the supporting member 753 is a cylindrical block member. The supporting member 753 includes the first supporting surface 753*a* which is an end surface facing the endless belt 453 and the second supporting surface 753*b* which is an end surface opposite to the first supporting surface 753*a* in the axial direction. The first and second supporting surfaces 753*a*, 753*b* are substantially circular.

The rubbing brush 760 rubs the image layer I on the sheet S. The entire first supporting surface 753*a* (brush mounting surface) of the supporting member 753 is covered with the rubbing brush 760. The rubbing brush 760 looks circular in a plane. The rubbing brush 760 has a brush surface 760*a* facing the endless belt 453, and a number of bristles 761 are implanted in the brush surface 760*a*. The bristles 761 are implanted in the periphery of the brush surface 760*a*. A piled woven fabric with electrically-conductive rayon or polyester is exemplified as a material of the bristles 761. With the electrically-conductive rayon, the pile fineness thereof is 300D/100F. With the polyester, the pile fineness thereof is 75D/12F.

The tip ends of the bristles 761 of the rubbing brush 760 are pressed against the endless belt 453 to be bent. Therefore, the rubbing brush 760 is in surface contact with the endless belt 453 because of the bent bristles 761. The bent tip ends of the bristles 761 form the rubbing surface. The bristles 761 of the rubbing brush 760 are pressed against the endless belt 453 such that the surface pressure applied to the endless belt 453 becomes, for example, 0.2 g/mm$^2$. Not only the abovementioned pile fineness but also the density and length of the bristles 761 are appropriately set so as to achieve a given surface pressure.

Figure 57:
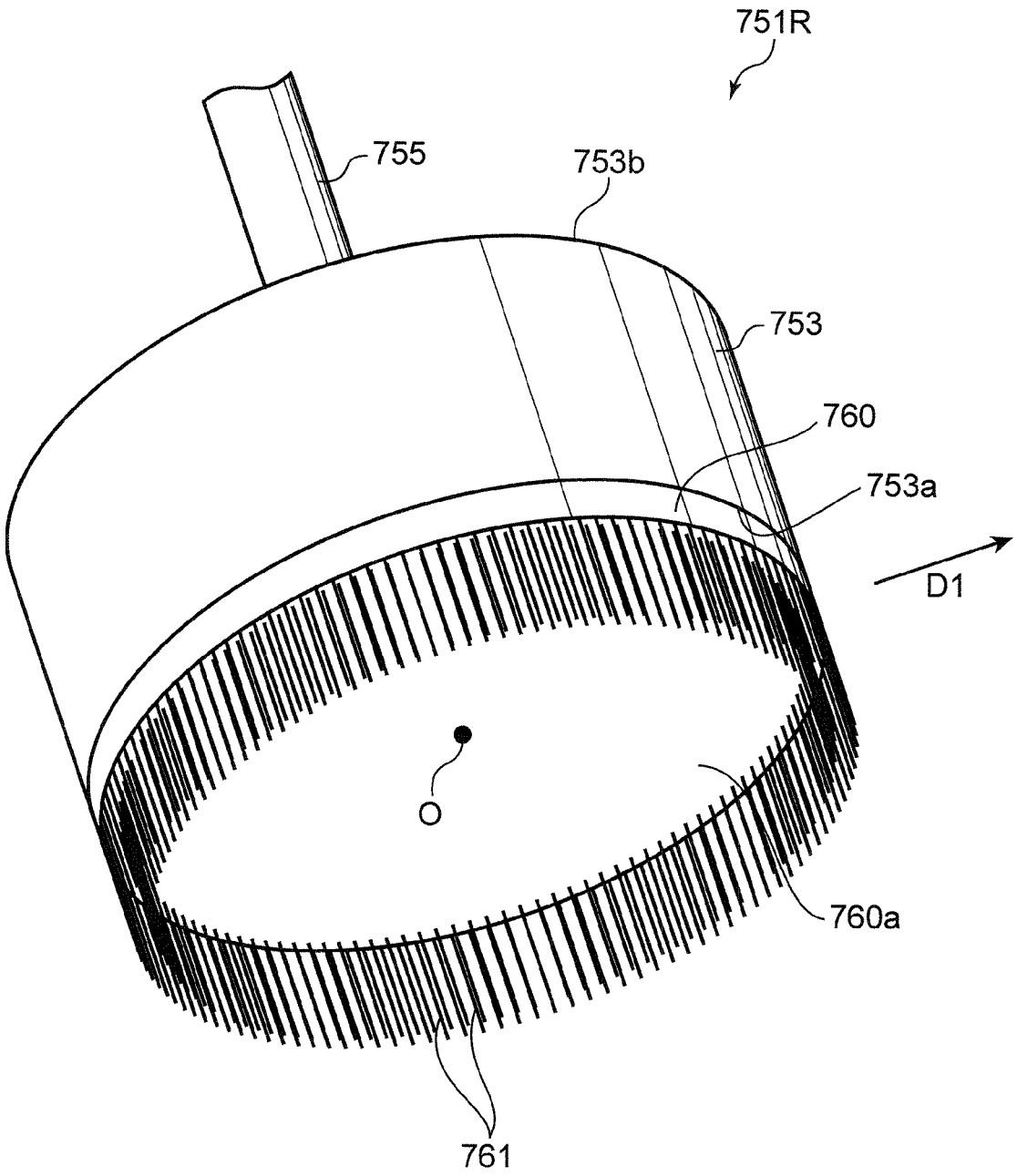
FIG. 57 is a perspective view of a rubbing member.
Figure 58:
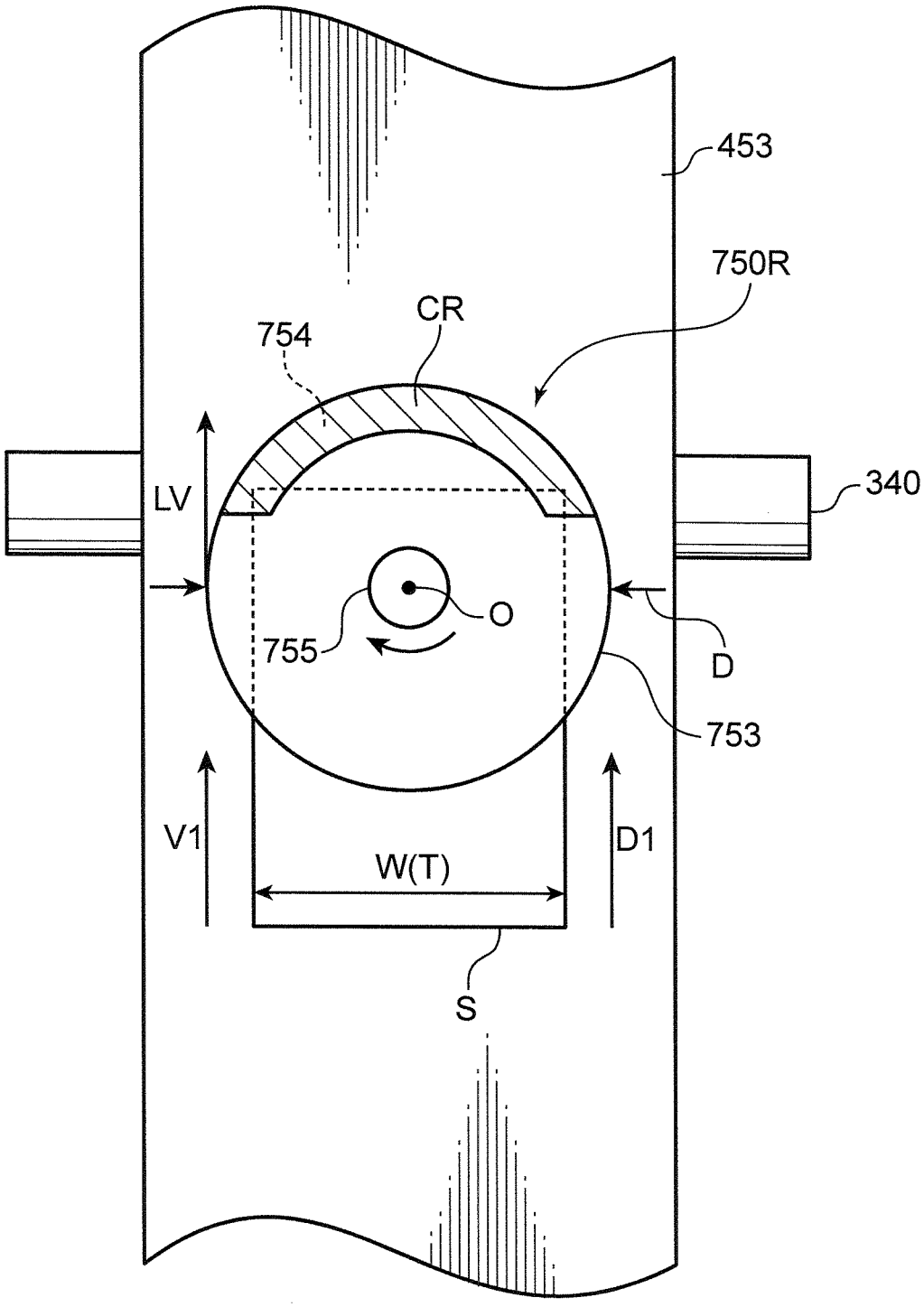
FIG. 58 is a plan view of the rubbing member and an endless belt.

The rubbing brush 760 has the rubbing region CR where the rubbing brush 760 rubs the image layer I while keeping in surface contact with the image layer I. The rubbing region CR is described with reference to FIGS. 56 to 58. FIG. 58 is a plan view of the rubbing member 751R and the endless belt 453. Like the configuration described with reference to FIGS. 53 to 55, the shaft 755 is fixed to the second supporting surface 753*b* of the supporting member 753 at a position where the shaft 755 aligns with the central axis of the supporting member 753. The drive source 752 is, for example, a motor which is coupled to the shaft 755 and rotates the shaft 755 in the clockwise direction in FIG. 58. The rubbing brush 760 has a rotation center O which aligns with the central axis of the supporting member 753 and the rotation axis of the shaft 755. When the shaft 755 rotates, the supporting member 753 rotates around the central axis. The rubbing brush 760 mounted on the first supporting surface 753*a* of the supporting member 753 also rotates around the rotation center O. Meanwhile the bent bristles 761 are kept in contact with the endless belt 453.

The rubbing region CR is a region which is set on the downstream side from the rotation center O of the rubbing brush 760 when viewed from the conveying direction (the first direction D1) of the sheet S, and looks a substantially semicircular shape in a plane. The bristles 761 of the rubbing brush 760 come into contact with the endless belt 453 to form the nip portion N with the endless belt 453 only in the rubbing region CR. The bristles 761 of the rubbing brush 760 in the entire rubbing region CR come into surface contact with the sheet S at the nip portion N.

Therefore, when the sheet S is conveyed to the nip portion N, the rubbing brush 760 rotates around the rotation center O. Meanwhile the bristles 761 are kept in surface contact with the sheet S and rub the image layer I. FIG. 58 shows a state in which the leading edge of the sheet S in the conveying direction (the first direction D1) enters the rubbing region CR.

In the nineteenth embodiment, the linear speed in a tangential direction of the supporting member 753 rotated by the shaft 755 (that is a linear speed LV of the rubbing brush 760) may be greater than the first speed V1 of conveying the sheet S. In addition, the diameter of the supporting member 753 (that is the diameter D of the rubbing brush 760) is greater than the sheet width W perpendicular to the conveying direction (the first direction D1) of the sheet S, so that the entire image layer I is rubbed.

In the nineteenth embodiment, the contact area of the contact surface between the bristles 761 of the rubbing brush 760 and the image layer I, which is the region area of the rubbing region CR where the bristles 761 of the rubbing brush 760 come into surface contact with the image layer I to rub the image layer I, may be switched between a first region area (first contact area) and a second region area (second contact area) larger than the first region area. The fixing device 750R according to the nineteenth embodiment further includes a switching mechanism 780 configured to change the region area of the rubbing region CR, and a controller U configured to control the switching mechanism 780.

Figure 59:
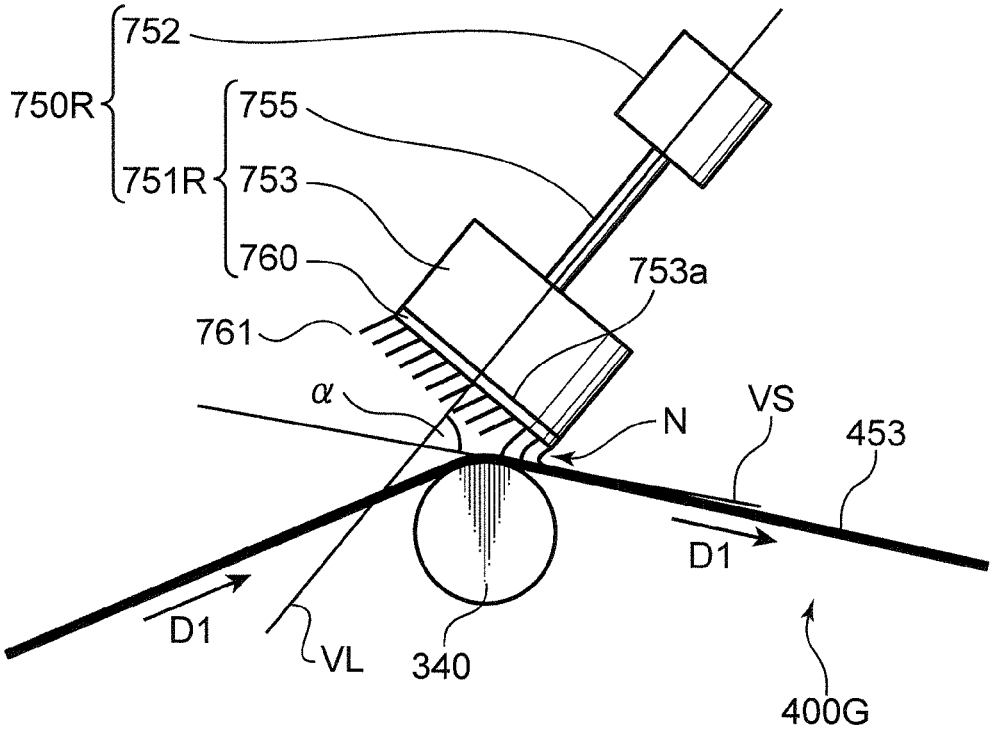
FIG. 59 is a schematic view of the fixing device.
Figure 60:
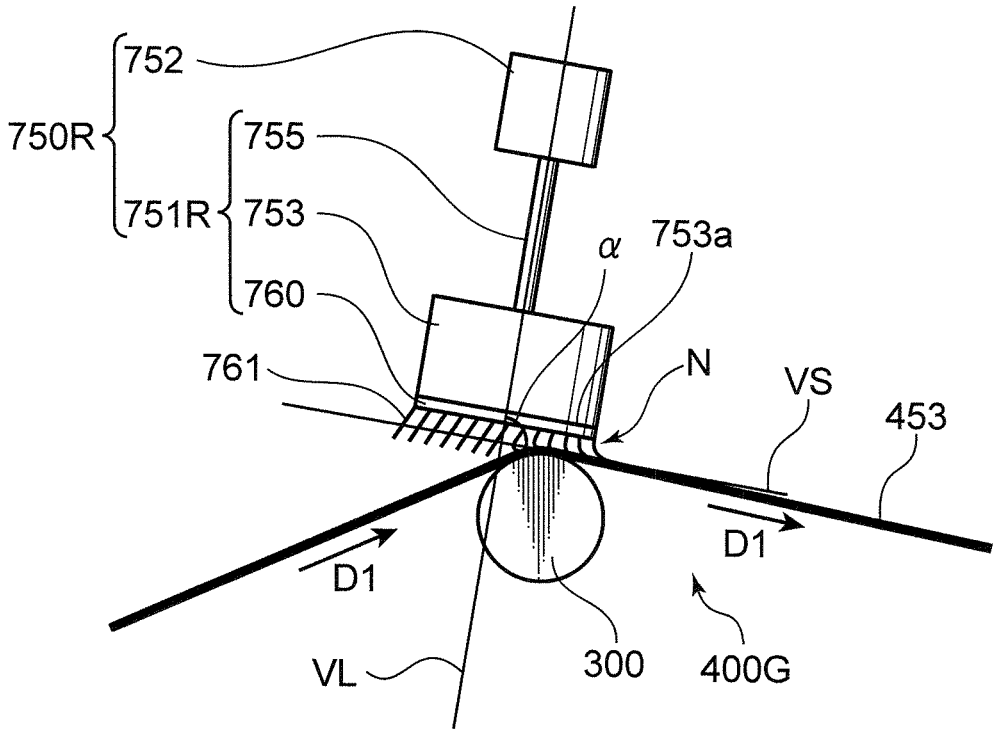
FIG. 60 is a schematic view of the fixing device.

The switching mechanism 780 is described with reference to FIGS. 56, 59 and 60. FIG. 59 shows a state in which the region area of the rubbing region CR is switched to the first region area, and FIG. 60 shows a state in which the region area of the rubbing region CR is switched to the second region area. The drive source 752 of the fixing device 750R is stored in a housing 783. The shaft 755 of the rubbing member 751R is coupled to the drive source 752 through a hole provided in the housing 783. The housing 783 may be turn in a given range. By turning the housing 783, the rubbing member 751R is turned around drive source 752.

The switching mechanism 780 includes, for example, a cam 781 and a biasing member 782. The biasing member 782, which is a spring member, for example, applies a basing force in a direction of an arrow B to the housing 783 in order to turn the housing 783 in a given direction (in the counterclockwise direction, in FIG. 56). The cam 781 abuts and turns the housing 783 in the clockwise direction in FIG. 56 against the biasing force of the biasing member 782.

In the nineteenth embodiment, an intersection angle $\alpha$ where a virtual line VL, which is an extension of the shaft 755 of the rubbing member 751R, intersects with a virtual surface VS, which is an extension of the contact surface between the bristles 761 of the rubbing brush 760 and the image layer I, is switched between a first angle and a second angle greater than the first angle. Therefore the region area of the rubbing region CR is switched between the first and second region areas. An increase in the intersection angle $\alpha$ results in greater region area of the rubbing region CR. More specifically, if the intersection angle $\alpha$ is switched to the first angle, the region area of the rubbing region CR is switched to the first region area. If the intersection angle $\alpha$ is switched to the second angle, the region area of the rubbing region CR is switched to the second region area. For instance, the first and second angles are set at 60° and 90°, respectively.

The controller U controls the switching mechanism 780 to switch the region area of the rubbing region CR between the first and second region areas. Control operations performed by the controller U on the switching mechanism 780 are described hereinafter. If the controller U turns the cam 781 in the first direction to switch the region area of the rubbing region CR from the first region area shown in FIG. 59 to the second region area, the biasing member 782 biases the housing 783 in the direction of the arrow B, and then the housing 783 is turned in the counterclockwise direction in FIG. 56. By turning the housing 783 in the counterclockwise direction, the rubbing member 751R also turns around the drive source 752 in the counterclockwise direction. Meanwhile a turning range of the cam 781 and the rubbing member 751R is set such that the intersection angle $\alpha$ becomes 90°. As a result, the region area of the rubbing region CR is switched to the second region area greater than the first region area.

On the other hand, if the controller U turns the cam 781 in the second direction opposite to the first direction to switch the region area of the rubbing region CR from the second region area to the first region area as shown in FIG. 60, the controller U turns the cam 781 in a second direction opposite to the first direction. As a result, the cam 781 turns against the biasing force of the biasing member 782, so that the housing 783 is turned in the clockwise direction. In response to this turning of the housing 783, the rubbing member 751R also turns around the drive source 752 in the clockwise direction. Meanwhile the turning range of the cam 781 and the rubbing member 751R is set such that the intersection angle α becomes 60°. As a result, the region area of the rubbing region CR is switched to the first region area smaller than the second region area.

If the sheets S include a thin sheet S with a first thickness (e.g., a normal A4-size thin sheet) and a thick sheet S with a second thickness thicker than the first thickness (e.g., a post-card or coated paper), the controller U controls the switching mechanism 780 to switch the region area of the rubbing region CR to the first region area (i.e., the intersection angle α is 60°) for the thin sheet S conveyed to the nip portion N. If the thick sheet S is conveyed to the nip portion P, the controller U controls the switching mechanism 780 to switch the region area of the rubbing region CR to the second region area (i.e., the intersection angle α is 90°). Because the second region area is greater than the first region area as described above, the time period during which the rubbing brush 760 rubs the image layer I in the rubbing region CR becomes longer. Thus, the controller U appropriately changes the rubbing time for rubbing the image layer I with the rubbing brush 760 in response to the thickness of sheets S (the type of the sheet S). In the present embodiment, the controller U and the switching mechanism 780 are exemplified as the adjustment mechanism.

According to the aforementioned fixing device 750R of the nineteenth embodiment, the rubbing brush 760 rotates around the rotation center O while the bristles 761 in the rubbing region CR are kept in surface contact with the sheet S and rub the image layer I. In addition, the linear speed LV of the rubbing brush 760 may be greater than the first speed V1 of conveying the sheet S. Thus, the time period in which the image layer I is rubbed by the bristles 761 of the rubbing brush 760 becomes long, compared to configurations which uses a roller for rubbing the image layer I while keeping in linear contact with the sheet S. Therefore, the components of the liquid developer which forms the image layer I are facilitated to enter into the surface layer of the sheet S, which shortens the time period during which the image layer I is fixed and preferably prevent the image layer I from peeling because of stronger fixation of the image layer I.

The fixing device 750R according to the nineteenth embodiment uses the rubbing brush 760 with many bristles 761 to rub the image layer I. Appropriate adjustments of the bristles 761 such as material, pile fineness, density and length cause less impingement on the conveyance of the sheet S and less damage to the image even under the rubbing operation.

The controller U of the fixing device 750R according to the nineteenth embodiment appropriately changes the rubbing time period for rubbing the image layer I in response to the thickness of sheets S, by switching the region area of the rubbing region CR between the first and second region areas in response to the thickness of the sheets S. Therefore, even if the sheets S are different in thickness, the components of the liquid developer for forming the image may be facilitated to permeate into the surface layer of the sheets S.

The rubbing brush 760 with the bristles 761 of the fixing device 750R according to the nineteenth embodiment is used for rubbing the image layer I. Therefore, the intersection angle α may be switched between the first and second angles, so that the region area of the rubbing region CR may be easily switched between the first and second region areas.

The fixing device 750R according to the nineteenth embodiment and the conveyor 400G, which is used for conveying the sheet S to the fixing device 750R, are preferably incorporated in the color printer 1 described in the context of FIGS. 8 to 10, in place of the fixing device 300 and the conveyor which are described in the context of the first embodiment.

Figure 61:
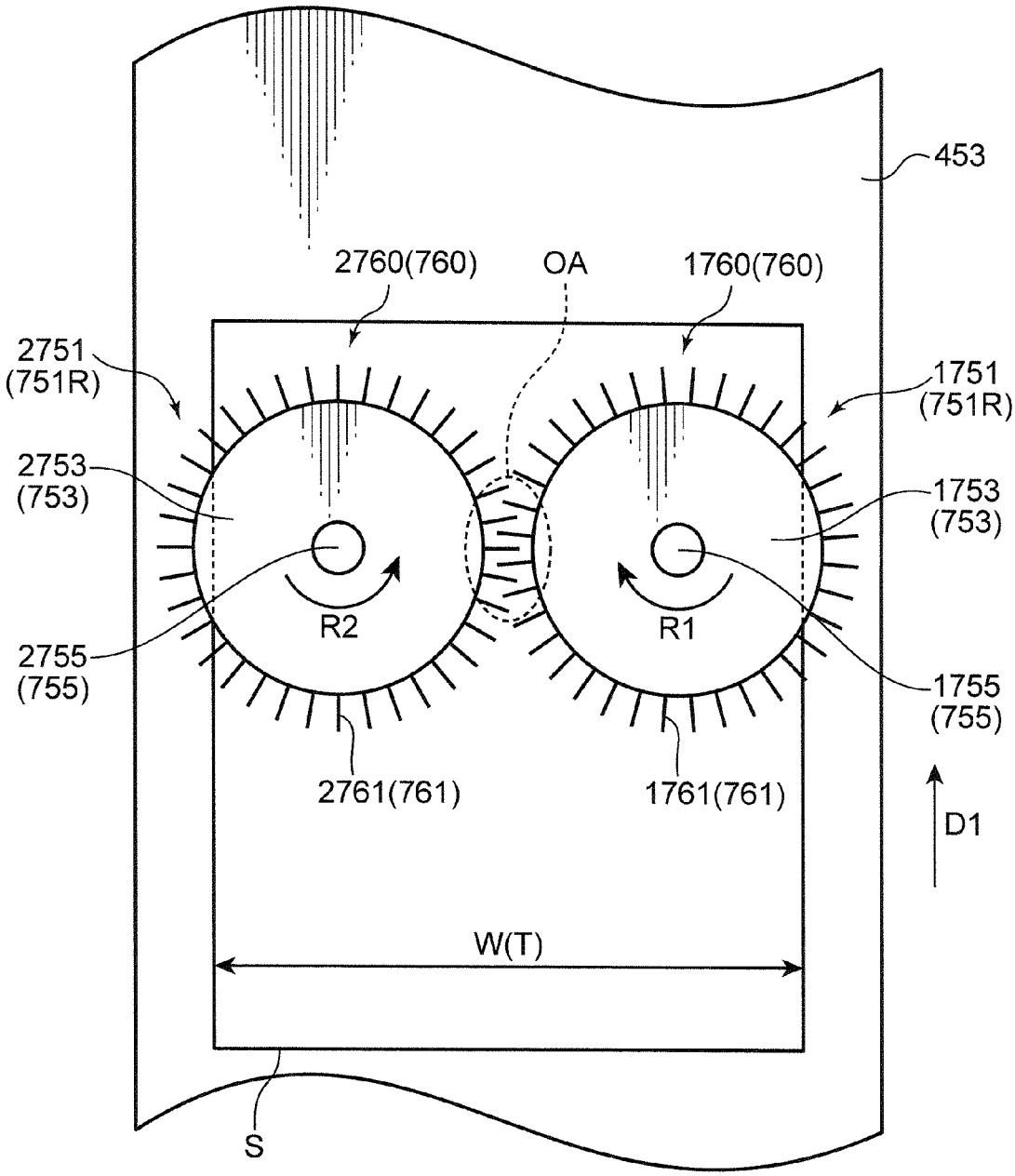
FIG. 61 is a plan view of the rubbing member and the endless belt.

Modifications from the nineteenth embodiment are described with reference to FIG. 61 hereinafter. FIG. 61 is a plan view of the rubbing member 751R and the endless belt 453. In the modifications from the nineteenth embodiment, two rubbing members, a first rubbing member 1751 and second rubbing member 2751, are used. The first and second rubbing members 1751, 2751 are situated side by side in a direction perpendicular to the conveying direction (the first direction D1) of the sheet S. In other words, a first rubbing surface (tip ends of first bristles 1761) formed by a first rubbing brush 1760 of the first rubbing member 1751 and a second rubbing surface (tip ends of second bristles 2761) formed by a second rubbing brush 2760 of the second rubbing member 2751 are situated side by side in the direction (a width direction W of the sheet S (a transverse direction T)) perpendicular to the conveying direction (the first direction D1) of the sheet S. Therefore, even if a color image layer I with an increased carrier liquid amount is fixed to the sheet S, the carrier liquid may be facilitated to enter the surface layer of the sheet S. In the present embodiment, the first rubbing brush 1760 is exemplified as the first brush. The second rubbing brush 2760 is exemplified as the second brush.

A first shaft 1755 of the first rubbing member 1751 is rotated by the drive source 752 in a first rotation direction R1 (the clockwise direction in FIG. 61), and a second shaft 2755 of the second rubbing member 2751 is rotated by the drive source 752 in a second rotation direction R2 (the counter-clockwise direction in FIG. 61) opposite to the first rotation direction R1. Therefore, the first rubbing brush 1760 rubs the image layer I while rotating in the first rotation direction R1, and the second rubbing brush 2760 rubs the image layer I while rotating in the second rotation direction R2. The sheet S is consequently rubbed while being stretched to prevent wrinkles on the sheet S. In the present embodiment, the rubbing surface formed by the first rubbing brush 1760 is exemplified as the first rotation surface. The rubbing surface formed by the second rubbing brush 2760 is exemplified as the second rotation surface.

In the modifications of the nineteenth embodiment, the first and second rubbing members 1751, 2751 are situated such that the first bristles 1761 of the first rubbing brush 1760 and the second bristles 2761 of the second rubbing brush 2760 come into contact with each other in the perpendicular direction to the conveying direction (the first direction D1) of the sheet S. Thus, a contact area OA where the first and second bristles 1761, 2761 come into contact with each other is formed between the first and second rubbing members 1751, 2751. Therefore it is less likely that there are non-rubbing regions where the image layer I is not rubbed.

FIG. 61 shows the configuration which uses two brushes, the first and second rubbing brushes 1760, 2760. However, in place of this configuration, two nonwoven fabric layers such as first and second nonwoven fabric layers may be situated side by side in the perpendicular direction to the conveying direction (the first direction D1) of the sheet S.

Figure 62:
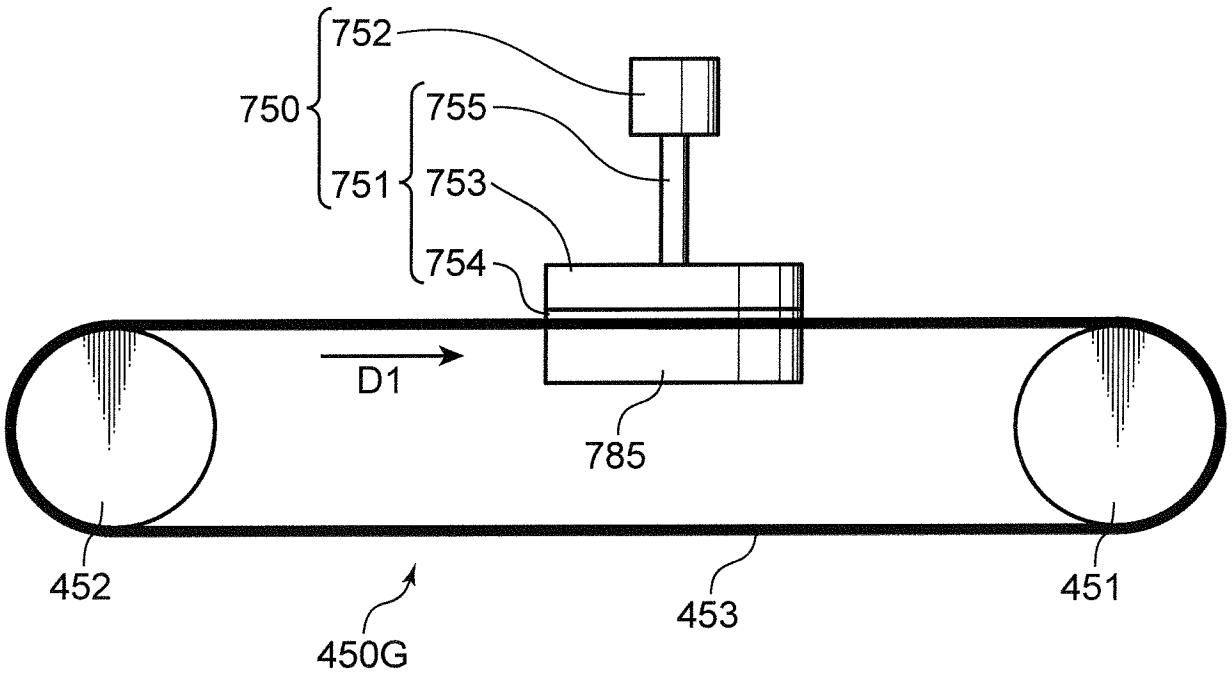
FIG. 62 is a schematic view of a modified fixing device and conveying device according to the eighteenth embodiment.

Modifications from the eighteenth embodiment are described with reference to FIG. 62 hereinafter. The configuration according to the eighteenth embodiment described with reference to FIGS. 53 to 55 has the nonwoven fabric layer 754, which is partially brought into surface contact with the endless belt 453. However, methodologies of the present invention is not limited to such a configuration, so that the entire nonwoven fabric layer 754 may be brought into contact with the endless belt 453 to rub the image layer I, as shown in FIG. 62. In this case, a support plate 785 configured to support the entire surface of the nonwoven fabric layer 754 is disposed on the opposite side of the nonwoven fabric layer 754 so that the endless belt 453 intervenes between the nonwoven fabric layer 754 and the support plate 785. With the configuration shown in FIG. 62, the surface pressure applied to the endless belt 453 by the nonwoven fabric layer 754 is appropriately adjusted in order to prevent the image layer I from being excessively rubbed by the nonwoven fabric layer 754. In the modifications shown in FIG. 62, the rubbing brush. 760 may be used in place of the nonwoven fabric layer 754. In this case, the entire rubbing brush 760 is brought into contact with the endless belt 453.

(Twentieth Embodiment)

<Fixing Device>

Figure 63:
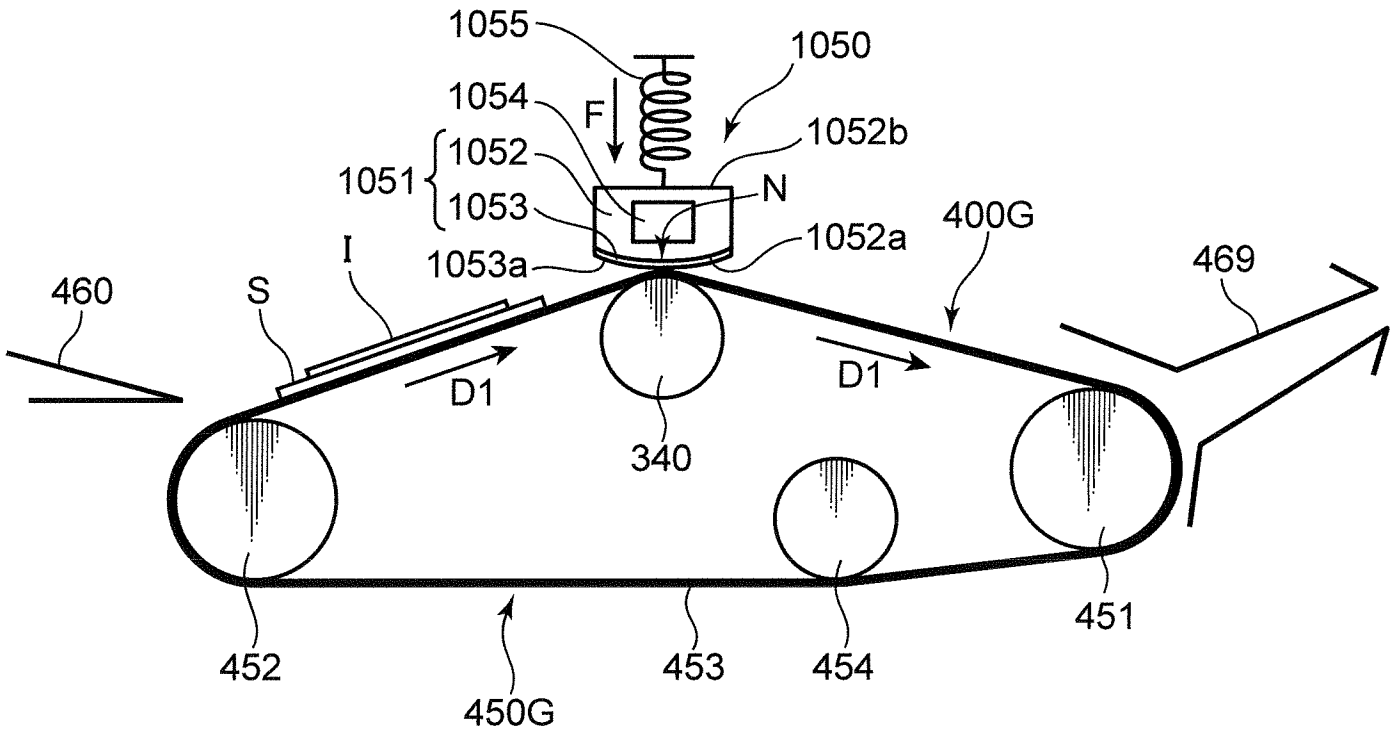
FIG. 63 is a schematic view of a fixing device and a conveyor according to the twentieth embodiment.
Figure 64:
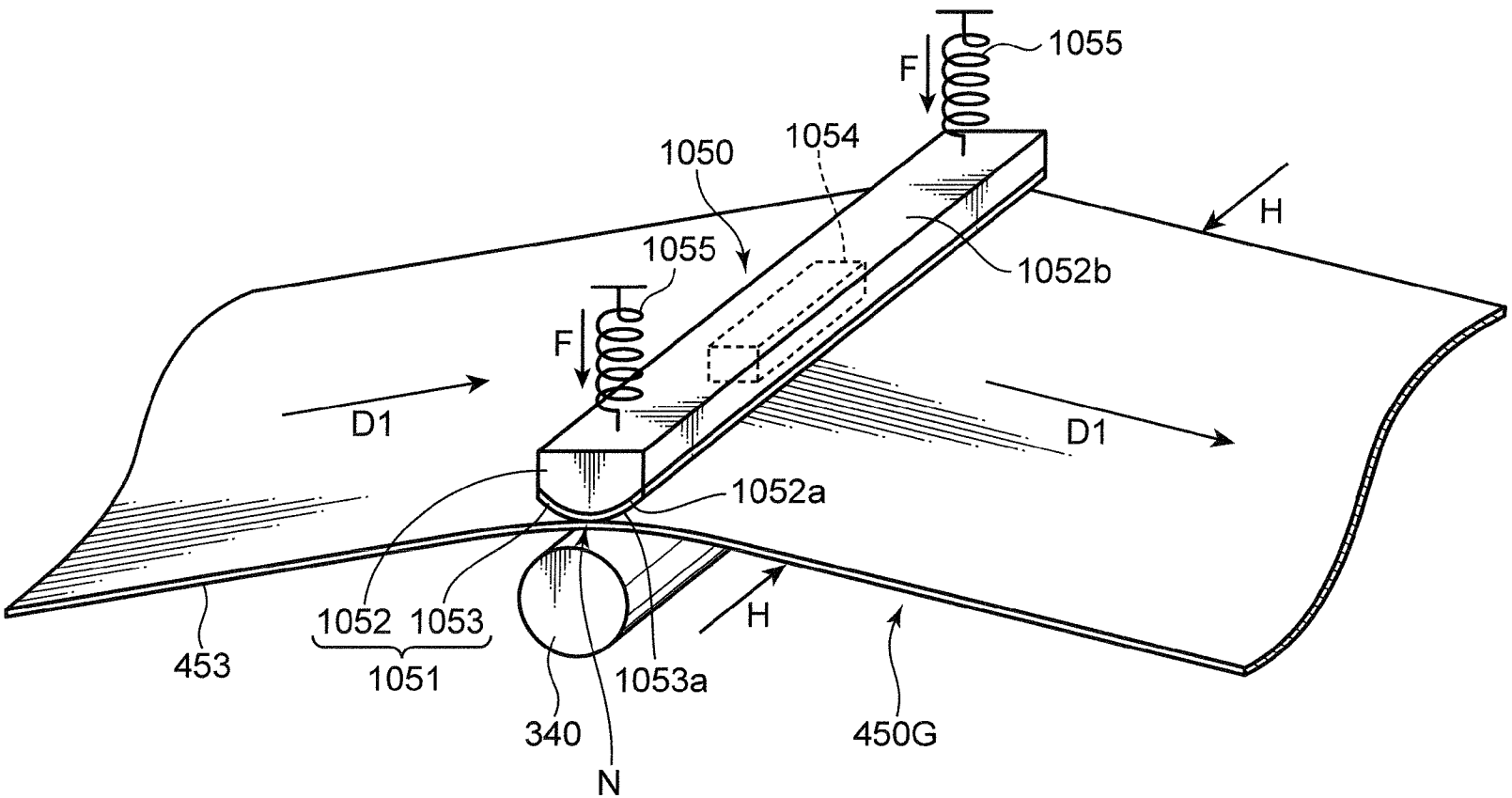
FIG. 64 is a perspective view of the fixing device and the conveyor.

FIG. 63 is a schematic view of a fixing device 1050 and the conveyor 400G according to the twentieth embodiment. FIG. 64 is a perspective view of the fixing device 1050 and the conveyor 400G. Hereinafter, the same reference numerals are used for describing the same elements as those of the aforementioned embodiments. The descriptions associated with the aforementioned embodiments are preferably incorporated into the elements which are not described hereinafter.

The sheet S having the image layer I formed thereon is conveyed to the fixing device 1050 by the conveyor 400G. The conveyor 400G comprises the belt unit 450G, the upstream guider 460 situated before the belt unit 450G, and the downstream guider 469 situated after the belt unit 450G. The sheet S is guided by the upstream guider 460 and sent to the belt unit 450G. Thereafter, the sheet S is sent to the downstream guide 469 by the belt unit 450G.

The belt unit 450G comprises the drive roller 451, the idler 452, the endless belt 453 (conveying belt) extending between the drive roller 451 and the idler 452, and the tension roller 454 applying tension to the endless belt 453. Rotation of the drive roller 451 causes the endless belt 453 to revolve around the drive roller 451, the idler 452 and the tension roller 454. The idler 452 and the tension roller 454 rotate in response to the revolution of the endless belt 453. As a result, the sheet S, which is sent from the upstream guider 460 to the endless belt 453, moves toward the downstream guider 469 in response to the revolution of the endless belt 453. The sheet S is conveyed from the upstream guider 460 to the downstream guider 469. Reference numeral D1 represents a direction in which the sheet S is moved from the upstream guider 460 toward the downstream guider 469 by the belt unit 450G. The belt unit 450G is exemplified as the conveying element.

The belt unit 450G further comprises the backup roller 340 disposed inside the endless belt 453. The backup roller 340 abuts the inner surface of the endless belt 453 to support the endless belt 453 between the drive roller 451 and the idler 452, which is situated on the opposite side to the tension roller 454.

The fixing device 1050 fixes the image layer I on the sheet S. The fixing device 1050 includes a rubbing member 1051, a drive source 1054, and a biasing member 1055.

The rubbing member 1051 includes a supporting member 1052 and a nonwoven fabric layer 1053. The supporting member 1052 is an elongated box, which is situated on the opposite side to the backup roller 340, so that the endless belt 453 intervenes between the supporting member 1052 and the backup roller 340. The supporting member 1052 extends in a width direction of the endless belt 453 and an axial direction of the backup roller 340. The supporting member 1052 has a first supporting surface 1052*a* facing the endless belt 453 and a second supporting surface 1052*b* opposite to the first supporting surface 1052*a*. The first supporting surface 1052*a* is curved along the conveying direction of the sheet S. The second supporting surface 1052*b* is substantially flat.

The nonwoven fabric layer 1053 rubs the image layer I on the sheet S. The nonwoven fabric layer 1053 is formed from a nonwoven fabric and entirely attached on the first supporting surface 1052*a*. Therefore, the nonwoven fabric layer 1053 extends in the form of an arc along the conveying direction (the first direction D1) of the sheet S. Any of the nonwoven fabrics described in the context of FIG. 4 is used as the nonwoven fabric. The dynamic friction coefficient of the nonwoven fabric is 0.50 or lower. In the present embodiment, the surface of the nonwoven fabric layer 1053 rubbing the image layer I on the sheet S is exemplified as the contact surface.

The biasing member 1055 is, for example, a spring member mounted on the second supporting surface 1052*b* of the supporting member 1052. In the twentieth embodiment, the biasing member 1055 is mounted in each longitudinal end of the supporting member 1052. The biasing member 1055 applies a biasing force F to the supporting member 1052 to allow the nonwoven fabric layer 1053 to keep in contact with the endless belt 453. A nip portion N is formed between a layer surface 1053*a* of the nonwoven fabric layer 1053, which contacts the endless belt 453, and the endless belt 453. Therefore, the layer surface 1053*a* of the nonwoven fabric layer 1053 forms a rubbing surface. The biasing member 1055 is set such that the nonwoven fabric layer 1053 is pressed against the endless belt 453 at a surface pressure of, for example, 0.2 $g/mm^2$. The layer thickness of the nonwoven fabric layer 1053 is appropriately set such that the nonwoven fabric layer 1053 and the image layer I come into smooth contact with each other.

Figure 65:
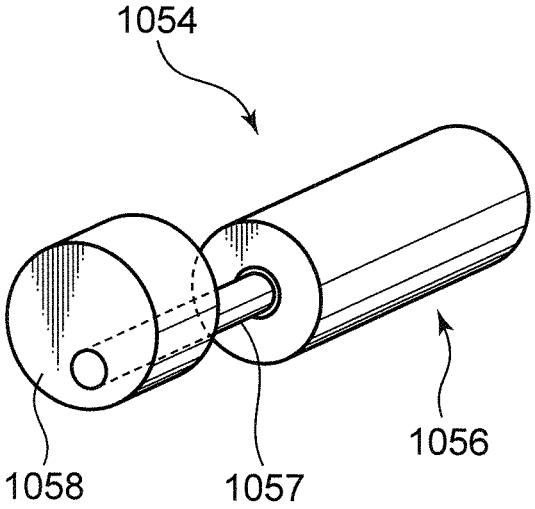
FIG. 65 is a perspective view of a vibration motor.

The drive source 1054 is held in an appropriate section (for example, a substantially intermediate portion of the supporting member 1052 in a longitudinal direction) inside the supporting member 1052. The drive source 1054 stored in the supporting member 1052 vibrates the supporting member 1052. A vibration motor is exemplified as the drive source 1054. FIG. 65 is a perspective view showing a schematic configuration of the vibration motor.

The vibration motor 1054 with an inner rotor structure comprises a main body 1056, an output shaft 1057, and an eccentric piece 1058. The eccentric piece 1058 is, for example, a weight which is externally fitted to the outer shaft 1057 in order to disrupt a dynamic balance of the main body 1056. Rotation of the main body 1056 causes vibration because the gravity center of the eccentric piece 1058 is not centered.

The vibration caused by the vibration motor 1054 vibrates the supporting member 1052 storing the vibration motor 1054 and the nonwoven fabric layer 1053 mounted on the first supporting surface 1052*a* of the supporting member 1052. The nonwoven fabric layer 1053 keeps the state where the nonwoven fabric layer 1053 is pressed against the endless belt 453 by the biasing member 1055 as described above. Therefore, when the sheet S is conveyed to the nip portion N, the nonwoven fabric layer 1053 utilizes the vibration to slide on the image layer I in multiple directions to rub the image layer I while keeping in contact with the image layer I without separating therefrom.

Figure 66:
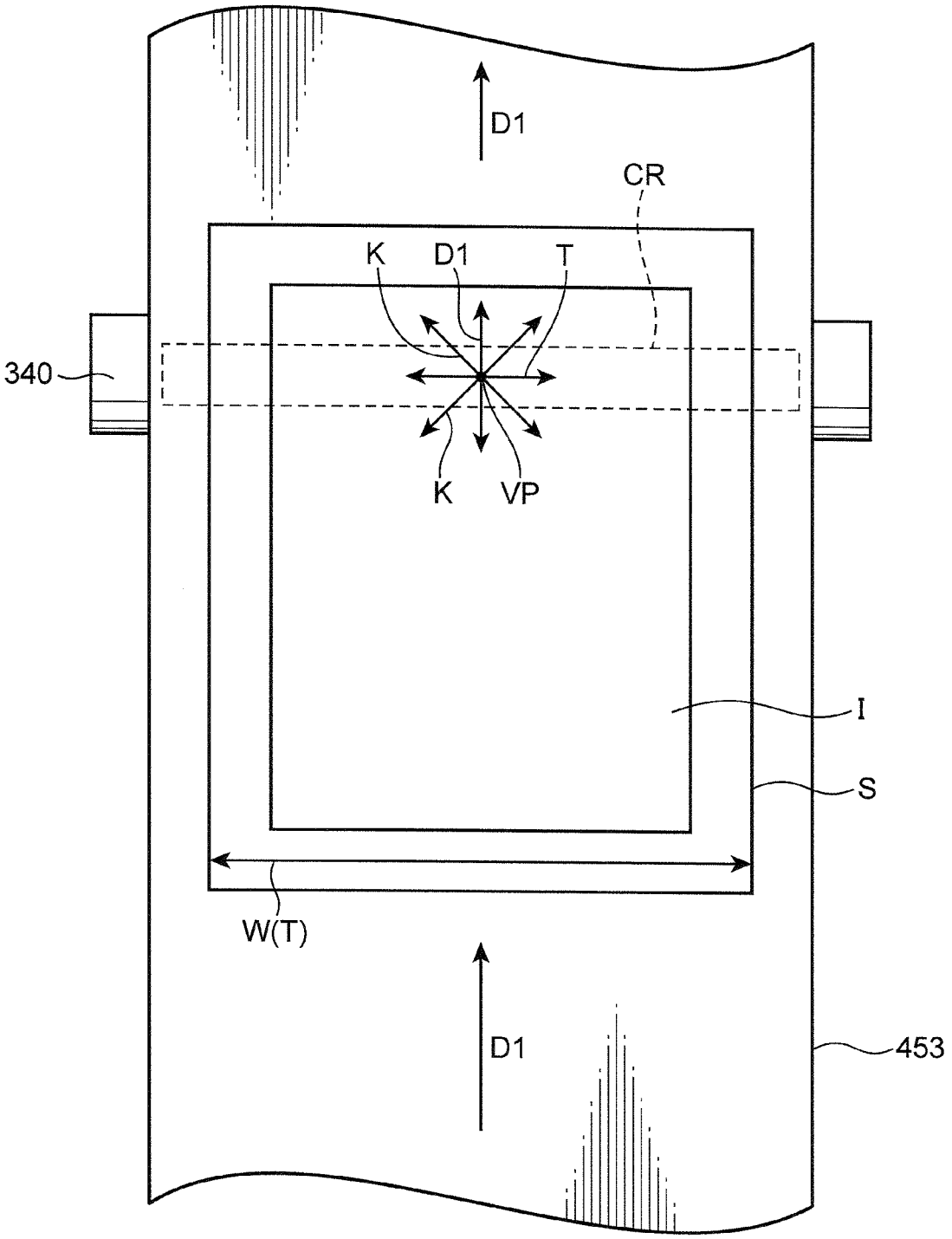
FIG. 66 is a plan view of an endless belt on which a sheet is placed.

FIG. 66 is a plan view of the endless belt 453, on which the sheet S is placed, schematically showing the rubbing operation performed on the image layer I by the nonwoven fabric layer 1053. It should be noted that FIG. 66 does not show the fixing device 1050 for clarification. The nonwoven fabric layer 1053 in the rubbing region CR shown by the dashed line in FIG. 66 contacts the endless belt 453, the sheet S and the image layer I. The rubbing region CR is situated on a line connecting a curvature center of the first supporting surface 1052 of the supporting member 1052 with the rotation center of the backup roller 340, and extends in the sheet width direction W (a transverse direction T) perpendicular to the conveying direction (the first direction D1) of the sheet S. The rubbing region CR extends somewhat beyond the width of the sheet S. The nonwoven fabric layer 1053 rubs the image layer I while sliding on the image layer I in the rubbing region CR in multiple directions.

More specifically, when viewed from any rubbing section VP in the nonwoven fabric layer 1053, the vibration of the nonwoven fabric layer 1053 reciprocates the rubbing section VP with a small amplitude in conveying direction (the first direction D1) of the sheet S, in the traverse direction T perpendicular to the conveying direction (the first direction D1) of the sheet S, or in an oblique direction K, which is oblique to the conveying direction (the first direction D1) or the traverse direction T. Because of the irregular rubbing operation performed on the rubbing section VP, the rubbing section VP slides irregularly on the image layer I in multiple directions including these directions D1, T, K with small amplitudes to rub the image layer I. As a result, the section of the image layer I into contact with the rubbing section VP is rubbed a number of times. It should be noted that the rubbing section VP does not necessarily reciprocate in these directions D1, T, K.

According to the aforementioned fixing device 1050 of the twentieth embodiment, the nonwoven fabric layer 1053 is vibrated by the vibration motor 1054 to rub the image layer I in multiple directions while keeping in contact with the image layer I. Therefore, the image layer I on the sheet S is rubbed a number of times by the nonwoven fabric layer 1053. As a result, the components of the liquid developer forming the image layer I may be facilitated to enter the surface layer of the sheet S, which may reduce the time period during which the image layer I is fixed and preferably prevent the image layer I from peeling because of stronger fixation of the image layer I.

According to the fixing device 1050 of the twentieth embodiment, the vibration motor is used as the drive source 1054. Therefore, the nonwoven fabric layer 1053 may vibrate with respect to the image layer I in multiple directions.

According to the fixing device 1050 of the twentieth embodiment, the nonwoven fabric layer 1053 is allowed to keep in contact with the image layer I by the biasing member 1055. Accordingly, the vibration of the nonwoven fabric layer 1053 is easily transmitted the image layer I.

According to the fixing device 1050 of the twentieth embodiment, the backup roller 340 is disposed on the opposite side to the nonwoven fabric layer 1053 so that the endless belt 453 intervenes between the backup roller 340 and the nonwoven fabric layer 1053. Therefore, the vibration of the nonwoven fabric layer 1053 is easily transmitted to the image.

According to the fixing device 1050 of the twentieth embodiment, the nonwoven fabric layer 1053 made of a nonwoven fabric is used as a rubbing member for the image layer I. The dynamic friction coefficient of the nonwoven fabric is 0.50 or lower, which result in less impingement on the conveyance of the sheet S as well as less damage to the image layer I under the rubbing operation.

The fixing device 1050 according to the twentieth embodiment and the conveyor 400G, which is used for conveying the sheet S to the fixing device 1050, are preferably incorporated in the color printer 1 described in the context of FIGS. 8 to 10, in place of the fixing device 300 and the conveyor which are described in the context of the first embodiment.

(Twenty-first Embodiment)

<Fixing Device>

Figure 67:
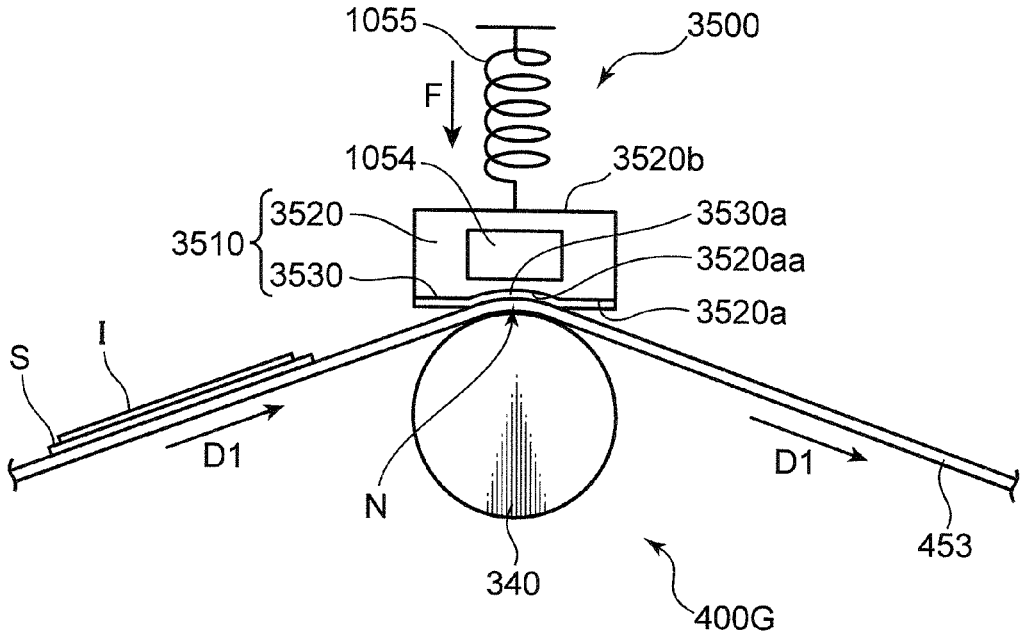
FIG. 67 is a schematic view of a fixing device and a conveyor according to the twenty-first embodiment.

A fixing device 3500 according to the twenty-first embodiment is described with reference to FIG. 67 hereinafter. FIG. 67 is a schematic view of the fixing device 3500 and the conveyor 400G according to the twenty-first embodiment. The sheet S having the image layer I formed thereon is conveyed to the fixing device 3500 by the conveyor 400G. The configuration of the conveyor 400G is described with reference to FIG. 63. The fixing device 3500 rubs and fixes the image layer I onto the sheet S. The fixing device 3500 includes a rubbing member 3510, the drive source 1054, and the biasing member 1055.

The rubbing member 3510 has a supporting member 3520 and a nonwoven fabric layer 3530. The supporting member 3520 is an elongated box which is situated on the opposite side to the backup roller 340, so that the endless belt 453 intervenes between the supporting member 3520 and backup roller 340. The supporting member 3520 extends in the width direction of the endless belt 453 and the axial direction of the backup roller 340. The supporting member 3520 has a first supporting surface 3520*a* facing the endless belt 453 and a second supporting surface 3520*b* opposite to the first supporting surface 3520*a*. The first supporting surface 3520*a* has a curved surface portion 3520*aa*. The curved surface portion 3520*aa* is curved along the outer circumferential surface of the backup roller 340. The second supporting surface 3520*b* is substantially flat.

The nonwoven fabric layer 3530 rubs the image layer I on the sheet S. The nonwoven fabric layer 3530 is formed from a nonwoven fabric and entirely mounted on the first supporting surface 3520*a*. Therefore, the nonwoven fabric layer 3530 has an arc section 3530*a* corresponding to the curved surface portion 3520*aa* of the first supporting surface 3520*a*. Any of the nonwoven fabrics'described in the context of FIG. 4 is used as the nonwoven fabric. The dynamic friction coefficient of the nonwoven fabric is 0.50 or lower.

The biasing member 1055 is, for example, a spring member mounted on the second supporting surface 3520*b* of the supporting member 3520. In the twenty-first embodiment as well, although not shown, the biasing member 1055 is mounted in each longitudinal end of the supporting member 3520. The biasing member 1055 applies a biasing force F to the supporting member 3520 to press the nonwoven fabric layer 3530 against the endless belt 453 to keep the surface contact between the entire arc section 3530*a* of the nonwoven fabric layer 3530 and the endless belt 453. A nip portion N is formed between the arc section 3530*a* of the nonwoven fabric layer 3530 and the endless belt 453. Therefore, the layer surface of the arc section 3530*a* of the nonwoven fabric layer 3530 forms a rubbing surface. The biasing member 1055 is set such that the arc section 3530*a* of the nonwoven fabric layer 3530 is pressed against the endless belt 453 at a surface pressure of, for example, 0.2 g/mm$^2$. The layer thickness of the nonwoven fabric layer 3530 is appropriately set such that the nonwoven fabric layer 3530 and the image layer I come into smooth contact with each other.

The drive source 1054 is stored in the supporting member 3520, and the same vibration motor as that of the twentieth embodiment is used. The vibration generated by the vibration motor 1054 vibrates the supporting member 3520 storing the vibration motor 1054 and the nonwoven fabric layer 3530 mounted on the first supporting surface 3520*a* of the supporting member 3520. The arc section 3530*a* of the nonwoven fabric layer 3530 keeps its state where the arc section 3530*a* is brought into surface contact with the endless belt 453 by the biasing member 1055 as described above. Therefore, when the sheet S is conveyed to the nip portion N, the arc section 3530*a* of the nonwoven fabric layer 3530 utilizes the vibration to slide on the image layer I in multiple directions to rub the image layer I while keeping in surface contact with the image layer I without separating therefrom.

According to the fixing device 3500 of the twenty-first embodiment, the arc section 3530*a* of the nonwoven fabric layer 3530 rubs the image layer I while keeping in surface contact with the image layer I. Therefore, the vibration of the arc section 3530*a* is widely transmitted to the image layer I. A wide range of the image layer I on the sheet S is rubbed a number of times by the nonwoven fabric layer 3530. Accordingly, the components of the liquid developer forming the image layer I may be facilitated to enter the surface layer of the sheet S, which may shorten the time period during which the image layer I is fixed and preferably prevent the image layer I from peeling because of stronger fixation of the image layer I.

According to the aforementioned fixing device 3500 of the twenty-first embodiment, the nonwoven fabric layer 3530 made of a nonwoven fabric is used as the rubbing surface. Thus, the nonwoven fabric layer 3530 may easily be brought into surface contact with the image layer I.

According to the fixing device 3500 of the twenty-first embodiment, the use of the nonwoven fabric with a low dynamic friction coefficient (0.5 or lower) is less likely to impinge on the conveyance of the sheet S and to damage the image layer I under the rubbing operation of the nonwoven fabric layer 3530.

The fixing device 3500 according to the twenty-first embodiment and the conveyor 400G, which is used for conveying the sheet S to the fixing device 3500, are preferably incorporated in the color printer 1 described in the context of FIGS. 8 to 10, in place of the fixing device 300 and the conveyor which are described in the context of the first embodiment.

(Twenty-second Embodiment)

<Fixing Device>

Figure 68:
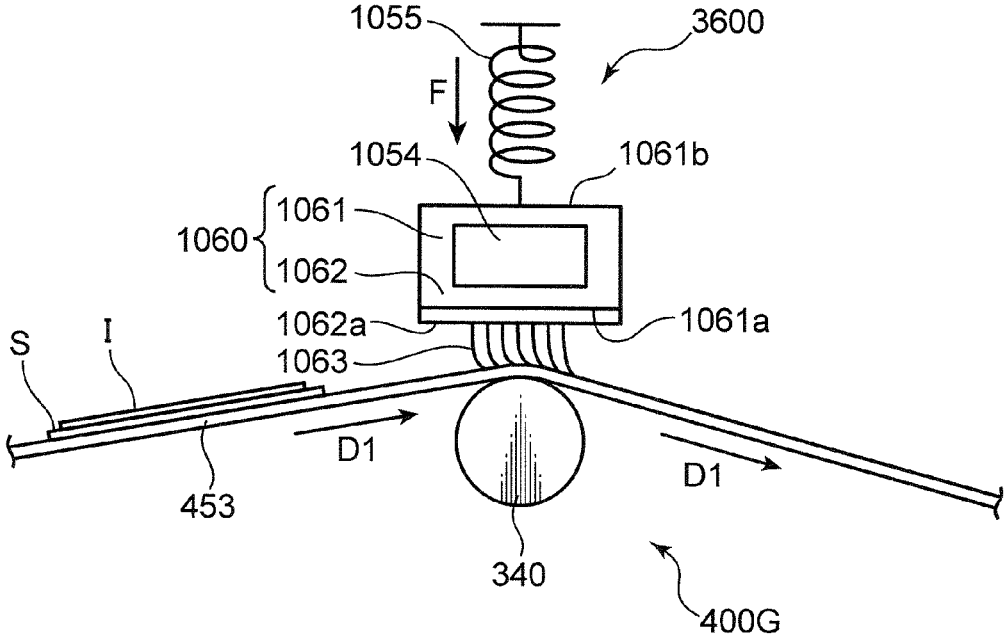
FIG. 68 is a schematic view of a fixing device and a conveyor according to the twenty-second embodiment.

A fixing device 3600 according to a twenty-second embodiment is described with reference to FIG. 68 hereinafter. FIG. 68 is a schematic view of the fixing device 3600 and the conveyor 400G according to the twenty-second embodiment. In the twentieth and twenty-first embodiments, the nonwoven fabric layers 1053 and 3530 are used for rubbing the image layer I, but a rubbing brush 1062 may be used for rubbing the image layer I in the twenty-second embodiment as shown in FIG. 68. The fixing device 3600 shown in FIG. 68 includes a rubbing member 1060, the drive source 1054, and the biasing member 1055. The rubbing member 1060 includes a supporting member 1061 and the rubbing brush 1062.

Like the twentieth and twenty-first embodiments, the supporting member 1061 is an elongated box which is situated on the opposite side to the backup roller 340, so that the endless belt 453 intervenes between the supporting member 1061 and the backup roller 340. The supporting member 1061 extends in the width direction of the endless belt 453 and the axial direction of the backup roller 340. The supporting member 1061 includes a first supporting surface 1061*a* facing the endless belt 453 and a second supporting surface 1061*b* opposite to the first supporting surface 1061*a*. The first and second supporting surface 1061*a*, 1061*b* are substantially flat.

The rubbing brush 1062 is mounted on the first supporting surface 1061*a* of the supporting member 1061. The rubbing brush 1062 includes a brush surface 1062*a* facing the endless belt 453. A number of bristles 1063 are implanted in the brush surface 1062*a*. A range in which the bristles 1063 are implanted is appropriately set. In FIG. 68, the bristles 1063 are implanted only in a position on the brush surface 1062*a* which contacts the endless belt 453. A piled woven fabric formed from electrically-conductive rayon or polyester is exemplified as a material of the bristles 1063. With the electrically-conductive rayon, the pile fineness thereof is 300D/100F. With the polyester, the pile fineness thereof is 75D/12F.

The biasing member 1055 is mounted on the second supporting surface 1061*b* of the supporting member 1061. The biasing member 1055 applies a biasing force F to the supporting member 1061 and then to the rubbing brush 1062, in order to press the bristles 1063 of the rubbing brush 1062 against the endless belt 453. Accordingly, the tip ends of the bristles 1063 of the rubbing brush 1062 are pressed against the endless belt 453 to be bent. Therefore, the rubbing brush 1062 with the bent bristles 1063 is in surface contact with the endless belt 453. The bent tip ends of the bristles 1063 form the rubbing surface. The bristles 1063 of the rubbing brush 1062 are pressed against the endless belt 453 such that the surface pressure applied to the endless belt 453 becomes, for example, 0.2 g/mm$^2$. Not only the abovementioned pile fineness but also the density and length of the bristles 1063 are appropriately set so as to obtain a given surface pressure.

The drive source 1054 is stored in the supporting member 1061, and the same vibration motor 1054 as those of the twentieth and twenty-first embodiments is used. The vibration generated by the vibration motor 1054 vibrates the supporting member 1061 storing the vibration motor 1054 and the rubbing brush 1062 mounted on the first supporting surface 1061*a* of the supporting member 1061. The tip ends of the bristles 1063 of the rubbing brush 1062 keep the state where the tip ends of the bristles 1063 are brought into surface contact with the endless belt 453 by the biasing member 1055 as described above. Therefore, when the sheet S is conveyed to the nip portion N, the bristles 1063 of the rubbing brush 1062 utilize the vibration to slide on the image layer I in multiple directions to rub the image layer I while keeping in surface contact with the image layer I without separating therefrom.

According to the fixing device 3600 of the twenty-second embodiment, the bristles 1063 of the rubbing brush 1062 slides on the image layer I while keeping surface contact therewith to rub the image layer I. Consequently, the image layer I on the sheet S is rubbed a number of times by the bristles 1063 of the rubbing brush 1062. Therefore, the components of the liquid developer forming the image layer I may be facilitated to enter the surface layer of the sheet S, which may shorten the time period during which the image layer I is fixed and preferably prevent the image layer I from peeling because of stronger fixation of the image layer I.

Appropriate adjustments of the bristles 1063 such as material, fineness, density and length reduce impingement on the conveyance of the sheet S and damage to the image layer I under the rubbing operation of the rubbing brush 1062.

The fixing device 3600 according to the twenty-second embodiment and the conveyor 400G which is used for conveying the sheet S to the fixing device 3600 are preferably incorporated in the color printer 1 described in the context of FIGS. 8 to 10, in place of the fixing device 300 and the conveyor described in the context of the first embodiment.

According to a series of the aforementioned embodiments, by moving the contact surface, which contacts an image, relative to the image on a sheet, the image is fixed onto the sheet. The movement of the contact surface relativd to the sheet may be accomplished not only by the mechanisms described in the context of these embodiments but also by other mechanisms. Therefore, the methodologies of these embodiments described above are not limited to the aforementioned structures in detail.

This application is based on Japanese Patent application Nos. 2010-177638, 2010-237186, 2010-237187, 2010-237188, 2010-237189, 2010-237190, 2010-237191, and 2010-237192 filed in Japan Patent Office on Aug. 6, 2010 and Oct. 22, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus for forming an image, comprising:

a conveying element configured to convey a sheet;

an image forming section configured to form the image on the sheet with liquid developer; and a fixing device configured to fix the image onto the sheet, wherein the fixing device includes a rubbing mechanism configured to rub the image on the sheet, the liquid developer includes colored particles for coloring the image, carrier liquid in which the colored particles are dispersed, and polymer compounds dissolved or swollen in the carrier liquid, and the polymer compounds cover the colored particles on the sheet.

2. The image forming apparatus according to claim 1, wherein the conveying element conveys the sheet in a first direction at a first speed, the fixing device includes a drive mechanism configured to operate the rubbing mechanism, the rubbing mechanism includes a contact surface which contacts the image on the sheet, and the drive mechanism moves the contact surface relative to the sheet.

3. The image forming apparatus according to claim 2, wherein the rubbing mechanism includes an upstream rubbing mechanism and a downstream rubbing mechanism configured to rub the image after the upstream rubbing mechanism.

4. The image forming apparatus according to claim 2, wherein the conveying element includes a conveying belt configured to convey the sheet, and a backup roller configured to push the conveying belt against the rubbing mechanism, and the sheet passes between the conveying belt and the contact surface.

5. The image forming apparatus according to claim 2, wherein the drive mechanism includes a drive source which reciprocates the contact surface in a first traverse direction traversing with the first direction and a second traverse direction opposite to the first traverse direction, the rubbing mechanism includes a contact cylinder configured to rub the sheet, a shaft configured to support the rotatable contact cylinder, and a cam element configured to press the shaft in the first traverse direction, and the drive source rotates the cam element.

6. The image forming apparatus according to claim 3, wherein the upstream rubbing mechanism fixes the image onto the sheet at a fixation ratio different from the downstream rubbing mechanism.

7. The image forming apparatus according to claim 4, wherein the rubbing mechanism includes a rubbing belt configured to rub the image on the sheet.

8. The image forming apparatus according to claim 7, wherein the drive mechanism includes:

an unwinder configured to unwind the rubbing belt;

a winder configured to wind the rubbing belt; and a first press mechanism configured to press the rubbing belt to the image between the unwinder and the winder.

9. The image forming apparatus according to claim 8, wherein the winder stops while the conveying belt conveys the sheet, and the winder winds the rubbing belt while the conveying belt is stopped.

10. The image forming apparatus according to claim 8, wherein the sheet includes a preceding sheet and a subsequent sheet conveyed after the preceding sheet, the first press mechanism includes:

a press piece configured to press the rubbing belt to the image;

a biasing element configured to bias the press piece toward the image; and a separator configured to separate the press piece from the rubbing belt, and the separator separates the press piece from the rubbing belt from when the preceding sheet passes between the rubbing and conveying belts to when the subsequent sheet passes between the rubbing and conveying belts.

11. The image forming apparatus according to claim 8, wherein the first press mechanism includes:

a press piece configured to press the rubbing belt to the image;

a biasing element configured to bias the press piece toward the image;

a separator configured to separate the press piece from the rubbing belt; and an intermediate piece configured to separate the rubbing belt from the conveying belt between the unwinder and the winder, and the press piece includes an upstream press piece configured to press the rubbing belt to the image before the sheet passes between the intermediate piece and the conveying belt, and a downstream press piece configured to press the rubbing belt to the image after the sheet passes between the intermediate piece and the conveying belt.

12. The image forming apparatus according to claim 8, further comprising a nip element configured to form a nip portion for holding the sheet on the conveying belt in cooperation with the backup roller extending in a traverse direction traversing with the first direction, wherein a rubbing position where the rubbing belt rubs the sheet and the nip portion are aligned in the traverse direction.

13. The image forming apparatus according to claim 2, wherein the rubbing mechanism includes a rubbing loop configured to rub the image, and the drive mechanism includes a revolving mechanism configured to revolve the rubbing loop.

14. The image forming apparatus according to claim 2, wherein the sheet includes a formation surface on which the image is formed, and the contact surface includes a rotation surface which rotates around a rotation axis extending in a direction intersecting with the formation surface.

15. The image forming apparatus according to claim 14, wherein the rotation surface includes a first rotation surface rotating in a first rotation direction, and a second rotation surface rotating in a second rotation direction opposite to the first rotation direction, and the first and second rotation surfaces are aligned in a traverse direction traversing with the first direction.

16. The image forming apparatus according to claim 14, further comprising:

an adjustment mechanism configured to adjust a size of a contact region between the formation and contact surfaces in response to a thickness of the sheet.

17. The image forming apparatus according to claim 2, wherein the rubbing mechanism includes a contact surface which contacts the image on the sheet, and the drive mechanism includes a vibration motor configured to vibrate the contact surface.

18. The image forming apparatus according to claim 2, wherein the contact surface includes a surface at least partially covered with a nonwoven fabric.

19. The image forming apparatus according to claim 1, wherein the fixing device is configured for non-thermally fixing the image on the sheet.

20. A fixing device, comprising a rubbing mechanism for rubbing an image which is formed with liquid developer, wherein the liquid developer includes colored particles for coloring the image, carrier liquid in which the colored particles are dispersed, and polymer compounds dissolved or swollen in the carrier liquid, and the polymer compounds cover the colored particles on the sheet.

* * * * *